US006044630A

United States Patent [19]

Coffin

[11] Patent Number: 6,044,630

[45] Date of Patent: Apr. 4, 2000

[54] PERFORMANCE SADDLE

[76] Inventor: Edmund S Coffin, R.R. 1, Box 14M, Ruckersville, Va. 22968

[21] Appl. No.: 08/964,107

[22] Filed: Nov. 5, 1997

Related U.S. Application Data

[60] Provisional application No. 60/030,335, Nov. 5, 1996.

[51] Int. Cl.[7] ..... B68C 1/00; B68C 1/10

[52] U.S. Cl. ..... 54/44.4; 54/44.1; 54/44.7

[58] Field of Search ..... 54/44.1, 44.4, 54/44.7

[56] References Cited

U.S. PATENT DOCUMENTS

| | | | |
|---|---|---|---|
| 2,208,303 | 7/1940 | Frueh | 54/44.4 |
| 3,780,494 | 12/1973 | Nankivell, Jr. | 54/44.7 |
| 4,745,734 | 5/1988 | Brown | 54/44 |
| 5,187,924 | 2/1993 | Marshall | 54/44.7 X |
| 5,517,808 | 5/1996 | Schleese | 54/44.1 X |

*Primary Examiner*—Robert P. Swiatek
*Attorney, Agent, or Firm*—Sheldon H. Parker

[57] ABSTRACT

A saddle is constructed around a tree designed using data points based on X, Y, and Z axes which correspond to the conformation of a horse's back. Two pair of torsion springs, attached with specifically placed rivets, sandwich the tree providing structural support. To cushion and maintain the equidistant configuration of the tree, panels are carefully constructed using a six pound foam. The thickness of the panel lessens as it reaches the edge of the tree, preventing bunching when the leather is attached. A withers wedge is secured to the panel adjacent the withers, serving as a sub-support and buffering the contact between the tree and the horse's withers. The cantle wedge is set into the panel to control the slant and angle of the saddle. The stirrup bar is an elongated V-shaped which places the area of greatest pressure directly under the securing rivets.

26 Claims, 11 Drawing Sheets

PERFORMANCE SADDLE

This application claims the benefit of U.S. Provisional Application No. 60/030,335, filed Nov. 5, 1996.

BACKGROUND OF THE INVENTION

1. Field of the Invention

The invention relates to an improved performance saddle designed to eliminate pinching and enhance the optimum performance of a horse.

2. Brief Description of the Prior Art

A major problem in fitting a saddle is that the saddle, including the tree and panels, tends to concentrate weight over localized areas, creating pressure points. Bruising of the horse's back is likely to result whenever the saddle creates localized pressure points between the horse's back and the saddle. Excessive weight concentration can further lead to the development of sores, pinching of the withers, and other painful conditions that can reduce the performance of the horse.

Saddles have been in use for centuries. The English saddle tree has kept approximately the same shape and has been made primarily of wood for hundreds of years. The latest major advancement in saddles trees, excluding the use of new materials such as plastics, was the design changes proposed by Count Ilias Toptani after World War II, including the incorporation of spring steel attachments into the design to allow the tree more elasticity combined with flexibility. The laminated wood form of the tree is created by hand on a mold. The hardware, including spring steel parts, stirrup bars and leather coverings is attached with rivets, staples, and nails. New innovations on saddle designs are few and not well documented.

There are few indications of how different the first English saddle trees were from the tree which is in common use today. A major change in saddles and trees for English riding occurred midway through the 20th century. After the Second World War, Count Ilias Toptani had a great influence on saddle design improvements. Toptani wanted to create a saddle that would conform to the basic principle of equitation: the rider should be in balance with the horse at all times by centering his or her weight over the horse's center of balance. Toptani created a new saddle tree for this purpose which had seven differences from the trees before.

1) pronounced dip in the seat
2) spring seat instead of rigid
3) waist or twist (width of tree) shaped to lie equidistant with the horse's back on either side and narrowed considerably.
4) the stirrup bar was moved forward and to the inside so that it was recessed
5) the points were cut off short (previously, points were as long as four inches below the attachment point of the bar)
6) the head of the saddle sloped forward from the points instead of being vertical
7) the reinforcements were made of alloy to lighten the tree The Toptani saddle tree had advantages and disadvantages. It positioned the rider in the center of the saddle. The shortened points allowed better fitting of the saddle to the horse's back and removed interference with shoulder movement, and the spring tree made the saddle more resilient and increased the rider's comfort. This tree allowed the influence of the rider's seat to be transmitted more directly to the horse. The problems were that the tree was so narrow that the weight of the rider was concentrated over a small area instead of spread over the bearing surface of the back, and the stirrup placement could create soreness in the horse's back if the rider rode with short stirrups for a long period of time. This tree was soon improved by widening the waist and reducing the slope of the head, and it became the saddle tree which is seen in almost all English riding saddles today.

U.S. Pat. No. 4,745,734 provides a flexible saddle which distributes the combined weight of saddle and rider through the deformation of flexible skirts that conform to a horse's back and contact the same over a large surface area. Two spanning elements are affixed to flexible skirts at four points (two opposed forward and two opposed rearward points), rigidifying the underlying skirts intermediate the respective points of connection. Additionally, the respective skirts have a forwardly extending portion that is formed as a single rounded piece, rigidifying the tree in the crucial wither-shoulder area. This rigidity makes the skirts less able to conform to the body contours of the horse and less able to reduce the magnitude of pounding forces transmitted from the horse to the rider.

SUMMARY OF THE INVENTION

An equine saddle having a tree, with an arced head, a cantle and a pair of side bars. The pair of side bars, each have a first surface, a second surface, a first edge and a second edge. The said side bars connect the head and the cantle; the head, cantle and second edge of the side bars enclosing an open seating area. A gullet notch is cut within the pair of side bars proximate the head and a lipped gullet plate being placed proximate the second surface of the head. The lip of the gullet plate is dimensioned to fit within the gullet notch. A top plate is placed proximate the first surface of the head.

The curvature of the tree is defined along X, Y and Z axes. The Y axis extends the length from the cantle to the head, contains multiple Y data points along the Y axis which correspond to predetermined calculations. The Z axis extends from the Y axis at about a 90 degree angle, and multiple Z data points are located along the Z axis which correspond to predetermined calculations. The X axis extends the width between end points of the head and multiple X data points placed along the X axis correspond to predetermined calculations. The tree is formed from a series of symmetrical arcs, the apex of these arcs being the highest value on the Z axis and having a constant value on the X axis. The ends of the arcs being maximum and minimum points on the X axis for a particular Y value and the minimum Z point for the particular Y value. This forms a three dimensional tree having a height, width and length based on a pair of at least about 6,000 mirror image data points. These data points are based on the configuration of a horse's back. Less than all data points can deviate less than ten (10%) percent and all data points can deviate, in ratio, less than twenty (20%) percent.

A pair of flexible upper torsion springs, are placed proximate the first surface of the tree and a pair of flexible lower torsion springs placed proximate the second surface of the tree. The upper torsion springs has an interior edge and an exterior edge, an upper spring width between said interior edge and said exterior edge and a length. Preferably the width of said upper torsion springs is greater proximate the tree head and decreases to a lesser width proximate the cantle. The interior edge is proximate the second edge of the side bars, and the length being less than the tree length. The upper spring width is less that the distance between the side bar first edge and the side bar second edge. The lower torsion springs have an interior edge and an exterior edge, a lower spring width formed between the interior edge and the exterior edge and a length. The interior edge extends beyond the second edge of the side bar into said open seating area. The upper torsional springs and lower torsional springs are affixed to the tree, thereby supporting the first and second surfaces. Preferably multiple rivets are used, at least two pairs of rivets are staggered proximate the head, penetrating the top plate, upper torsion spring, tree, gullet notch and lower torsion spring. At least three pairs of rivets are staggered proximate the top plate, penetrating the upper torsion spring, tree and lower torsion spring. At least five rivets are placed along the upper torsion spring, penetrating the upper torsion spring, tree and lower torsion spring.

A pair of support panels have an upper panel edge which is curved and substantially equal to the length of the tree. A lower panel edge has a cantle curvature, a bar curvature and a head curvature, the head curvature extending beyond the head arc end points. A foam body has a flat surface and a contoured surface. The contoured surface has a first thickness at the cantle curvature, a second thickness at the bar curvature and a third thickness at the head curvature. The first thickness is greater than the third thickness and the third thickness is greater than the second thickness. A support panel has a periphery approximately equal to, or slightly less than, the periphery of body foam body and is affixed to the flat surface of the foam body. The contoured surface of the foam body, proximate the cantle extends over the support panel by the cantle curvature and is tapered downwardly to the support panel proximate the upper panel edge. The foam body proximate the head apex has a thickness greater than the thickness proximate the end points, the end points being tapered downwardly toward the support panel. The panels prevent said tree from coming into contact with a horse's body and spread the rider's weight evenly over said horse's back. The support panel can further have a buffer sheet affixed to the support panel.

The support panels further have a withers wedge proximate the apex of the arced head between the foam body and support panel. The withers wedge is beveled around its periphery and has a density greater than the foam body. A cantle wedge is proximate the cantle curvature at the lower panel edge between the foam body and the support panel. The cantle wedge extends to the periphery of the support panel and has a density greater than the foam body. The support panels further have a cover layer, adjacent the curvature surface proximate the arced head. The cover layer reduces shearing of said foam body during use.

The head can further have graphite reinforcement. When the is manufactured from laminated wood, at least two non-adjacent layers of graphite are placed between wood layers.

The tree further comprising stirrup bars in a modified "V" shape. One leg of said V modified to be affixed to the tree bars proximate the head, thereby placing the area of greatest pressure directly under affixing means.

BRIEF DESCRIPTION OF THE DRAWINGS

The advantages of the instant disclosure will become more apparent when read with the specification and the drawings, wherein.

DETAILED DESCRIPTION OF THE INVENTION

Figure 1:
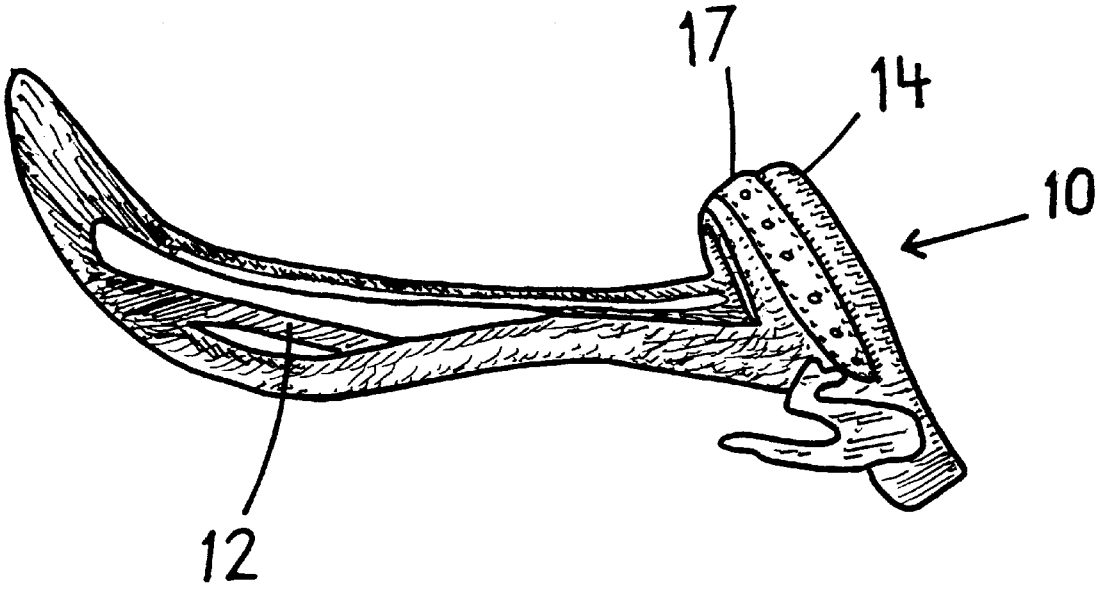
FIG. 1 is a perspective view of a prior art saddle tree.

The instant invention relates to a Performance Saddle™ which is different from prior art saddles in that the precise shape, composition and construction of the underside of the saddle accommodates the physiological requirements of the sport horses' back. The design of the Performance Saddle™ creates an inducement for the horse to lift its back, raise its withers and fully use its shoulders through incorporation of the natural curvature of a horse's back in a moving, engaged position. The shaping of the top side of the saddle accommodates the physiological needs of the rider, creating an inducement for the rider to achieve a more comfortable and athletic balance, thereby producing a tool to allow optimal performance of both the horse and the rider. The anatomical structure relating to bone and muscle is similar for all healthy, properly developed equines. When in a balanced position, the carriage is similar in all horses because of the muscle requirements to achieve the balanced position. If a saddle pinches a horse, the horse logically moves away from the pain. Since horses have no boney attachment between their shoulders and spine, when a good posture is achieved, the thorax comes up between the shoulder blades and spine, creating a "rounded back". By moving away from the pain located on his back, the horse lowers the girth, causing a concave back. Subsequently, the pelvis sits at a different angle, putting the hind leg further behind center of gravity, and shifting all of the weight to the front end.

Without pinching and pain a phenomenon exists between the rider, the saddle and the horses back in which the pressure, described as rider balance and weight, muscle use and strength, applied by the rider at certain moments and with varying amounts stimulates the back muscles in a way that a rider would describe as the horse olifting his withers and raising his backs. It is during this inducement to equine posture that the muscles of a horse's back are developed allowing him to support the rider's weight and improve his own balance, ultimately creating the physical skills to best collect his gait or jump an obstacle. Optimal performance of the rider is linked to the ability to communicate to the horse at specific moments. The saddle becomes the medium through which these communications are expressed. The quality of the saddle's design, material composition and construction all effect the manner in which these communications are received and responded to by the horse.

While logic would dictate that each horse needs a custom fit saddle, a phenomena exists in that a few trees have been made that have the ability to give a good general fit for a large number of horses. In contrast, some trees are known to fit only specific conformations, i.e. high withers, especially broad or flat backs, etc., while a few trees don't properly fit any horses. These trees, however, have been fitted to the standing horse. The disclosed saddle has taken this general fit and refined the concept by producing a saddle designed to fit the moving horse. Producing a dynamic model versus a static model. By designing the tree and saddle for optimum fit to a horse engaged in optimal performance, the greatest balance and comfort are achieved in the engaged position. The points used to determine the pitch of the tree are absolutely symmetrical, with the center access representing a true center. The shape of the tree will not loosen, alter, warp or shift. The materials used to pad the saddle for both rider and horse will not deteriorate, collapse or bunch. Even the stirrup bars have been redesigned to a safer, flatter design.

The performance tree is designed to anticipate the relaxed athletic frame and/or movement of the horse and reward this relaxed position by a comfortable fit. As the horse relaxes and the loins expand to fill the saddle underline, the comfort level of the performance saddle, as described herein, increases. This comfort increase is due to the ability of the performance tree design to evenly distribute the rider's weight along the inner surface of the saddle. Since the performance tree is, as stated heretofore, designed to imitate and accommodate the muscular structure of the back of a horse in performance postures, the weight is distributed in a manner which is natural to the horse's configuration.

In order to accurately describe the novelty of the disclosed saddle, the following definitions will be applied herein.

Tree head refers to the curved center portion of the tree which is proximate the top of the horse's withers.

Tree points refer to the portion of the tree which extend downward behind the horse's shoulders.

Tree bars describe the area of the tree over which the rider sits.

Tree cantle refers to the portion of the tree which is turned up at the back of the tree.

Gullet plate is the metal insert placed in the tree head, preventing the head from spreading.

Prior art strip springs extend from the tree cantle to the tree head and are generally manufactured from spring steel.

Torsion springs are the curved single piece, spring steel springs as disclosed herein.

Optimal performance can best be described as the relationship between a rider and horse that allows for a maximum range of motion and freedom from pain while not encumbering the balancing process.

Prior art saddles are generally manufactured from a wood, Plexiglas or plastic tree which is reinforced with a steel gullet plate and strip springs then padded and covered with leather. An example of one configuration of a prior art tree is illustrated in FIG. 1. The tree 10 incorporates a pair of metal strip springs 12 to reinforce the tree while allowing for flexibility and are affixed to the tree 10 through use of nails, rivets or other appropriate means. A gullet plate is placed on the inside of the head of the tree for stability. The curvature and dimensions of the gullet plate can vary dependent upon the manufacturers criteria, such as saddle style, type and size. Generally the gullet plate will consist of a base and a lip and are attached directly to the tree in the same manner as the strip spring 12. The tree head 14 is further reinforced with the top plate 17, which is also secured to the tree head 14 in a manner known in the art; providing additional reinforcement to the tree head 14.

Three types of panels are used in the prior art. Traditionally, leather pockets have been stuffed with wool flocking. This method, however limits the shapes and, since it is done manually, each saddle is different. Further, the wool flocking tends to shift with use, changing the configuration of the panels. Leather covered pre-formed foam or injection molded foam has also been used, although the material is limited to a single density throughout the entire panel. In an attempt to change the densities, layered foam has been used, each sheet of foam being hand shaped, layered, and covered with leather. Due to the hand shaping, each panel is slightly different and those with an especially good design cannot be duplicated. Additionally, the foam generally used, which is easy to hand shape, does not always keep its shape, compressing at the areas of greatest pressure.

In the disclosed performance saddle, the tree is configured to imitate the muscle conformation of a horse in a relaxed, working posture. To accomplish the reproduction of the horse's back, the tree was divided into a series of lateral arcs crossing the horse's spine, from front to back in conjunction with the front to back curvature corresponding to the horses back when engaged in optimal performance.

To accomplish the disclosed configuration, knowledge of the conformation of horses' backs is a requirement, since the tree determines whether or not the saddle fits the horse properly. First, the tree should be designed such that the saddle fits in the right place on the horse's back so that the rider and horse will be in balance. To be in balance, the rider's center of gravity should be directly over the horse's center of gravity at all times. This allows the horse to move with the least interference from the rider's shifting weight. The saddle also requires a fairly flat seat to allow the rider to easily shift positioning to maintain rider balance. The saddle tree should be shaped so that it interferes in the least amount possible with the muscles of the moving, engaged horse, especially muscles effecting the shoulder. When the under surface of the saddle is closely contoured to the horse's back, avoiding any contact with the horse's spine, the rider's weight is spread equally over the load bearing surface.

Figure 2:
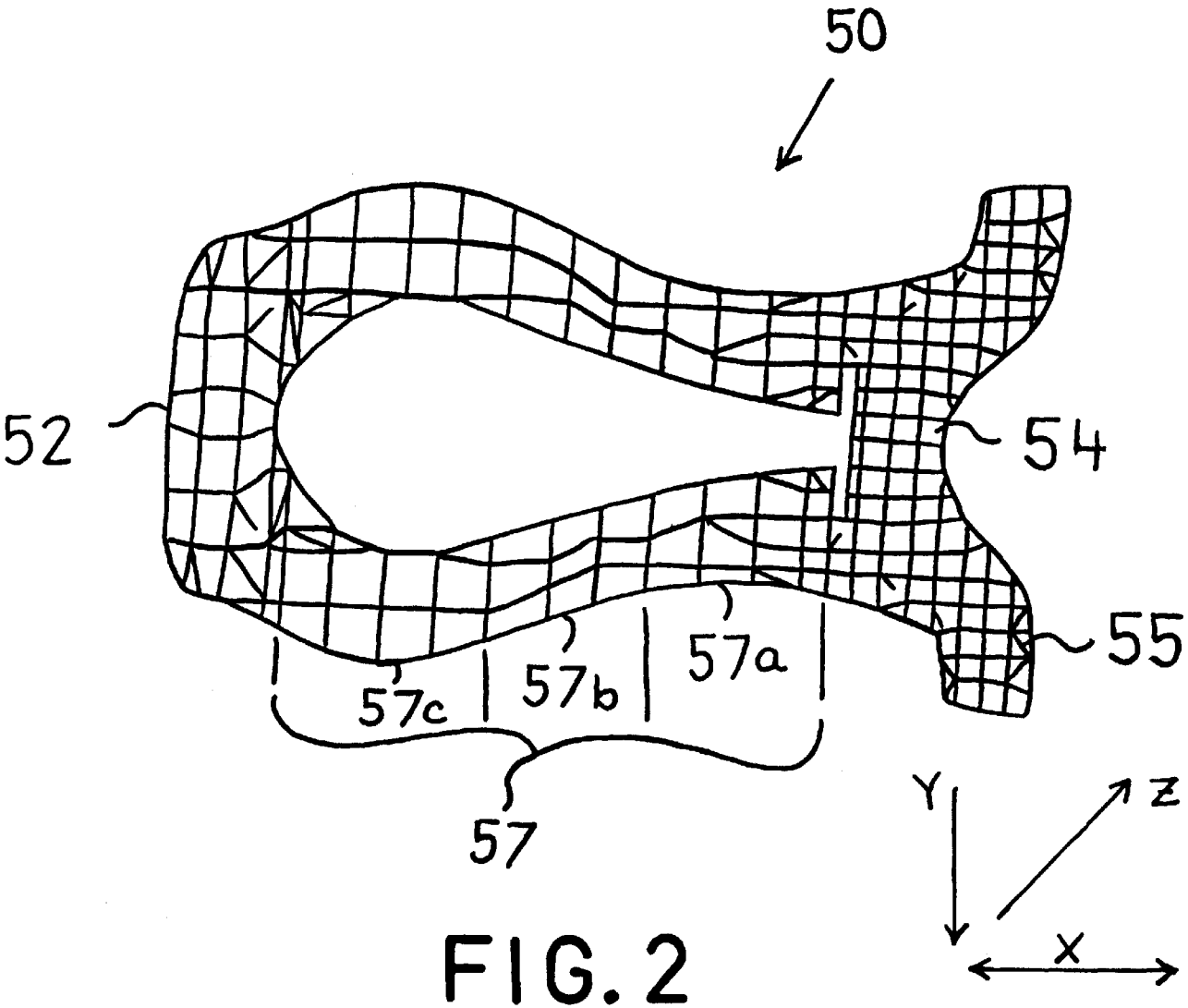
FIG. 2 is a top view of a computer printout of the data points of the performance tree of the instant invention.
Figure 3:
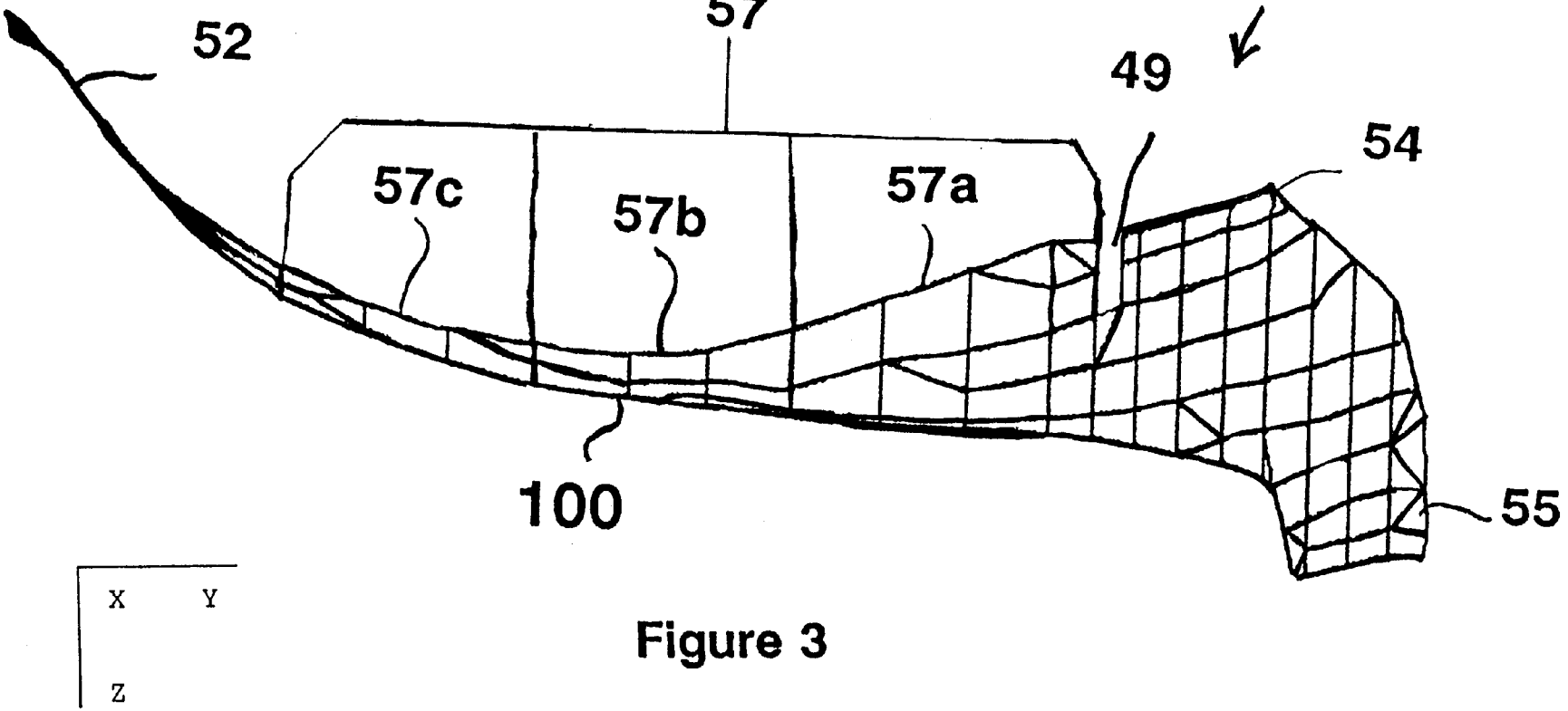
FIG. 3 is a side view of a computer printout of the data points of the performance tree of the instant invention.
Figure 7:
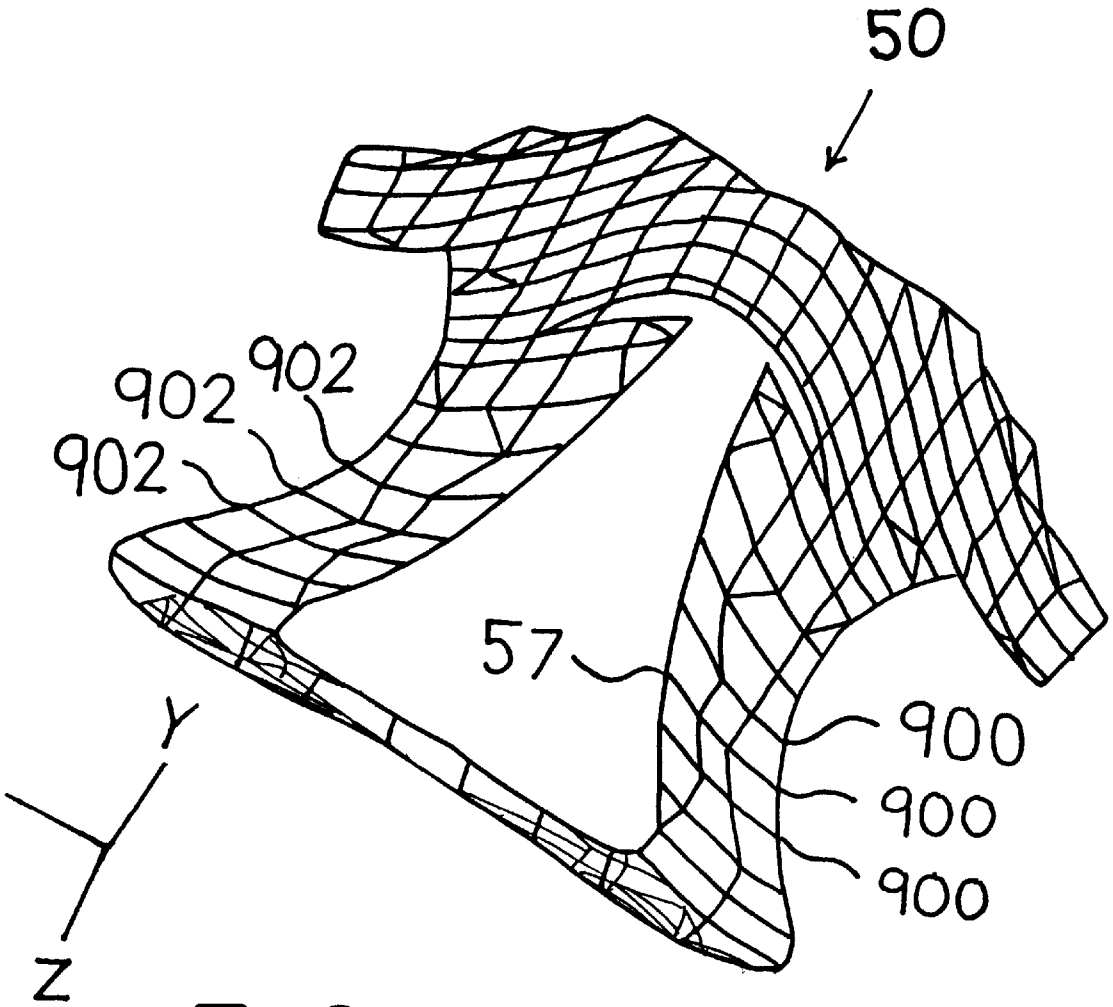
FIG. 7 is a perspective top view of the data points of the disclosed tree.
Figure 8:
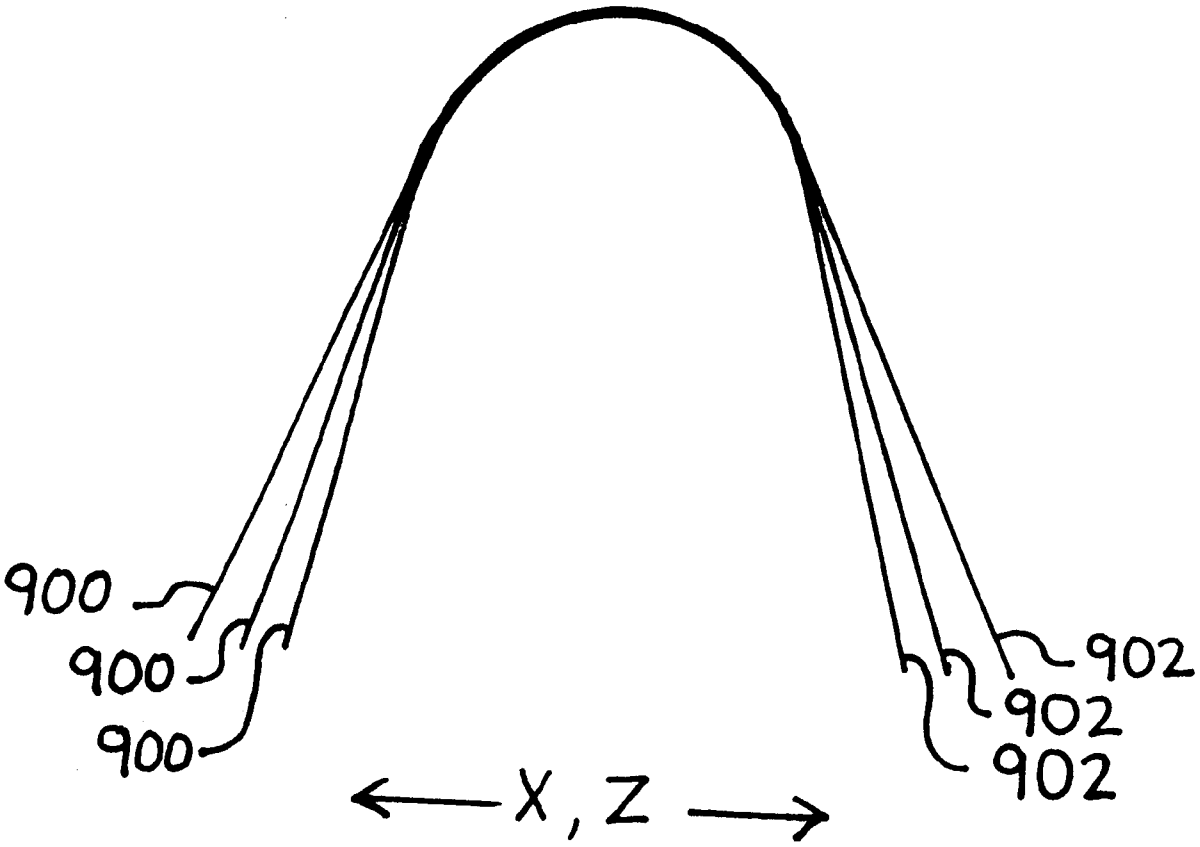
FIG. 8 is a front view of the arcs created by the data points.
Figure 9:
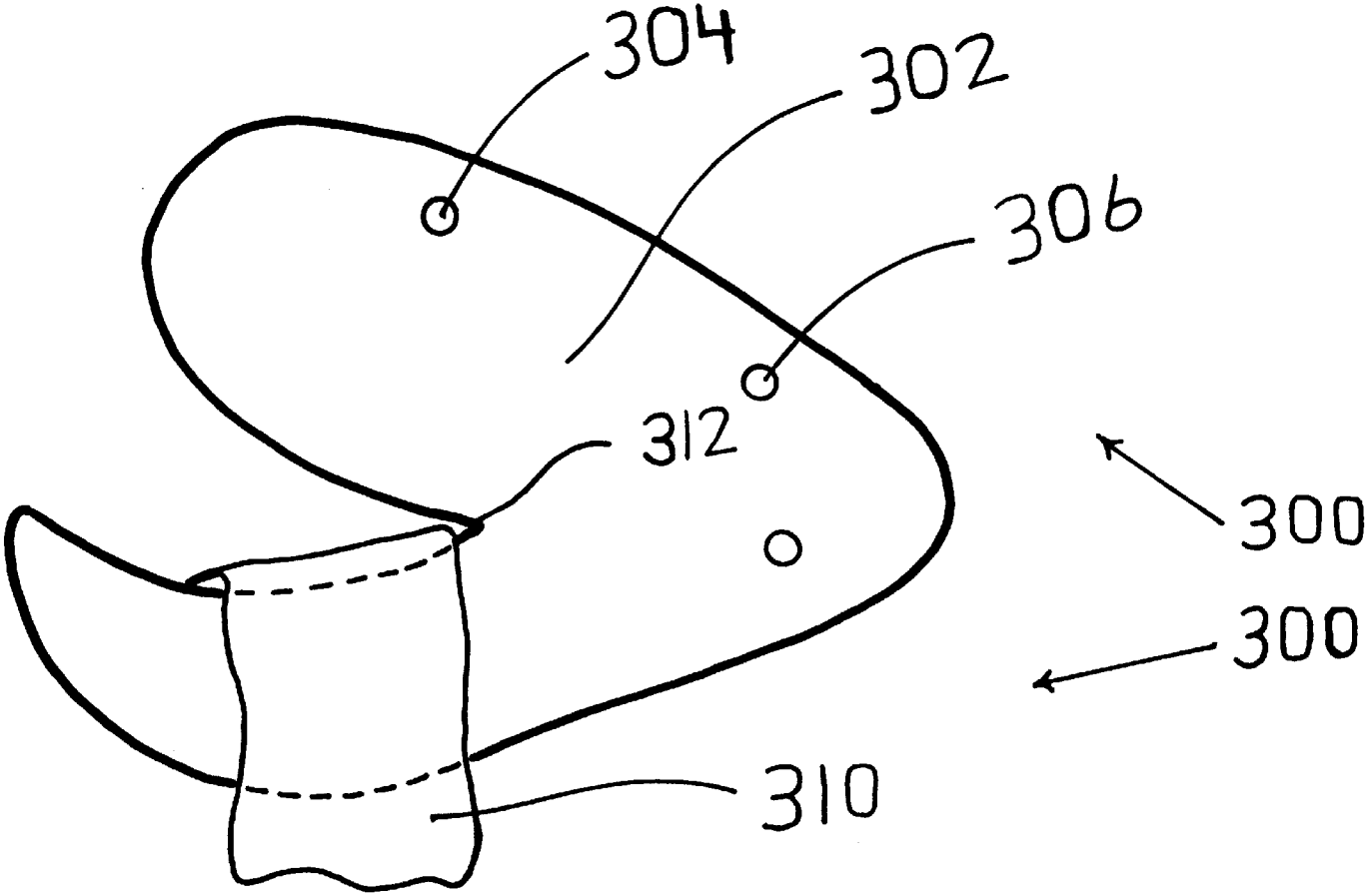
FIG. 9 is a front view of the stirrup bar of the instant invention.

Although the tree is referred to herein as being wood, the tree can be manufactured from any material which will meet the criteria herein. The performance tree 50 illustrated in FIGS. 2 and 3 is shown as a CDA/SPRINT print out, illustrating the data points which form X (width or bar to bar), Y (length head to cantle) and Z (height or lowest to highest points) axis of the saddle. For ease of explanation, the bars 57 are divided into three parts, 57*a*, 57*b* and 57*c*, representing the front, mid and back portions respectively. This division is required due to the fact that the saddle is not only curved on the Z-Y plane but the X-Y plane as well. Thus, in a cross section on the X-Z plane, the end points of each lateral arc vary on the Y axis from the end points of adjacent arcs. This is illustrated in more detail hereinafter in FIGS. 7 and 8 wherein several points of the tree 50 are compared from a top and bottom view. As can be seen from these Figures, the tree 50 is divided into points which form a grid. Each of these points has been created on the computer and represents a specific dimension of the tree 50. Al though the data points disclosed in Table 1 are the optimum configuration, setting forth predetermined calculations, it should be noted that multiple data points can be adjusted without changing the overall shape of the tree. This adjustment can produce a size variation, such as the length deviation along the Y axis which can be up to about thirty (30%) percent. However, the deviation from the shape created by the X and Y axis must be no greater than a twenty (20%) percent deviation and preferably ten (10%) percent or less. A shift in all data points is defined as a 0% deviation. A twenty (20%) percent deviation is understood to mean a twenty (20%) percent deviation of less than all data points. In addition to the Y, Z curvature, shown in FIG. 3, there is the Z-X arcing illustrated in FIG. 8. The apex of each of the lateral arcs must follow the Y-Z curvature while the ends of each arc move in the X-Z plane and the Y - Z plane. It is critical to maintaining the design of the tree 50 that both the Z-Y curvature and the X-Z arcing are followed. To facilitate the description of the tree curvatures, references will be made to the Y-Z and X-Y planes.

The tree 50 is designed and configured to remain approximately equidistant to a horse's back, along the Z-Y plane underline 100, except at the back bars 57C, where the arc end points are moved away from one another an equal distance from the apex to accommodate for the muscular change of the working posture. The term approximately equidistant is used as the tree may not always be exactly a consistent equal distance from the back. The disclosed tree design, when properly placed on a horses back, is not at odds with the horses confirmation. To accomplish this, the Z-Y and X-Z planes are configured to correspond to the shape of the horse when in the postures of optimum performance. To create this fit, the arcs in the X-Z plane are flattened at the back bars 57C, thereby maintaining the X-Z arcs approximately equidistant to the horse's back. When a horse is in a relaxed working frame, the muscles along the croup and loins expand as the neck and head are lowered and the back rounded. When a horse is in this frame, the natural expansion of the back and loin muscles brings the muscles into approximately equidistant alignment with the back bars 57C. In a non-working frame, or a working horse in an unrelaxed frame, the back drops, becoming more concave while the muscles along the croup and loins narrow. In this non-working frame, distance between the horse's loins and the underline 100 is greater along the end points of the X-Z arcs than the arc apex.

The tree 50 is comprised of 180 independently determined lateral arcs, placed along the Y axis, whose position relative to adjacent arcs is determined by the configuration of a horse engaged in optimal performance. As seen more clearly in FIGS. 7 and 8, each lateral arc is centered relative to one another on the X, Y plane with each end point region of each arc having a consistent slope to form mirror images of each other. That is if a plumb line was dropped from the apex of the arc, the first end point 900 and the second end point 902 of each arc would be an identical distance from the plumb line. These lateral arcs are positioned in a longitudinal curvature which follows along the back bone of the animal on the Y, Z plane. In contrast to the arc apex along the X axis, the arc apex along the Y, Z plane does change. To ensure that the lateral arcs and longitudinal curvature are repeatable, master molds are created onto which the tree is formed. To maintain the desired tree 50 accuracy level, it is preferable that a separate mold for each size be manufactured directly from the computer generated configuration for that specific size.

The head 60 of the performance tree 50 is designed to maintain an approximately equidistant configuration to a horse's withers. By maintaining the approximately equidistant configuration, the withers pressure points are avoided. In prior art saddles, a common fitting criteria is the withers area of the saddle. The heads on these trees vary according to brand, style, etc., and is considered a critical fitting feature, as a curvature that is either too wide or narrow, places the saddle is at an angle on the horse's back, thereby placing the greatest pressure on the narrowest area, the withers. By maintaining the tree approximately equidistant to the back, no one point of the saddle is closer to the horse's back than any other point, with any variance easily being accommodated by the panels.

Figure 4:
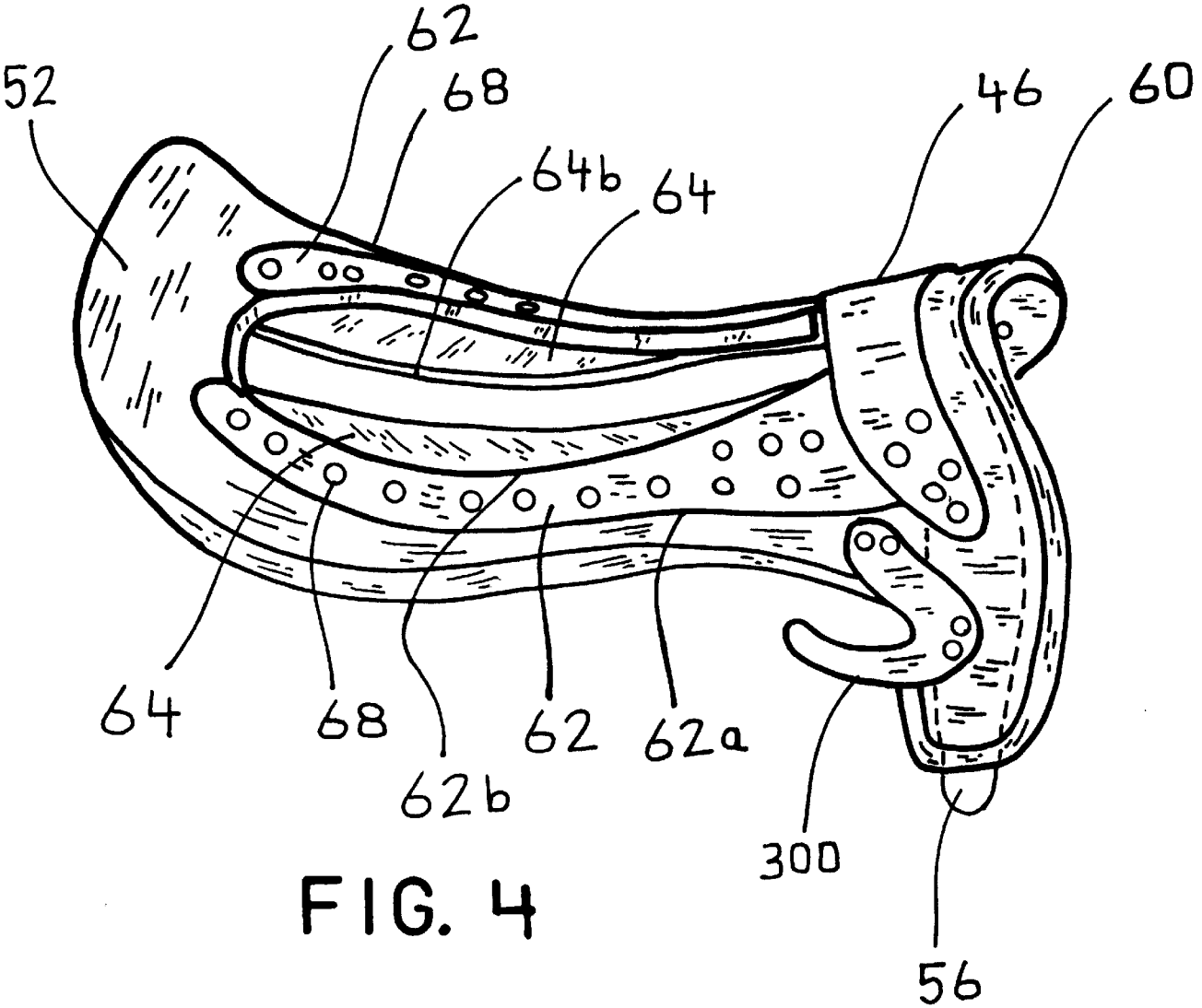
FIG. 4 is a perspective view of the performance tree.

As illustrated in FIG. 4, the gullet plate 56 is dimensioned to fit in the underside of the tree head 60. Preferably the gullet plate 56 is beveled to maintain a smooth under surface. Due to the extreme stress placed on the tree head 60 and the resulting potential weakening, it is preferable that the gullet plate 56 be beveled rather than recessed. Although it is important to maintain a smooth under surface, the integrity of the tree head 60 cannot be jeopardized and by beveling the gullet plate 56, the tree head 60 does not require cutting. The gullet lip keeps the tree from spreading under normal use and maintains the desired tree head 60 configuration. The tree head 60 is further locked in place through use of top plate 46, which is placed opposite the gullet plate 56. This locks the tree head 60 between two unmovable metal plates, greatly reducing any spreading of the tree head 60.

Figure 6:
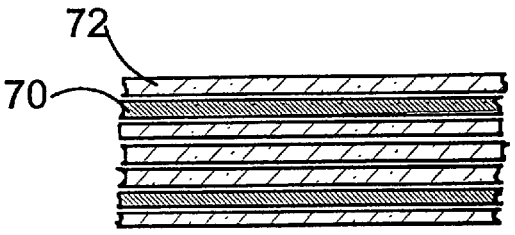
FIG. 6 is a cutaway front view of the tree layering for the preferred embodiment.

In order to provide further reinforcement to the tree head 60, the material used for the head 60 is strengthened with strips of uni-directional graphite 70, as illustrated in FIG. 6. In wooden trees, the graphite 70 is preferably placed between the wood layers 72, forming a composite consisting of, top to bottom, layer of wood, layer of graphite, three layers of wood, one layer graphite and one layer of wood, Although this composite is a preferred embodiment, other composite combinations can also be used. The width of the graphite is preferably about 1½ inches, although this can vary dependent upon saddle size. Alternatively, the graphite can be applied as top and/or bottom layers in the form of a unidirectional tape.

In prior art designs, the wood tree serves as the main structural support for the completed saddle. In the Performance Saddle, the tree 50 serves as the substratum. As described heretofore, the curvature of the tree 50 is critical and the basis for the performance saddle. Without appropriate structural support, the performance tree 50 will eventually lose the critical curvatures which give the saddle the advantages over the prior art. Therefore, once the optimum configuration was reached, corresponding to the horses' back, the tree 50 was tested for stress points which would, under heavy use, fail, causing discomfort for the horse.

To accomplish the stress tests reverse engineering was incorporated. To create a geometric model of the saddle tree, the tree was accurately measured with a coordinate measuring machine (CMM). This machine uses a laser or a mechanical touch point to measure points on the tree in three dimensions, and creates a data file of the measured points. The points are then used to create models which were used in a finite element program to determine the stresses in the tree and, from these, the approximate forces which cause it to fail. Finite Element Analysis (FEA) was used to establish the stress points and is described in detail in *What Every Engineer Should Know About Finite Element Analysis* Brauer, John R., 2nd ed. New York: Marcel Deeker, Inc., 1993, which is incorporated herein as though recited in full.

FEA is particularly useful for modeling the English riding saddle tree, due to the complexity of the tree's geometry and material combinations. Points are measured on the tree in three dimensions and used to define the model. Material properties are assigned to the appropriate areas of the tree, allowing a variety of materials to be present in a single model. The details of the stress testing are presented in *Finite Element Modeling of an English Saddle Tree. An Evaluation of the Finite Element Method in Application*, Koenig, Michelle S, University of Virginia Mechanical Engineering Department, April 1996, which is incorporated herein as though recited in full.

The performance tree 50 is reinforced using two pairs of torsion spring supports which replace the traditional narrow steel strips. The upper torsion spring supports 62 and lower torsion spring supports 64 are generally 0.020 inch steel, although the gauge can be altered somewhat and will be apparent to those skilled in the art. The torsion spring supports 62 and 64 extend from the back bars 57C to the tree head 60. Some trees are manufactured with a point of connection between the bars and the head, creating a weak point subject to high stress. If this design is used, the upper torsion spring support 62 must cover this stress point to provide optimum strength to this weak point. To obtain maximum strength benefit from the gullet plate 56, a lip must be formed at approximately a 45° angle to the gullet plate 56 body. To accommodate lip, the tree head 60 is notched at gullet plate notch 49 rather than reducing the width of the front bars 57*a*. The structural strength provided by the addition of the gullet plate 56 and top plate 46 further weakens the front bars 57*a* by rigidly reinforcing the head 60 while the bars 57 are allowed to flex, thereby increasing the torque pressure applied to the bar 57 a adjacent the gullet plate notch 49. The addition of the combination of torsion spring supports 62 and 64 serve to compensate for the increased torque pressure caused by the gullet plate 56.

The outside edge 62*a* of the upper torsion spring support 62 follows the curve of the bars of the performance tree 50. The distancing from the tree edge is not critical and should be based on the requirements for secure attachment of the leather. The inner edge 62*b* of the upper torsion spring 62 follows the interior curve of the bars 57 to prevent the upper torsion spring 62 from interfering with the rider's seat. The length of the upper torsion spring 62 preferably extends from the cantle 52 to the head 60. The width of the upper torsion spring 62 widens as it approaches the head 60 in order to provide maximum structural support at the weakest area. It is critical that the upper torsion spring 62 overlaps the gullet plate notch, both horizontally and vertically, by approximately ¾ inch. The width of the upper torsion spring 62 at the head 60 must not, however, interfere with the mounting of the stirrup bars as described further herein. The general width of the upper torsion spring 62 can vary, however to maintain maximum structural integrity, the width should not be less than ½ inch, and is preferably in the range of 1 to 1½ inches. These dimensions will change dependent when the disclosed technology is incorporated on different style saddles and all sizes should be kept in proportion to the saddle size and style.

The outer edge of the lower torsion spring 64 follows the outside curve of the tree 50 in the same manner as the upper torsion spring 62. The inner edge of the torsion spring 64 is preferably straight in order to provide a broad, flat surfaced bearing area. The lower torsion spring 64 extends from the cantle 52 to the furthest point of the head 60, covering the gullet plate 56 on the under side of the tree 50.

The upper torsion spring 62 and lower torsion spring 64 combination serve to lock in the curvature of the tree 50 by supporting the tree 50 while maintaining flexibility. The combination of materials is critical to the performance capabilities of the saddle. The tree must be molded from a semi-rigid material which can be conformed to the appropriate shape. The materials, however, which allow for the formation of the tree do not provide the necessary strength. Conversely, any material which provides the strength does not provide the flexibility. Thus, the use of steel to manufacture a tree would not provide the required flexibility while the use of only wood does not provide the strength. The use of spring steel, in combination with a suitable tree material, allows for the tree to flex while providing support to the light, flexible tree. The design of the tosion springs 62 and 64 not only enhance the strength of the tree but also provides active, or dynamic, torsional forces.

By placing the tree 50 between the two flexible torsion springs 62 and 64, creating a sandwiching effect, tree 50 is reinforced from both sides. This is most critical in the front of the saddle, due to the head configuration, gullet plate notch and the locking of the head between the gullet plate and the top plate.

Figure 5:
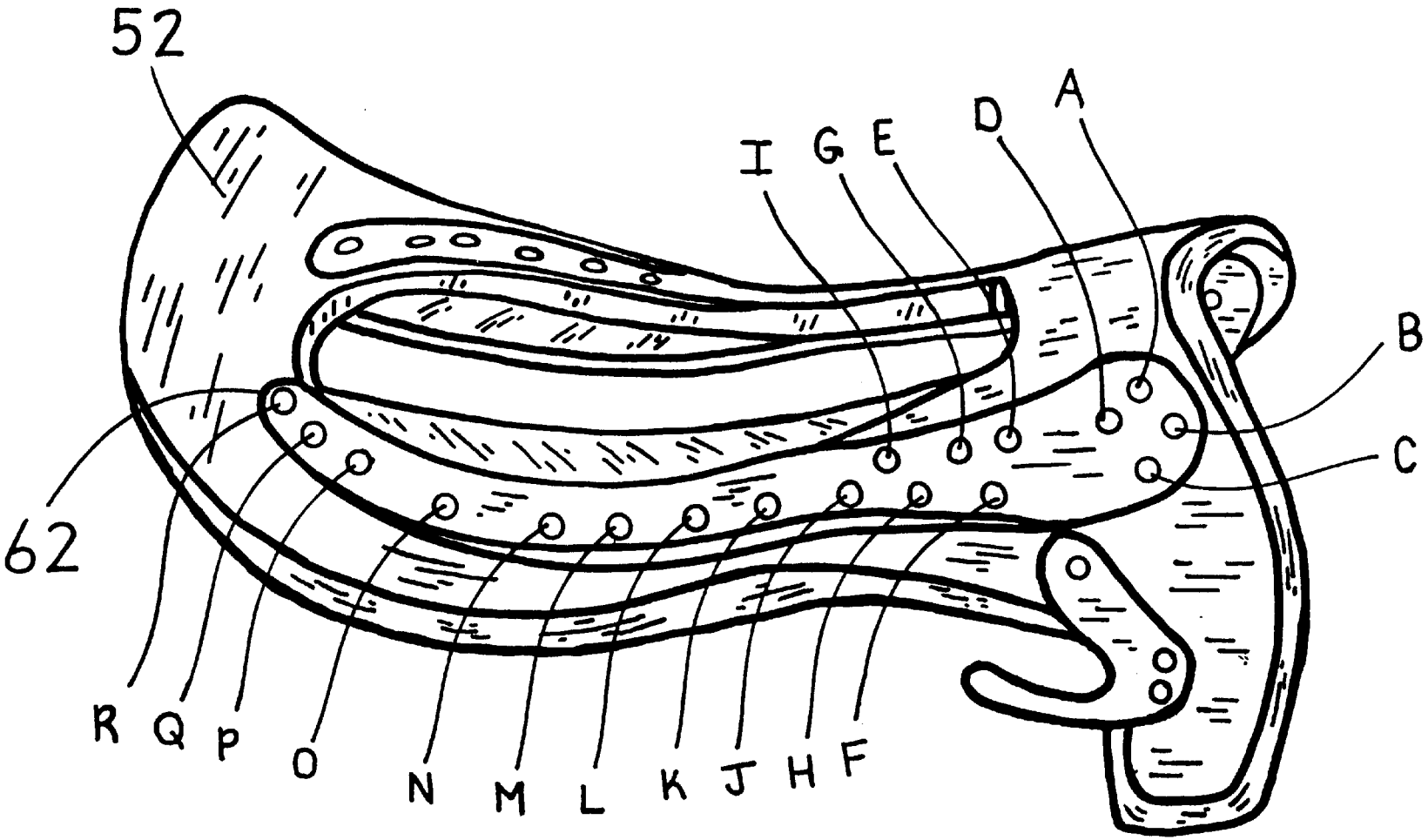
FIG. 5 is a perspective side view of the performance tree illustrating the placement of the torsion spring rivets.

The upper and lower torsion springs 62 and 64, as illustrated, are secured to the tree 50 through the use of rivets 68. Although rivets are illustrated herein, it should be noted that other means can be used, such as screws, nuts and bolts special adhesives or another method which will securely affix the torsion springs to the material used for the tree. The rivets 68 are placed at intervals along the torsion springs 62 and 64 to secure the springs 62 and 64 to the tree 50 without creating fracture lines within the tree 50. The torsion springs 62 and 64 are affixed to the tree 50 through the use of a single rivet 68 per location in order to create the desired steel I-beam effect. In this way, maximum strength is achieved while maintaining the integrity of the tree and reducing the saddle weight and costs. The positioning of the rivets in the "lead" rows is critical in order to reduce localized stress points and prevent fracture lines. Although the top plate 46 is required, for clarity FIG. 5 illustrates the placement of the rivets A, B, C and D without the top plate 46. The rivets 68 A, B, C and D are placed through the top plate 46, upper torsion spring 62, tree 50, gullet plate 56 and lower torsion spring 64. Although the placement of all rivets 68 are critical, the placement of the two lead row rivets can be only be varied slightly. As can be noted, none of the lead row rivets 68, A, B, C or D, are in a direct line of any other lead row rivet 68. This staggered configuration spreads the pressure over a larger area and prevents fracture lines of occurring. The placement must further take into consideration the width of the top plate 46 and gullet plate 56. Although the overall number of rivets 68 can vary, as disclosed further herein, the number must be sufficient to maintain the close contact between the upper and lower spring supports 62 and 64 and the performance tree 50. This close contact is not only for stability reasons, but to maintain the smooth inner surface of the performance tree 50. Generally 18 rivets 68 per side, provides the required stability, however an approximate minimum 12–16 could be used on an average saddle. It should be noted that a child's saddle would require fewer rivets and the optimum number of rivets required will be obvious to those skilled in the art. The lower torsion springs 64 are secured to the tree 50 over the gullet plate 56, thereby maintaining a smooth under surface. The upper torsion springs 62 are designed to either clear the top plate 46 or, alternatively be mounted below the top plate 46.

The optimal placement of the rivets 68 within the upper torsional springs 62 is illustrated in FIG. 5. Although the disclosed placing provides optimum placement of the rivets 68, it is provided as a preferred example and some movement and variation can be used. Rivets A–D are placed, in pairs, at the head of the springs 62 which, although the placement of the pair can vary slightly, the distance between the rivets within the pair remains approximately the same. Rivets E–J are also placed in pairs, with the lower rivets F, H and J being placed off-set and between the upper rivets E, G and I. At the cantle end of the springs 62, rivets R, Q and P are positioned an equal distance from one another, with rivet O spaced somewhat further. The spacing between middle rivets, N, M, L and K can be reduced is required, however, less than ¼ inch is not recommended. In the optimum embodiment, rivets are placed at the following approximate distances: R, Q and P ¾ inch from one another; O is spaced 1½ inch from P; O through N are spaced 1¾ inches apart; N through K are spaced 1¼ inches apart; I through G are spaced 1⅛ inches apart; G through E are spaced ¾ inch apart; E through F are spaced 1⅛ inches apart; G and H 1¼ inches apart; I and 1¼ inches; A and B ⅝ inch; A and D ⅞ inch; C and D ½ inch; and C and B 1 inch apart. Again, it should be noted that these distances are disclosed as the preferred embodiment, and in no way limit the scope of the invention.

Prior art stirrup bars are basically thick metal devices which can be uncomfortable for the rider as well as place further stress on the saddle leather, providing a wear problem. The body 302 of the stirrup bar 300 is a one piece, relatively concave unit which maintains, as closely as possible, the smooth exterior surface of the saddle. The stirrup bar 300 provides structural advantages in that the design places the rider's weight, as received through the stirrup leather 310, directly under the top supports 304. By placing the rider's weight directly under the top supports 304, the torquing usually occurring in prior art stirrup bars is eliminated. The top supports 304 are supplemented by a pair of side supports 306 which help maintain the stirrup bar 300 flush with the performance tree 50 as well as provide additional support. The edges of the body 302 are preferably beveled to further reduce any protrusions. The top supports 304 and side supports 306 go through full thickness of the wood tree 50 and the gullet plate 56. Unlike some prior art saddles, the stirrup bar 300 is not routed into the tree 50, thereby maintaining the structural strength of the tree 50. Riding, especially jumping, places tremendous pressure on the stirrups and stirrup leathers, approximately four (4) times the rider's weight. Thus, a 150 pound rider exerts 600 pounds of concentrated force on the stirrup leathers. This concentrated pressure subsequently rests on the stirrup bars. This leads the stirrup bars to be the greatest point of failure on the saddle. Riders tend to expect failure from stirrup leathers and therefore check the leathers frequently. The stirrup bars, however, are more difficult to check and failure is not as expected.

To compare the disclosed stirrup bar and the prior art stirrup bar finite element models were created of both designs. Using these models, the stirrup bars' performances under conventional and maximum loading conditions were calculated. Both stirrup bars were assumed to be made of 13 gage, oil quenched, spring steel. Both bars had distributed loads placed along the bars to represent the presence of stirrup leathers that would transmit the rider's load to the stirrup bars.

In both the modified V-shaped stirrup bar 300 and the prior art bar, the rivets were assumed to hold the stirrup bars in place in the X, Y, and Z directions, allowing no translation at these locations. Two loading conditions were tested. In the first case, a load of 600 pounds distributed across the stirrup bar was used. In the second case, maximum loading conditions were found that caused stress concentrations equal to the yield strength of spring steel. The yield strength of oil quenched, spring steel is 150,000 pounds per square inch. Yield strength is the approximate stress at which permanent deformation occurs. In other words, if a material undergoes a stress greater than the yield stress, then the material cannot return to its original shape and will be permanently deformed. A loading of this type can cause failure within the material.

In the V-shaped stirrup bar 300 the highest stress occurred along the bend 312. The stress at this location is 60,820 pounds per square inch. At the same loads, the conventional stirrup bar generates 1.45 times more stress. The prior art stirrup bars fail at 1,060 pounds of pressure in comparison to the failure load of 1,475 pounds.

Once the foundation has been established, the performance tree 50 is covered with nylon straps, or webs as is standard with saddle preparation. A seat wedge, having the outside configuration of the tree 50, is placed over the webbing. The seat wedge extends approximately ¾ the length of the seat of the saddle. A front piece is also provided which levels out the seat wedge but does not require the shaping of the wedge. One material which provides the desired results is Plastizotes LD45, although any material which provides the equivalent can be utilized. The thickness and curvature of the seat wedge should be such to encourage the rider to use correct posture and maintain the body in a balanced line. Saddles that provide a cantle seat area which is too high tend to roll the riders pelvic bones forward onto the pubis bone. Conversely, saddles which do not provide sufficient support for the riders buttocks, tend to roll the rider's pelvis backward, thereby curving the rider's spine. An initial layer of firm material, such as 3⁄16 inch MC 1900, is placed over the seat wedge. A secondary, softer layer, such as Rubatex 4981, is then placed over the initial layer. As a final layer, 2 or 3 sheets of 1⁄16 thick material, such as XL65 is applied for rider comfort. The final layer sheets should also be shaved to provide a smooth edge and reduce bulk at the edge of the saddle. The saddle is then covered with the desired grade of leather. The materials set forth are for example only and are not intended to restrict the application in any way.

In order to maintain the approximately equidistant configuration of the tree 50, the panels 500 are carefully constructed. The panel 500, as illustrated in FIGS. 10–13, is formed through use of a press cutter. The two piece master form is constructed so that the bottom form has the desired perimeter and the top form has the desired depth and configuration. Foam is placed over the bottom form and the top form pressed down, thereby creating a foam duplicate having the desired depth, configuration and perimeter of the form. The foam duplicate is sliced, at the lower edge of the bottom form, thereby taking on the desired configuration and perimeter. To accommodate the rear wedge 506 and withers wedge 504, the body 502 is wrapped around the wedges 504 and 506, and glued in place. As seen in FIG. 13, this is evident in at the cantle wedge 506 where the highest point of the wedge 506 is directly over the edge of the support board 518. This method increases the foam density at these two critical areas and allows for the desired curvature adjacent the support board 518. Alternatively, the areas receiving the wedges 504 and 506 could be cut from the main body 502, by either a press cutter, hand cutting, or other means known in the industry. The dimensioning of the panels disclosed are based on the foam 502 being wrapped around the wedges, in the event the foam is cut to receive the wedges, compensation must be made for the lost foam density, height changes, etc.

The panels 500 are, as stated, pressed foam rather than prior art wool stuffing. The use of six (6) pound foam provides the benefits that it will not shift or compress as does the wool stuffing. Most importantly, the use of foam allows for each panel 500 to reproducibly maintain the critical configuration required to meet the standards of the Performance Saddle. The height of the panels 500 must be within about ten (10%) percent of the optimum configuration. The preferred height of the panels 500 at the withers is about 1¾ inches, as indicated by arrow A and about 2 inches at the cantle, as indicated by arrow B in the side view of FIG. 11. The lateral length of the panels 500 are dimensioned to correspond to the size and style of the saddle, however the height of the panels 500 will only vary slightly with the size and/or style of the saddle. Although the surface shape is critical, the configuration along the perimeter of the panels 500 is of equal importance. The foam panel body 502 smoothly arches to the support board 518 which forms the structural support for the underside of the panels 500. The support board 518 is manufactured from a stiff supporting material, such as the mid-sole material used in shoes. Felt cloth 520, or other equivalent material, is glued onto the support board 518 as a buffer sheet. The support layer 518 prevents the foam body 502 from curling or crushing when the leather is mounted. In the cantle area, shown in FIG. 13, the support board 518 and felt cloth 520 has a periphery slightly smaller than the outer perimeter of the foam 502, approximately equal the rear wedge 506. The exterior periphery of the foam body 502 is rounded, curving down to meet with the felt board 518. The widest point of the panel 500 is at the cantle, with the width narrowing around the mid-point to accommodate the rider's leg, and then increasing again at the withers area. By providing the curved periphery, the hard edges of the felt board 518 are prevented from pressing into the horse. Additionally, the curvature of the foam body 502 prevents the leather from bunching or ridging, helping to maintain the smooth under body of the saddle, as well as appealing aesthetics.

Figure 12:
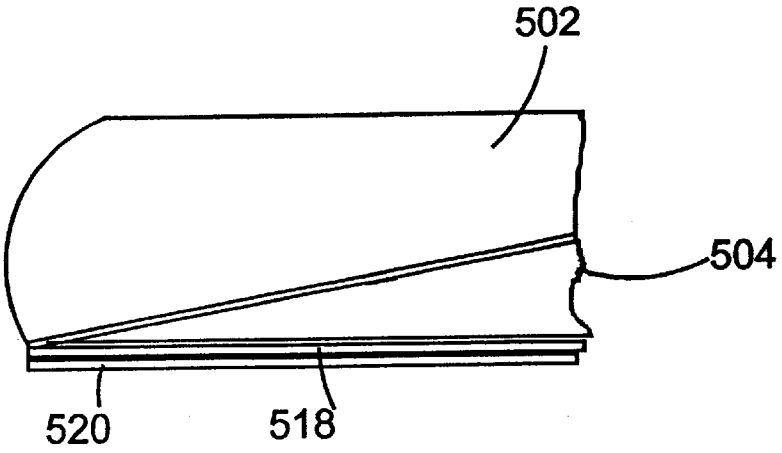
FIG. 12 is a cutaway side view of an interior section of the withers portion of the panel of FIG. 10.
Figure 13:
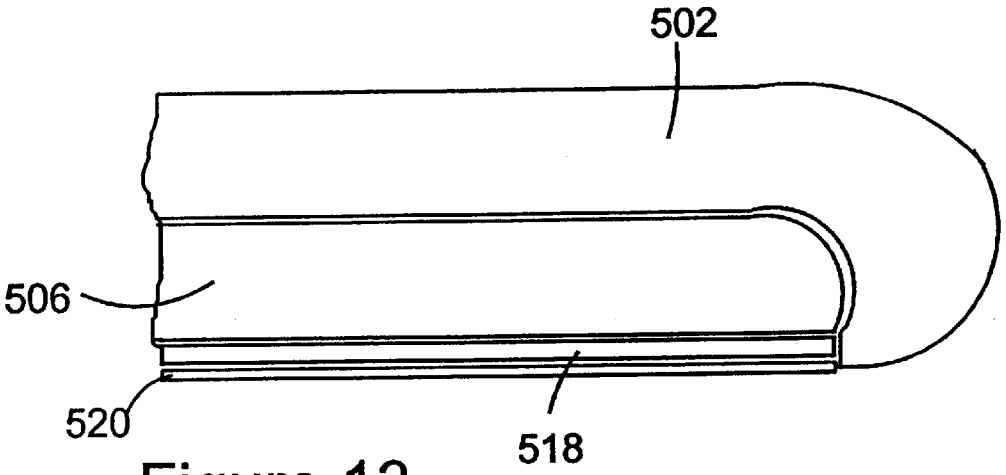
FIG. 13 is a cutaway side view of an interior section of the cantle portion of the panel of FIG. 10.

A cross section of the interior of the panels 500 is illustrated in FIGS. 12 and 13. FIG. 12 illustrates the withers portion of the panel 500 with the withers wedge 504 secured to the foam body 502 by adhesive or other means. The withers wedge 504 serves as a sub-support and must be placed so it spans the edge of the performance tree 50, thereby buffering the contact between the head 54 of the tree 50 and the horse's withers. The material used to produce the withers wedge 504 must not wear out, degrade or in any way change its cushioning capabilities. Material which meets this criteria are well known to those versed in the art. If the material changes its dimensioning during use, it can create chafing, or allow the tree 50 edge to rub the horses withers. However, since the material does not change or shift it's dimensions, the edges must be beveled and exactly configured with only about a 1/32 inch tolerance. As can be seen in FIG. 12, the wedge 504 is beveled to provide a smooth transition between the withers wedge 504 and the surrounding, unwedged area. The withers wedge 504 has been beveled from a maximum center height to a thin layer at the edges. The reduction from the high center point within the wedge 504 to the edges must be consistent and smooth with no ridges or sudden reductions, since an improperly configured withers wedge 504 can create the equivalent of a pebble in shoe. Although it would appear that the foam used for the panels 500 would cushion the edge of the tree 50, the presence of the tree 50 can still be felt through the foam. The tree 50 edge will not cut into the horse's withers, but its presence can be felt as a hard surface, and for some horses an annoyance. The use of the withers wedge 504 eliminates any pressure created by the edge of the tree 50.

The rear wedge 506 is surrounded by the panel body 502 and serves to control the slant and angle of the saddle, and therefore rider balance. In order to maintain the performance tree 50 approximately equidistant to the horse's back, the rear wedge 506 must be exact. Since the intent of the saddle is to maintain the tree 50 as close to equidistant to the horse's back as possible, the shape of the rear wedge 506 has to maintain even pressure during movement of the horse and rider. As stated heretofore, the cantle 52 was widened/raised to allow for muscle expansion during movement, therefore the greater thickness (arrow B) of the rear wedge 506 and panel body 502.

Figure 14:
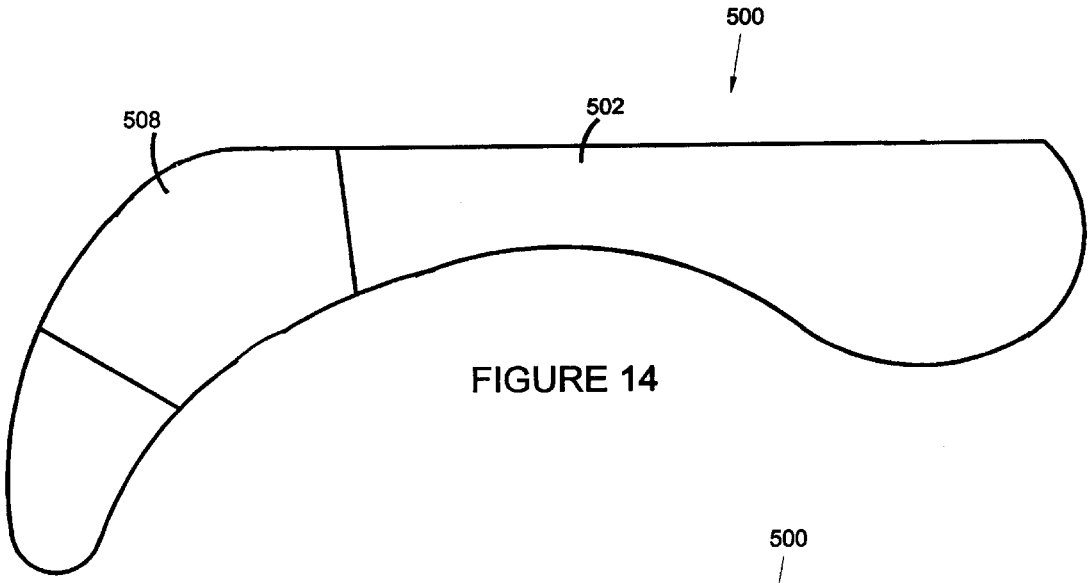
FIG. 14 is a top view of the exterior of the saddle panel of FIG. 10.
Figure 10:
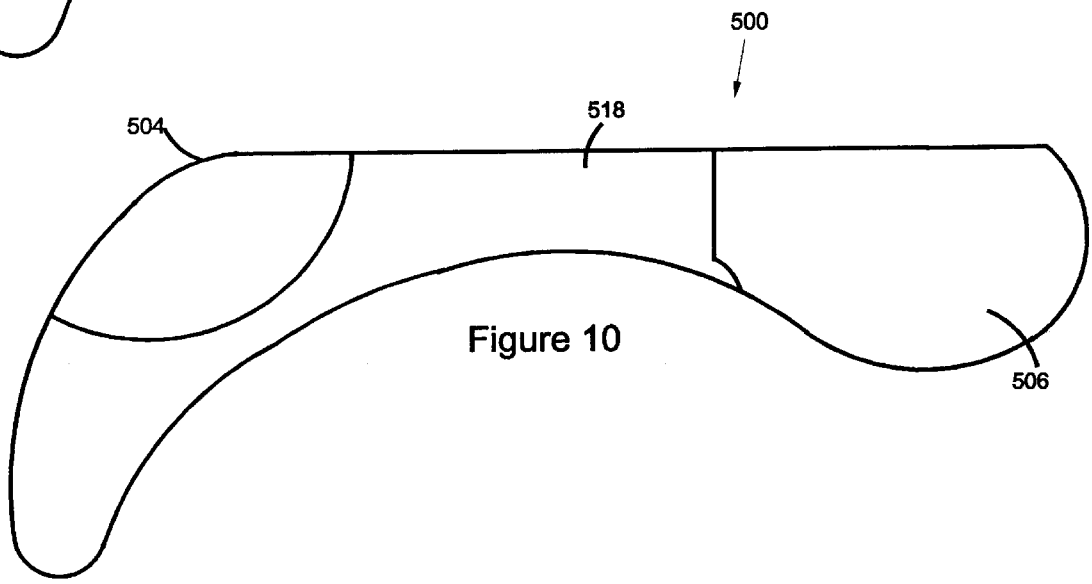
FIG. 10 is a top view of the interior of the saddle panel.
Figure 11:
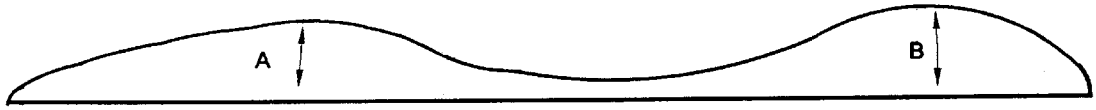
FIG. 11 is a side view of the panel of FIG. 10.

The front side of the panel 500, illustrated in FIG. 14, can be provided with an optional cover layer 508, which is a thin skin of material, such as LD 45. The cover layer 508 provides additional cell structure to the foam forming the panel body 502. Due to the structure of a saddle, the withers section is subject pressure at 45 to 75 degrees from the horizontal. Foam is manufactured to take pressure horizontally or vertically and the shear created by this angle changes the fit of the saddle. By placing the cover layer 508 in the areas subjected to the angled pressure, the shear factor is nearly eliminated. To be effective, the cover layer 508 must have a high memory level, and resist shearing and imprinting. The cover layer 508 has a thickness of about 1/16 to 1/8 inch and is preferably glued onto the panel body 502. The use of glue provides the added advantage of serving as a composite, providing additional shear resistance. The cover layer 508 is not always desired and in instances where the saddle is being fitted to an extremely wide horse, the cover layer 508 is not used. This allows the withers area of the saddle to slide down, leveling the tree along the horse's back.

Figure 15:
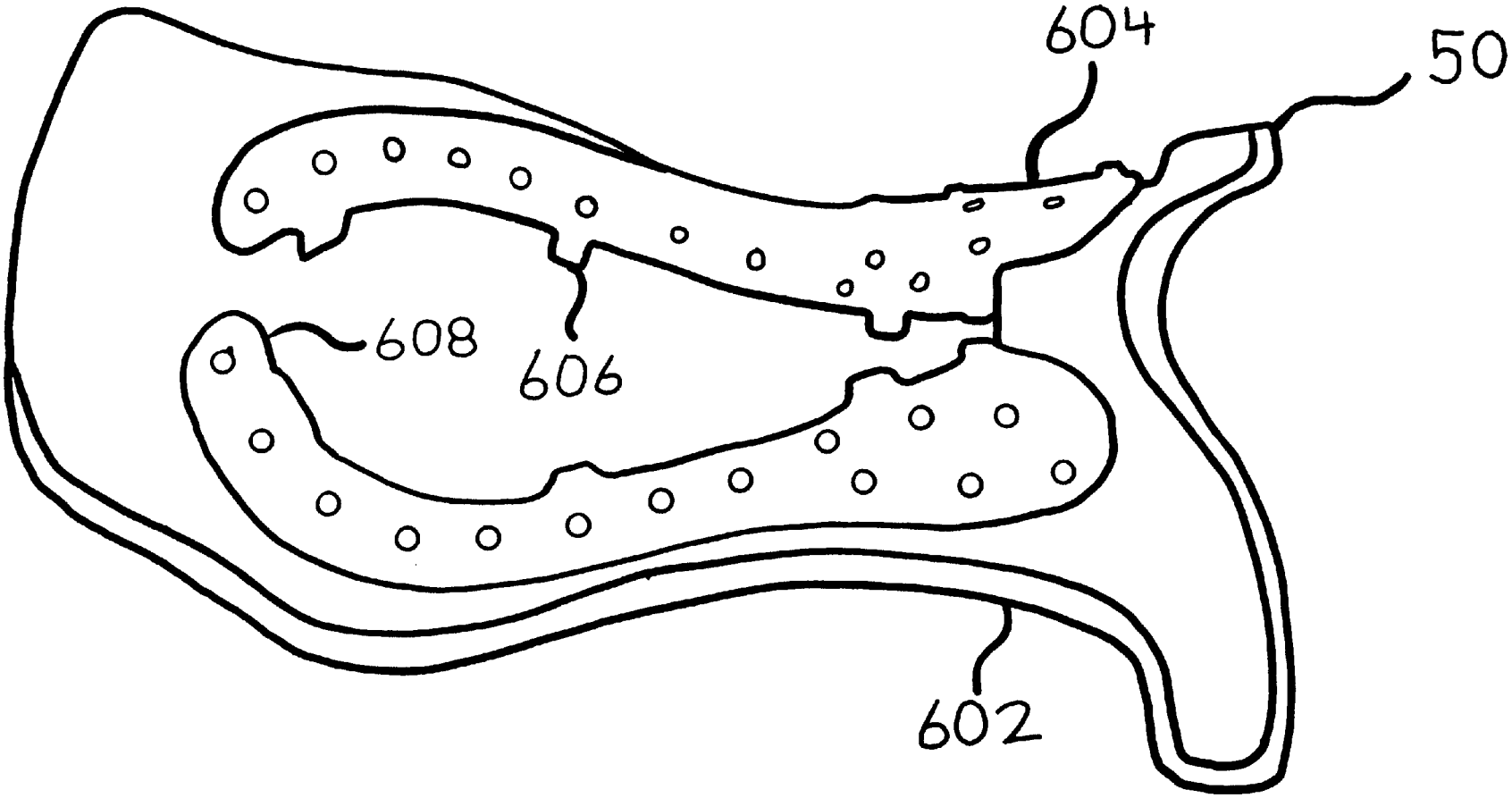
FIG. 15 is a perspective view of the drilling templates for use with the instant invention.

To facilitate the mounting of the torsion springs 62 and 64 to the tree 50, the mounting templates 602 and 604 of FIG. 15 are used. The mounting templates 602 and 604 are manufactured from steel to fit the contour of the tree 50. The templates 602 and 604 are provided with guide holes 608 which are placed along the templates 602 and 604 in the rivet 68 locations of the torsion springs 62 and 64. When the template guides 606 are placed flush with the interior edge of the tree 50, the templates 602 and 604 are placed in the appropriate position to drill the holes for the rivets 68. In this way, the torsion springs 62 and 64 are consistently located along the tree 50.

It should be noted that many of the dimensions set forth herein are critical, however in many instances the ratio is the controlling factor. The foregoing dimensions are suggested as optimal for an adult English and/or dressage saddle. Any changes in the dimensions when manufacturing a child's saddle or a Western saddle would be apparent to those skilled in the art.

TABLE I

| X | Y | Z |
|---|---|---|
| −0.0000 | −2.4072 | −3.0050 |
| −0.1002 | −2.4076 | −3.0050 |
| −0.1997 | −2.4094 | −3.0050 |
| −0.2993 | −2.4074 | −3.0050 |
| −0.3992 | −2.4059 | −3.0050 |
| −0.4992 | −2.4026 | −3.0050 |

TABLE I-continued

| X | Y | Z |
|---|---|---|
| −0.5997 | −2.4013 | −3.0050 |
| −0.6331 | −2.4010 | −3.0050 |
| −0.0001 | −2.3991 | −2.9051 |
| −0.1001 | −2.3998 | −2.9051 |
| −0.1998 | −2.4007 | −2.9051 |
| −0.2998 | −2.4003 | −2.9051 |
| −0.4000 | −2.4018 | −2.9051 |
| −0.4995 | −2.4019 | −2.9051 |
| −0.5995 | −2.4016 | −2.9051 |
| −0.6994 | −2.4014 | −2.9051 |
| −0.7993 | −2.4001 | −2.9051 |
| −0.8995 | −2.3991 | −2.9051 |
| −0.9995 | −2.3978 | −2.9051 |
| −1.0997 | −2.3964 | −2.9051 |
| −1.1997 | −2.3948 | −2.9051 |
| −1.2988 | −2.3901 | −2.9051 |
| −1.3982 | −2.3799 | −2.9051 |
| −1.4989 | −2.3710 | −2.9051 |
| −1.5970 | −2.3600 | −2.9051 |
| −1.6390 | −2.3519 | −2.9051 |
| −0.0002 | −2.3707 | −2.8050 |
| −0.1000 | −2.3712 | −2.8050 |
| −0.1998 | −2.3713 | −2.8050 |
| −0.2996 | −2.3712 | −2.8050 |
| −0.3996 | −2.3709 | −2.8050 |
| −0.4996 | −2.3711 | −2.8050 |
| −0.5994 | −2.3704 | −2.8050 |
| −0.6995 | −2.3698 | −2.8050 |
| −0.7995 | −2.3689 | −2.8050 |
| −0.8996 | −2.3674 | −2.8050 |
| −1.0000 | −2.3665 | −2.8050 |
| −1.1000 | −2.3658 | −2.8050 |
| −1.1999 | −2.3634 | −2.8050 |
| −1.3006 | −2.3617 | −2.8050 |
| −1.4008 | −2.3619 | −2.8050 |
| −1.5005 | −2.3596 | −2.8050 |
| −1.6014 | −2.3594 | −2.8050 |
| −1.7003 | −2.3587 | −2.8050 |
| −1.7999 | −2.3516 | −2.8050 |
| −1.8996 | −2.3444 | −2.8050 |
| −1.9978 | −2.3297 | −2.8050 |
| −2.0960 | −2.3119 | −2.8050 |
| −2.1675 | −2.2957 | −2.8050 |
| −0.0000 | −2.3353 | −2.7052 |
| −0.1000 | −2.3355 | −2.7052 |
| −0.1999 | −2.3361 | −2.7052 |
| −0.2996 | −2.3363 | −2.7052 |
| −0.3995 | −2.3358 | −2.7052 |
| −0.4996 | −2.3359 | −2.7052 |
| −0.5993 | −2.3350 | −2.7052 |
| −0.6994 | −2.3337 | −2.7052 |
| −0.7997 | −2.3325 | −2.7052 |
| −0.8999 | −2.3320 | −2.7052 |
| −1.0000 | −2.3311 | −2.7052 |
| −1.1000 | −2.3309 | −2.7052 |
| −1.2000 | −2.3292 | −2.7052 |
| −1.3002 | −2.3282 | −2.7052 |
| −1.4005 | −2.3261 | −2.7052 |
| −1.5006 | −2.3259 | −2.7052 |
| −1.6005 | −2.3224 | −2.7052 |
| −1.7008 | −2.3208 | −2.7052 |
| −1.8008 | −2.3169 | −2.7052 |
| −1.9010 | −2.3135 | −2.7052 |
| −2.0005 | −2.3081 | −2.7052 |
| −2.1007 | −2.3010 | −2.7052 |
| −2.2009 | −2.2956 | −2.7052 |
| −2.2992 | −2.2871 | −2.7052 |
| −2.3973 | −2.2689 | −2.7052 |
| −2.4877 | −2.2429 | −2.7052 |
| −2.4922 | −2.2403 | −2.7052 |
| −0.0006 | −2.2926 | −2.6049 |
| −0.1001 | −2.2951 | −2.6049 |
| −0.1998 | −2.2953 | −2.6049 |
| −0.2997 | −2.2960 | −2.6049 |
| −0.3995 | −2.2956 | −2.6049 |
| −0.4996 | −2.2959 | −2.6049 |
| −0.5992 | −2.2947 | −2.6049 |

TABLE I-continued

| X | Y | Z |
|---|---|---|
| −0.6994 | −2.2931 | −2.6049 |
| −0.7997 | −2.2916 | −2.6049 |
| −0.9001 | −2.2911 | −2.6049 |
| −1.002 | −2.2912 | −2.6049 |
| −1.1000 | −2.2907 | −2.6049 |
| −1.2000 | −2.2902 | −2.6049 |
| −1.3000 | −2.2889 | −2.6049 |
| −1.4008 | −2.2892 | −2.6049 |
| −1.4996 | −2.2896 | −2.6049 |
| −1.5995 | −2.2837 | −2.6049 |
| −1.7006 | −2.2822 | −2.6049 |
| −1.8007 | −2.2761 | −2.6049 |
| −1.9016 | −2.2748 | −2.6049 |
| −2.0008 | −2.2704 | −2.6049 |
| −2.1011 | −2.2644 | −2.6049 |
| −2.2009 | −2.2592 | −2.6049 |
| −2.3008 | −2.2513 | −2.6049 |
| −2.4008 | −2.2444 | −2.6049 |
| −2.5004 | −2.2356 | −2.6049 |
| −2.5984 | −2.2240 | −2.6049 |
| −2.6904 | −2.1964 | −2.6049 |
| −2.7284 | −2.1744 | −2.6049 |
| −0.0002 | −2.2501 | −2.5049 |
| −0.1001 | −2.2515 | −2.5049 |
| −0.1998 | −2.2520 | −2.5049 |
| −0.2998 | −2.2520 | −2.5049 |
| −0.3997 | −2.2530 | −2.5049 |
| −0.4993 | −2.2524 | −2.5049 |
| −0.5994 | −2.2512 | −2.5049 |
| 0.6996 | −2.2501 | −2.5049 |
| 0.7997 | −2.2492 | −2.5049 |
| 0.8999 | −2.2481 | −2.5049 |
| 1.0001 | −2.2482 | −2.5049 |
| −1.1002 | −2.2477 | −2.5649 |
| −1.2003 | −2.2492 | −2.5049 |
| −1.2998 | −2.2485 | −2.5049 |
| −1.4001 | −2.2479 | −2.5049 |
| −1.5000 | −2.2471 | −2.5049 |
| −1.6000 | −2.2452 | −2.5049 |
| −1.6997 | −2.2424 | −2.5049 |
| −1.7999 | −2.2366 | −2.5049 |
| −1.9004 | −2.2337 | −2.5049 |
| −2.0001 | −2.2286 | −2.5049 |
| −2.1003 | −2.2229 | −2.5049 |
| −2.2004 | −2.2176 | −2.5049 |
| −2.3002 | −2.2113 | −2.5049 |
| −2.4000 | −2.2035 | −2.5049 |
| −2.4999 | −2.1958 | −2.5049 |
| −2.5990 | −2.1862 | −2.5049 |
| −2.7009 | −2.1772 | −2.5049 |
| −2.7923 | −2.1628 | −2.5049 |
| −2.9024 | −2.1484 | −2.5049 |
| −2.8985 | −2.1512 | −2.5049 |
| −1.0003 | −2.2045 | −2.4051 |
| −0.1001 | −2.2059 | −2.4051 |
| −0.1999 | −2.2063 | −2.4051 |
| −1.2997 | −2.2068 | −2.4051 |
| −1.3996 | −2.2066 | −2.4051 |
| −0.4997 | −2.2071 | −2.4051 |
| −0.5990 | −2.2069 | −2.4051 |
| −0.6992 | −2.2042 | −2.4051 |
| −0.8000 | −2.2051 | −2.4051 |
| −0.8993 | −2.2048 | −2.4051 |
| −0.9998 | −2.2028 | −2.4051 |
| −1.1004 | −2.2050 | −2.4051 |
| −1.1999 | −2.2048 | −2.4051 |
| −1.3002 | −2.2052 | −2.4051 |
| −1.3997 | −2.2056 | −2.4051 |
| −1.4995 | −2.2035 | −2.4051 |
| −1.6000 | −2.2030 | −2.4051 |
| −1.6994 | −2.2009 | −2.4051 |
| −1.7996 | −2.1960 | −2.4051 |
| −1.8995 | −2.1919 | −2.4051 |
| −1.9992 | −2.1845 | −2.4051 |
| −2.0999 | −2.1788 | −2.4051 |
| −2.2000 | −2.1746 | −2.4051 |
| −2.2997 | −2.1687 | −2.4051 |

TABLE I-continued

| X | Y | Z |
|---|---|---|
| −2.3998 | −2.1614 | −2.4051 |
| −2.4995 | −2.1548 | −2.4051 |
| −2.5989 | −2.1449 | −2.4051 |
| −2.6988 | −2.1355 | −2.4051 |
| −2.7988 | −2.1260 | −2.4051 |
| −2.8953 | −2.1137 | −2.4051 |
| −2.9839 | −2.0729 | −2.4051 |
| −2.9963 | −2.0636 | −2.4051 |
| −0.0002 | −2.1548 | −2.3049 |
| −0.1001 | −2.1560 | −2.3049 |
| −0.1999 | −2.1569 | −2.3049 |
| −0.2997 | −2.1572 | −2.3049 |
| −0.3997 | −2.1575 | −2.3049 |
| −0.4997 | −2.1589 | −2.3049 |
| −0.5991 | −2.1597 | −2.3049 |
| −0.6991 | −2.1578 | −2.3049 |
| −0.7995 | −2.1586 | −2.3049 |
| −0.8993 | −2.1573 | −2.3049 |
| −0.9998 | −2.1578 | −2.3049 |
| −1.0997 | −2.1586 | −2.3049 |
| −1.1994 | −2.1596 | −2.3049 |
| −1.2993 | −2.1591 | −2.3049 |
| −1.3993 | −2.1597 | −2.3049 |
| −1.4991 | −2.1579 | −2.3049 |
| −1.5992 | −2.1573 | −2.3049 |
| −1.6991 | −2.1538 | −2.3049 |
| −1.7993 | −2.1515 | −2.3049 |
| −1.8991 | −2.1461 | −2.3049 |
| −1.9994 | −2.1410 | −2.3049 |
| −2.0995 | −2.1362 | −2.3049 |
| −2.1994 | −2.1305 | −2.3049 |
| −2.2995 | −2.1244 | −2.3049 |
| −2.3994 | −2.1182 | −2.3049 |
| −2.4990 | −2.1107 | −2.3049 |
| −2.5989 | −2.1016 | −2.3049 |
| −2.6988 | −2.0937 | −2.3049 |
| −2.7981 | −2.0842 | −2.3049 |
| −2.8986 | −2.0743 | −2.3049 |
| −2.9943 | −2.0631 | −2.3049 |
| −3.0834 | −2.0172 | −2.3049 |
| −3.0902 | −2.0123 | −2.3049 |
| −0.0003 | −2.1019 | −2.2052 |
| −0.1002 | −2.1037 | −2.2052 |
| −0.1999 | −2.1052 | −2.2052 |
| −0.2996 | −2.1052 | −2.2052 |
| −0.3997 | −2.1056 | −2.2052 |
| −0.4996 | −2.1066 | −2.2052 |
| −0.5994 | −2.1071 | −2.2052 |
| −0.6991 | −2.1074 | −2.2052 |
| −0.7992 | −2.1069 | −2.2052 |
| −0.8995 | −2.1088 | −2.2052 |
| −0.9991 | −2.1094 | −2.2052 |
| −1.0991 | −2.1102 | −2.2052 |
| −1.1991 | −2.1114 | −2.2052 |
| −1.2987 | −2.1123 | −2.2052 |
| −1.3984 | −2.1112 | −2.2052 |
| −1.4983 | −2.1098 | −2.2052 |
| −1.5985 | −2.1069 | −2.2052 |
| −1.6988 | −2.1047 | −2.2052 |
| −1.7988 | −2.1014 | −2.2052 |
| −1.8991 | −2.0975 | −2.2052 |
| −1.9993 | −2.0942 | −2.2052 |
| −2.0993 | −2.0902 | −2.2052 |
| −2.1993 | −2.0849 | −2.2052 |
| −2.2994 | −2.0795 | −2.2052 |
| −2.3992 | −2.0731 | −2.2052 |
| −2.4990 | −2.0659 | −2.2052 |
| −2.5989 | −2.0579 | −2.2052 |
| −2.6987 | −2.0501 | −2.2052 |
| −2.7986 | −2.0412 | −2.2052 |
| −2.8982 | −2.0332 | −2.2052 |
| −2.9982 | −2.0226 | −2.2052 |
| −3.0928 | −2.0086 | −2.2052 |
| −3.1724 | −1.9630 | −2.2052 |
| −0.0003 | −2.0470 | −2.1052 |
| −0.1002 | −2.0484 | −2.1052 |
| −0.2000 | −2.0498 | −2.1052 |

TABLE I-continued

| X | Y | Z |
|---|---|---|
| −0.2997 | −2.0505 | −2.1052 |
| −0.3997 | −2.0513 | −2.1052 |
| −0.4995 | −2.0522 | −2.1052 |
| −0.5993 | −2.0525 | −2.1052 |
| −0.6994 | −2.0528 | −2.1052 |
| −0.7993 | −2.0544 | −2.1052 |
| −0.8991 | −2.0552 | −2.1052 |
| −0.9991 | −2.0562 | −2.1052 |
| −1.0990 | −2.0577 | −2.1052 |
| −1.1987 | −2.0593 | −2.1052 |
| −1.2986 | −2.0596 | −2.1052 |
| −1.3982 | −2.0603 | −2.1052 |
| −1.4976 | −2.0584 | −2.1052 |
| −1.5979 | −2.0553 | −2.1052 |
| −1.6982 | −2.0524 | −2.1052 |
| −1.7984 | −2.0493 | −2.1052 |
| −1.8988 | −2.0462 | −2.1052 |
| −1.9989 | −2.0439 | −2.1052 |
| −2.0988 | −2.0397 | −2.1052 |
| −2.1987 | −2.0343 | −2.1052 |
| −2.2992 | −2.0288 | −2.1052 |
| −2.3993 | −2.0255 | −2.1052 |
| −2.4988 | −2.0185 | −2.1052 |
| −2.5990 | −2.0116 | −2.1052 |
| −2.6988 | −2.0046 | −2.1052 |
| −2.7987 | −1.9968 | −2.1052 |
| −2.8982 | −1.9883 | −2.1052 |
| −2.9980 | −1.9781 | −2.1052 |
| −3.0973 | −1.9681 | −2.1052 |
| −3.1891 | −1.9453 | −2.1052 |
| −3.2351 | −1.9143 | −2.1052 |
| 0.0000 | −1.9921 | −2.0049 |
| −0.1000 | −1.9926 | −2.0049 |
| −0.2000 | −1.9936 | −2.0049 |
| −0.2997 | −1.9945 | −2.0049 |
| −0.3997 | −1.9949 | −2.0049 |
| −0.4996 | −1.9964 | −2.0049 |
| −0.5993 | −1.9970 | −2.0049 |
| −0.6992 | −1.9973 | −2.0049 |
| −0.7992 | −1.9980 | −2.0049 |
| −0.8992 | −1.9992 | −2.0049 |
| −0.9992 | −2.0013 | −2.0049 |
| −1.0987 | −2.0026 | −2.0049 |
| −1.1987 | −2.0027 | −2.0049 |
| −1.2988 | −2.0048 | −2.0049 |
| −1.3983 | −2.0055 | −2.0049 |
| −1.4979 | −2.0045 | −2.0049 |
| −1.5979 | −2.0025 | −2.0049 |
| −1.6981 | −1.9997 | −2.0049 |
| −1.7987 | −1.9973 | −2.0049 |
| −1.8989 | −1.9968 | −2.0049 |
| −1.9983 | −1.9928 | −2.0049 |
| −2.0982 | −1.9870 | −2.0049 |
| −2.1986 | −1.9809 | −2.0049 |
| −2.2992 | −1.9775 | −2.0049 |
| −2.3993 | −1.9745 | −2.0049 |
| −2.4989 | −1.9693 | −2.0049 |
| −2.5990 | −1.9625 | −2.0049 |
| −2.6990 | −1.9567 | −2.0049 |
| −2.7988 | −1.9494 | −2.0049 |
| −2.8984 | −1.9411 | −2.0049 |
| −2.9982 | −1.9314 | −2.0049 |
| −3.0976 | −1.9218 | −2.0049 |
| −3.1952 | −1.9069 | −2.0049 |
| −3.2794 | −1.8735 | −2.0049 |
| −3.2940 | −1.8573 | −2.0049 |
| −0.0005 | −1.9375 | −1.9053 |
| −0.1000 | −1.9389 | −1.9053 |
| −0.1996 | −1.9383 | −1.9053 |
| −0.3002 | −1.9383 | −1.9053 |
| −0.3999 | −1.9399 | −1.9053 |
| −0.4999 | −1.9397 | −1.9053 |
| −0.5998 | −1.9413 | −1.9053 |
| −0.6996 | −1.9408 | −1.9053 |
| −0.7998 | −1.9421 | −1.9053 |
| −0.8995 | −1.9421 | −1.9053 |
| −0.9998 | −1.9430 | −1.9053 |

TABLE I-continued

| X | Y | Z |
|---|---|---|
| −1.0997 | −1.9451 | −1.9053 |
| −1.1995 | −1.9461 | −1.9053 |
| −1.2994 | −1.9475 | −1.9053 |
| −1.3991 | −1.9483 | −1.9053 |
| −1.4989 | −1.9484 | −1.9053 |
| −1.5987 | −1.9480 | −1.9053 |
| −1.6983 | −1.9467 | −1.9053 |
| −1.7985 | −1.9435 | −1.9053 |
| −1.8991 | −1.9423 | −1.9053 |
| −1.9985 | −1.9396 | −1.9053 |
| −2.0985 | −1.9334 | −1.9053 |
| −2.1991 | −1.9285 | −1.9053 |
| −2.2995 | −1.9252 | −1.9053 |
| −2.3998 | −1.9226 | −1.9053 |
| −2.4995 | −1.9187 | −1.9053 |
| −2.5992 | −1.9124 | −1.9053 |
| −2.6993 | −1.9053 | −1.9053 |
| −2.7991 | −1.8986 | −1.9053 |
| −2.8989 | −1.8903 | −1.9053 |
| −2.9989 | −1.8825 | −1.9053 |
| −3.0977 | −1.8728 | −1.9053 |
| −3.1970 | −1.8580 | −1.9053 |
| −3.2900 | −1.8391 | −1.9053 |
| −3.3472 | −1.8027 | −1.9053 |
| −0.0003 | −1.8804 | −1.8050 |
| −0.1001 | −1.8819 | −1.8050 |
| −0.1998 | −1.8824 | −1.8050 |
| −0.2995 | −1.8825 | −1.8050 |
| −0.3995 | −1.8816 | −1.8050 |
| −0.4998 | −1.8823 | −1.8050 |
| −0.5996 | −1.8825 | −1.8050 |
| −0.6996 | −1.8831 | −1.8050 |
| −0.7994 | −1.8837 | −1.8050 |
| −0.8993 | −1.8838 | −1.8050 |
| −0.9992 | −1.8841 | −1.8050 |
| −1.0992 | −1.8849 | −1.8050 |
| −1.1991 | −1.8859 | −1.8050 |
| −1.2991 | −1.8869 | −1.8050 |
| −1.3988 | −1.8885 | −1.8050 |
| −1.4985 | −1.8886 | −1.8050 |
| −1.5985 | −1.8886 | −1.8050 |
| −1.6983 | −1.8885 | −1.8050 |
| −1.7981 | −1.8876 | −1.8050 |
| −1.8980 | −1.8859 | −1.8050 |
| −1.9980 | −1.8828 | −1.8050 |
| −2.0983 | −1.8789 | −1.8050 |
| −2.1985 | −1.8756 | −1.8050 |
| −2.2987 | −1.8715 | −1.8050 |
| −2.3990 | −1.8685 | −1.8050 |
| −2.4988 | −1.8644 | −1.8050 |
| −2.5987 | −1.8584 | −1.8050 |
| −2.6987 | −1.8520 | −1.8050 |
| −2.7984 | −1.8452 | −1.8050 |
| −2.8984 | −1.8370 | −1.8050 |
| −2.9984 | −1.8299 | −1.8050 |
| −3.0973 | −1.8203 | −1.8050 |
| −3.1966 | −1.8068 | −1.8050 |
| −3.2928 | −1.7907 | −1.8050 |
| −3.3746 | −1.7594 | −1.8050 |
| −0.0005 | −1.8224 | −1.7049 |
| −0.1001 | −1.8239 | −1.7049 |
| −0.1996 | −1.8241 | −1.7049 |
| −0.2993 | −1.8231 | −1.7049 |
| −0.3998 | −1.8219 | −1.7049 |
| −0.5001 | −1.8226 | −1.7049 |
| −0.5999 | −1.8228 | −1.7049 |
| −0.6996 | −1.8229 | −1.7049 |
| −0.7996 | −1.8218 | −1.7049 |
| −0.8999 | −1.8223 | −1.7049 |
| −0.9999 | −1.8231 | −1.7049 |
| −1.0997 | −1.8245 | −1.7049 |
| −1.1996 | −1.8245 | −1.7049 |
| −1.2997 | −1.8258 | −1.7049 |
| −1.3994 | −1.8268 | −1.7049 |
| −1.4994 | −1.8272 | −1.7049 |
| −1.5992 | −1.8284 | −1.7049 |
| −1.6990 | −1.8284 | −1.7049 |

TABLE I-continued

| X | Y | Z |
|---|---|---|
| −1.7985 | −1.8287 | −1.7049 |
| −1.8982 | −1.8255 | −1.7049 |
| −1.9987 | −1.8239 | −1.7049 |
| −2.0988 | −1.8211 | −1.7049 |
| −2.1992 | −1.8193 | −1.7049 |
| −2.2992 | −1.8163 | −1.7049 |
| −2.3995 | −1.8129 | −1.7049 |
| −2.4994 | −1.8095 | −1.7049 |
| −2.5992 | −1.8035 | −1.7049 |
| −2.6992 | −1.7973 | −1.7049 |
| −2.7991 | −1.7901 | −1.7049 |
| −2.8991 | −1.7831 | −1.7049 |
| −2.9988 | −1.7754 | −1.7049 |
| −3.0985 | −1.7668 | −1.7049 |
| −3.1972 | −1.7558 | −1.7049 |
| −3.2964 | −1.7403 | −1.7049 |
| −3.3854 | −1.7171 | −1.7049 |
| −3.4357 | −1.6205 | −1.7049 |
| −3.4360 | −1.6153 | −1.7049 |
| −0.0002 | −1.7625 | −1.6049 |
| −0.1000 | −1.7628 | −1.6049 |
| −0.1998 | −1.7627 | −1.6049 |
| −0.2998 | −1.7623 | −1.6049 |
| −0.3998 | −1.7623 | −1.6049 |
| −0.4997 | −1.7617 | −1.6049 |
| −0.5999 | −1.7619 | −1.6049 |
| −0.6995 | −1.7610 | −1.6049 |
| −0.7999 | −1.7598 | −1.6049 |
| −0.9002 | −1.7609 | −1.6049 |
| −0.9999 | −1.7608 | −1.6049 |
| −1.1001 | −1.7613 | −1.6049 |
| −1.2001 | −1.7626 | −1.6049 |
| −1.2998 | −1.7637 | −1.6049 |
| −1.3996 | −1.7639 | −1.6049 |
| −1.4997 | −1.7646 | −1.6049 |
| −1.5992 | −1.7653 | −1.6049 |
| −1.6992 | −1.7639 | −1.6049 |
| −1.7997 | −1.7646 | −1.6049 |
| −1.8992 | −1.7647 | −1.6049 |
| −1.9990 | −1.7632 | −1.6049 |
| −2.0993 | −1.7617 | −1.6049 |
| −2.1994 | −1.7601 | −1.6049 |
| −2.2997 | −1.7581 | −1.6049 |
| −2.3997 | −1.7560 | −1.6049 |
| −2.4996 | −1.7517 | −1.6049 |
| −2.5997 | −1.7471 | −1.6049 |
| −2.6995 | −1.7413 | −1.6049 |
| −2.7996 | −1.7350 | −1.6049 |
| −2.8996 | −1.7287 | −1.6049 |
| −2.9991 | −1.7211 | −1.6049 |
| −3.0988 | −1.7113 | −1.6049 |
| −3.1979 | −1.7010 | −1.6049 |
| −3.2977 | −1.6878 | −1.6049 |
| −3.3896 | −1.6695 | −1.6049 |
| −3.4565 | −1.5923 | −1.6049 |
| −3.4635 | −1.5663 | −1.6049 |
| −3.4775 | −1.4926 | −1.6049 |
| −0.0003 | −1.6984 | −1.5049 |
| −0.1001 | −1.6991 | −1.5049 |
| −1.1997 | −1.6990 | −1.5049 |
| −1.2997 | −1.6978 | −1.5049 |
| −1.3999 | −1.6974 | −1.5049 |
| −1.5000 | −1.6965 | −1.5049 |
| −0.6003 | −1.6966 | −1.5049 |
| −1.7001 | −1.6965 | −1.5049 |
| −1.7999 | −1.6963 | −1.5049 |
| −1.9000 | −1.6954 | −1.5049 |
| −1.0004 | −1.6959 | −1.5049 |
| −1.1002 | −1.6970 | −1.5049 |
| −1.2001 | −1.6977 | −1.5049 |
| −1.2998 | −1.6984 | −1.5049 |
| −1.4000 | −1.6985 | −1.5049 |
| −1.5000 | −1.7009 | −1.5049 |
| −1.5994 | −1.7013 | −1.5049 |
| −1.6993 | −1.7010 | −1.5049 |
| −1.7996 | −1.7012 | −1.5049 |
| −1.8990 | −1.7012 | −1.5049 |

TABLE I-continued

| X | Y | Z |
|---|---|---|
| −1.9991 | −1.6990 | −1.5049 |
| −2.0996 | −1.7002 | −1.5049 |
| −2.1992 | −1.6985 | −1.5049 |
| −2.2993 | −1.6975 | −1.5049 |
| −2.3992 | −1.6934 | −1.5049 |
| −2.4997 | −1.6907 | −1.5049 |
| −2.5997 | −1.6873 | −1.5049 |
| −2.6996 | −1.6832 | −1.5049 |
| −2.7996 | −1.6775 | −1.5049 |
| −2.8995 | −1.6722 | −1.5049 |
| −2.9989 | −1.6638 | −1.5049 |
| −3.0986 | −1.6543 | −1.5049 |
| −3.1979 | −1.6437 | −1.5049 |
| −3.2973 | −1.6309 | −1.5049 |
| −3.3918 | −1.6132 | −1.5049 |
| −3.4676 | −1.5588 | −1.5049 |
| −3.4815 | −1.5248 | −1.5049 |
| −3.4952 | −1.4775 | −1.5049 |
| −0.0004 | −1.6302 | −1.4052 |
| −0.1002 | −1.6313 | −1.4052 |
| −0.1999 | −1.6318 | −1.4052 |
| −0.2993 | −1.6311 | −1.4052 |
| −0.3997 | −1.6290 | −1.4052 |
| −0.5001 | −1.6292 | −1.4052 |
| −0.5999 | −1.6282 | −1.4052 |
| −0.7002 | −1.6281 | −1.4052 |
| −0.8003 | −1.6283 | −1.4052 |
| 1.9003 | −1.6294 | −1.4052 |
| −1.0001 | −1.6308 | −1.4052 |
| −1.0998 | −1.6311 | −1.4052 |
| −1.1998 | −1.6312 | −1.4052 |
| −1.3000 | −1.6323 | −1.4052 |
| −1.3998 | −1.6344 | −1.4052 |
| −1.4996 | −1.6359 | −1.4052 |
| −1.5994 | −1.6373 | −1.4052 |
| −1.6992 | −1.6375 | −1.4052 |
| −1.7989 | −1.6376 | −1.4052 |
| −1.8989 | −1.6368 | −1.4052 |
| −1.9989 | −1.6370 | −1.4052 |
| −2.0987 | −1.6352 | −1.4052 |
| −2.1992 | −1.6344 | −1.4052 |
| −2.2989 | −1.6327 | −1.4052 |
| −2.3992 | −1.6298 | −1.4052 |
| −2.4994 | −1.6276 | −1.4052 |
| −2.5995 | −1.6242 | −1.4052 |
| −2.6997 | −1.6211 | −1.4052 |
| −2.7998 | −1.6172 | −1.4052 |
| −2.8996 | −1.6124 | −1.4052 |
| −2.9991 | −1.6054 | −1.4052 |
| −3.0988 | −1.5961 | −1.4052 |
| −3.1978 | −1.5857 | −1.4052 |
| −3.2966 | −1.5710 | −1.4052 |
| −3.3940 | −1.5537 | −1.4052 |
| −3.4774 | −1.5160 | −1.4052 |
| −3.5034 | −1.4566 | −1.4052 |
| −3.5192 | −1.3921 | −1.4052 |
| −0.0004 | −1.5592 | −1.3049 |
| −0.0999 | −1.5600 | −1.3049 |
| −0.1997 | −1.5592 | −1.3049 |
| −0.2999 | −1.5592 | −1.3049 |
| −0.3999 | −1.5588 | −1.3049 |
| −0.4998 | −1.5593 | −1.3049 |
| −0.5996 | −1.5579 | −1.3049 |
| −0.7002 | −1.5580 | −1.3049 |
| −0.8000 | −1.5586 | −1.3049 |
| −0.9001 | −1.5592 | −1.3049 |
| −1.0000 | −1.5612 | −1.3049 |
| −1.0997 | −1.5624 | −1.3049 |
| −1.1997 | −1.5633 | −1.3049 |
| −1.2997 | −1.5648 | −1.3049 |
| −1.3996 | −1.5668 | −1.3049 |
| −1.4993 | −1.5688 | −1.3049 |
| −1.5991 | −1.5697 | −1.3049 |
| −1.6989 | −1.5705 | −1.3049 |
| −1.7987 | −1.5708 | −1.3049 |
| −1.8986 | −1.5710 | −1.3049 |
| −1.9983 | −1.5706 | −1.3049 |

TABLE I-continued

| X | Y | Z |
|---|---|---|
| −2.0984 | −1.5699 | −1.3049 |
| −2.1983 | −1.5687 | −1.3049 |
| −2.2984 | −1.5664 | −1.3049 |
| −2.3983 | −1.5643 | −1.3049 |
| −2.5000 | −1.5622 | −1.3049 |
| −2.5992 | −1.5668 | −1.3049 |
| −2.7004 | −1.5564 | −1.3049 |
| −2.8057 | −1.5528 | −1.3049 |
| −2.9055 | −1.5487 | −1.3049 |
| −3.0054 | −1.5437 | −1.3049 |
| −3.1044 | −1.5350 | −1.3049 |
| −3.2035 | −1.5224 | −1.3049 |
| −3.3014 | −1.5076 | −1.3049 |
| −3.3990 | −1.4861 | −1.3049 |
| −3.4845 | −1.4558 | −1.3049 |
| −3.5285 | −1.3589 | −1.3049 |
| −3.5328 | −1.3343 | −1.3049 |
| −3.5335 | −1.2830 | −1.3049 |
| −0.0002 | −1.4843 | −1.2050 |
| −0.1000 | −1.4853 | −1.2950 |
| −0.1997 | −1.4854 | −1.2050 |
| −0.2997 | −1.4852 | −1.2050 |
| −0.3995 | −1.4856 | −1.2050 |
| −0.4995 | −1.4847 | −1.2050 |
| −0.5999 | −1.4855 | −1.2050 |
| −0.6999 | −1.4862 | −1.2050 |
| −0.7999 | −1.4885 | −1.2050 |
| −0.8997 | −1.4898 | −1.2050 |
| −0.9994 | −1.4915 | −1.2050 |
| −1.0992 | −1.4918 | −1.2050 |
| −1.1993 | −1.4927 | −1.2050 |
| −1.2993 | −1.4945 | −1.2050 |
| −1.3993 | −1.4971 | −1.2050 |
| −1.4991 | −1.5003 | −1.2050 |
| −1.5985 | −1.5022 | −1.2050 |
| −1.6985 | −1.5021 | −1.2050 |
| −1.7987 | −1.5041 | −1.2050 |
| −1.8984 | −1.5049 | −1.2050 |
| −1.9980 | −1.5056 | −1.2050 |
| −2.0977 | −1.5037 | −1.2050 |
| −2.1980 | −1.5022 | −1.2050 |
| −2.2982 | −1.5001 | −1.2050 |
| −2.3984 | −1.4982 | −1.2050 |
| −2.4984 | −1.4954 | −1.2050 |
| −2.5988 | −1.4920 | −1.2050 |
| −2.6990 | −1.4894 | −1.2050 |
| −2.7991 | −1.4858 | −1.2050 |
| −2.8993 | −1.4824 | −1.2050 |
| −2.9991 | −1.4779 | −1.2050 |
| −3.0982 | −1.4706 | −1.2050 |
| −3.1969 | −1.4575 | −1.2050 |
| −3.2950 | −1.4413 | −1.2050 |
| −3.3929 | −1.4205 | −1.2050 |
| −3.4816 | −1.3918 | −1.2050 |
| −3.5356 | −1.3074 | −1.2050 |
| −3.5402 | −1.2816 | −1.2050 |
| −3.5454 | −1.2334 | −1.2050 |
| −0.0007 | −1.3260 | −1.0050 |
| −0.1002 | −1.3291 | −1.0050 |
| −0.1994 | −1.3292 | −1.0050 |
| −0.2989 | −1.3262 | −1.0050 |
| −0.3999 | −1.3238 | −1.0050 |
| −0.5008 | −1.3261 | −1.0050 |
| −0.6005 | −1.3281 | −1.0050 |
| −0.7006 | −1.3302 | −1.0050 |
| −0.8005 | −1.3339 | −1.0050 |
| −0.9003 | −1.3366 | −1.0050 |
| −1.0002 | −1.3402 | −1.0050 |
| −1.0997 | −1.3426 | −1.0050 |
| −1.1996 | −1.3438 | −1.0050 |
| −1.2996 | −1.3463 | −1.0050 |
| −1.3994 | −1.3483 | −1.0050 |
| −1.4995 | −1.3507 | −1.0050 |
| −1.5993 | −1.3540 | −1.0050 |
| −1.6989 | −1.3560 | −1.0050 |
| −1.7991 | −1.3583 | −1.0050 |
| −1.8989 | −1.3617 | −1.0050 |

TABLE I-continued

| X | Y | Z |
|---|---|---|
| −1.9984 | −1.3634 | −1.0050 |
| −2.0981 | −1.3640 | −1.0050 |
| −2.1979 | −1.3634 | −1.0050 |
| −2.2977 | −1.3624 | −1.0050 |
| −2.3979 | −1.3599 | −1.0050 |
| −2.4980 | −1.3585 | −1.0050 |
| −2.5978 | −1.3544 | −1.0050 |
| −2.6980 | −1.3500 | −1.0050 |
| −2.7986 | −1.3465 | −1.0050 |
| −2.8987 | −1.3443 | −1.0050 |
| −2.9983 | −1.3395 | −1.0050 |
| −3.0979 | −1.3322 | −1.0050 |
| −3.1971 | −1.3227 | −1.0050 |
| −3.2954 | −1.3085 | −1.0050 |
| −3.3935 | −1.2903 | −1.0050 |
| −3.4847 | −1.2635 | −1.0050 |
| −3.5494 | −1.1966 | −1.0050 |
| −3.5573 | −1.1668 | −1.0050 |
| −3.5627 | −1.1166 | −1.0050 |
| 0.0010 | −1.2436 | −0.9049 |
| −0.0997 | −1.2389 | −0.9049 |
| −0.2005 | −1.2379 | −0.9049 |
| −0.3014 | −1.2391 | −0.9049 |
| −0.4011 | −1.2442 | −0.9049 |
| −0.5008 | −1.2453 | −0.9049 |
| −0.6008 | −1.2483 | −0.9049 |
| −0.7005 | −1.2496 | −0.9049 |
| −0.8008 | −1.2528 | −0.9049 |
| −0.9004 | −1.2563 | −0.9049 |
| −1.0004 | −1.2593 | −0.9049 |
| −1.1000 | −1.2633 | −0.9049 |
| −1.1996 | −1.2651 | −0.9049 |
| −1.2996 | −1.2667 | −0.9049 |
| −1.3995 | −1.2693 | −0.9049 |
| −1.4994 | −1.2717 | −0.9049 |
| −1.5994 | −1.2751 | −0.9049 |
| −1.6992 | −1.2785 | −0.9049 |
| −1.7989 | −1.2819 | −0.9049 |
| −1.8987 | −1.2842 | −0.9049 |
| −1.9985 | −1.2871 | −0.9049 |
| −2.0981 | −1.2886 | −0.9049 |
| −2.1978 | −1.2896 | −0.9049 |
| −2.2976 | −1.2891 | −0.9049 |
| −2.3977 | −1.2886 | −0.9049 |
| −2.4972 | −1.2869 | −0.9049 |
| −2.5972 | −1.2825 | −0.9049 |
| −2.6976 | −1.2791 | −0.9049 |
| −2.7975 | −1.2752 | −0.9049 |
| −2.8979 | −1.2702 | −0.9049 |
| −2.9980 | −1.2672 | −0.9049 |
| −3.0973 | −1.2604 | −0.9049 |
| −3.1967 | −1.2504 | −0.9049 |
| −3.2955 | −1.2382 | −0.9049 |
| −3.3937 | −1.2217 | −0.9049 |
| −3.4864 | −1.1970 | −0.9049 |
| −3.5558 | −1.1382 | −0.9049 |
| −3.5673 | −1.0813 | −0.9049 |
| −0.0003 | −1.1591 | −0.8049 |
| −0.1001 | −1.1608 | −0.8049 |
| −0.1997 | −1.1614 | −0.8049 |
| −0.2998 | −1.1616 | −0.8049 |
| −0.3998 | −1.1630 | −0.8049 |
| −0.4997 | −1.1646 | −0.8049 |
| −0.5996 | −1.1666 | −0.8049 |
| −0.6995 | −1.1686 | −0.8049 |
| −0.7995 | −1.1712 | −0.8049 |
| −0.8993 | −1.1740 | −0.8049 |
| −0.9991 | −1.1768 | −0.8049 |
| −1.0990 | −1.1797 | −0.8049 |
| −1.1988 | −1.1825 | −0.8049 |
| −1.2986 | −1.1847 | −0.8049 |
| −1.3987 | −1.1879 | −0.8049 |
| −1.4984 | −1.1918 | −0.8049 |
| −1.5982 | −1.1945 | −0.8049 |
| −1.6980 | −1.1981 | −0.8049 |
| −1.7979 | −1.2005 | −0.8049 |
| −1.8978 | −1.2041 | −0.8049 |

TABLE I-continued

| X | Y | Z |
|---|---|---|
| −1.9974 | −1.2064 | −0.8049 |
| −2.0974 | −1.2087 | −0.8049 |
| −2.1970 | −1.2112 | −0.8049 |
| −2.2968 | −1.2120 | −0.8049 |
| −2.3964 | −1.2129 | −0.8049 |
| −2.4960 | −1.2108 | −0.8049 |
| −2.5963 | −1.2088 | −0.8049 |
| −2.6963 | −1.2062 | −0.8049 |
| −2.7963 | −1.2025 | −0.8049 |
| −2.8965 | −1.1982 | −0.8049 |
| −2.9965 | −1.1939 | −0.8049 |
| −3.0959 | −1.1873 | −0.8049 |
| −3.1950 | −1.1773 | −0.8049 |
| −3.2941 | −1.1643 | −0.8049 |
| −3.3924 | −1.1489 | −0.8049 |
| −3.4870 | −1.1257 | −0.8049 |
| −3.5615 | −1.0771 | −0.8049 |
| −3.5740 | −1.0332 | −0.8049 |
| −3.5782 | −0.9713 | −0.8049 |
| −0.0002 | −1.0799 | −0.7052 |
| −0.1000 | −1.0807 | −0.7052 |
| −0.1999 | −1.0811 | −0.7052 |
| −0.2998 | −1.0823 | −0.7052 |
| −0.3997 | −1.0827 | −0.7052 |
| −0.4998 | −1.0842 | −0.7052 |
| −0.5995 | −1.0860 | −0.7052 |
| −0.6994 | −1.0870 | −0.7052 |
| −0.7992 | −1.0887 | −0.7052 |
| −0.8993 | −1.0897 | −0.7052 |
| −0.9992 | −1.0931 | −0.7052 |
| −1.0989 | −1.0948 | −0.7052 |
| −1.1990 | −1.0971 | −0.7052 |
| −1.2988 | −1.1000 | −0.7052 |
| −1.3988 | −1.1026 | −0.7052 |
| −1.4987 | −1.1066 | −0.7052 |
| −1.5984 | −1.1095 | −0.7052 |
| −1.6984 | −1.1130 | −0.7052 |
| −1.7984 | −1.1171 | −0.7052 |
| −1.8979 | −1.1214 | −0.7052 |
| −1.9977 | −1.1240 | −0.7052 |
| −2.0976 | −1.1279 | −0.7052 |
| −2.1971 | −1.1299 | −0.7052 |
| −2.2970 | −1.1311 | −0.7052 |
| −2.3967 | −1.1325 | −0.7052 |
| −2.4964 | −1.1318 | −0.7052 |
| −2.5966 | −1.1317 | −0.7052 |
| −2.6960 | −1.1301 | −0.7052 |
| −2.7959 | −1.1263 | −0.7052 |
| −2.8960 | −1.1217 | −0.7052 |
| −2.9959 | −1.1167 | −0.7052 |
| −3.0956 | −1.1096 | −0.7052 |
| −3.1949 | −1.1010 | −0.7052 |
| −3.2940 | −1.0889 | −0.7052 |
| −3.3922 | −1.0744 | −0.7052 |
| −3.4884 | −1.0523 | −0.7052 |
| −3.5674 | −1.0126 | −0.7052 |
| −3.5878 | −0.9483 | −0.7052 |
| −3.5922 | −0.9222 | −0.7052 |
| −3.5979 | −0.8567 | −0.7052 |
| −0.0001 | −0.9966 | −0.6049 |
| −0.1001 | −0.9974 | −0.6049 |
| −0.2001 | −0.9987 | −0.6049 |
| −0.2999 | −1.0006 | −0.6049 |
| −0.3994 | −1.0009 | −0.6049 |
| −0.4997 | −1.0010 | −0.6049 |
| −0.5997 | −1.0034 | −0.6049 |
| −0.6992 | −1.0034 | −0.6049 |
| −0.7993 | −1.0036 | −0.6049 |
| −0.8994 | −1.0050 | −0.6049 |
| −0.9990 | −1.0062 | −0.6049 |
| −1.0991 | −1.0067 | −0.6049 |
| −1.1991 | −1.0091 | −0.6049 |
| −1.2990 | −1.0113 | −0.6049 |
| −1.3990 | −1.0146 | −0.6049 |
| −1.4987 | −1.0178 | −0.6049 |
| −1.5988 | −1.0210 | −0.6049 |
| −1.6985 | −1.0254 | −0.6049 |

TABLE I-continued

| X | Y | Z |
|---|---|---|
| −1.7985 | −1.0289 | −0.6049 |
| −1.8983 | −1.0343 | −0.6049 |
| −1.9979 | −1.0382 | −0.6049 |
| −2.0976 | −1.0420 | −0.6049 |
| −2.1974 | −1.0449 | −0.6049 |
| −2.2970 | −1.0478 | −0.6049 |
| −2.3966 | −1.0481 | −0.6049 |
| −2.4965 | −1.0485 | −0.6049 |
| −2.5962 | −1.0482 | −0.6049 |
| −2.6961 | −1.0474 | −0.6049 |
| −2.7958 | −1.0454 | −0.6049 |
| −2.8958 | −1.0413 | −0.6049 |
| −2.9957 | −1.0368 | −0.6049 |
| −3.0952 | −1.0296 | −0.6049 |
| −3.1947 | −1.0202 | −0.6049 |
| −3.2939 | −1.0091 | −0.6049 |
| −3.3919 | −0.9946 | −0.6049 |
| −3.4890 | −0.9729 | −0.6049 |
| −3.5733 | −0.9396 | −0.6049 |
| −3.6110 | −0.8455 | −0.6049 |
| −3.6121 | −0.8185 | −0.6049 |
| −3.6139 | −0.8056 | −0.6049 |
| −0.0004 | −0.9123 | −0.5052 |
| −0.1000 | −0.9141 | −0.5052 |
| −0.1999 | −0.9144 | −0.5052 |
| −0.3000 | −0.9159 | −0.5052 |
| −0.3997 | −0.9172 | −0.5052 |
| −0.4996 | −0.9181 | −0.5052 |
| −0.5995 | −0.9191 | −0.5052 |
| −0.6991 | −0.9198 | −0.5052 |
| −0.7990 | −0.9190 | −0.5052 |
| −0.8994 | −0.9194 | −0.5052 |
| −0.9989 | −0.9200 | −0.5052 |
| −1.0989 | −0.9190 | −0.5052 |
| −1.1995 | −0.9200 | −0.5052 |
| −1.2994 | −0.9217 | −0.5052 |
| −1.3993 | −0.9242 | −0.5052 |
| −1.4993 | −0.9264 | −0.5052 |
| −1.5996 | −0.9306 | −0.5052 |
| −1.6993 | −0.9364 | −0.5052 |
| −1.7990 | −0.9414 | −0.5052 |
| −1.8985 | −0.9461 | −0.5052 |
| −1.9985 | −0.9500 | −0.5052 |
| −2.0982 | −0.9550 | −0.5052 |
| −2.1977 | −0.9584 | −0.5052 |
| −2.2975 | −0.9605 | −0.5052 |
| −2.3973 | −0.9627 | −0.5052 |
| −2.4969 | −0.9638 | −0.5052 |
| −2.5966 | −0.9634 | −0.5052 |
| −2.6965 | −0.9628 | −0.5052 |
| −2.7964 | −0.9609 | −0.5052 |
| −2.8963 | −0.9579 | −0.5052 |
| −2.9960 | −0.9523 | −0.5052 |
| −3.0958 | −0.9454 | −0.5052 |
| −3.1953 | −0.9367 | −0.5052 |
| −3.2944 | −0.9257 | −0.5052 |
| −3.3921 | −0.9098 | −0.5052 |
| −3.4904 | −0.8886 | −0.5052 |
| −3.5784 | −0.8618 | −0.5052 |
| −3.6293 | −0.7644 | −0.5052 |
| −3.6332 | −0.7400 | −0.5052 |
| −3.6334 | −0.7378 | −0.5052 |
| −0.0004 | −0.8216 | −0.4053 |
| −0.1003 | −0.8240 | −0.4053 |
| −0.2000 | −0.8257 | −0.4053 |
| −0.2998 | −0.8271 | −0.4053 |
| −0.3996 | −0.8282 | −0.4053 |
| −0.4996 | −0.8289 | −0.4053 |
| −0.5994 | −0.8307 | −0.4053 |
| −0.6991 | −0.8308 | −0.4053 |
| −0.7990 | −0.8312 | −0.4053 |
| −0.8986 | −0.8304 | −0.4053 |
| −0.9990 | −0.8297 | −0.4053 |
| −1.0991 | −0.8302 | −0.4053 |
| −1.1991 | −0.8298 | −0.4053 |
| −1.2995 | −0.8317 | −0.4053 |
| −1.3991 | −0.8336 | −0.4053 |

TABLE I-continued

| X | Y | Z |
|---|---|---|
| −1.4993 | −0.8354 | −0.4053 |
| −1.5995 | −0.8399 | −0.4053 |
| −1.6994 | −0.8449 | −0.4053 |
| −1.7992 | −0.8511 | −0.4053 |
| −1.8987 | −0.8563 | −0.4053 |
| −1.9983 | −0.8607 | −0.4053 |
| −2.0981 | −0.8646 | −0.4053 |
| −2.1977 | −0.8679 | −0.4053 |
| −2.2979 | −0.8704 | −0.4053 |
| −2.3972 | −0.8750 | −0.4053 |
| −2.4968 | −0.8739 | −0.4053 |
| −2.5979 | −0.8746 | −0.4053 |
| −2.6974 | −0.8745 | −0.4053 |
| −2.7972 | −0.8733 | −0.4053 |
| −2.8969 | −0.8706 | −0.4053 |
| −2.9967 | −0.8659 | −0.4053 |
| −3.0964 | −0.8586 | −0.4053 |
| −3.1959 | −0.8504 | −0.4053 |
| −3.2949 | −0.8387 | −0.4053 |
| −3.3933 | −0.8241 | −0.4053 |
| −3.4915 | −0.8055 | −0.4053 |
| −3.5823 | −0.7791 | −0.4053 |
| −3.6452 | −0.7087 | −0.4053 |
| −3.6519 | −0.6798 | −0.4053 |
| −3.6602 | −0.6219 | −0.4053 |
| −0.0008 | −0.7227 | −0.3052 |
| −0.1005 | −0.7264 | −0.3052 |
| −0.2001 | −0.7284 | −0.3052 |
| −0.3001 | −0.7302 | −0.3052 |
| −0.3999 | −0.7325 | −0.3052 |
| −0.4997 | −0.7343 | −0.3052 |
| −0.5995 | −0.7357 | −0.3052 |
| −0.6992 | −0.7365 | −0.3052 |
| −0.7989 | −0.7366 | −0.3052 |
| −0.8990 | −0.7360 | −0.3052 |
| −0.9989 | −0.7370 | −0.3052 |
| −1.0991 | −0.7357 | −0.3052 |
| −1.1994 | −0.7385 | −0.3052 |
| −1.2991 | −0.7378 | −0.3052 |
| −1.3996 | −0.7394 | −0.3052 |
| −1.4997 | −0.7413 | −0.3052 |
| −1.5998 | −0.7457 | −0.3052 |
| −1.6998 | −0.7508 | −0.3052 |
| −1.7996 | −0.7574 | −0.3052 |
| −1.8989 | −0.7627 | −0.3052 |
| −1.9988 | −0.7670 | −0.3052 |
| −2.0985 | −0.7725 | −0.3052 |
| −2.1979 | −0.7763 | −0.3052 |
| −2.2978 | −0.7789 | −0.3052 |
| −2.3976 | −0.7819 | −0.3052 |
| −2.4971 | −0.7835 | −0.3052 |
| −2.5969 | −0.7834 | −0.3052 |
| −2.6968 | −0.7841 | −0.3052 |
| −2.7962 | −0.7832 | −0.3052 |
| −2.8961 | −0.7797 | −0.3052 |
| −2.9961 | −0.7762 | −0.3052 |
| −3.0956 | −0.7699 | −0.3052 |
| −3.1951 | −0.7613 | −0.3052 |
| −3.2943 | −0.7503 | −0.3052 |
| −3.3927 | −0.7364 | −0.3052 |
| −3.4906 | −0.7177 | −0.3052 |
| −3.5851 | −0.6938 | −0.3052 |
| −3.6604 | −0.6434 | −0.3052 |
| −3.6749 | −0.6001 | −0.3052 |
| −3.6837 | −0.5472 | −0.3052 |
| 0.0003 | −0.6124 | −0.2049 |
| −0.1006 | −0.6131 | −0.2049 |
| −0.2008 | −0.6189 | −0.2049 |
| −0.3002 | −0.6231 | −0.2049 |
| −0.3997 | −0.6262 | −0.2049 |
| −0.4995 | −0.6275 | −0.2049 |
| −0.5994 | −0.6296 | −0.2049 |
| −0.6990 | −0.6304 | −0.2049 |
| −0.7990 | −0.6310 | −0.2049 |
| −0.8990 | −0.6322 | −0.2049 |
| −0.9990 | −0.6334 | −0.2049 |
| −1.0987 | −0.6354 | −0.2049 |

TABLE I-continued

| X | Y | Z |
|---|---|---|
| −1.1986 | −0.6358 | −0.2049 |
| −1.2988 | −0.6378 | −0.2049 |
| −1.3987 | −0.6404 | −0.2049 |
| −1.4986 | −0.6436 | −0.2049 |
| −1.5985 | −0.6467 | −0.2049 |
| −1.6987 | −0.6517 | −0.2049 |
| −1.7985 | −0.6580 | −0.2049 |
| −1.8980 | −0.6635 | −0.2049 |
| −1.9979 | −0.6689 | −0.2049 |
| −2.0974 | −0.6748 | −0.2049 |
| −2.1971 | −0.6781 | −0.2049 |
| −2.2969 | −0.6824 | −0.2049 |
| −2.3965 | −0.6854 | −0.2049 |
| −2.4963 | −0.6879 | −0.2049 |
| −2.5959 | −0.6899 | −0.2049 |
| −2.6957 | −0.6903 | −0.2049 |
| −2.7950 | −0.6899 | −0.2049 |
| −2.8948 | −0.6861 | −0.2049 |
| −2.9949 | −0.6831 | −0.2049 |
| −3.0946 | −0.6771 | −0.2049 |
| −3.1943 | −0.6701 | −0.2049 |
| −3.2931 | −0.6593 | −0.2049 |
| −3.3920 | −0.6450 | −0.2049 |
| −3.4898 | −0.6287 | −0.2049 |
| −3.5864 | −0.6052 | −0.2049 |
| −3.6703 | −0.5706 | −0.2049 |
| −3.7101 | −0.4776 | −0.2049 |
| −3.7127 | −0.4556 | −0.2049 |
| −0.0008 | −0.4909 | −0.1051 |
| −0.1005 | −0.4946 | −0.1051 |
| −0.2003 | −0.4975 | −0.1051 |
| −0.3002 | −0.5006 | −0.1051 |
| −0.3999 | −0.5040 | −0.1051 |
| −0.4996 | −0.5062 | −0.1051 |
| −0.5994 | −0.5081 | −0.1051 |
| −0.6995 | −0.5096 | −0.1051 |
| −0.7996 | −0.5129 | −0.1051 |
| −0.8997 | −0.5171 | −0.1051 |
| −0.9993 | −0.5227 | −0.1051 |
| −1.0988 | −0.5259 | −0.1051 |
| −1.1986 | −0.5287 | −0.1051 |
| −1.2985 | −0.5309 | −0.1051 |
| −1.3986 | −0.5344 | −0.1051 |
| −1.4984 | −0.5384 | −0.1051 |
| −1.5983 | −0.5426 | −0.1051 |
| −1.6982 | −0.5474 | −0.1051 |
| −1.7980 | −0.5530 | −0.1051 |
| −1.8975 | −0.5582 | −0.1051 |
| −1.9975 | −0.5626 | −0.1051 |
| −2.0972 | −0.5688 | −0.1051 |
| −2.1970 | −0.5735 | −0.1051 |
| −2.2965 | −0.5789 | −0.1051 |
| −2.3962 | −0.5819 | −0.1051 |
| −2.4962 | −0.5862 | −0.1051 |
| −2.5958 | −0.5896 | −0.1051 |
| −2.6956 | −0.5924 | −0.1051 |
| −2.7950 | −0.5942 | −0.1051 |
| −2.8941 | −0.5924 | −0.1051 |
| −2.9942 | −0.5877 | −0.1051 |
| −3.0943 | −0.5836 | −0.1051 |
| −3.1935 | −0.5768 | 0.1051 |
| −3.2926 | −0.5659 | −0.1051 |
| −3.3920 | −0.5533 | −0.1051 |
| −3.4897 | −0.5388 | −0.1051 |
| −3.5869 | −0.5153 | −0.1051 |
| −3.6769 | −0.4868 | −0.1051 |
| −3.7396 | −0.4123 | −0.1051 |
| −3.7468 | −0.3833 | −0.1051 |
| −3.7505 | −0.3594 | −0.1051 |
| 0.0002 | −0.3901 | −0.0435 |
| −0.0997 | −0.3901 | −0.0440 |
| −0.2006 | −0.3901 | −0.0431 |
| −0.3004 | −0.3901 | −0.0382 |
| −0.4001 | −0.3901 | −0.0358 |
| −0.4999 | −0.3901 | −0.0316 |
| −0.5993 | −0.3901 | −0.0303 |
| −0.7008 | −0.3901 | −0.0262 |

TABLE I-continued

| X | Y | Z |
|---|---|---|
| −0.8004 | −0.3901 | −0.0140 |
| −0.9003 | −0.3901 | −0.0076 |
| −1.0007 | −0.3901 | −0.0014 |
| −1.1000 | −0.3901 | 0.0021 |
| −1.2002 | −0.3901 | 0.0057 |
| −1.2999 | −0.3901 | 0.0110 |
| −1.3996 | −0.3901 | 0.0154 |
| −1.4993 | −0.3901 | 0.0210 |
| −1.5990 | −0.3901 | 0.0256 |
| −1.6987 | −0.3901 | 0.0313 |
| −1.7981 | −0.3901 | 0.0358 |
| −1.8979 | −0.3901 | 0.0398 |
| −1.9976 | −0.3901 | 0.0442 |
| −2.0974 | −0.3901 | 0.0481 |
| −2.1974 | −0.3901 | 0.0528 |
| −2.2973 | −0.3901 | 0.0589 |
| −2.3968 | −0.3901 | 0.0658 |
| −2.4962 | −0.3901 | 0.0712 |
| −2.5959 | −0.3901 | 0.0769 |
| −2.6954 | −0.3901 | 0.0818 |
| −2.7952 | −0.3901 | 0.0865 |
| −2.8944 | −0.3901 | 0.0906 |
| −2.9937 | −0.3901 | 0.0908 |
| −3.0931 | −0.3901 | 0.0896 |
| −3.1926 | −0.3901 | 0.0846 |
| −3.2925 | −0.3901 | 0.0778 |
| −3.3914 | −0.3901 | 0.0685 |
| −3.4899 | −0.3901 | 0.0531 |
| −3.5871 | −0.3901 | 0.0340 |
| −3.6809 | −1.3901 | 0.0039 |
| −3.7518 | −0.3901 | −0.0440 |
| −3.7451 | −0.3901 | −0.1051 |
| −3.7345 | −0.3901 | −0.1381 |
| −0.0014 | −0.2801 | −0.0013 |
| −0.1004 | −0.2801 | 0.0055 |
| −0.2000 | −0.2801 | 0.0083 |
| −0.3010 | −0.2801 | 0.0145 |
| −0.3999 | −0.2801 | 0.0250 |
| −0.4996 | −0.2801 | 0.0305 |
| −0.5999 | −0.2801 | 0.0417 |
| −0.6990 | −0.2801 | 0.0531 |
| −0.7978 | −0.2801 | 0.0632 |
| −0.8969 | −0.2801 | 0.0699 |
| −0.9968 | −0.2801 | 0.0760 |
| −1.0961 | −0.2801 | 0.0835 |
| −1.1954 | −0.2801 | 0.0880 |
| −1.2954 | −0.2801 | 0.0923 |
| −1.3954 | −0.2801 | 0.0985 |
| −1.4948 | −0.2801 | 0.1056 |
| −1.5945 | −0.2801 | 0.1114 |
| −1.6941 | −0.2801 | 0.1187 |
| −1.7933 | −0.2801 | 0.1241 |
| −1.8928 | −0.2801 | 0.1283 |
| −1.9927 | −0.2801 | 0.1316 |
| −2.0925 | −0.2801 | 0.1365 |
| −2.1922 | −0.2801 | 0.1406 |
| −2.2922 | −0.2801 | 0.1455 |
| −2.3923 | −0.2801 | 0.1519 |
| −2.4917 | −0.2801 | 0.1602 |
| −2.5909 | −0.2801 | 0.1662 |
| −2.6907 | −0.2801 | 0.1719 |
| −2.7903 | −0.2801 | 0.1788 |
| −2.8899 | −0.2801 | 0.1849 |
| −2.9889 | −0.2801 | 0.1901 |
| −3.0882 | −0.2801 | 0.1899 |
| −3.1884 | −0.2801 | 0.1890 |
| −3.2879 | −0.2801 | 0.1843 |
| −3.3872 | −0.2801 | 0.1770 |
| −3.4859 | −0.2801 | 0.1643 |
| −3.5831 | −0.2801 | 0.1469 |
| −3.6801 | −0.2801 | 0.1211 |
| −3.7666 | −0.2801 | 0.0892 |
| −3.8065 | −0.2801 | 0.0361 |
| −0.2156 | −0.1901 | 0.0426 |
| −0.3144 | −0.1901 | 0.0489 |
| −0.4152 | −0.1901 | 0.0522 |
| −0.5169 | −0.1901 | 0.0681 |

TABLE I-continued

| X | Y | Z |
|---|---|---|
| −0.6145 | −0.1901 | 0.0882 |
| −0.7128 | −0.1901 | 0.1014 |
| −0.8114 | −0.1901 | 0.1135 |
| −0.9109 | −0.1901 | 0.1196 |
| −1.0121 | −0.1901 | 0.1295 |
| −1.1113 | −0.1901 | 0.1398 |
| −1.2102 | −0.1901 | 0.1496 |
| −1.3094 | −0.1901 | 0.1571 |
| −1.4080 | −0.1901 | 0.1622 |
| −1.5095 | −0.1901 | 0.1644 |
| −1.6092 | −0.1901 | 0.1795 |
| −1.7121 | −0.1901 | 0.1836 |
| −1.8148 | −0.1901 | 0.1926 |
| −1.9138 | −0.1901 | 0.1977 |
| −2.0137 | −0.1901 | 0.2031 |
| −2.1129 | −0.1901 | 0.2075 |
| −2.2128 | −0.1901 | 0.2098 |
| −2.3132 | −0.1901 | 0.2147 |
| −2.4131 | −0.1901 | 0.2219 |
| −2.5125 | −0.1901 | 0.2297 |
| −2.6119 | −0.1901 | 0.2365 |
| −2.7115 | −0.1901 | 0.2440 |
| −2.8109 | −0.1901 | 0.2511 |
| −2.9106 | −0.1901 | 0.2580 |
| −3.0098 | −0.1901 | 0.2644 |
| −3.1088 | −0.1901 | 0.2675 |
| −3.2082 | −0.1901 | 0.2671 |
| −3.3078 | −0.1901 | 0.2646 |
| −3.4071 | −0.1901 | 0.2590 |
| −3.5058 | −0.1901 | 0.2481 |
| −3.6033 | −0.1901 | 0.2306 |
| −3.7010 | −0.1901 | 0.2082 |
| −3.7916 | −0.1901 | 0.1785 |
| −3.8510 | −0.1901 | 0.1076 |
| −3.8492 | −0.1901 | 0.0780 |
| −0.7272 | −0.0901 | 0.1183 |
| −0.8220 | −0.0901 | 0.1464 |
| −0.9189 | −0.0901 | 0.1673 |
| −1.0159 | −0.0901 | 0.1862 |
| −1.1147 | −0.0901 | 0.1966 |
| −1.2157 | −0.0901 | 0.2103 |
| −1.3141 | −0.0901 | 0.2201 |
| −1.4130 | −0.0901 | 0.2270 |
| −1.5130 | −0.0901 | 0.2320 |
| −1.6129 | −0.0901 | 0.2411 |
| −1.7126 | −0.0901 | 0.2497 |
| −1.8113 | −0.0901 | 0.2605 |
| −1.9110 | −0.0901 | 0.2654 |
| −2.0118 | −0.0901 | 0.2744 |
| −2.1110 | −0.0901 | 0.2791 |
| −2.2106 | −0.0901 | 0.2841 |
| −2.3106 | −0.0901 | 0.2871 |
| −2.4108 | −0.0901 | 0.2938 |
| −2.5105 | −0.0901 | 0.3004 |
| −2.6101 | −0.0901 | 0.3093 |
| −2.7094 | −0.0901 | 0.3173 |
| −2.8089 | −0.0901 | 0.3249 |
| −2.9085 | −0.0901 | 0.3325 |
| −3.0078 | −0.0901 | 0.3398 |
| −3.1072 | −0.0901 | 0.3451 |
| −3.2062 | −0.0901 | 0.3485 |
| −3.3057 | −0.0901 | 0.3474 |
| −3.4050 | −0.0901 | 0.3454 |
| −3.5040 | −0.0901 | 0.3359 |
| −3.6029 | −0.0901 | 0.3232 |
| −3.6993 | −0.0901 | 0.3022 |
| −3.7959 | −0.0901 | 0.2739 |
| −3.8791 | −0.0901 | 0.2396 |
| −3.9067 | −0.0901 | 0.1766 |
| −1.0271 | 0.0902 | 0.1918 |
| −1.1047 | 0.0902 | 0.2494 |
| −1.1960 | 0.0902 | 0.2875 |
| −1.2654 | 0.0902 | 0.3090 |
| −1.3619 | 0.0902 | 0.3253 |
| −1.4627 | 0.0902 | 0.3406 |
| −1.5615 | 0.0902 | 0.3521 |
| −1.6603 | 0.0902 | 0.3636 |

TABLE I-continued

| X | Y | Z |
|---|---|---|
| −1.7596 | 0.0902 | 0.3719 |
| −1.8589 | 0.0902 | 0.3814 |
| −1.9580 | 0.0902 | 0.3883 |
| −2.0576 | 0.0902 | 0.3940 |
| −2.1573 | 0.0902 | 0.3998 |
| −2.2570 | 0.0902 | 0.4062 |
| −2.3564 | 0.0902 | 0.4127 |
| −2.4563 | 0.0902 | 0.4189 |
| −2.5561 | 0.0902 | 0.4274 |
| −2.6554 | 0.0902 | 0.4359 |
| −2.7549 | 0.0902 | 0.4444 |
| −2.8541 | 0.0902 | 0.4530 |
| −2.9534 | 0.0902 | 0.4601 |
| −3.0529 | 0.0902 | 0.4669 |
| −3.1524 | 0.0902 | 0.4729 |
| −3.2520 | 0.0902 | 0.4786 |
| −3.3509 | 0.0902 | 0.4828 |
| −3.4498 | 0.0902 | 0.4815 |
| −3.5490 | 0.0902 | 0.4755 |
| −3.6478 | 0.0902 | 0.4640 |
| −3.7455 | 0.0902 | 0.4473 |
| −3.8416 | 0.0902 | 0.4234 |
| −3.9345 | 0.0902 | 0.3917 |
| −4.0043 | 0.0902 | 0.3410 |
| −4.0051 | 0.0902 | 0.3014 |
| −1.1806 | 0.1902 | 0.2364 |
| −1.2578 | 0.1902 | 0.2996 |
| −1.3364 | 0.1902 | 0.3533 |
| −1.4302 | 0.1902 | 0.3785 |
| −1.4846 | 0.1902 | 0.3892 |
| −1.5825 | 0.1902 | 0.4081 |
| −1.6804 | 0.1902 | 0.4224 |
| −1.7793 | 0.1902 | 0.4343 |
| −1.8781 | 0.1902 | 0.4444 |
| −1.9773 | 0.1902 | 0.4521 |
| −2.0766 | 0.1902 | 0.4593 |
| −2.1761 | 0.1902 | 0.4646 |
| −2.2760 | 0.1902 | 0.4708 |
| −2.3757 | 0.1902 | 0.4776 |
| −2.4752 | 0.1902 | 0.4852 |
| −2.5749 | 0.1902 | 0.4920 |
| −2.6745 | 0.1902 | 0.5002 |
| −2.7740 | 0.1902 | 0.5081 |
| −2.8734 | 0.1902 | 0.5172 |
| −2.9725 | 0.1902 | 0.5249 |
| −3.0723 | 0.1902 | 0.5315 |
| −3.1713 | 0.1902 | 0.5387 |
| −3.2712 | 0.1902 | 0.5423 |
| −3.3710 | 0.1902 | 0.5499 |
| −3.4693 | 0.1902 | 0.5524 |
| −3.5680 | 0.1902 | 0.5479 |
| −3.6668 | 0.1902 | 0.5374 |
| −3.7651 | 0.1902 | 0.5220 |
| −3.8615 | 0.1902 | 0.5003 |
| −3.9565 | 0.1902 | 0.4700 |
| −4.0368 | 0.1902 | 0.4308 |
| −4.0586 | 0.1902 | 0.3656 |
| −1.3520 | 0.2901 | 0.2963 |
| −1.4139 | 0.2901 | 0.3704 |
| −1.4961 | 0.2901 | 0.4227 |
| −1.5489 | 0.2901 | 0.4393 |
| −1.6021 | 0.2901 | 0.4521 |
| −1.6997 | 0.2901 | 0.4731 |
| −1.7970 | 0.2901 | 0.4896 |
| −1.8956 | 0.2901 | 0.5015 |
| −1.9945 | 0.2901 | 0.5121 |
| −2.0932 | 0.2901 | 0.5195 |
| −2.1931 | 0.2901 | 0.5246 |
| −2.2930 | 0.2901 | 0.5324 |
| −2.3924 | 0.2901 | 0.5395 |
| −2.4919 | 0.2901 | 0.5469 |
| −2.5915 | 0.2901 | 0.5539 |
| −2.6911 | 0.2901 | 0.5621 |
| −2.7905 | 0.2901 | 0.5701 |
| −2.8899 | 0.2901 | 0.5783 |
| −2.9894 | 0.2901 | 0.5862 |
| −3.0889 | 0.2901 | 0.5949 |

TABLE I-continued

| X | Y | Z |
|---|---|---|
| −3.1878 | 0.2901 | 0.6025 |
| −3.2874 | 0.2901 | 0.6077 |
| −3.3870 | 0.2901 | 0.6137 |
| −3.4860 | 0.2901 | 0.6175 |
| −3.5849 | 0.2901 | 0.6172 |
| −3.6837 | 0.2901 | 0.6106 |
| −3.7812 | 0.2901 | 0.5969 |
| −3.8774 | 0.2901 | 0.5734 |
| −3.9747 | 0.2901 | 0.5467 |
| −4.0615 | 0.2901 | 0.5103 |
| −4.1099 | 0.2901 | 0.4300 |
| −4.1100 | 0.2901 | 0.4229 |
| −1.4798 | 0.3901 | 0.3408 |
| −1.5350 | 0.3901 | 0.4205 |
| −1.6102 | 0.3901 | 0.4807 |
| −1.6641 | 0.3901 | 0.5010 |
| −1.7084 | 0.3901 | 0.5135 |
| −1.8053 | 0.3901 | 0.5368 |
| −1.9025 | 0.3901 | 0.5541 |
| −2.0008 | 0.3901 | 0.5670 |
| −2.0992 | 0.3901 | 0.5757 |
| −2.1990 | 0.3901 | 0.5807 |
| −2.2991 | 0.3901 | 0.5894 |
| −2.3982 | 0.3901 | 0.5982 |
| −2.4976 | 0.3901 | 0.6055 |
| −2.5972 | 0.3901 | 0.6126 |
| −2.6969 | 0.3901 | 0.6203 |
| −2.7963 | 0.3901 | 0.6285 |
| −2.8958 | 0.3901 | 0.6366 |
| −2.9952 | 0.3901 | 0.6450 |
| −3.0944 | 0.3901 | 0.6535 |
| −3.1941 | 0.3901 | 0.6612 |
| −3.2933 | 0.3901 | 0.6705 |
| −3.3925 | 0.3901 | 0.6767 |
| −3.4917 | 0.3901 | 0.6818 |
| −3.5911 | 0.3901 | 0.6834 |
| −3.6895 | 0.3901 | 0.6824 |
| −3.7877 | 0.3901 | 0.6707 |
| −3.8859 | 0.3901 | 0.6530 |
| −3.9806 | 0.3901 | 0.6267 |
| −4.0733 | 0.3901 | 0.5909 |
| −4.1483 | 0.3901 | 0.5432 |
| −4.1613 | 0.3901 | 0.5130 |
| −1.6136 | 0.4902 | 0.4326 |
| −1.6666 | 0.4902 | 0.5104 |
| −1.7585 | 0.4902 | 0.5588 |
| −1.7958 | 0.4902 | 0.5702 |
| −1.8628 | 0.4902 | 0.5888 |
| −1.9595 | 0.4902 | 0.6076 |
| −2.0578 | 0.4902 | 0.6228 |
| −2.1564 | 0.4902 | 0.6331 |
| −2.2556 | 0.4902 | 0.6426 |
| −2.3548 | 0.4902 | 0.6507 |
| −2.4543 | 0.4902 | 0.6588 |
| −2.5537 | 0.4902 | 0.6660 |
| −2.6532 | 0.4902 | 0.6730 |
| −2.7530 | 0.4902 | 0.6804 |
| −2.8523 | 0.4902 | 0.6890 |
| −2.9519 | 0.4902 | 0.6959 |
| −3.0518 | 0.4902 | 0.7056 |
| −3.1508 | 0.4902 | 0.7154 |
| −3.2503 | 0.4902 | 0.7237 |
| −3.3496 | 0.4902 | 0.7331 |
| −3.4487 | 0.4902 | 0.7402 |
| −3.5478 | 0.4902 | 0.7453 |
| −3.6473 | 0.4902 | 0.7473 |
| −3.7458 | 0.4902 | 0.7470 |
| −3.8439 | 0.4902 | 0.7358 |
| −3.9415 | 0.4902 | 0.7180 |
| −4.0363 | 0.4902 | 0.6913 |
| −4.1283 | 0.4902 | 0.6556 |
| −4.2033 | 0.4902 | 0.6050 |
| −4.2264 | 0.4902 | 0.5274 |
| −1.7496 | 0.5902 | 0.5406 |
| −1.8196 | 0.5902 | 0.6038 |
| −1.9177 | 0.5902 | 0.6358 |
| −1.9631 | 0.5902 | 0.6474 |

TABLE I-continued

| X | Y | Z |
|---|---|---|
| −2.0596 | 0.5902 | 0.6654 |
| −2.1583 | 0.5902 | 0.6807 |
| −2.2567 | 0.5902 | 0.6930 |
| −2.3557 | 0.5902 | 0.7024 |
| −2.4550 | 0.5902 | 0.7113 |
| −2.5542 | 0.5902 | 0.7189 |
| −2.6540 | 0.5902 | 0.7257 |
| −2.7536 | 0.5902 | 0.7343 |
| −2.8530 | 0.5902 | 0.7418 |
| −2.9527 | 0.5902 | 0.7506 |
| −3.0521 | 0.5902 | 0.7596 |
| −3.1518 | 0.5902 | 0.7688 |
| −3.2509 | 0.5902 | 0.7800 |
| −3.3499 | 0.5902 | 0.7891 |
| −3.4489 | 0.5902 | 0.7974 |
| −3.5481 | 0.5902 | 0.8017 |
| −3.6474 | 0.5902 | 0.8043 |
| −3.7473 | 0.5902 | 0.8046 |
| −3.8457 | 0.5902 | 0.8041 |
| −3.9434 | 0.5902 | 0.7910 |
| −4.0401 | 0.5902 | 0.7693 |
| −4.1346 | 0.5902 | 0.7395 |
| −4.2212 | 0.5902 | 0.6997 |
| −4.2772 | 0.5902 | 0.6287 |
| −4.2791 | 0.5902 | 0.5925 |
| −1.8144 | 0.6901 | 0.5504 |
| −1.8574 | 0.6901 | 0.6305 |
| −1.9648 | 0.6901 | 0.6764 |
| −1.9972 | 0.6901 | 0.6871 |
| −2.0915 | 0.6901 | 0.7104 |
| −2.1897 | 0.6901 | 0.7258 |
| −2.2888 | 0.6901 | 0.7418 |
| −2.3873 | 0.6901 | 0.7533 |
| −2.4862 | 0.6901 | 0.7634 |
| −2.5858 | 0.6901 | 0.7710 |
| −2.6854 | 0.6901 | 0.7812 |
| −2.7846 | 0.6901 | 0.7910 |
| −2.8833 | 0.6901 | 0.8004 |
| −2.9833 | 0.6901 | 0.8063 |
| −3.0828 | 0.6901 | 0.8168 |
| −3.1823 | 0.6901 | 0.8238 |
| −3.2821 | 0.6901 | 0.8348 |
| −3.3809 | 0.6901 | 0.8449 |
| −3.4798 | 0.6901 | 0.8535 |
| −3.5789 | 0.6901 | 0.8581 |
| −3.6784 | 0.6901 | 0.8603 |
| −3.7782 | 0.6901 | 0.8615 |
| −3.8773 | 0.6901 | 0.8616 |
| −3.9750 | 0.6901 | 0.8541 |
| −4.0716 | 0.6901 | 0.8354 |
| −4.1669 | 0.6901 | 0.8086 |
| −4.2568 | 0.6901 | 0.7716 |
| −4.3239 | 0.6901 | 0.7147 |
| −4.3283 | 0.6901 | 0.6583 |
| −1.9000 | 0.7901 | 0.6149 |
| −1.9505 | 0.7901 | 0.6914 |
| −2.0572 | 0.7901 | 0.7321 |
| −2.0916 | 0.7901 | 0.7436 |
| −2.1870 | 0.7901 | 0.7646 |
| −2.2869 | 0.7901 | 0.7825 |
| −2.3851 | 0.7901 | 0.7969 |
| −2.4837 | 0.7901 | 0.8092 |
| −2.5828 | 0.7901 | 0.8198 |
| −2.6819 | 0.7901 | 0.8305 |
| −2.7811 | 0.7901 | 0.8404 |
| −2.8804 | 0.7901 | 0.8506 |
| −2.9795 | 0.7901 | 0.8600 |
| −3.0789 | 0.7901 | 0.8683 |
| −3.1782 | 0.7901 | 0.8765 |
| −3.2779 | 0.7901 | 0.8838 |
| −3.3776 | 0.7901 | 0.8941 |
| −3.4764 | 0.7901 | 0.9035 |
| −3.5753 | 0.7901 | 0.9095 |
| −3.6746 | 0.7901 | 0.9119 |
| −3.7746 | 0.7901 | 0.9129 |
| −3.8746 | 0.7901 | 0.9156 |
| −3.9730 | 0.7901 | 0.9152 |

TABLE I-continued

| X | Y | Z |
|---|---|---|
| −4.0705 | 0.7901 | 0.9039 |
| −4.1665 | 0.7901 | 0.8811 |
| −4.2619 | 0.7901 | 0.8518 |
| −4.3433 | 0.7901 | 0.8097 |
| −4.3762 | 0.7901 | 0.7253 |
| −4.3758 | 0.7901 | 0.7137 |
| −1.9713 | 0.8900 | 0.6520 |
| −2.0187 | 0.8900 | 0.7324 |
| −2.1206 | 0.8900 | 0.7783 |
| −2.1540 | 0.8900 | 0.7879 |
| −2.2411 | 0.8900 | 0.8104 |
| −2.3380 | 0.8900 | 0.8295 |
| −2.4362 | 0.8900 | 0.8449 |
| −2.5348 | 0.8900 | 0.8589 |
| −2.6334 | 0.8900 | 0.8709 |
| −2.7325 | 0.8900 | 0.8810 |
| −2.8316 | 0.8900 | 0.8912 |
| −2.9308 | 0.8900 | 0.9002 |
| −3.0303 | 0.8900 | 0.9096 |
| −3.1293 | 0.8900 | 0.9183 |
| −3.2292 | 0.8900 | 0.9255 |
| −3.3288 | 0.8900 | 0.9368 |
| −3.4276 | 0.8900 | 0.9465 |
| −3.5266 | 0.8900 | 0.9543 |
| −3.6258 | 0.8900 | 0.9594 |
| −3.7254 | 0.8900 | 0.9632 |
| −3.8249 | 0.8900 | 0.9663 |
| −3.9247 | 0.8900 | 0.9678 |
| −4.0232 | 0.8900 | 0.9682 |
| −4.1209 | 0.8900 | 0.9572 |
| −4.2164 | 0.8900 | 0.9365 |
| −4.3138 | 0.8900 | 0.9055 |
| −4.3893 | 0.8900 | 0.8689 |
| −4.4583 | 0.8900 | 0.7639 |
| −4.4588 | 0.8900 | 0.7729 |
| −2.0518 | 0.9901 | 0.7128 |
| −2.0995 | 0.9901 | 0.7917 |
| −2.2084 | 0.9901 | 0.8329 |
| −2.2417 | 0.9901 | 0.8421 |
| −2.3378 | 0.9901 | 0.8644 |
| −2.4357 | 0.9901 | 0.8819 |
| −2.5338 | 0.9901 | 0.8986 |
| −2.6319 | 0.9901 | 0.9124 |
| −2.7306 | 0.9901 | 0.9236 |
| −2.8298 | 0.9901 | 0.9333 |
| −2.9291 | 0.9901 | 0.9429 |
| −3.0284 | 0.9901 | 0.9520 |
| −3.1277 | 0.9901 | 0.9612 |
| −3.2271 | 0.9901 | 0.9704 |
| −3.3267 | 0.9901 | 0.9802 |
| −3.4256 | 0.9901 | 0.9915 |
| −3.5244 | 0.9901 | 0.9994 |
| −3.6239 | 0.9901 | 1.0054 |
| −3.7232 | 0.9901 | 1.0102 |
| −3.8231 | 0.9901 | 1.0138 |
| −3.9225 | 0.9901 | 1.0189 |
| −4.0213 | 0.9901 | 1.0193 |
| −4.1201 | 0.9901 | 1.0145 |
| −4.2175 | 0.9901 | 1.0015 |
| −4.3121 | 0.9901 | 0.9754 |
| −4.4013 | 0.9901 | 0.9383 |
| −4.4624 | 0.9901 | 0.8769 |
| −4.4613 | 0.9901 | 0.8438 |
| −2.1132 | 1.0900 | 0.7573 |
| −2.1609 | 1.0900 | 0.8369 |
| −2.2697 | 1.0900 | 0.8778 |
| −2.3028 | 1.0900 | 0.8863 |
| −2.3999 | 1.0900 | 0.9097 |
| −2.4970 | 1.0900 | 0.9295 |
| −2.5947 | 1.0900 | 0.9455 |
| −2.6932 | 1.0900 | 0.9585 |
| −2.7921 | 1.0900 | 0.9698 |
| −2.8911 | 1.0900 | 0.9799 |
| −2.9905 | 1.0900 | 0.9894 |
| −3.0898 | 1.0900 | 0.9996 |
| −3.1890 | 1.0900 | 1.0098 |
| −3.2882 | 1.0900 | 1.0202 |

TABLE I-continued

| X | Y | Z |
|---|---|---|
| −3.3874 | 1.0900 | 1.0300 |
| −3.4865 | 1.0900 | 1.0394 |
| −3.5856 | 1.0900 | 1.0466 |
| −3.6851 | 1.0900 | 1.0531 |
| −3.7845 | 1.0900 | 1.0590 |
| −3.8839 | 1.0900 | 1.0636 |
| −3.9835 | 1.0900 | 1.0672 |
| −4.0825 | 1.0900 | 1.0685 |
| −4.1811 | 1.0900 | 1.0636 |
| −4.2777 | 1.0900 | 1.0501 |
| −4.3717 | 1.0900 | 1.0216 |
| −4.4554 | 1.0900 | 0.9822 |
| −4.5023 | 1.0900 | 0.9046 |
| −2.1976 | 1.1900 | 0.8670 |
| −2.2862 | 1.1900 | 0.9080 |
| −2.3812 | 1.1900 | 0.9354 |
| −2.4787 | 1.1900 | 0.9600 |
| −2.5760 | 1.1900 | 0.9777 |
| −2.6743 | 1.1900 | 0.9931 |
| −2.7730 | 1.1900 | 1.0051 |
| −2.8719 | 1.1900 | 1.0170 |
| −2.9708 | 1.1900 | 1.0279 |
| −3.0698 | 1.1900 | 1.0383 |
| −3.1691 | 1.1900 | 1.0481 |
| −3.2684 | 1.1900 | 1.0590 |
| −3.3674 | 1.1900 | 1.0696 |
| −3.4665 | 1.1900 | 1.0787 |
| −3.5658 | 1.1900 | 1.0874 |
| −3.6650 | 1.1900 | 1.0953 |
| −3.7644 | 1.1900 | 1.1020 |
| −3.8639 | 1.1900 | 1.1081 |
| −3.9632 | 1.1900 | 1.1131 |
| −4.0624 | 1.1900 | 1.1150 |
| −4.1617 | 1.1900 | 1.1139 |
| −4.2600 | 1.1900 | 1.1081 |
| −4.3562 | 1.1900 | 1.0891 |
| −4.4482 | 1.1900 | 1.0559 |
| −4.5213 | 1.1900 | 1.0062 |
| −4.5358 | 1.1900 | 0.9616 |
| −2.2230 | 1.2901 | 0.8426 |
| −2.2733 | 1.2901 | 0.9210 |
| −2.3800 | 1.2901 | 0.9619 |
| −2.4143 | 1.2901 | 0.9726 |
| −2.5094 | 1.2901 | 0.9975 |
| −2.6061 | 1.2901 | 1.0173 |
| −2.7041 | 1.2901 | 1.0320 |
| −2.8031 | 1.2901 | 1.0462 |
| −2.9018 | 1.2901 | 1.0591 |
| −3.0005 | 1.2901 | 1.0711 |
| −3.0995 | 1.2901 | 1.0811 |
| −3.1988 | 1.2901 | 1.0917 |
| −3.2980 | 1.2901 | 1.1019 |
| −3.3973 | 1.2901 | 1.1118 |
| −3.4965 | 1.2901 | 1.1208 |
| −3.5961 | 1.2901 | 1.1289 |
| −3.6956 | 1.2901 | 1.1384 |
| −3.7945 | 1.2901 | 1.1467 |
| −3.8941 | 1.2901 | 1.1531 |
| −3.9933 | 1.2901 | 1.1597 |
| −4.0920 | 1.2901 | 1.1611 |
| −4.1919 | 1.2901 | 1.1590 |
| −4.2908 | 1.2901 | 1.1563 |
| −4.3872 | 1.2901 | 1.1396 |
| −4.4784 | 1.2901 | 1.1066 |
| −4.5508 | 1.2901 | 1.0557 |
| −4.5668 | 1.2901 | 1.0018 |
| −2.2700 | 1.3901 | 0.8737 |
| −2.3138 | 1.3901 | 0.9552 |
| −2.4230 | 1.3901 | 1.0002 |
| −2.4556 | 1.3901 | 1.0103 |
| −2.5509 | 1.3901 | 1.0349 |
| −2.6478 | 1.3901 | 1.0556 |
| −2.7456 | 1.3901 | 1.0718 |
| −2.8442 | 1.3901 | 1.0866 |
| −2.9426 | 1.3901 | 1.1008 |
| −3.0413 | 1.3901 | 1.1127 |
| −3.1404 | 1.3901 | 1.1235 |

TABLE I-continued

| X | Y | Z |
|---|---|---|
| −3.2396 | 1.3901 | 1.1338 |
| −3.3389 | 1.3901 | 1.1437 |
| −3.4381 | 1.3901 | 1.1532 |
| −3.5376 | 1.3901 | 1.1617 |
| −3.6371 | 1.3901 | 1.1715 |
| −3.7362 | 1.3901 | 1.1810 |
| −3.8355 | 1.3901 | 1.1897 |
| −3.9347 | 1.3901 | 1.1973 |
| −4.0339 | 1.3901 | 1.2020 |
| −4.1329 | 1.3901 | 1.2037 |
| −4.2329 | 1.3901 | 1.2018 |
| −4.3319 | 1.3901 | 1.2009 |
| −4.4278 | 1.3901 | 1.1836 |
| −4.5176 | 1.3901 | 1.1484 |
| −4.5797 | 1.3901 | 1.1003 |
| −4.5928 | 1.3901 | 1.0558 |
| −2.3168 | 1.4900 | 0.8911 |
| −2.3395 | 1.4900 | 0.9787 |
| −2.4639 | 1.4900 | 1.0377 |
| −2.4937 | 1.4900 | 1.0466 |
| −2.5839 | 1.4900 | 1.0709 |
| −2.6803 | 1.4900 | 1.0916 |
| −2.7785 | 1.4900 | 1.1071 |
| −2.8774 | 1.4900 | 1.1234 |
| −2.9755 | 1.4900 | 1.1385 |
| −3.0742 | 1.4900 | 1.1511 |
| −3.1730 | 1.4900 | 1.1631 |
| −3.2721 | 1.4900 | 1.1734 |
| −3.3711 | 1.4900 | 1.1832 |
| −3.4706 | 1.4900 | 1.1912 |
| −3.5701 | 1.4900 | 1.2010 |
| −3.6694 | 1.4900 | 1.2102 |
| −3.7689 | 1.4900 | 1.2207 |
| −3.8677 | 1.4900 | 1.2308 |
| −3.9669 | 1.4900 | 1.2375 |
| −4.0665 | 1.4900 | 1.2441 |
| −4.1646 | 1.4900 | 1.2473 |
| −4.2649 | 1.4900 | 1.2429 |
| −4.3657 | 1.4900 | 1.2441 |
| −4.4630 | 1.4900 | 1.2264 |
| −4.5458 | 1.4900 | 1.1917 |
| −4.5998 | 1.4900 | 1.1476 |
| −4.6163 | 1.4900 | 1.1006 |
| −2.3601 | 1.5901 | 0.9490 |
| −2.4063 | 1.5901 | 1.0333 |
| −2.5151 | 1.5901 | 1.0777 |
| −2.5481 | 1.5901 | 1.0874 |
| −2.6440 | 1.5901 | 1.1118 |
| −2.7411 | 1.5901 | 1.1309 |
| −2.8394 | 1.5901 | 1.1474 |
| −2.9377 | 1.5901 | 1.1636 |
| −3.0360 | 1.5901 | 1.1776 |
| −3.1351 | 1.5901 | 1.1904 |
| −3.2336 | 1.5901 | 1.2036 |
| −3.3326 | 1.5901 | 1.2134 |
| −3.4319 | 1.5901 | 1.2233 |
| −3.5310 | 1.5901 | 1.2324 |
| −3.6306 | 1.5901 | 1.2415 |
| −3.7300 | 1.5901 | 1.2524 |
| −3.8290 | 1.5901 | 1.2625 |
| −3.9282 | 1.5901 | 1.2718 |
| −4.0272 | 1.5901 | 1.2803 |
| −4.1263 | 1.5901 | 1.2852 |
| −4.2252 | 1.5901 | 1.2871 |
| −4.3252 | 1.5901 | 1.2849 |
| −4.4237 | 1.5901 | 1.2833 |
| −4.5184 | 1.5901 | 1.2606 |
| −4.5827 | 1.5901 | 1.2235 |
| −4.6350 | 1.5901 | 1.1499 |
| −2.3985 | 1.6900 | 0.9713 |
| −2.4265 | 1.6900 | 1.0610 |
| −2.5556 | 1.6900 | 1.1141 |
| −2.5867 | 1.6900 | 1.1229 |
| −2.6828 | 1.6900 | 1.1478 |
| −2.7799 | 1.6900 | 1.1674 |
| −2.8779 | 1.6900 | 1.1843 |
| −2.9764 | 1.6900 | 1.1989 |

TABLE I-continued

| X | Y | Z |
|---|---|---|
| −3.0750 | 1.6900 | 1.2134 |
| −3.1737 | 1.6900 | 1.2268 |
| −3.2725 | 1.6900 | 1.2395 |
| −3.3712 | 1.6900 | 1.2504 |
| −3.4705 | 1.6900 | 1.2600 |
| −3.5694 | 1.6900 | 1.2690 |
| −3.6694 | 1.6900 | 1.2760 |
| −3.7694 | 1.6900 | 1.2885 |
| −3.8681 | 1.6900 | 1.3011 |
| −3.9670 | 1.6900 | 1.3107 |
| −4.0660 | 1.6900 | 1.3191 |
| −4.1652 | 1.6900 | 1.3244 |
| −4.2643 | 1.6900 | 1.3275 |
| −4.3638 | 1.6900 | 1.3268 |
| −4.4614 | 1.6900 | 1.3216 |
| −4.5541 | 1.6900 | 1.2939 |
| −4.6120 | 1.6900 | 1.2545 |
| −4.6407 | 1.6900 | 1.2220 |
| −4.6479 | 1.6900 | 1.1641 |
| −2.4342 | 1.7901 | 0.9917 |
| −2.4365 | 1.7901 | 1.0480 |
| −2.4741 | 1.7901 | 1.1041 |
| −2.5598 | 1.7901 | 1.1394 |
| −2.6555 | 1.7901 | 1.1678 |
| −2.7519 | 1.7901 | 1.1898 |
| −2.8494 | 1.7901 | 1.2087 |
| −2.9473 | 1.7901 | 1.2242 |
| −3.0460 | 1.7901 | 1.2379 |
| −3.1449 | 1.7901 | 1.2517 |
| −3.2434 | 1.7901 | 1.2655 |
| −3.3422 | 1.7901 | 1.2758 |
| −3.4417 | 1.7901 | 1.2863 |
| −3.5406 | 1.7901 | 1.2974 |
| −3.6402 | 1.7901 | 1.3073 |
| −3.7390 | 1.7901 | 1.3200 |
| −3.8381 | 1.7901 | 1.3287 |
| −3.9379 | 1.7901 | 1.3399 |
| −4.0365 | 1.7901 | 1.3513 |
| −4.1353 | 1.7901 | 1.3592 |
| −4.2343 | 1.7901 | 1.3647 |
| −4.3335 | 1.7901 | 1.3663 |
| −4.4323 | 1.7901 | 1.3645 |
| −4.5277 | 1.7901 | 1.3501 |
| −4.6121 | 1.7901 | 1.3075 |
| −4.6465 | 1.7901 | 1.2744 |
| −4.6557 | 1.7901 | 1.2100 |
| −2.4682 | 1.8901 | 1.0340 |
| −2.4701 | 1.8901 | 1.0778 |
| −2.4942 | 1.8901 | 1.1338 |
| −2.5768 | 1.8901 | 1.1692 |
| −2.6731 | 1.8901 | 1.1977 |
| −2.7699 | 1.8901 | 1.2198 |
| −2.8672 | 1.8901 | 1.2392 |
| −2.9652 | 1.8901 | 1.2539 |
| −3.0641 | 1.8901 | 1.2677 |
| −3.1628 | 1.8901 | 1.2818 |
| −3.2614 | 1.8901 | 1.2943 |
| −3.3605 | 1.8901 | 1.3057 |
| −3.4595 | 1.8901 | 1.3168 |
| −3.5588 | 1.8901 | 1.3277 |
| −3.6581 | 1.8901 | 1.3400 |
| −3.7569 | 1.8901 | 1.3532 |
| −3.8556 | 1.8901 | 1.3652 |
| −3.9545 | 1.8901 | 1.3759 |
| −4.0535 | 1.8901 | 1.3857 |
| −4.1526 | 1.8901 | 1.3942 |
| −4.2516 | 1.8901 | 1.4011 |
| −4.3505 | 1.8901 | 1.4040 |
| −4.4492 | 1.8901 | 1.4017 |
| −4.5445 | 1.8901 | 1.3873 |
| −4.6264 | 1.8901 | 1.3417 |
| −4.6535 | 1.8901 | 1.3098 |
| −4.6608 | 1.8901 | 1.2577 |
| −2.4951 | 1.9900 | 1.0546 |
| −2.4917 | 1.9900 | 1.1113 |
| −2.5088 | 1.9900 | 1.1598 |
| −2.5890 | 1.9900 | 1.1972 |

TABLE I-continued

| X | Y | Z |
|---|---|---|
| −2.6865 | 1.9900 | 1.2249 |
| −2.7838 | 1.9900 | 1.2498 |
| −2.8809 | 1.9900 | 1.2683 |
| −2.9789 | 1.9900 | 1.2838 |
| −3.0779 | 1.9900 | 1.2961 |
| −3.1767 | 1.9900 | 1.3104 |
| −3.2757 | 1.9900 | 1.3223 |
| −3.3746 | 1.9900 | 1.3363 |
| −3.4733 | 1.9900 | 1.3484 |
| −3.5723 | 1.9900 | 1.3609 |
| −3.6711 | 1.9900 | 1.3729 |
| −3.7701 | 1.9900 | 1.3848 |
| −3.8691 | 1.9900 | 1.3971 |
| −3.9678 | 1.9900 | 1.4086 |
| −4.0669 | 1.9900 | 1.4182 |
| −4.1661 | 1.9900 | 1.4276 |
| −4.2649 | 1.9900 | 1.4353 |
| −4.3638 | 1.9900 | 1.4387 |
| −4.4623 | 1.9900 | 1.4371 |
| −4.5580 | 1.9900 | 1.4219 |
| −4.6357 | 1.9900 | 1.3776 |
| −4.6618 | 1.9900 | 1.3194 |
| −2.5175 | 2.0900 | 1.0781 |
| −2.5172 | 2.0900 | 1.1370 |
| −2.5385 | 2.0900 | 1.1965 |
| −2.6207 | 2.0900 | 1.2311 |
| −2.7168 | 2.0900 | 1.2603 |
| −2.8132 | 2.0900 | 1.2817 |
| −2.9109 | 2.0900 | 1.3003 |
| −3.0092 | 2.0900 | 1.3144 |
| −3.1082 | 2.0900 | 1.3290 |
| −3.2064 | 2.0900 | 1.3439 |
| −3.3051 | 2.0900 | 1.3559 |
| −3.4042 | 2.0900 | 1.3679 |
| −3.5034 | 2.0900 | 1.3805 |
| −3.6022 | 2.0900 | 1.3940 |
| −3.7009 | 2.0900 | 1.4065 |
| −3.7999 | 2.0900 | 1.4184 |
| −3.8989 | 2.0900 | 1.4307 |
| −3.9975 | 2.0900 | 1.4423 |
| −4.0967 | 2.0900 | 1.4519 |
| −4.1960 | 2.0900 | 1.4623 |
| −4.2948 | 2.0900 | 1.4709 |
| −4.3935 | 2.0900 | 1.4754 |
| −4.4909 | 2.0900 | 1.4717 |
| −4.5837 | 2.0900 | 1.4487 |
| −4.6451 | 2.0900 | 1.4075 |
| −4.6606 | 2.0900 | 1.3590 |
| −2.5315 | 2.1902 | 1.0987 |
| −2.5310 | 2.1902 | 1.1665 |
| −2.5572 | 2.1902 | 1.2281 |
| −2.6412 | 2.1902 | 1.2607 |
| −2.7383 | 2.1902 | 1.2876 |
| −2.8350 | 2.1902 | 1.3102 |
| −2.9324 | 2.1902 | 1.3283 |
| −3.0309 | 2.1902 | 1.3431 |
| −3.1294 | 2.1902 | 1.3584 |
| −3.2280 | 2.1902 | 1.3714 |
| −3.3267 | 2.1902 | 1.3843 |
| −3.4259 | 2.1902 | 1.3964 |
| −3.5247 | 2.1902 | 1.4101 |
| −3.6238 | 2.1902 | 1.4229 |
| −3.7222 | 2.1902 | 1.4382 |
| −3.8209 | 2.1902 | 1.4504 |
| −3.9196 | 2.1902 | 1.4641 |
| −4.0181 | 2.1902 | 1.4742 |
| −4.1180 | 2.1902 | 1.4834 |
| −4.2171 | 2.1902 | 1.4961 |
| −4.3156 | 2.1902 | 1.5055 |
| −4.4142 | 2.1902 | 1.5104 |
| −4.5106 | 2.1902 | 1.5045 |
| −4.6007 | 2.1902 | 1.4736 |
| −4.6449 | 2.1902 | 1.4406 |
| −4.6573 | 2.1902 | 1.3958 |
| −2.5424 | 2.2901 | 1.1450 |
| −2.5418 | 2.2901 | 1.2002 |
| −2.5766 | 2.2901 | 1.2597 |

TABLE I-continued

| X | Y | Z |
|---|---|---|
| −2.6627 | 2.2901 | 1.2915 |
| −2.7594 | 2.2901 | 1.3177 |
| −2.8559 | 2.2901 | 1.3378 |
| −2.9539 | 2.2901 | 1.3546 |
| −3.0522 | 2.2901 | 1.3702 |
| −3.1507 | 2.2901 | 1.3856 |
| −3.2489 | 2.2901 | 1.4004 |
| −3.3479 | 2.2901 | 1.4123 |
| −3.4468 | 2.2901 | 1.4259 |
| −3.5458 | 2.2901 | 1.4387 |
| −3.6444 | 2.2901 | 1.4541 |
| −3.7430 | 2.2901 | 1.4682 |
| −3.8413 | 2.2901 | 1.4830 |
| −3.9399 | 2.2901 | 1.4943 |
| −4.0395 | 2.2901 | 1.5063 |
| −4.1384 | 2.2901 | 1.5201 |
| −4.2369 | 2.2901 | 1.5326 |
| −4.3351 | 2.2901 | 1.5417 |
| −4.4333 | 2.2901 | 1.5430 |
| −4.5298 | 2.2901 | 1.5323 |
| −4.6130 | 2.2901 | 1.4974 |
| −4.6515 | 2.2901 | 1.4369 |
| −2.5489 | 2.3901 | 1.1615 |
| −2.5482 | 2.3901 | 1.2261 |
| −2.5807 | 2.3901 | 1.2837 |
| −2.6663 | 2.3901 | 1.3158 |
| −2.7631 | 2.3901 | 1.3417 |
| −2.8599 | 2.3901 | 1.3619 |
| −2.9578 | 2.3901 | 1.3790 |
| −3.0566 | 2.3901 | 1.3951 |
| −3.1542 | 2.3901 | 1.4134 |
| −3.2524 | 2.3901 | 1.4263 |
| −3.3521 | 2.3901 | 1.4397 |
| −3.4504 | 2.3901 | 1.4542 |
| −3.5492 | 2.3901 | 1.4664 |
| −3.6487 | 2.3901 | 1.4809 |
| −3.7468 | 2.3901 | 1.4980 |
| −3.8451 | 2.3901 | 1.5123 |
| −3.9440 | 2.3901 | 1.5262 |
| −4.0426 | 2.3901 | 1.5401 |
| −4.1414 | 2.3901 | 1.5525 |
| −4.2404 | 2.3901 | 1.5654 |
| −4.3382 | 2.3901 | 1.5762 |
| −4.4360 | 2.3901 | 1.5758 |
| −4.5322 | 2.3901 | 1.5617 |
| −4.6133 | 2.3901 | 1.5253 |
| −4.6425 | 2.3901 | 1.4672 |
| −2.5490 | 2.4901 | 1.1919 |
| −2.5480 | 2.4901 | 1.2482 |
| −2.5773 | 2.4901 | 1.3056 |
| −2.6624 | 2.4901 | 1.3366 |
| −2.7592 | 2.4901 | 1.3631 |
| −2.8555 | 2.4901 | 1.3830 |
| −2.9538 | 2.4901 | 1.4020 |
| −3.0515 | 2.4901 | 1.4214 |
| −3.1488 | 2.4901 | 1.4379 |
| −3.2470 | 2.4901 | 1.4497 |
| −3.3469 | 2.4901 | 1.4599 |
| −3.4461 | 2.4901 | 1.4760 |
| −3.5448 | 2.4901 | 1.4915 |
| −3.6434 | 2.4901 | 1.5084 |
| −3.7412 | 2.4901 | 1.5252 |
| −3.8397 | 2.4901 | 1.5398 |
| −3.9379 | 2.4901 | 1.5537 |
| −4.0375 | 2.4901 | 1.5657 |
| −4.1359 | 2.4901 | 1.5819 |
| −4.2348 | 2.4901 | 1.5932 |
| −4.3329 | 2.4901 | 1.6057 |
| −4.4303 | 2.4901 | 1.6062 |
| −4.5263 | 2.4901 | 1.5912 |
| −4.6064 | 2.4901 | 1.5548 |
| −4.6317 | 2.4901 | 1.4970 |
| −2.5455 | 2.5900 | 1.2052 |
| −2.5403 | 2.5900 | 1.2668 |
| −2.5714 | 2.5900 | 1.3250 |
| −2.6570 | 2.5900 | 1.3569 |
| −2.7532 | 2.5900 | 1.3838 |

TABLE I-continued

| X | Y | Z |
|---|---|---|
| −2.8502 | 2.5900 | 1.4036 |
| −2.9482 | 2.5900 | 1.4245 |
| −3.0460 | 2.5900 | 1.4422 |
| −3.1433 | 2.5900 | 1.4604 |
| −3.2418 | 2.5900 | 1.4723 |
| −3.3420 | 2.5900 | 1.4864 |
| −3.4406 | 2.5900 | 1.5015 |
| −3.5393 | 2.5900 | 1.5171 |
| −3.6378 | 2.5900 | 1.5342 |
| −3.7359 | 2.5900 | 1.5518 |
| −3.8340 | 2.5900 | 1.5690 |
| −3.9318 | 2.5900 | 1.5848 |
| −4.0306 | 2.5900 | 1.5982 |
| −4.1292 | 2.5900 | 1.6126 |
| −4.2282 | 2.5900 | 1.6246 |
| −4.3261 | 2.5900 | 1.6365 |
| −4.4233 | 2.5900 | 1.6361 |
| −4.5189 | 2.5900 | 1.6193 |
| −4.5979 | 2.5900 | 1.5820 |
| −4.6191 | 2.5900 | 1.5175 |
| −2.5375 | 2.6901 | 1.2031 |
| −2.5321 | 2.6901 | 1.2708 |
| −2.5601 | 2.6901 | 1.3426 |
| −2.6445 | 2.6901 | 1.3747 |
| −2.7411 | 2.6901 | 1.4023 |
| −2.8378 | 2.6901 | 1.4238 |
| −2.9355 | 2.6901 | 1.4452 |
| −3.0331 | 2.6901 | 1.4642 |
| −3.1305 | 2.6901 | 1.4821 |
| −3.2292 | 2.6901 | 1.4951 |
| −3.3281 | 2.6901 | 1.5100 |
| −3.4268 | 2.6901 | 1.5244 |
| −3.5260 | 2.6901 | 1.5401 |
| −3.6242 | 2.6901 | 1.5590 |
| −3.7222 | 2.6901 | 1.5768 |
| −3.8205 | 2.6901 | 1.5945 |
| −3.9183 | 2.6901 | 1.6117 |
| −4.0168 | 2.6901 | 1.6258 |
| −4.1153 | 2.6901 | 1.6394 |
| −4.2145 | 2.6901 | 1.6514 |
| −4.3125 | 2.6901 | 1.6641 |
| −4.4097 | 2.6901 | 1.6641 |
| −4.5050 | 2.6901 | 1.6465 |
| −4.5805 | 2.6901 | 1.6104 |
| −4.6028 | 2.6901 | 1.5564 |
| −2.5205 | 2.7901 | 1.2814 |
| −2.5244 | 2.7901 | 1.3195 |
| −2.5494 | 2.7901 | 1.3608 |
| −2.6349 | 2.7901 | 1.3923 |
| −2.7310 | 2.7901 | 1.4206 |
| −2.8271 | 2.7901 | 1.4429 |
| −2.9249 | 2.7901 | 1.4655 |
| −3.0213 | 2.7901 | 1.4869 |
| −3.1193 | 2.7901 | 1.5032 |
| −3.2177 | 2.7901 | 1.5195 |
| −3.3168 | 2.7901 | 1.5329 |
| −3.4156 | 2.7901 | 1.5507 |
| −3.5136 | 2.7901 | 1.5673 |
| −3.6121 | 2.7901 | 1.5844 |
| −3.7101 | 2.7901 | 1.6017 |
| −3.8083 | 2.7901 | 1.6180 |
| −3.9066 | 2.7901 | 1.6343 |
| −4.0049 | 2.7901 | 1.6501 |
| −4.1033 | 2.7901 | 1.6650 |
| −4.2019 | 2.7901 | 1.6782 |
| −4.3001 | 2.7901 | 1.6899 |
| −4.3969 | 2.7901 | 1.6912 |
| −4.4920 | 2.7901 | 1.6721 |
| −4.5587 | 2.7901 | 1.6421 |
| −4.5839 | 2.7901 | 1.5863 |
| −2.5058 | 2.8899 | 1.2796 |
| −2.5143 | 2.8899 | 1.3269 |
| −2.5416 | 2.8899 | 1.3795 |
| −2.6262 | 2.8899 | 1.4103 |
| −2.7229 | 2.8899 | 1.4381 |
| −2.8190 | 2.8899 | 1.4621 |
| −2.9160 | 2.8899 | 1.4853 |

TABLE I-continued

| X | Y | Z |
|---|---|---|
| −3.0128 | 2.8899 | 1.5070 |
| −3.1103 | 2.8899 | 1.5255 |
| −3.2082 | 2.8899 | 1.5424 |
| −3.3066 | 2.8899 | 1.5582 |
| −3.4051 | 2.8899 | 1.5744 |
| −3.5036 | 2.8899 | 1.5902 |
| −3.6022 | 2.8899 | 1.6077 |
| −3.7003 | 2.8899 | 1.6258 |
| −3.7979 | 2.8899 | 1.6432 |
| −3.8967 | 2.8899 | 1.6578 |
| −3.9950 | 2.8899 | 1.6761 |
| −4.0929 | 2.8899 | 1.6914 |
| −4.1916 | 2.8899 | 1.7059 |
| −4.2891 | 2.8899 | 1.7174 |
| −4.3862 | 2.8899 | 1.7152 |
| −4.4804 | 2.8899 | 1.6941 |
| −4.5469 | 2.8899 | 1.6577 |
| −4.5597 | 2.8899 | 1.6226 |
| −2.4893 | 2.9900 | 1.2816 |
| −2.4912 | 2.9900 | 1.3409 |
| −2.5173 | 2.9900 | 1.3920 |
| −2.6019 | 2.9900 | 1.4233 |
| −2.6985 | 2.9900 | 1.4514 |
| −2.7948 | 2.9900 | 1.4755 |
| −2.8918 | 2.9900 | 1.5001 |
| −2.9879 | 2.9900 | 1.5244 |
| −3.0852 | 2.9900 | 1.5439 |
| −3.1829 | 2.9900 | 1.5626 |
| −3.2809 | 2.9900 | 1.5790 |
| −3.3793 | 2.9900 | 1.5952 |
| −3.4778 | 2.9900 | 1.6113 |
| −3.5761 | 2.9900 | 1.6288 |
| −3.6744 | 2.9900 | 1.6454 |
| −3.7728 | 2.9900 | 1.6634 |
| −3.8707 | 2.9900 | 1.6818 |
| −3.9686 | 2.9900 | 1.6986 |
| −4.0669 | 2.9900 | 1.7137 |
| −4.1657 | 2.9900 | 1.7280 |
| −4.2631 | 2.9900 | 1.7408 |
| −4.3604 | 2.9900 | 1.7399 |
| −4.4545 | 2.9900 | 1.7206 |
| −4.5225 | 2.9900 | 1.6816 |
| −4.5390 | 2.9900 | 1.6346 |
| −2.4704 | 3.0900 | 1.3115 |
| −2.4704 | 3.0900 | 1.3545 |
| −2.4883 | 3.0900 | 1.4013 |
| −2.5710 | 3.0900 | 1.4329 |
| −2.6671 | 3.0900 | 1.4630 |
| −2.7630 | 3.0900 | 1.4873 |
| −2.8601 | 3.0900 | 1.5135 |
| −2.9561 | 3.0900 | 1.5381 |
| −3.0529 | 3.0900 | 1.5597 |
| −3.1503 | 3.0900 | 1.5795 |
| −3.2481 | 3.0900 | 1.5968 |
| −3.3462 | 3.0900 | 1.6121 |
| −3.4455 | 3.0900 | 1.6268 |
| −3.5442 | 3.0900 | 1.6461 |
| −3.6417 | 3.0900 | 1.6658 |
| −3.7394 | 3.0900 | 1.6833 |
| −3.8378 | 3.0900 | 1.6995 |
| −3.9359 | 3.0900 | 1.7167 |
| −4.0343 | 3.0900 | 1.7323 |
| −4.1328 | 3.0900 | 1.7493 |
| −4.2300 | 3.0900 | 1.7632 |
| −4.3272 | 3.0900 | 1.7647 |
| −4.4216 | 3.0900 | 1.7472 |
| −4.4896 | 3.0900 | 1.7114 |
| −4.5123 | 3.0900 | 1.6587 |
| −2.4354 | 3.1901 | 1.3332 |
| −2.4392 | 3.1901 | 1.3692 |
| −2.4767 | 3.1901 | 1.4178 |
| −2.5639 | 3.1901 | 1.4510 |
| −2.6598 | 3.1901 | 1.4801 |
| −2.7557 | 3.1901 | 1.5056 |
| −2.8523 | 3.1901 | 1.5306 |
| −2.9485 | 3.1901 | 1.5561 |
| −3.0450 | 3.1901 | 1.5795 |

TABLE I-continued

| X | Y | Z |
|---|---|---|
| −3.1416 | 3.1901 | 1.6003 |
| −3.2397 | 3.1901 | 1.6164 |
| −3.3383 | 3.1901 | 1.6346 |
| −3.4359 | 3.1901 | 1.6533 |
| −3.5341 | 3.1901 | 1.6701 |
| −3.6323 | 3.1901 | 1.6880 |
| −3.7307 | 3.1901 | 1.7050 |
| −3.8285 | 3.1901 | 1.7236 |
| −3.9268 | 3.1901 | 1.7394 |
| −4.0252 | 3.1901 | 1.7574 |
| −4.1229 | 3.1901 | 1.7737 |
| −4.2203 | 3.1901 | 1.7859 |
| −4.3175 | 3.1901 | 1.7855 |
| −4.4106 | 3.1901 | 1.7644 |
| −4.4669 | 3.1901 | 1.7291 |
| −4.4752 | 3.1901 | 1.6924 |
| −2.4123 | 3.2900 | 1.3299 |
| −2.4153 | 3.2900 | 1.3804 |
| −2.4393 | 3.2900 | 1.4235 |
| −2.5236 | 3.2900 | 1.4569 |
| −2.6194 | 3.2900 | 1.4875 |
| −2.7149 | 3.2900 | 1.5136 |
| −2.8114 | 3.2900 | 1.5394 |
| −2.9076 | 3.2900 | 1.5652 |
| −3.0038 | 3.2900 | 1.5897 |
| −3.1006 | 3.2900 | 1.6119 |
| −3.1979 | 3.2900 | 1.6327 |
| −3.2952 | 3.2900 | 1.6521 |
| −3.3933 | 3.2900 | 1.6697 |
| −3.4914 | 3.2900 | 1.6886 |
| −3.5887 | 3.2900 | 1.7063 |
| −3.6877 | 3.2900 | 1.7212 |
| −3.7860 | 3.2900 | 1.7405 |
| −3.8840 | 3.2900 | 1.7576 |
| −3.9821 | 3.2900 | 1.7762 |
| −4.0798 | 3.2900 | 1.7934 |
| −4.1771 | 3.2900 | 1.8065 |
| −4.2746 | 3.2900 | 1.8079 |
| −4.3685 | 3.2900 | 1.7917 |
| −4.4377 | 3.2900 | 1.7486 |
| −4.4517 | 3.2900 | 1.7188 |
| −2.3834 | 3.3900 | 1.3571 |
| −2.3851 | 3.3900 | 1.3883 |
| −2.4190 | 3.3900 | 1.4366 |
| −2.5055 | 3.3900 | 1.4702 |
| −2.6012 | 3.3900 | 1.5003 |
| −2.6966 | 3.3900 | 1.5269 |
| −2.7930 | 3.3900 | 1.5528 |
| −2.8891 | 3.3900 | 1.5794 |
| −2.9849 | 3.3900 | 1.6053 |
| −3.0813 | 3.3900 | 1.6282 |
| −3.1783 | 3.3900 | 1.6495 |
| −3.2757 | 3.3900 | 1.6693 |
| −3.3735 | 3.3900 | 1.6886 |
| −3.4711 | 3.3900 | 1.7081 |
| −3.5691 | 3.3900 | 1.7255 |
| −3.6674 | 3.3900 | 1.7435 |
| −3.7653 | 3.3900 | 1.7621 |
| −3.8633 | 3.3900 | 1.7802 |
| −3.9610 | 3.3900 | 1.7980 |
| −4.0593 | 3.3900 | 1.8131 |
| −4.1566 | 3.3900 | 1.8266 |
| −4.2541 | 3.3900 | 1.8271 |
| −4.3467 | 3.3900 | 1.8092 |
| −4.4083 | 3.3900 | 1.7637 |
| −4.4225 | 3.3900 | 1.7201 |
| −2.3525 | 3.4900 | 1.3628 |
| −2.3532 | 3.4900 | 1.4054 |
| −2.3936 | 3.4900 | 1.4471 |
| −2.4828 | 3.4900 | 1.4809 |
| −2.5778 | 3.4900 | 1.5115 |
| −2.6733 | 3.4900 | 1.5380 |
| −2.7696 | 3.4900 | 1.5647 |
| −2.8655 | 3.4900 | 1.5919 |
| −2.9612 | 3.4900 | 1.6185 |
| −3.0575 | 3.4900 | 1.6421 |
| −3.1544 | 3.4900 | 1.6642 |

TABLE I-continued

| X | Y | Z |
|---|---|---|
| −3.2517 | 3.4900 | 1.6848 |
| −3.3492 | 3.4900 | 1.7048 |
| −3.4469 | 3.4900 | 1.7242 |
| −3.5446 | 3.4900 | 1.7429 |
| −3.6428 | 3.4900 | 1.7606 |
| −3.7410 | 3.4900 | 1.7794 |
| −3.8388 | 3.4900 | 1.7989 |
| −3.9363 | 3.4900 | 1.8176 |
| −4.0342 | 3.4900 | 1.8334 |
| −4.1317 | 3.4900 | 1.8452 |
| −4.2293 | 3.4900 | 1.8453 |
| −4.3210 | 3.4900 | 1.8258 |
| −4.3766 | 3.4900 | 1.7817 |
| −4.3875 | 3.4900 | 1.7407 |
| −2.3224 | 3.5901 | 1.3766 |
| −2.3236 | 3.5901 | 1.4088 |
| −2.3461 | 3.5901 | 1.4485 |
| −2.4305 | 3.5901 | 1.4830 |
| −2.5262 | 3.5901 | 1.5143 |
| −2.6215 | 3.5901 | 1.5415 |
| −2.7178 | 3.5901 | 1.5684 |
| −2.8137 | 3.5901 | 1.5963 |
| −2.9093 | 3.5901 | 1.6237 |
| −3.0052 | 3.5901 | 1.6493 |
| −3.1016 | 3.5901 | 1.6725 |
| −3.1989 | 3.5901 | 1.6934 |
| −3.2963 | 3.5901 | 1.7142 |
| −3.3940 | 3.5901 | 1.7338 |
| −3.4917 | 3.5901 | 1.7534 |
| −3.5892 | 3.5901 | 1.7724 |
| −3.6873 | 3.5901 | 1.7902 |
| −3.7852 | 3.5901 | 1.8099 |
| −3.8827 | 3.5901 | 1.8293 |
| −3.9800 | 3.5901 | 1.8471 |
| −4.0779 | 3.5901 | 1.8594 |
| −4.1752 | 3.5901 | 1.8641 |
| −4.2695 | 3.5901 | 1.8498 |
| −4.3349 | 3.5901 | 1.8114 |
| −4.3521 | 3.5901 | 1.7646 |
| −2.2872 | 3.6900 | 1.3831 |
| −2.2879 | 3.6900 | 1.4237 |
| −2.3103 | 3.6900 | 1.4542 |
| −2.3957 | 3.6900 | 1.4894 |
| −2.4908 | 3.6900 | 1.5215 |
| −2.5860 | 3.6900 | 1.5488 |
| −2.6822 | 3.6900 | 1.5761 |
| −2.7780 | 3.6900 | 1.6042 |
| −2.8737 | 3.6900 | 1.6322 |
| −2.9692 | 3.6900 | 1.6594 |
| −3.0654 | 3.6900 | 1.6831 |
| −3.1625 | 3.6900 | 1.7055 |
| −3.2595 | 3.6900 | 1.7266 |
| −3.3573 | 3.6900 | 1.7459 |
| −3.4549 | 3.6900 | 1.7665 |
| −3.5524 | 3.6900 | 1.7862 |
| −3.6500 | 3.6900 | 1.8059 |
| −3.7478 | 3.6900 | 1.8249 |
| −3.8456 | 3.6900 | 1.8439 |
| −3.9431 | 3.6900 | 1.8616 |
| −4.0411 | 3.6900 | 1.8749 |
| −4.1385 | 3.6900 | 1.8803 |
| −4.2328 | 3.6900 | 1.8669 |
| −4.2983 | 3.6900 | 1.8282 |
| −4.3111 | 3.6900 | 1.7989 |
| −2.2554 | 3.7901 | 1.3890 |
| −2.2560 | 3.7901 | 1.4229 |
| −2.2934 | 3.7901 | 1.4692 |
| −2.3810 | 3.7901 | 1.5038 |
| −2.4765 | 3.7901 | 1.5342 |
| −2.5720 | 3.7901 | 1.5623 |
| −2.6680 | 3.7901 | 1.5894 |
| −2.7639 | 3.7901 | 1.6179 |
| −2.8590 | 3.7901 | 1.6470 |
| −2.9545 | 3.7901 | 1.6739 |
| −3.0503 | 3.7901 | 1.6988 |
| −3.1477 | 3.7901 | 1.7213 |
| −3.2438 | 3.7901 | 1.7467 |

TABLE I-continued

| X | Y | Z |
|---|---|---|
| −3.3404 | 3.7901 | 1.7662 |
| −3.4388 | 3.7901 | 1.7834 |
| −3.5373 | 3.7901 | 1.8022 |
| −3.6349 | 3.7901 | 1.8237 |
| −3.7320 | 3.7901 | 1.8437 |
| −3.8299 | 3.7901 | 1.8618 |
| −3.9274 | 3.7901 | 1.8795 |
| −4.0252 | 3.7901 | 1.8911 |
| −4.1226 | 3.7901 | 1.8944 |
| −4.2142 | 3.7901 | 1.8771 |
| −4.2658 | 3.7901 | 1.8332 |
| −4.2703 | 3.7901 | 1.8219 |
| −2.2218 | 3.8901 | 1.3810 |
| −2.2197 | 3.8901 | 1.4276 |
| −2.2483 | 3.8901 | 1.4711 |
| −2.3336 | 3.8901 | 1.5060 |
| −2.4292 | 3.8901 | 1.5372 |
| −2.5243 | 3.8901 | 1.5653 |
| −2.6208 | 3.8901 | 1.5921 |
| −2.7160 | 3.8901 | 1.6222 |
| −2.8115 | 3.8901 | 1.6506 |
| −2.9067 | 3.8901 | 1.6795 |
| −3.0023 | 3.8901 | 1.7052 |
| −3.0989 | 3.8901 | 1.7284 |
| −3.1960 | 3.8901 | 1.7504 |
| −3.2931 | 3.8901 | 1.7720 |
| −3.3904 | 3.8901 | 1.7926 |
| −3.4879 | 3.8901 | 1.8128 |
| −3.5855 | 3.8901 | 1.8338 |
| −3.6825 | 3.8901 | 1.8552 |
| −3.7799 | 3.8901 | 1.8738 |
| −3.8780 | 3.8901 | 1.8907 |
| −3.9756 | 3.8901 | 1.9047 |
| −4.0736 | 3.8901 | 1.9095 |
| −4.1646 | 3.8901 | 1.8958 |
| −4.2314 | 3.8901 | 1.8407 |
| −2.1866 | 3.9901 | 1.3813 |
| −2.1850 | 3.9901 | 1.4278 |
| −2.2144 | 3.9901 | 1.4776 |
| −2.2995 | 3.9901 | 1.5123 |
| −2.3952 | 3.9901 | 1.5438 |
| −2.4904 | 3.9901 | 1.5727 |
| −2.5862 | 3.9901 | 1.6005 |
| −2.6819 | 3.9901 | 1.6288 |
| −2.7773 | 3.9901 | 1.6577 |
| −2.8727 | 3.9901 | 1.6862 |
| −2.9680 | 3.9901 | 1.7138 |
| −3.0640 | 3.9901 | 1.7382 |
| −3.1607 | 3.9901 | 1.7607 |
| −3.2581 | 3.9901 | 1.7818 |
| −3.3553 | 3.9901 | 1.8035 |
| −3.4527 | 3.9901 | 1.8248 |
| −3.5500 | 3.9901 | 1.8466 |
| −3.6472 | 3.9901 | 1.8682 |
| −3.7443 | 3.9901 | 1.8883 |
| −3.8422 | 3.9901 | 1.9052 |
| −3.9400 | 3.9901 | 1.9186 |
| −4.0377 | 3.9901 | 1.9234 |
| −4.1301 | 3.9901 | 1.9088 |
| −4.1866 | 3.9901 | 1.8640 |
| −4.1908 | 3.9901 | 1.8511 |
| −2.1479 | 4.0900 | 1.3967 |
| −2.1506 | 4.0900 | 1.4299 |
| −2.1798 | 4.0900 | 1.4830 |
| −2.2644 | 4.0900 | 1.5183 |
| −2.3596 | 4.0900 | 1.5505 |
| −2.4551 | 4.0900 | 1.5795 |
| −2.5486 | 4.0900 | 1.6064 |
| −2.6497 | 4.0900 | 1.6228 |
| −2.7522 | 4.0900 | 1.6678 |
| −2.8256 | 4.0900 | 1.6891 |
| −2.9235 | 4.0900 | 1.7180 |
| −3.0187 | 4.0900 | 1.7441 |
| −3.1154 | 4.0900 | 1.7675 |
| −3.2120 | 4.0900 | 1.7904 |
| −3.3094 | 4.0900 | 1.8116 |
| −3.4064 | 4.0900 | 1.8345 |

TABLE I-continued

| X | Y | Z |
|---|---|---|
| −3.5036 | 4.0900 | 1.8556 |
| −3.6010 | 4.0900 | 1.8780 |
| −3.6978 | 4.0900 | 1.8994 |
| −3.7950 | 4.0900 | 1.9175 |
| −3.8929 | 4.0900 | 1.9304 |
| −3.9907 | 4.0900 | 1.9363 |
| −4.0838 | 4.0900 | 1.9241 |
| −4.1460 | 4.0900 | 1.8767 |
| −4.1533 | 4.0900 | 1.8511 |
| −2.1134 | 4.1902 | 1.4154 |
| −2.1169 | 4.1902 | 1.4442 |
| −2.1382 | 4.1902 | 1.4826 |
| −2.2209 | 4.1902 | 1.5209 |
| −2.3161 | 4.1902 | 1.5539 |
| −2.4113 | 4.1902 | 1.5835 |
| −2.5070 | 4.1902 | 1.6115 |
| −2.6029 | 4.1902 | 1.6398 |
| −2.6984 | 4.1902 | 1.6689 |
| −2.7937 | 4.1902 | 1.6973 |
| −2.8895 | 4.1902 | 1.7250 |
| −2.9851 | 4.1902 | 1.7524 |
| −3.0812 | 4.1902 | 1.7775 |
| −3.1776 | 4.1902 | 1.8013 |
| −3.2748 | 4.1902 | 1.8233 |
| −3.3717 | 4.1902 | 1.8464 |
| −3.4691 | 4.1902 | 1.8679 |
| −3.5663 | 4.1902 | 1.8911 |
| −3.6631 | 4.1902 | 1.9123 |
| −3.7609 | 4.1902 | 1.9303 |
| −3.8577 | 4.1902 | 1.9435 |
| −3.9592 | 4.1902 | 1.9493 |
| −4.0441 | 4.1902 | 1.9395 |
| −4.1449 | 4.1902 | 1.8973 |
| −4.1430 | 4.1902 | 1.9011 |
| −2.0796 | 4.2901 | 1.4272 |
| −2.0758 | 4.2901 | 1.4505 |
| −2.1027 | 4.2901 | 1.4878 |
| −2.1879 | 4.2901 | 1.5263 |
| −2.2823 | 4.2901 | 1.5601 |
| −2.3769 | 4.2901 | 1.5900 |
| −2.4725 | 4.2901 | 1.6184 |
| −2.5681 | 4.2901 | 1.6475 |
| −2.6633 | 4.2901 | 1.6764 |
| −2.7590 | 4.2901 | 1.7046 |
| −2.8545 | 4.2901 | 1.7326 |
| −2.9503 | 4.2901 | 1.7600 |
| −3.0461 | 4.2901 | 1.7864 |
| −3.1424 | 4.2901 | 1.8109 |
| −3.2389 | 4.2901 | 1.8347 |
| −3.3360 | 4.2901 | 1.8568 |
| −3.4331 | 4.2901 | 1.8798 |
| −3.5302 | 4.2901 | 1.9024 |
| −3.6271 | 4.2901 | 1.9243 |
| −3.7245 | 4.2901 | 1.9429 |
| −3.8218 | 4.2901 | 1.9568 |
| −3.9200 | 4.2901 | 1.9615 |
| −4.0111 | 4.2901 | 1.9480 |
| −4.0664 | 4.2901 | 1.8924 |
| −4.0687 | 4.2901 | 1.8851 |
| −2.0408 | 4.3901 | 1.4369 |
| −2.0409 | 4.3901 | 1.4535 |
| −2.0617 | 4.3901 | 1.4902 |
| −2.1450 | 4.3901 | 1.5281 |
| −2.2393 | 4.3901 | 1.5629 |
| −2.3336 | 4.3901 | 1.5929 |
| −2.4290 | 4.3901 | 1.6220 |
| −2.5244 | 4.3901 | 1.6510 |
| −2.6196 | 4.3901 | 1.6801 |
| −2.7151 | 4.3901 | 1.7087 |
| −2.8107 | 4.3901 | 1.7369 |
| −2.9063 | 4.3901 | 1.7648 |
| −3.0019 | 4.3901 | 1.7921 |
| −3.0979 | 4.3901 | 1.8176 |
| −3.1944 | 4.3901 | 1.8415 |
| −3.2912 | 4.3901 | 1.8651 |
| −3.3883 | 4.3901 | 1.8882 |
| −3.4851 | 4.3901 | 1.9119 |

TABLE I-continued

| X | Y | Z |
|---|---|---|
| −3.5821 | 4.3901 | 1.9333 |
| −3.6794 | 4.3901 | 1.9531 |
| −3.7766 | 4.3901 | 1.9681 |
| −3.8744 | 4.3901 | 1.9735 |
| −3.9663 | 4.3901 | 1.9595 |
| −4.0220 | 4.3901 | 1.9136 |
| −4.0288 | 4.3901 | 1.8898 |
| −1.9989 | 4.4902 | 1.4132 |
| −2.0014 | 4.4902 | 1.4495 |
| −2.0219 | 4.4902 | 1.4908 |
| −2.1039 | 4.4902 | 1.5291 |
| −2.1980 | 4.4902 | 1.5653 |
| −2.2916 | 4.4902 | 1.5967 |
| −2.3868 | 4.4902 | 1.6262 |
| −2.4820 | 4.4902 | 1.6555 |
| −2.5775 | 4.4902 | 1.6842 |
| −2.6728 | 4.4902 | 1.7137 |
| −2.7678 | 4.4902 | 1.7422 |
| −2.8642 | 4.4902 | 1.7686 |
| −2.9596 | 4.4902 | 1.7974 |
| −3.0554 | 4.4902 | 1.8234 |
| −3.1514 | 4.4902 | 1.8494 |
| −3.2480 | 4.4902 | 1.8732 |
| −3.3448 | 4.4902 | 1.8970 |
| −3.4419 | 4.4902 | 1.9204 |
| −3.5384 | 4.4902 | 1.9433 |
| −3.6360 | 4.4902 | 1.9622 |
| −3.7332 | 4.4902 | 1.9789 |
| −3.8306 | 4.4902 | 1.9845 |
| −3.9230 | 4.4902 | 1.9704 |
| −3.9784 | 4.4902 | 1.9279 |
| −3.9821 | 4.4902 | 1.9177 |
| −1.9648 | 4.5901 | 1.4212 |
| −1.9630 | 4.5901 | 1.4557 |
| −1.9860 | 4.5901 | 1.4918 |
| −2.0694 | 4.5901 | 1.5325 |
| −2.1629 | 4.5901 | 1.5693 |
| −2.2565 | 4.5901 | 1.6013 |
| −2.3515 | 4.5901 | 1.6314 |
| −2.4465 | 4.5901 | 1.6608 |
| −2.5420 | 4.5901 | 1.6898 |
| −2.6369 | 4.5901 | 1.7196 |
| −2.7325 | 4.5901 | 1.7474 |
| −2.8278 | 4.5901 | 1.7765 |
| −2.9234 | 4.5901 | 1.8033 |
| −3.0193 | 4.5901 | 1.8310 |
| −3.1148 | 4.5901 | 1.8576 |
| −3.2112 | 4.5901 | 1.8824 |
| −3.3077 | 4.5901 | 1.9066 |
| −3.4048 | 4.5901 | 1.9301 |
| −3.5013 | 4.5901 | 1.9532 |
| −3.5987 | 4.5901 | 1.9724 |
| −3.6960 | 4.5901 | 1.9895 |
| −3.7927 | 4.5901 | 1.9953 |
| −3.8843 | 4.5901 | 1.9769 |
| −3.9308 | 4.5901 | 1.9435 |
| −3.9450 | 4.5901 | 1.9122 |
| −1.9247 | 4.6902 | 1.4384 |
| −1.9266 | 4.6902 | 1.4524 |
| −1.9525 | 4.6902 | 1.4957 |
| −2.0357 | 4.6902 | 1.5359 |
| −2.1292 | 4.6902 | 1.5730 |
| −2.2224 | 4.6902 | 1.6061 |
| −2.3171 | 4.6902 | 1.6366 |
| −2.4122 | 4.6902 | 1.6660 |
| −2.5076 | 4.6902 | 1.6957 |
| −2.6025 | 4.6902 | 1.7254 |
| −2.6977 | 4.6902 | 1.7544 |
| −2.7928 | 4.6902 | 1.7826 |
| −2.8887 | 4.6902 | 1.8094 |
| −2.9844 | 4.6902 | 1.8372 |
| −3.0799 | 4.6902 | 1.8648 |
| −3.1756 | 4.6902 | 1.8912 |
| −3.2720 | 4.6902 | 1.9158 |
| −3.3687 | 4.6902 | 1.9398 |
| −3.4654 | 4.6902 | 1.9629 |
| −3.5623 | 4.6902 | 1.9835 |

TABLE I-continued

| X | Y | Z |
|---|---|---|
| −3.6597 | 4.6902 | 1.9996 |
| −3.7566 | 4.6902 | 2.0060 |
| −3.8483 | 4.6902 | 1.9880 |
| −3.8926 | 4.6902 | 1.9543 |
| −3.9028 | 4.6902 | 1.9226 |
| −1.8933 | 4.7901 | 1.4280 |
| −1.8923 | 4.7901 | 1.4524 |
| −1.9086 | 4.7901 | 1.4921 |
| −1.9893 | 4.7901 | 1.5323 |
| −2.0823 | 4.7901 | 1.5712 |
| −2.1750 | 4.7901 | 1.6048 |
| −2.2691 | 4.7901 | 1.6366 |
| −2.3638 | 4.7901 | 1.6662 |
| −2.4590 | 4.7901 | 1.6962 |
| −2.5538 | 4.7901 | 1.7266 |
| −2.6487 | 4.7901 | 1.7560 |
| −2.7440 | 4.7901 | 1.7843 |
| −2.8396 | 4.7901 | 1.8123 |
| −2.9346 | 4.7901 | 1.8402 |
| −3.0313 | 4.7901 | 1.8653 |
| −3.1270 | 4.7901 | 1.8944 |
| −3.2227 | 4.7901 | 1.9201 |
| −3.3193 | 4.7901 | 1.9452 |
| −3.4156 | 4.7901 | 1.9689 |
| −3.5125 | 4.7901 | 1.9898 |
| −3.6097 | 4.7901 | 2.0067 |
| −3.7070 | 4.7901 | 2.0151 |
| −3.7993 | 4.7901 | 2.0025 |
| −3.8518 | 4.7901 | 1.9622 |
| −3.8608 | 4.7901 | 1.9320 |
| −1.8555 | 4.8908 | 1.4522 |
| −1.8526 | 4.8908 | 1.4606 |
| −1.8724 | 4.8908 | 1.4904 |
| −1.9553 | 4.8908 | 1.5331 |
| −2.0476 | 4.8908 | 1.5726 |
| −2.1400 | 4.8908 | 1.6075 |
| −2.2340 | 4.8908 | 1.6400 |
| −2.3286 | 4.8908 | 1.6708 |
| −2.4236 | 4.8908 | 1.7008 |
| −2.5189 | 4.8908 | 1.7305 |
| −2.6135 | 4.8908 | 1.7612 |
| −2.7087 | 4.8908 | 1.7896 |
| −2.8041 | 4.8908 | 1.8183 |
| −2.8996 | 4.8908 | 1.8461 |
| −2.9952 | 4.8908 | 1.8740 |
| −3.0910 | 4.8908 | 1.9013 |
| −3.1870 | 4.8908 | 1.9278 |
| −3.2832 | 4.8908 | 1.9538 |
| −3.3793 | 4.8908 | 1.9783 |
| −3.4761 | 4.8908 | 1.9995 |
| −3.5732 | 4.8908 | 2.0163 |
| −3.6709 | 4.8908 | 2.0241 |
| −3.7620 | 4.8908 | 2.0113 |
| −3.8122 | 4.8908 | 1.9657 |
| −3.8191 | 4.8908 | 1.9436 |
| −1.8195 | 4.9900 | 1.4307 |
| −1.8168 | 4.9900 | 1.4527 |
| −1.8433 | 4.9900 | 1.4940 |
| −1.9267 | 4.9900 | 1.5367 |
| −2.0191 | 4.9900 | 1.5756 |
| −2.1117 | 4.9900 | 1.6114 |
| −2.2053 | 4.9900 | 1.6445 |
| −2.2998 | 4.9900 | 1.6755 |
| −2.3946 | 4.9900 | 1.7063 |
| −2.4894 | 4.9900 | 1.7369 |
| −2.5843 | 4.9900 | 1.7667 |
| −2.6796 | 4.9900 | 1.7959 |
| −2.7748 | 4.9900 | 1.8250 |
| −2.8703 | 4.9900 | 1.8532 |
| −2.9662 | 4.9900 | 1.8813 |
| −3.0616 | 4.9900 | 1.9093 |
| −3.1581 | 4.9900 | 1.9351 |
| −3.2540 | 4.9900 | 1.9633 |
| −3.3498 | 4.9900 | 1.9880 |
| −3.4469 | 4.9900 | 2.0089 |
| −3.5438 | 4.9900 | 2.0259 |
| −3.6417 | 4.9900 | 2.0323 |

TABLE I-continued

| X | Y | Z |
|---|---|---|
| −3.7306 | 4.9900 | 2.0179 |
| −3.7731 | 4.9900 | 1.9652 |
| −3.7783 | 4.9900 | 1.9429 |
| −1.7798 | 5.0901 | 1.4410 |
| −1.7776 | 5.0901 | 1.4626 |
| −1.8013 | 5.0901 | 1.4870 |
| −1.8860 | 5.0901 | 1.5333 |
| −1.9772 | 5.0901 | 1.5727 |
| −2.0698 | 5.0901 | 1.6092 |
| −2.1631 | 5.0901 | 1.6431 |
| −2.2569 | 5.0901 | 1.6762 |
| −2.3511 | 5.0901 | 1.7076 |
| −2.4459 | 5.0901 | 1.7378 |
| −2.5410 | 5.0901 | 1.7677 |
| −2.6359 | 5.0901 | 1.7981 |
| −2.7308 | 5.0901 | 1.8276 |
| −2.8261 | 5.0901 | 1.8561 |
| −2.9218 | 5.0901 | 1.8845 |
| −3.0175 | 5.0901 | 1.9127 |
| −3.1131 | 5.0901 | 1.9409 |
| −3.2087 | 5.0901 | 1.9683 |
| −3.3046 | 5.0901 | 1.9940 |
| −3.4010 | 5.0901 | 2.0163 |
| −3.4979 | 5.0901 | 2.0334 |
| −3.5952 | 5.0901 | 2.0402 |
| −3.6850 | 5.0901 | 2.0259 |
| −3.7299 | 5.0901 | 1.9782 |
| −3.7358 | 5.0901 | 1.9564 |
| −1.7490 | 5.1901 | 1.4306 |
| −1.7448 | 5.1901 | 1.4528 |
| −1.7657 | 5.1901 | 1.4851 |
| −1.8477 | 5.1901 | 1.5296 |
| −1.9398 | 5.1901 | 1.5695 |
| −2.0323 | 5.1901 | 1.6072 |
| −2.1249 | 5.1901 | 1.6430 |
| −2.2182 | 5.1901 | 1.6768 |
| −2.3123 | 5.1901 | 1.7088 |
| −2.4068 | 5.1901 | 1.7398 |
| −2.5017 | 5.1901 | 1.7703 |
| −2.5967 | 5.1901 | 1.8003 |
| −2.6917 | 5.1901 | 1.8304 |
| −2.7868 | 5.1901 | 1.8600 |
| −2.8821 | 5.1901 | 1.8890 |
| −2.9777 | 5.1901 | 1.9172 |
| −3.0734 | 5.1901 | 1.9459 |
| −3.1689 | 5.1901 | 1.9739 |
| −3.2645 | 5.1901 | 2.0001 |
| −3.3612 | 5.1901 | 2.0222 |
| −3.4578 | 5.1901 | 2.0410 |
| −3.5555 | 5.1901 | 2.0480 |
| −3.6435 | 5.1901 | 2.0343 |
| −3.6912 | 5.1901 | 1.9708 |
| −1.7148 | 5.2901 | 1.4194 |
| −1.7119 | 5.2901 | 1.4469 |
| −1.7383 | 5.2901 | 1.4856 |
| −1.8208 | 5.2901 | 1.5308 |
| −1.9122 | 5.2901 | 1.5719 |
| −2.0037 | 5.2901 | 1.6095 |
| −2.0971 | 5.2901 | 1.6442 |
| −2.1902 | 5.2901 | 1.6799 |
| −2.2836 | 5.2901 | 1.7130 |
| −2.3780 | 5.2901 | 1.7444 |
| −2.4727 | 5.2901 | 1.7750 |
| −2.5679 | 5.2901 | 1.8049 |
| −2.6629 | 5.2901 | 1.8357 |
| −2.7577 | 5.2901 | 1.8662 |
| −2.8527 | 5.2901 | 1.8959 |
| −2.9481 | 5.2901 | 1.9246 |
| −3.0438 | 5.2901 | 1.9526 |
| −3.1394 | 5.2901 | 1.9810 |
| −3.2347 | 5.2901 | 2.0080 |
| −3.3311 | 5.2901 | 2.0305 |
| −3.4276 | 5.2901 | 2.0482 |
| −3.5255 | 5.2901 | 2.0540 |
| −3.6120 | 5.2901 | 2.0378 |
| −3.6503 | 5.2901 | 1.9733 |
| −1.6825 | 5.3900 | 1.3968 |

TABLE I-continued

| X | Y | Z |
|---|---|---|
| −1.6783 | 5.3900 | 1.4411 |
| −1.7014 | 5.3900 | 1.4795 |
| −1.7826 | 5.3900 | 1.5251 |
| −1.8734 | 5.3900 | 1.5674 |
| −1.9650 | 5.3900 | 1.6053 |
| −2.0574 | 5.3900 | 1.6422 |
| −2.1503 | 5.3900 | 1.6776 |
| −2.2437 | 5.3900 | 1.7116 |
| −2.3377 | 5.3900 | 1.7439 |
| −2.4322 | 5.3900 | 1.7751 |
| −2.5270 | 5.3900 | 1.8064 |
| −2.6215 | 5.3900 | 1.8375 |
| −2.7165 | 5.3900 | 1.8678 |
| −2.8113 | 5.3900 | 1.8983 |
| −2.9066 | 5.3900 | 1.9270 |
| −3.0023 | 5.3900 | 1.9559 |
| −3.0974 | 5.3900 | 1.9844 |
| −3.1934 | 5.3900 | 2.0105 |
| −3.2894 | 5.3900 | 2.0358 |
| −3.3853 | 5.3900 | 2.0545 |
| −3.4827 | 5.3900 | 2.0597 |
| −3.5693 | 5.3900 | 2.0443 |
| −3.6053 | 5.3900 | 1.9843 |
| −3.6084 | 5.3900 | 1.9738 |
| −1.6519 | 5.4901 | 1.4057 |
| −1.6480 | 5.4901 | 1.4335 |
| −1.6724 | 5.4901 | 1.4772 |
| −1.7540 | 5.4901 | 1.5227 |
| −1.8444 | 5.4901 | 1.5658 |
| −1.9357 | 5.4901 | 1.6038 |
| −2.0277 | 5.4901 | 1.6421 |
| −2.1203 | 5.4901 | 1.6779 |
| −2.2133 | 5.4901 | 1.7132 |
| −2.3069 | 5.4901 | 1.7465 |
| −2.4009 | 5.4901 | 1.7784 |
| −2.4956 | 5.4901 | 1.8095 |
| −2.5900 | 5.4901 | 1.8410 |
| −2.6849 | 5.4901 | 1.8718 |
| −2.7797 | 5.4901 | 1.9028 |
| −2.8749 | 5.4901 | 1.9328 |
| −2.9699 | 5.4901 | 1.9627 |
| −3.0652 | 5.4901 | 1.9910 |
| −3.1612 | 5.4901 | 2.0174 |
| −3.2573 | 5.4901 | 2.0432 |
| −3.3524 | 5.4901 | 2.0625 |
| −3.4501 | 5.4901 | 2.0643 |
| −3.5325 | 5.4901 | 2.0489 |
| −3.5613 | 5.4901 | 1.9967 |
| −1.6248 | 5.5900 | 1.3899 |
| −1.6240 | 5.5900 | 1.4270 |
| −1.6437 | 5.5900 | 1.4736 |
| −1.7229 | 5.5900 | 1.5189 |
| −1.8135 | 5.5900 | 1.5626 |
| −1.9043 | 5.5900 | 1.6019 |
| −1.9964 | 5.5900 | 1.6396 |
| −2.0885 | 5.5900 | 1.6768 |
| −2.1815 | 5.5900 | 1.7122 |
| −2.2746 | 5.5900 | 1.7470 |
| −2.3683 | 5.5900 | 1.7798 |
| −2.4624 | 5.5900 | 1.8115 |
| −2.5570 | 5.5900 | 1.8428 |
| −2.6514 | 5.5900 | 1.8750 |
| −2.7459 | 5.5900 | 1.9062 |
| −2.8407 | 5.5900 | 1.9370 |
| −2.9356 | 5.5900 | 1.9673 |
| −3.0306 | 5.5900 | 1.9964 |
| −3.1261 | 5.5900 | 2.0235 |
| −3.2223 | 5.5900 | 2.0491 |
| −3.3170 | 5.5900 | 2.0692 |
| −3.4161 | 5.5900 | 2.0688 |
| −3.4878 | 5.5900 | 2.0555 |
| −3.5254 | 5.5900 | 1.9842 |
| −1.5981 | 5.6902 | 1.3980 |
| −1.5968 | 5.6902 | 1.4227 |
| −1.6245 | 5.6902 | 1.4753 |
| −1.7056 | 5.6902 | 1.5213 |
| −1.7963 | 5.6902 | 1.5644 |

TABLE I-continued

| X | Y | Z |
|---|---|---|
| −1.8869 | 5.6902 | 1.6049 |
| −1.9787 | 5.6902 | 1.6430 |
| −2.0709 | 5.6902 | 1.6802 |
| −2.1635 | 5.6902 | 1.7164 |
| −2.2564 | 5.6902 | 1.7519 |
| −2.3497 | 5.6902 | 1.7855 |
| −2.4438 | 5.6902 | 1.8178 |
| −2.5380 | 5.6902 | 1.8500 |
| −2.6325 | 5.6902 | 1.8816 |
| −2.7268 | 5.6902 | 1.9137 |
| −2.8215 | 5.6902 | 1.9447 |
| −2.9161 | 5.6902 | 1.9762 |
| −3.0107 | 5.6902 | 2.0055 |
| −3.1062 | 5.6902 | 2.0319 |
| −3.2025 | 5.6902 | 2.0556 |
| −3.2982 | 5.6902 | 2.0734 |
| −3.3940 | 5.6902 | 2.0713 |
| −3.4623 | 5.6902 | 2.0468 |
| −3.4846 | 5.6902 | 1.9871 |
| −1.5711 | 5.7901 | 1.4014 |
| −1.5678 | 5.7901 | 1.4230 |
| −1.5858 | 5.7901 | 1.4600 |
| −1.6643 | 5.7901 | 1.5092 |
| −1.7541 | 5.7901 | 1.5541 |
| −1.8446 | 5.7901 | 1.5952 |
| −1.9360 | 5.7901 | 1.6342 |
| −2.0279 | 5.7901 | 1.6724 |
| −2.1200 | 5.7901 | 1.7098 |
| −2.2127 | 5.7901 | 1.7460 |
| −2.3056 | 5.7901 | 1.7812 |
| −2.3993 | 5.7901 | 1.8145 |
| −2.4929 | 5.7901 | 1.8473 |
| −2.5878 | 5.7901 | 1.8785 |
| −2.6817 | 5.7901 | 1.9122 |
| −2.7764 | 5.7901 | 1.9431 |
| −2.8710 | 5.7901 | 1.9752 |
| −2.9655 | 5.7901 | 2.0052 |
| −3.0609 | 5.7901 | 2.0328 |
| −3.1570 | 5.7901 | 2.0574 |
| −3.2529 | 5.7901 | 2.0766 |
| −3.3481 | 5.7901 | 2.0771 |
| −3.4207 | 5.7901 | 2.0481 |
| −3.4403 | 5.7901 | 2.0132 |
| −1.5457 | 5.8901 | 1.3933 |
| −1.5419 | 5.8901 | 1.4170 |
| −1.5734 | 5.8901 | 1.4597 |
| −1.6537 | 5.8901 | 1.5131 |
| −1.7419 | 5.8901 | 1.5579 |
| −1.8331 | 5.8901 | 1.5984 |
| −1.9243 | 5.8901 | 1.6382 |
| −2.0159 | 5.8901 | 1.6769 |
| −2.1080 | 5.8901 | 1.7145 |
| −2.2005 | 5.8901 | 1.7512 |
| −2.2933 | 5.8901 | 1.7868 |
| −2.3864 | 5.8901 | 1.8214 |
| −2.4802 | 5.8901 | 1.8546 |
| −2.5743 | 5.8901 | 1.8877 |
| −2.6685 | 5.8901 | 1.9204 |
| −2.7627 | 5.8901 | 1.9531 |
| −2.8570 | 5.8901 | 1.9842 |
| −2.9518 | 5.8901 | 2.0132 |
| −3.0476 | 5.8901 | 2.0396 |
| −3.1436 | 5.8901 | 2.0650 |
| −3.2390 | 5.8901 | 2.0832 |
| −3.3332 | 5.8901 | 2.0780 |
| −3.3874 | 5.8901 | 2.0519 |
| −3.4062 | 5.8901 | 2.0027 |
| −1.5154 | 5.9900 | 1.3730 |
| −1.5140 | 5.9900 | 1.4012 |
| −1.5449 | 5.9900 | 1.4480 |
| −1.6226 | 5.9900 | 1.5040 |
| −1.7105 | 5.9900 | 1.5501 |
| −1.8015 | 5.9900 | 1.5920 |
| −1.8924 | 5.9900 | 1.6324 |
| −1.9838 | 5.9900 | 1.6718 |
| −2.0755 | 5.9900 | 1.7105 |
| −2.1675 | 5.9900 | 1.7482 |

TABLE I-continued

| X | Y | Z |
|---|---|---|
| −2.2602 | 5.9900 | 1.7845 |
| −2.3529 | 5.9900 | 1.8200 |
| −2.4462 | 5.9900 | 1.8541 |
| −2.5401 | 5.9900 | 1.8880 |
| −2.6337 | 5.9900 | 1.9218 |
| −2.7283 | 5.9900 | 1.9539 |
| −2.8223 | 5.9900 | 1.9873 |
| −2.9166 | 5.9900 | 2.0175 |
| −3.0120 | 5.9900 | 2.0450 |
| −3.1080 | 5.9900 | 2.0694 |
| −3.2043 | 5.9900 | 2.0869 |
| −3.2968 | 5.9900 | 2.0832 |
| −3.3532 | 5.9900 | 2.0465 |
| −3.3708 | 5.9900 | 1.9926 |
| −1.4859 | 6.0900 | 1.3687 |
| −1.4822 | 6.0900 | 1.3924 |
| −1.5132 | 6.0900 | 1.4382 |
| −1.5922 | 6.0900 | 1.4933 |
| −1.6788 | 6.0900 | 1.5415 |
| −1.7683 | 6.0900 | 1.5841 |
| −1.8590 | 6.0900 | 1.6256 |
| −1.9503 | 6.0900 | 1.6650 |
| −2.0415 | 6.0900 | 1.7048 |
| −2.1336 | 6.0900 | 1.7424 |
| −2.2255 | 6.0900 | 1.7809 |
| −2.3177 | 6.0900 | 1.8176 |
| −2.4105 | 6.0900 | 1.8527 |
| −2.5042 | 6.0900 | 1.8868 |
| −2.5978 | 6.0900 | 1.9212 |
| −2.6916 | 6.0900 | 1.9549 |
| −2.7854 | 6.0900 | 1.9880 |
| −2.8798 | 6.0900 | 2.0186 |
| −2.9750 | 6.0900 | 2.0473 |
| −3.0705 | 6.0900 | 2.0725 |
| −3.1672 | 6.0900 | 2.0902 |
| −3.2586 | 6.0900 | 2.0883 |
| −3.3182 | 6.0900 | 2.0418 |
| −3.3357 | 6.0900 | 1.9854 |
| −1.4614 | 6.1900 | 1.3543 |
| −1.4569 | 6.1900 | 1.3779 |
| −1.4937 | 6.1900 | 1.4278 |
| −1.5707 | 6.1900 | 1.4881 |
| −1.6570 | 6.1900 | 1.5363 |
| −1.7470 | 6.1900 | 1.5808 |
| −1.8373 | 6.1900 | 1.6221 |
| −1.9283 | 6.1900 | 1.6628 |
| −2.0193 | 6.1900 | 1.7030 |
| −2.1107 | 6.1900 | 1.7422 |
| −2.2026 | 6.1900 | 1.7806 |
| −2.2944 | 6.1900 | 1.8185 |
| −2.3871 | 6.1900 | 1.8543 |
| −2.4802 | 6.1900 | 1.8896 |
| −2.5737 | 6.1900 | 1.9240 |
| −2.6677 | 6.1900 | 1.9580 |
| −2.7611 | 6.1900 | 1.9921 |
| −2.8553 | 6.1900 | 2.0232 |
| −2.9503 | 6.1900 | 2.0515 |
| −3.0463 | 6.1900 | 2.0757 |
| −3.1430 | 6.1900 | 2.0941 |
| −3.2329 | 6.1900 | 2.0902 |
| −3.2805 | 6.1900 | 2.0428 |
| −3.2891 | 6.1900 | 2.0230 |
| −3.2976 | 6.1900 | 1.9777 |
| −1.4337 | 6.2901 | 1.3417 |
| −1.4294 | 6.2901 | 1.3680 |
| −1.4613 | 6.2901 | 1.4194 |
| −1.5401 | 6.2901 | 1.4738 |
| −1.6262 | 6.2901 | 1.5238 |
| −1.7138 | 6.2901 | 1.5693 |
| −1.8041 | 6.2901 | 1.6115 |
| −1.8941 | 6.2901 | 1.6542 |
| −1.9850 | 6.2901 | 1.6944 |
| −2.0760 | 6.2901 | 1.7348 |
| −2.1675 | 6.2901 | 1.7742 |
| −2.2590 | 6.2901 | 1.8131 |
| −2.3514 | 6.2901 | 1.8502 |
| −2.4441 | 6.2901 | 1.8869 |

TABLE I-continued

| X | Y | Z |
|---|---|---|
| −2.5367 | 6.2901 | 1.9224 |
| −2.6308 | 6.2901 | 1.9562 |
| −2.7239 | 6.2901 | 1.9918 |
| −2.8179 | 6.2901 | 2.0233 |
| −2.9128 | 6.2901 | 2.0520 |
| −3.0088 | 6.2901 | 2.0766 |
| −3.1051 | 6.2901 | 2.0965 |
| −3.1967 | 6.2901 | 2.0922 |
| −3.2404 | 6.2901 | 2.0485 |
| −3.2570 | 6.2901 | 2.0036 |
| −1.4221 | 6.3900 | 1.3962 |
| −1.5018 | 6.3900 | 1.4544 |
| −1.5866 | 6.3900 | 1.5048 |
| −1.6736 | 6.3900 | 1.5530 |
| −1.7619 | 6.3900 | 1.5967 |
| −1.8525 | 6.3900 | 1.6384 |
| −1.9426 | 6.3900 | 1.6808 |
| −2.0333 | 6.3900 | 1.7219 |
| −2.1237 | 6.3900 | 1.7635 |
| −2.2150 | 6.3900 | 1.8026 |
| −2.3065 | 6.3900 | 1.8417 |
| −2.3983 | 6.3900 | 1.8791 |
| −2.4911 | 6.3900 | 1.9151 |
| −2.5836 | 6.3900 | 1.9507 |
| −2.6778 | 6.3900 | 1.9836 |
| −2.7707 | 6.3900 | 2.0187 |
| −2.8651 | 6.3900 | 2.0472 |
| −2.9613 | 6.3900 | 2.0738 |
| −3.0569 | 6.3900 | 2.0961 |
| −3.1489 | 6.3900 | 2.0957 |
| −3.1999 | 6.3900 | 2.0595 |
| −1.3586 | 6.4901 | 1.2572 |
| −1.3407 | 6.4901 | 1.2928 |
| −1.4074 | 6.4901 | 1.3836 |
| −1.4836 | 6.4901 | 1.4459 |
| −1.5674 | 6.4901 | 1.4975 |
| −1.6551 | 6.4901 | 1.5456 |
| −1.7429 | 6.4901 | 1.5909 |
| −1.8327 | 6.4901 | 1.6336 |
| −1.9225 | 6.4901 | 1.6767 |
| −2.0127 | 6.4901 | 1.7188 |
| −2.1030 | 6.4901 | 1.7605 |
| −2.1939 | 6.4901 | 1.8008 |
| −2.2850 | 6.4901 | 1.8407 |
| −2.3766 | 6.4901 | 1.8793 |
| −2.4686 | 6.4901 | 1.9168 |
| −2.5613 | 6.4901 | 1.9525 |
| −2.6545 | 6.4901 | 1.9874 |
| −2.7475 | 6.4901 | 2.0214 |
| −2.8416 | 6.4901 | 2.0512 |
| −2.9371 | 6.4901 | 2.0773 |
| −3.0333 | 6.4901 | 2.0979 |
| −3.1223 | 6.4901 | 2.0958 |
| −3.1685 | 6.4901 | 2.0508 |
| −1.3149 | 6.5900 | 1.2426 |
| −1.2996 | 6.5900 | 1.2889 |
| −1.3460 | 6.5900 | 1.3539 |
| −1.4263 | 6.5900 | 1.4094 |
| −1.5094 | 6.5900 | 1.4644 |
| −1.5940 | 6.5900 | 1.5146 |
| −1.6813 | 6.5900 | 1.5615 |
| −1.7697 | 6.5900 | 1.6062 |
| −1.8595 | 6.5900 | 1.6494 |
| −1.9492 | 6.5900 | 1.6933 |
| −2.0388 | 6.5900 | 1.7365 |
| −2.1291 | 6.5900 | 1.7779 |
| −2.2199 | 6.5900 | 1.8188 |
| −2.3108 | 6.5900 | 1.8591 |
| −2.4021 | 6.5900 | 1.8981 |
| −2.4941 | 6.5900 | 1.9357 |
| −2.5864 | 6.5900 | 1.9724 |
| −2.6791 | 6.5900 | 2.0073 |
| −2.7728 | 6.5900 | 2.0402 |
| −2.8665 | 6.5900 | 2.0687 |
| −2.9656 | 6.5900 | 2.0937 |
| −3.0505 | 6.5900 | 2.1032 |
| −3.1683 | 6.5900 | 2.0655 |

TABLE I-continued

| X | Y | Z |
|---|---|---|
| −3.1662 | 6.5900 | 2.0699 |
| −1.2691 | 6.6901 | 1.2035 |
| −1.2594 | 6.6901 | 1.2567 |
| −1.2890 | 6.6901 | 1.3263 |
| −1.3685 | 6.6901 | 1.3757 |
| −1.4549 | 6.6901 | 1.4288 |
| −1.5385 | 6.6901 | 1.4820 |
| −1.6240 | 6.6901 | 1.5316 |
| −1.7115 | 6.6901 | 1.5776 |
| −1.8013 | 6.6901 | 1.6205 |
| −1.8912 | 6.6901 | 1.6651 |
| −1.9799 | 6.6901 | 1.7108 |
| −2.0690 | 6.6901 | 1.7543 |
| −2.1592 | 6.6901 | 1.7966 |
| −2.2497 | 6.6901 | 1.8380 |
| −2.3406 | 6.6901 | 1.8788 |
| −2.4313 | 6.6901 | 1.9189 |
| −2.5236 | 6.6901 | 1.9560 |
| −2.6157 | 6.6901 | 1.9935 |
| −2.7086 | 6.6901 | 2.0282 |
| −2.8020 | 6.6901 | 2.0601 |
| −2.8976 | 6.6901 | 2.0845 |
| −2.9936 | 6.6901 | 2.1012 |
| −3.0794 | 6.6901 | 2.0878 |
| −3.0983 | 6.6901 | 2.0614 |
| −1.2476 | 6.7901 | 1.1267 |
| −1.2270 | 6.7901 | 1.2149 |
| −1.2602 | 6.7901 | 1.3033 |
| −1.3374 | 6.7901 | 1.3554 |
| −1.4252 | 6.7901 | 1.4061 |
| −1.5095 | 6.7901 | 1.4625 |
| −1.5942 | 6.7901 | 1.5143 |
| −1.6803 | 6.7901 | 1.5622 |
| −1.7696 | 6.7901 | 1.6062 |
| −1.8581 | 6.7901 | 1.6525 |
| −1.9472 | 6.7901 | 1.6967 |
| −2.0363 | 6.7901 | 1.7414 |
| −2.1257 | 6.7901 | 1.7848 |
| −2.2151 | 6.7901 | 1.8279 |
| −2.3061 | 6.7901 | 1.8688 |
| −2.3959 | 6.7901 | 1.9107 |
| −2.4878 | 6.7901 | 1.9484 |
| −2.5792 | 6.7901 | 1.9877 |
| −2.6713 | 6.7901 | 2.0233 |
| −2.7648 | 6.7901 | 2.0571 |
| −2.8579 | 6.7901 | 2.0853 |
| −2.9561 | 6.7901 | 2.0981 |
| −3.0424 | 6.7901 | 2.0914 |
| −3.0604 | 6.7901 | 2.0747 |
| −1.2136 | 6.8900 | 1.0946 |
| −1.1874 | 6.8900 | 1.1838 |
| −1.2187 | 6.8900 | 1.2667 |
| −1.2940 | 6.8900 | 1.3212 |
| −1.3827 | 6.8900 | 1.3714 |
| −1.4671 | 6.8900 | 1.4332 |
| −1.5522 | 6.8900 | 1.4871 |
| −1.6378 | 6.8900 | 1.5370 |
| −1.7257 | 6.8900 | 1.5832 |
| −1.8139 | 6.8900 | 1.6296 |
| −1.9025 | 6.8900 | 1.6751 |
| −1.9913 | 6.8900 | 1.7204 |
| −2.0802 | 6.8900 | 1.7652 |
| −2.1695 | 6.8900 | 1.8091 |
| −2.2592 | 6.8900 | 1.8526 |
| −2.3486 | 6.8900 | 1.8958 |
| −2.4391 | 6.8900 | 1.9367 |
| −2.5298 | 6.8900 | 1.9759 |
| −2.6229 | 6.8900 | 2.0111 |
| −2.7153 | 6.8900 | 2.0489 |
| −2.8074 | 6.8900 | 2.0798 |
| −2.9038 | 6.8900 | 2.0966 |
| −2.9939 | 6.8900 | 2.0966 |
| −3.0568 | 6.8900 | 2.0387 |
| −1.1696 | 6.9902 | 1.0793 |
| −1.1614 | 6.9902 | 1.1388 |
| −1.1754 | 6.9902 | 1.2297 |
| −1.2469 | 6.9902 | 1.2851 |

TABLE I-continued

| X | Y | Z |
|---|---|---|
| −1.3352 | 6.9902 | 1.3355 |
| −1.4224 | 6.9902 | 1.3949 |
| −1.5038 | 6.9902 | 1.4521 |
| −1.5872 | 6.9902 | 1.5049 |
| −1.6730 | 6.9902 | 1.5546 |
| −1.7599 | 6.9902 | 1.6018 |
| −1.8486 | 6.9902 | 1.6473 |
| −1.9369 | 6.9902 | 1.6937 |
| −2.0255 | 6.9902 | 1.7391 |
| −2.1141 | 6.9902 | 1.7844 |
| −2.2031 | 6.9902 | 1.8288 |
| −2.2921 | 6.9902 | 1.8735 |
| −2.3811 | 6.9902 | 1.9170 |
| −2.4718 | 6.9902 | 1.9576 |
| −2.5623 | 6.9902 | 1.9979 |
| −2.6542 | 6.9902 | 2.0346 |
| −2.7471 | 6.9902 | 2.0692 |
| −2.8407 | 6.9902 | 2.0975 |
| −2.9344 | 6.9902 | 2.1071 |
| −3.0080 | 6.9902 | 2.0802 |
| −3.0223 | 6.9902 | 2.0614 |
| −1.1600 | 7.0899 | 0.9987 |
| −1.1285 | 7.0899 | 1.0726 |
| −1.1688 | 7.0899 | 1.2196 |
| −1.2442 | 7.0899 | 1.2753 |
| −1.3311 | 7.0899 | 1.3268 |
| −1.4162 | 7.0899 | 1.3853 |
| −1.4976 | 7.0899 | 1.4427 |
| −1.5802 | 7.0899 | 1.4969 |
| −1.6652 | 7.0899 | 1.5478 |
| −1.7515 | 7.0899 | 1.5948 |
| −1.8422 | 7.0899 | 1.6384 |
| −1.9291 | 7.0899 | 1.6889 |
| −2.0182 | 7.0899 | 1.7350 |
| −2.1066 | 7.0899 | 1.7816 |
| −2.1952 | 7.0899 | 1.8270 |
| −2.2836 | 7.0899 | 1.8730 |
| −2.3723 | 7.0899 | 1.9176 |
| −2.4618 | 7.0899 | 1.9604 |
| −2.5520 | 7.0899 | 2.0013 |
| −2.6435 | 7.0899 | 2.0398 |
| −2.7356 | 7.0899 | 2.0751 |
| −2.8301 | 7.0899 | 2.1025 |
| −2.9212 | 7.0899 | 2.1119 |
| −2.9960 | 7.0899 | 2.0768 |
| −1.1407 | 7.1901 | 0.9526 |
| −1.0986 | 7.1901 | 1.0382 |
| −1.1393 | 7.1901 | 1.1890 |
| −1.2142 | 7.1901 | 1.2463 |
| −1.2995 | 7.1901 | 1.2999 |
| −1.3837 | 7.1901 | 1.3574 |
| −1.4649 | 7.1901 | 1.4153 |
| −1.5463 | 7.1901 | 1.4712 |
| −1.6306 | 7.1901 | 1.5233 |
| −1.7157 | 7.1901 | 1.5736 |
| −1.8037 | 7.1901 | 1.6196 |
| −1.8918 | 7.1901 | 1.6673 |
| −1.9794 | 7.1901 | 1.7146 |
| −2.0675 | 7.1901 | 1.7612 |
| −2.1555 | 7.1901 | 1.8082 |
| −2.2434 | 7.1901 | 1.8549 |
| −2.3316 | 7.1901 | 1.9007 |
| −2.4205 | 7.1901 | 1.9453 |
| −2.5097 | 7.1901 | 1.9887 |
| −2.5998 | 7.1901 | 2.0298 |
| −2.6914 | 7.1901 | 2.0669 |
| −2.7846 | 7.1901 | 2.0987 |
| −2.8782 | 7.1901 | 2.1170 |
| −2.9622 | 7.1901 | 2.0964 |
| −2.9737 | 7.1901 | 2.0802 |
| −1.0978 | 7.2901 | 0.9434 |
| −1.0741 | 7.2901 | 1.0042 |
| −1.1074 | 7.2901 | 1.1496 |
| −1.1800 | 7.2901 | 1.2095 |
| −1.2636 | 7.2901 | 1.2660 |
| −1.3457 | 7.2901 | 1.3261 |
| −1.4266 | 7.2901 | 1.3839 |

TABLE I-continued

| X | Y | Z |
|---|---|---|
| −1.5079 | 7.2901 | 1.4409 |
| −1.5911 | 7.2901 | 1.4945 |
| −1.6761 | 7.2901 | 1.5457 |
| −1.7625 | 7.2901 | 1.5943 |
| −1.8503 | 7.2901 | 1.6419 |
| −1.9378 | 7.2901 | 1.6901 |
| −2.0251 | 7.2901 | 1.7380 |
| −2.1132 | 7.2901 | 1.7847 |
| −2.2008 | 7.2901 | 1.8326 |
| −2.2884 | 7.2901 | 1.8799 |
| −2.3761 | 7.2901 | 1.9269 |
| −2.4643 | 7.2901 | 1.9722 |
| −2.5536 | 7.2901 | 2.0153 |
| −2.6439 | 7.2901 | 2.0557 |
| −2.7361 | 7.2901 | 2.0905 |
| −2.8298 | 7.2901 | 2.1163 |
| −2.9177 | 7.2901 | 2.1151 |
| −2.9556 | 7.2901 | 2.0805 |
| −1.0824 | 7.3901 | 0.8964 |
| −1.0432 | 7.3901 | 0.9892 |
| −1.0663 | 7.3901 | 1.0977 |
| −1.1352 | 7.3901 | 1.1621 |
| −1.2127 | 7.3901 | 1.2241 |
| −1.2948 | 7.3901 | 1.2797 |
| −1.3763 | 7.3901 | 1.3407 |
| −1.4558 | 7.3901 | 1.3991 |
| −1.5382 | 7.3901 | 1.4546 |
| −1.6210 | 7.3901 | 1.5084 |
| −1.7065 | 7.3901 | 1.5583 |
| −1.7931 | 7.3901 | 1.6074 |
| −1.8803 | 7.3901 | 1.6553 |
| −1.9678 | 7.3901 | 1.7035 |
| −2.0551 | 7.3901 | 1.7518 |
| −2.1418 | 7.3901 | 1.8006 |
| −2.2294 | 7.3901 | 1.8474 |
| −2.3173 | 7.3901 | 1.8947 |
| −2.4045 | 7.3901 | 1.9425 |
| −2.4922 | 7.3901 | 1.9890 |
| −2.5804 | 7.3901 | 2.0337 |
| −2.6707 | 7.3901 | 2.0729 |
| −2.7636 | 7.3901 | 2.1055 |
| −2.8546 | 7.3901 | 2.1226 |
| −2.9369 | 7.3901 | 2.0821 |
| −2.9400 | 7.3901 | 2.0772 |
| −1.0555 | 7.4900 | 0.8661 |
| −1.0136 | 7.4900 | 0.9601 |
| −1.0320 | 7.4900 | 1.0678 |
| −1.1073 | 7.4900 | 1.1251 |
| −1.1832 | 7.4900 | 1.1910 |
| −1.2661 | 7.4900 | 1.2479 |
| −1.3472 | 7.4900 | 1.3123 |
| −1.4271 | 7.4900 | 1.3714 |
| −1.5086 | 7.4900 | 1.4282 |
| −1.5909 | 7.4900 | 1.4830 |
| −1.6759 | 7.4900 | 1.5340 |
| −1.7617 | 7.4900 | 1.5842 |
| −1.8482 | 7.4900 | 1.6333 |
| −1.9352 | 7.4900 | 1.6817 |
| −2.0222 | 7.4900 | 1.7302 |
| −2.1096 | 7.4900 | 1.7780 |
| −2.1965 | 7.4900 | 1.8268 |
| −2.2839 | 7.4900 | 1.8743 |
| −2.3711 | 7.4900 | 1.9230 |
| −2.4574 | 7.4900 | 1.9722 |
| −2.5444 | 7.4900 | 2.0194 |
| −2.6328 | 7.4900 | 2.0629 |
| −2.7242 | 7.4900 | 2.0995 |
| −2.8159 | 7.4900 | 2.1233 |
| −2.9020 | 7.4900 | 2.1041 |
| −2.9211 | 7.4900 | 2.0805 |
| −1.0332 | 7.5900 | 0.8227 |
| −0.9901 | 7.5900 | 0.9174 |
| −0.9912 | 7.5900 | 1.0238 |
| −1.0628 | 7.5900 | 1.0812 |
| −1.1421 | 7.5900 | 1.1439 |
| −1.2212 | 7.5900 | 1.2032 |
| −1.3006 | 7.5900 | 1.2648 |

TABLE I-continued

| X | Y | Z |
|---|---|---|
| −1.3781 | 7.5900 | 1.3269 |
| −1.4579 | 7.5900 | 1.3852 |
| −1.5395 | 7.5900 | 1.4408 |
| −1.6241 | 7.5900 | 1.4931 |
| −1.7078 | 7.5900 | 1.5471 |
| −1.7929 | 7.5900 | 1.5970 |
| −1.8805 | 7.5900 | 1.6448 |
| −1.9674 | 7.5900 | 1.6946 |
| −2.0537 | 7.5900 | 1.7444 |
| −2.1401 | 7.5900 | 1.7921 |
| −2.2295 | 7.5900 | 1.8383 |
| −2.3144 | 7.5900 | 1.8921 |
| −2.4013 | 7.5900 | 1.9422 |
| −2.4871 | 7.5900 | 1.9925 |
| −2.5740 | 7.5900 | 2.0391 |
| −2.6630 | 7.5900 | 2.0813 |
| −2.7552 | 7.5900 | 2.1142 |
| −2.8440 | 7.5900 | 2.1239 |
| −2.9023 | 7.5900 | 2.0869 |
| −1.0102 | 7.6901 | 0.7908 |
| −1.9631 | 7.6901 | 0.8850 |
| −0.9731 | 7.6901 | 0.9949 |
| −1.0455 | 7.6901 | 1.0535 |
| −1.1232 | 7.6901 | 1.1176 |
| −1.2020 | 7.6901 | 1.1772 |
| −1.2806 | 7.6901 | 1.2396 |
| −1.3583 | 7.6901 | 1.3014 |
| −1.4377 | 7.6901 | 1.3610 |
| −1.5179 | 7.6901 | 1.4185 |
| −1.6015 | 7.6901 | 1.4710 |
| −1.6872 | 7.6901 | 1.5233 |
| −1.7703 | 7.6901 | 1.5771 |
| −1.8564 | 7.6901 | 1.6262 |
| −1.9433 | 7.6901 | 1.6768 |
| −2.0291 | 7.6901 | 1.7272 |
| −2.1154 | 7.6901 | 1.7763 |
| −2.2024 | 7.6901 | 1.8257 |
| −2.2876 | 7.6901 | 1.8789 |
| −2.3711 | 7.6901 | 1.9312 |
| −2.4586 | 7.6901 | 1.9782 |
| −2.5460 | 7.6901 | 2.0282 |
| −2.6332 | 7.6901 | 2.0729 |
| −2.7244 | 7.6901 | 2.1095 |
| −2.8145 | 7.6901 | 2.1271 |
| −2.8852 | 7.6901 | 2.0930 |
| −2.8893 | 7.6901 | 2.0851 |
| −0.9856 | 7.7901 | 0.7567 |
| −0.9429 | 7.7901 | 0.8436 |
| −0.9400 | 7.7901 | 0.9496 |
| −1.0103 | 7.7901 | 1.0080 |
| −1.0890 | 7.7901 | 1.0721 |
| −1.1661 | 7.7901 | 1.1342 |
| −1.2446 | 7.7901 | 1.1959 |
| −1.3224 | 7.7901 | 1.2586 |
| −1.4007 | 7.7901 | 1.3198 |
| −1.4803 | 7.7901 | 1.3791 |
| −1.5611 | 7.7901 | 1.4365 |
| −1.6440 | 7.7901 | 1.4906 |
| −1.7283 | 7.7901 | 1.5430 |
| −1.8137 | 7.7901 | 1.5939 |
| −1.8998 | 7.7901 | 1.6442 |
| −1.9860 | 7.7901 | 1.6951 |
| −2.0708 | 7.7901 | 1.7477 |
| −2.1563 | 7.7901 | 1.7987 |
| −2.2415 | 7.7901 | 1.8511 |
| −2.3263 | 7.7901 | 1.9021 |
| −2.4133 | 7.7901 | 1.9502 |
| −2.5000 | 7.7901 | 2.0000 |
| −2.5859 | 7.7901 | 2.0490 |
| −2.6747 | 7.7901 | 2.0915 |
| −2.7654 | 7.7901 | 2.1226 |
| −2.8515 | 7.7901 | 2.1179 |
| −2.8736 | 7.7901 | 2.0930 |
| −0.9551 | 7.8900 | 0.7295 |
| −0.9182 | 7.8900 | 0.8025 |
| −0.9395 | 7.8900 | 0.9332 |
| −1.0120 | 7.8900 | 0.9932 |

TABLE I-continued

| X | Y | Z |
|---|---|---|
| −1.0906 | 7.8900 | 1.0567 |
| −1.1670 | 7.8900 | 1.1203 |
| −1.2444 | 7.8900 | 1.1830 |
| −1.3214 | 7.8900 | 1.2460 |
| −1.4001 | 7.8900 | 1.3066 |
| −1.4796 | 7.8900 | 1.3669 |
| −1.5586 | 7.8900 | 1.4266 |
| −1.6400 | 7.8900 | 1.4825 |
| −1.7236 | 7.8900 | 1.5353 |
| −1.8094 | 7.8900 | 1.5859 |
| −1.8945 | 7.8900 | 1.6386 |
| −1.9796 | 7.8900 | 1.6905 |
| −2.0644 | 7.8900 | 1.7426 |
| −2.1501 | 7.8900 | 1.7935 |
| −2.2351 | 7.8900 | 1.8459 |
| −2.3201 | 7.8900 | 1.8971 |
| −2.4059 | 7.8900 | 1.9473 |
| −2.4919 | 7.8900 | 1.9977 |
| −2.5777 | 7.8900 | 2.0470 |
| −2.6657 | 7.8900 | 2.0914 |
| −2.7555 | 7.8900 | 2.1235 |
| −2.8419 | 7.8900 | 2.1174 |
| −2.8673 | 7.8900 | 2.0856 |
| −0.9185 | 7.9900 | 0.7120 |
| −0.8844 | 7.9900 | 0.7915 |
| −0.9086 | 7.9900 | 0.8904 |
| −0.9795 | 7.9900 | 0.9522 |
| −1.0575 | 7.9900 | 1.0157 |
| −1.1345 | 7.9900 | 1.0786 |
| −1.2113 | 7.9900 | 1.1419 |
| −1.2888 | 7.9900 | 1.2045 |
| −1.3656 | 7.9900 | 1.2673 |
| −1.4451 | 7.9900 | 1.3272 |
| −1.5237 | 7.9900 | 1.3886 |
| −1.6032 | 7.9900 | 1.4474 |
| −1.6845 | 7.9900 | 1.5036 |
| −1.7682 | 7.9900 | 1.5569 |
| −1.8521 | 7.9900 | 1.6104 |
| −1.9370 | 7.9900 | 1.6623 |
| −2.0219 | 7.9900 | 1.7148 |
| −2.1065 | 7.9900 | 1.7670 |
| −2.1916 | 7.9900 | 1.8184 |
| −2.2770 | 7.9900 | 1.8696 |
| −2.3623 | 7.9900 | 1.9207 |
| −2.4476 | 7.9900 | 1.9718 |
| −2.5329 | 7.9900 | 2.0229 |
| −2.6185 | 7.9900 | 2.0720 |
| −2.7073 | 7.9900 | 2.1126 |
| −2.7947 | 7.9900 | 2.1285 |
| −2.8534 | 7.9900 | 2.0940 |
| −0.9033 | 8.0901 | 0.6622 |
| −0.8644 | 8.0901 | 0.7634 |
| −0.8817 | 8.0901 | 0.8495 |
| −0.9513 | 8.0901 | 0.9116 |
| −1.0288 | 8.0901 | 0.9760 |
| −1.1052 | 8.0901 | 1.0395 |
| −1.1819 | 8.0901 | 1.1026 |
| −1.2594 | 8.0901 | 1.1650 |
| −1.3362 | 8.0901 | 1.2284 |
| −1.4143 | 8.0901 | 1.2898 |
| −1.4927 | 8.0901 | 1.3513 |
| −1.5710 | 8.0901 | 1.4121 |
| −1.6507 | 8.0901 | 1.4711 |
| −1.7315 | 8.0901 | 1.5281 |
| −1.8149 | 8.0901 | 1.5821 |
| −1.8983 | 8.0901 | 1.6364 |
| −1.9830 | 8.0901 | 1.6887 |
| −2.0677 | 8.0901 | 1.7409 |
| −2.1531 | 8.0901 | 1.7927 |
| −2.2375 | 8.0901 | 1.8460 |
| −2.3223 | 8.0901 | 1.8981 |
| −2.4065 | 8.0901 | 1.9506 |
| −2.4926 | 8.0901 | 2.0010 |
| −2.5769 | 8.0901 | 2.0522 |
| −2.6665 | 8.0901 | 2.1001 |
| −2.7461 | 8.0901 | 2.1300 |
| −2.8695 | 8.0901 | 2.1249 |

TABLE I-continued

| X | Y | Z |
|---|---|---|
| −2.8580 | 8.0901 | 2.1387 |
| −0.8692 | 8.1900 | 0.6398 |
| −0.8448 | 8.1900 | 0.7003 |
| −0.8676 | 8.1900 | 0.8184 |
| −0.9383 | 8.1900 | 0.8811 |
| −1.0145 | 8.1900 | 0.9468 |
| −1.0908 | 8.1900 | 1.0103 |
| −1.1672 | 8.1900 | 1.0739 |
| −1.2451 | 8.1900 | 1.1361 |
| −1.3214 | 8.1900 | 1.2004 |
| −1.3989 | 8.1900 | 1.2628 |
| −1.4761 | 8.1900 | 1.3255 |
| −1.5549 | 8.1900 | 1.3863 |
| −1.6329 | 8.1900 | 1.4479 |
| −1.7130 | 8.1900 | 1.5059 |
| −1.7946 | 8.1900 | 1.5625 |
| −1.8770 | 8.1900 | 1.6176 |
| −1.9615 | 8.1900 | 1.6704 |
| −2.0457 | 8.1900 | 1.7240 |
| −2.1300 | 8.1900 | 1.7770 |
| −2.2141 | 8.1900 | 1.8308 |
| −2.2980 | 8.1900 | 1.8843 |
| −2.3821 | 8.1900 | 1.9374 |
| −2.4670 | 8.1900 | 1.9893 |
| −2.5518 | 8.1900 | 2.0412 |
| −2.6376 | 8.1900 | 2.0897 |
| −2.7263 | 8.1900 | 2.1259 |
| −2.8130 | 8.1900 | 2.1207 |
| −2.8256 | 8.1900 | 2.1089 |
| −0.8625 | 8.2900 | 0.5807 |
| −0.8198 | 8.2900 | 0.6580 |
| −0.8357 | 8.2900 | 0.7681 |
| −0.9074 | 8.2900 | 0.8295 |
| −0.9821 | 8.2900 | 0.8982 |
| −1.0570 | 8.2900 | 0.9628 |
| −1.1329 | 8.2900 | 1.0268 |
| −1.2111 | 8.2900 | 1.0890 |
| −1.2869 | 8.2900 | 1.1543 |
| −1.3635 | 8.2900 | 1.2178 |
| −1.4402 | 8.2900 | 1.2815 |
| −1.5180 | 8.2900 | 1.3436 |
| −1.5958 | 8.2900 | 1.4058 |
| −1.6745 | 8.2900 | 1.4665 |
| −1.7539 | 8.2900 | 1.5259 |
| −1.8350 | 8.2900 | 1.5826 |
| −1.9182 | 8.2900 | 1.6371 |
| −2.0023 | 8.2900 | 1.6910 |
| −2.0858 | 8.2900 | 1.7456 |
| −2.1692 | 8.2900 | 1.8000 |
| −2.2528 | 8.2900 | 1.8547 |
| −2.3352 | 8.2900 | 1.9101 |
| −2.4192 | 8.2900 | 1.9630 |
| −2.5039 | 8.2900 | 2.0154 |
| −2.5888 | 8.2900 | 2.0663 |
| −2.6761 | 8.2900 | 2.1116 |
| −2.7625 | 8.2900 | 2.1345 |
| −2.8160 | 8.2900 | 2.1122 |
| −0.8218 | 8.3900 | 0.5677 |
| −0.7917 | 8.3900 | 0.6381 |
| −0.9116 | 8.3900 | 0.8083 |
| −0.9850 | 8.3900 | 0.8779 |
| −1.0586 | 8.3900 | 0.9434 |
| −1.1350 | 8.3900 | 1.0071 |
| −1.2119 | 8.3900 | 1.0709 |
| −1.2876 | 8.3900 | 1.1361 |
| −1.3628 | 8.3900 | 1.2012 |
| −1.4390 | 8.3900 | 1.2650 |
| −1.5164 | 8.3900 | 1.3275 |
| −1.5944 | 8.3900 | 1.3898 |
| −1.6718 | 8.3900 | 1.4515 |
| −1.7524 | 8.3900 | 1.5100 |
| −1.8313 | 8.3900 | 1.5707 |
| −1.9128 | 8.3900 | 1.6266 |
| −1.9966 | 8.3900 | 1.6815 |
| −2.0791 | 8.3900 | 1.7376 |
| −2.1624 | 8.3900 | 1.7922 |
| −2.2454 | 8.3900 | 1.8483 |

TABLE I-continued

| X | Y | Z |
|---|---|---|
| −2.3271 | 8.3900 | 1.9050 |
| −2.4099 | 8.3900 | 1.9595 |
| −2.4941 | 8.3900 | 2.0130 |
| −2.5780 | 8.3900 | 2.0638 |
| −2.6680 | 8.3900 | 2.1117 |
| −2.7468 | 8.3900 | 2.1375 |
| −2.8533 | 8.3900 | 2.1187 |
| −2.8468 | 8.3900 | 2.1267 |
| −0.8087 | 8.4901 | 0.5163 |
| −0.7769 | 8.4901 | 0.5709 |
| −0.8013 | 8.4901 | 0.6911 |
| −0.8759 | 8.4901 | 0.7514 |
| −0.9495 | 8.4901 | 0.8224 |
| −1.0235 | 8.4901 | 0.8891 |
| −1.0990 | 8.4901 | 0.9541 |
| −1.1751 | 8.4901 | 1.0183 |
| −1.2511 | 8.4901 | 1.0830 |
| −1.3254 | 8.4901 | 1.1496 |
| −1.3999 | 8.4901 | 1.2147 |
| −1.4772 | 8.4901 | 1.2776 |
| −1.5536 | 8.4901 | 1.3414 |
| −1.6311 | 8.4901 | 1.4033 |
| −1.7092 | 8.4901 | 1.4650 |
| −1.7875 | 8.4901 | 1.5259 |
| −1.8670 | 8.4901 | 1.5850 |
| −1.9483 | 8.4901 | 1.6419 |
| −2.1127 | 8.4901 | 1.7548 |
| −2.1950 | 8.4901 | 1.8107 |
| −2.2773 | 8.4901 | 1.8675 |
| −2.3581 | 8.4901 | 1.9258 |
| −2.4394 | 8.4901 | 1.9817 |
| −2.5237 | 8.4901 | 2.0337 |
| −2.6094 | 8.4901 | 2.0840 |
| −2.6958 | 8.4901 | 2.1261 |
| −2.7841 | 8.4901 | 2.1302 |
| −2.8154 | 8.4901 | 2.0968 |
| −0.7848 | 8.5900 | 0.4795 |
| −0.7552 | 8.5900 | 0.5499 |
| −0.7687 | 8.5900 | 0.6364 |
| −0.8404 | 8.5900 | 0.6961 |
| −0.9160 | 8.5900 | 0.7649 |
| −0.9891 | 8.5900 | 0.8319 |
| −1.0630 | 8.5900 | 0.8988 |
| −1.1375 | 8.5900 | 0.9643 |
| −1.2132 | 8.5900 | 1.0294 |
| −1.2871 | 8.5900 | 1.0960 |
| −1.3626 | 8.5900 | 1.1607 |
| −1.4371 | 8.5900 | 1.2267 |
| −1.5139 | 8.5900 | 1.2899 |
| −1.5897 | 8.5900 | 1.3544 |
| −1.6671 | 8.5900 | 1.4167 |
| −1.7439 | 8.5900 | 1.4797 |
| −1.8225 | 8.5900 | 1.5400 |
| −1.9015 | 8.5900 | 1.5997 |
| −1.9834 | 8.5900 | 1.6562 |
| −2.0651 | 8.5900 | 1.7141 |
| −2.1460 | 8.5900 | 1.7720 |
| −2.2277 | 8.5900 | 1.8291 |
| −2.3089 | 8.5900 | 1.8867 |
| −2.3903 | 8.5900 | 1.9439 |
| −2.4716 | 8.5900 | 2.0011 |
| −2.5540 | 8.5900 | 2.0535 |
| −2.6428 | 8.5900 | 2.1041 |
| −2.7205 | 8.5900 | 2.1372 |
| −2.8514 | 8.5900 | 2.1078 |
| −2.8372 | 8.5900 | 2.1286 |
| −0.7808 | 8.6900 | 0.4090 |
| −0.7390 | 8.6900 | 0.5021 |
| −0.7608 | 8.6900 | 0.6021 |
| −0.8324 | 8.6900 | 0.6632 |
| −0.9088 | 8.6900 | 0.7305 |
| −0.9818 | 8.6900 | 0.7984 |
| −1.0552 | 8.6900 | 0.8662 |
| −1.1282 | 8.6900 | 0.9332 |
| −1.2035 | 8.6900 | 0.9981 |
| −1.2780 | 8.6900 | 1.0648 |
| −1.3515 | 8.6900 | 1.1312 |

TABLE I-continued

| X | Y | Z |
|---|---|---|
| −1.4269 | 8.6900 | 1.1960 |
| −1.5022 | 8.6900 | 1.2615 |
| −1.5777 | 8.6900 | 1.3261 |
| −1.6536 | 8.6900 | 1.3902 |
| −1.7302 | 8.6900 | 1.4534 |
| −1.8075 | 8.6900 | 1.5157 |
| −1.8856 | 8.6900 | 1.5769 |
| −1.9653 | 8.6900 | 1.6356 |
| −2.0470 | 8.6900 | 1.6930 |
| −2.1276 | 8.6900 | 1.7520 |
| −2.2080 | 8.6900 | 1.8104 |
| −2.2889 | 8.6900 | 1.8684 |
| −2.3693 | 8.6900 | 1.9269 |
| −2.4510 | 8.6900 | 1.9836 |
| −2.5323 | 8.6900 | 2.0398 |
| −2.6172 | 8.6900 | 2.0910 |
| −2.7017 | 8.6900 | 2.1314 |
| −2.7927 | 8.6900 | 2.1177 |
| −2.8034 | 8.6900 | 2.1045 |
| −0.7423 | 8.7900 | 0.4034 |
| −0.7183 | 8.7900 | 0.4533 |
| −0.7496 | 8.7900 | 0.5659 |
| −0.8207 | 8.7900 | 0.6288 |
| −0.8995 | 8.7900 | 0.6926 |
| −0.9721 | 8.7900 | 0.7622 |
| −1.0454 | 8.7900 | 0.8307 |
| −1.1183 | 8.7900 | 0.8986 |
| −1.1920 | 8.7900 | 0.9652 |
| −1.2660 | 8.7900 | 1.0313 |
| −1.3404 | 8.7900 | 1.0976 |
| −1.4138 | 8.7900 | 1.1643 |
| −1.4891 | 8.7900 | 1.2292 |
| −1.5641 | 8.7900 | 1.2952 |
| −1.6388 | 8.7900 | 1.3603 |
| −1.7148 | 8.7900 | 1.4243 |
| −1.7909 | 8.7900 | 1.4881 |
| −1.8679 | 8.7900 | 1.5503 |
| −1.9460 | 8.7900 | 1.6111 |
| −2.0268 | 8.7900 | 1.6693 |
| −2.1067 | 8.7900 | 1.7289 |
| −2.1870 | 8.7900 | 1.7876 |
| −2.2668 | 8.7900 | 1.8470 |
| −2.3469 | 8.7900 | 1.9057 |
| −2.4273 | 8.7900 | 1.9641 |
| −2.5081 | 8.7900 | 2.0210 |
| −2.5914 | 8.7900 | 2.0744 |
| −2.6764 | 8.7900 | 2.1210 |
| −2.7634 | 8.7900 | 2.1346 |
| −2.7997 | 8.7900 | 2.1082 |
| −0.7290 | 8.8901 | 0.3491 |
| −0.7002 | 8.8901 | 0.4205 |
| −0.7181 | 8.8901 | 0.5118 |
| −0.7886 | 8.8901 | 0.5717 |
| −0.8698 | 8.8901 | 0.6342 |
| −0.9421 | 8.8901 | 0.7073 |
| −1.0162 | 8.8901 | 0.7767 |
| −1.0887 | 8.8901 | 0.8455 |
| −1.1612 | 8.8901 | 0.9132 |
| −1.2352 | 8.8901 | 0.9794 |
| −1.3094 | 8.8901 | 1.0461 |
| −1.3825 | 8.8901 | 1.1135 |
| −1.4563 | 8.8901 | 1.1798 |
| −1.5309 | 8.8901 | 1.2457 |
| −1.6056 | 8.8901 | 1.3116 |
| −1.6801 | 8.8901 | 1.3776 |
| −1.7546 | 8.8901 | 1.4428 |
| −1.8316 | 8.8901 | 1.5051 |
| −1.9081 | 8.8901 | 1.5683 |
| −1.9866 | 8.8901 | 1.6285 |
| −2.0670 | 8.8901 | 1.6874 |
| −2.1467 | 8.8901 | 1.7474 |
| −2.2256 | 8.8901 | 1.8080 |
| −2.3049 | 8.8901 | 1.8678 |
| −2.3844 | 8.8901 | 1.9273 |
| −2.4647 | 8.8901 | 1.9861 |
| −2.5447 | 8.8901 | 2.0423 |
| −2.6312 | 8.8901 | 2.0964 |

TABLE I-continued

| X | Y | Z |
|---|---|---|
| −2.7055 | 8.8901 | 2.1353 |
| −2.8468 | 8.8901 | 2.1033 |
| −2.8244 | 8.8901 | 2.1365 |
| −0.7101 | 8.9901 | 0.3113 |
| −0.6792 | 8.9901 | 0.3664 |
| −0.7073 | 8.9901 | 0.4784 |
| −0.7784 | 8.9901 | 0.5407 |
| −0.8563 | 8.9901 | 0.6050 |
| −0.9310 | 8.9901 | 0.6718 |
| −1.0038 | 8.9901 | 0.7404 |
| −1.0753 | 8.9901 | 0.8098 |
| −1.1483 | 8.9901 | 0.8773 |
| −1.2212 | 8.9901 | 0.9450 |
| −1.2950 | 8.9901 | 1.0117 |
| −1.3683 | 8.9901 | 1.0796 |
| −1.4408 | 8.9901 | 1.1472 |
| −1.5154 | 8.9901 | 1.2130 |
| −1.5895 | 8.9901 | 1.2801 |
| −1.6629 | 8.9901 | 1.3470 |
| −1.7371 | 8.9901 | 1.4129 |
| −1.8122 | 8.9901 | 1.4776 |
| −1.8882 | 8.9901 | 1.5411 |
| −1.9656 | 8.9901 | 1.6027 |
| −2.0455 | 8.9901 | 1.6622 |
| −2.1240 | 8.9901 | 1.7241 |
| −2.2019 | 8.9901 | 1.7856 |
| −2.2806 | 8.9901 | 1.8462 |
| −2.3596 | 8.9901 | 1.9065 |
| −2.4388 | 8.9901 | 1.9668 |
| −2.5182 | 8.9901 | 2.0256 |
| −2.6008 | 8.9901 | 2.0800 |
| −2.6848 | 8.9901 | 2.1270 |
| −2.7706 | 8.9901 | 2.1369 |
| −2.7893 | 8.9901 | 2.1177 |
| −0.6864 | 9.0901 | 0.2798 |
| −0.6630 | 9.0901 | 0.3423 |
| −0.6794 | 9.0901 | 0.4292 |
| −0.7497 | 9.0901 | 0.4903 |
| −0.8275 | 9.0901 | 0.5547 |
| −0.9033 | 9.0901 | 0.6195 |
| −0.9776 | 9.0901 | 0.6871 |
| −1.0495 | 9.0901 | 0.7562 |
| −1.1221 | 9.0901 | 0.8242 |
| −1.1948 | 9.0901 | 0.8924 |
| −1.2674 | 9.0901 | 0.9601 |
| −1.3412 | 9.0901 | 1.0271 |
| −1.4135 | 9.0901 | 1.0958 |
| −1.4858 | 9.0901 | 1.1636 |
| −1.5592 | 9.0901 | 1.2308 |
| −1.6330 | 9.0901 | 1.2977 |
| −1.7063 | 9.0901 | 1.3651 |
| −1.7796 | 9.0901 | 1.4317 |
| −1.8549 | 9.0901 | 1.4959 |
| −1.9314 | 9.0901 | 1.5594 |
| −2.0083 | 9.0901 | 1.6220 |
| −2.0870 | 9.0901 | 1.6829 |
| −2.1655 | 9.0901 | 1.7448 |
| −2.2432 | 9.0901 | 1.8070 |
| −2.3214 | 9.0901 | 1.8681 |
| −2.3999 | 9.0901 | 1.9295 |
| −2.4779 | 9.0901 | 1.9909 |
| −2.5581 | 9.0901 | 2.0475 |
| −2.6428 | 9.0901 | 2.1035 |
| −2.7175 | 9.0901 | 2.1414 |
| −2.8586 | 9.0901 | 2.0797 |
| −2.8343 | 9.0901 | 2.1243 |
| −0.6802 | 9.1901 | 0.2216 |
| −0.6455 | 9.1901 | 0.3055 |
| −0.6664 | 9.1901 | 0.3911 |
| −0.7383 | 9.1901 | 0.4514 |
| −0.8158 | 9.1901 | 0.5163 |
| −0.8917 | 9.1901 | 0.5807 |
| −0.9665 | 9.1901 | 0.6476 |
| −1.0390 | 9.1901 | 0.7158 |
| −1.1116 | 9.1901 | 0.7841 |
| −1.1836 | 9.1901 | 0.8531 |
| −1.2561 | 9.1901 | 0.9210 |

TABLE I-continued

| X | Y | Z |
|---|---|---|
| −1.3288 | 9.1901 | 0.9891 |
| −1.4011 | 9.1901 | 1.0576 |
| −1.4728 | 9.1901 | 1.1263 |
| −1.5452 | 9.1901 | 1.1941 |
| −1.6184 | 9.1901 | 1.2613 |
| −1.6916 | 9.1901 | 1.3288 |
| −1.7645 | 9.1901 | 1.3962 |
| −1.8380 | 9.1901 | 1.4625 |
| −1.9131 | 9.1901 | 1.5272 |
| −1.9888 | 9.1901 | 1.5914 |
| −2.0663 | 9.1901 | 1.6533 |
| −2.1444 | 9.1901 | 1.7151 |
| −2.2226 | 9.1901 | 1.7772 |
| −2.2990 | 9.1901 | 1.8410 |
| −2.3761 | 9.1901 | 1.9033 |
| −2.4539 | 9.1901 | 1.9652 |
| −2.5319 | 9.1901 | 2.0252 |
| −2.6144 | 9.1901 | 2.0818 |
| −2.6937 | 9.1901 | 2.1308 |
| −2.7949 | 9.1901 | 2.1157 |
| −2.8098 | 9.1901 | 2.0947 |
| −2.8115 | 9.1901 | 2.0922 |
| −0.6666 | 9.2901 | 0.1804 |
| −0.6319 | 9.2901 | 0.2517 |
| −0.6521 | 9.2901 | 0.3466 |
| −0.7231 | 9.2901 | 0.4082 |
| −0.8000 | 9.2901 | 0.4735 |
| −0.8755 | 9.2901 | 0.5377 |
| −0.9510 | 9.2901 | 0.6026 |
| −1.0262 | 9.2901 | 0.6695 |
| −1.0960 | 9.2901 | 0.7411 |
| −1.1690 | 9.2901 | 0.8099 |
| −1.2407 | 9.2901 | 0.8790 |
| −1.3141 | 9.2901 | 0.9462 |
| −1.3860 | 9.2901 | 1.0155 |
| −1.4576 | 9.2901 | 1.0841 |
| −1.5296 | 9.2901 | 1.1528 |
| −1.6013 | 9.2901 | 1.2217 |
| −1.6738 | 9.2901 | 1.2898 |
| −1.7461 | 9.2901 | 1.3578 |
| −1.8196 | 9.2901 | 1.4244 |
| −1.8934 | 9.2901 | 1.4909 |
| −1.9677 | 9.2901 | 1.5565 |
| −2.0436 | 9.2901 | 1.6204 |
| −2.1209 | 9.2901 | 1.6830 |
| −2.1984 | 9.2901 | 1.7461 |
| −2.2743 | 9.2901 | 1.8108 |
| −2.3507 | 9.2901 | 1.8739 |
| −2.4279 | 9.2901 | 1.9365 |
| −2.5050 | 9.2901 | 1.9989 |
| −2.5846 | 9.2901 | 2.0573 |
| −2.6665 | 9.2901 | 2.1122 |
| −2.7502 | 9.2901 | 2.1441 |
| −2.8095 | 9.2901 | 2.1017 |
| −2.8095 | 9.2901 | 2.1016 |
| −0.6544 | 9.3900 | 0.1361 |
| −0.6211 | 9.3900 | 0.2133 |
| −0.6328 | 9.3900 | 0.2997 |
| −0.7034 | 9.3900 | 0.3601 |
| −0.7797 | 9.3900 | 0.4266 |
| −0.8556 | 9.3900 | 0.4901 |
| −0.9316 | 9.3900 | 0.5551 |
| −1.0067 | 9.3900 | 0.6215 |
| −1.0787 | 9.3900 | 0.6912 |
| −1.1503 | 9.3900 | 0.7604 |
| −1.2216 | 9.3900 | 0.8299 |
| −1.2942 | 9.3900 | 0.8977 |
| −1.3669 | 9.3900 | 0.9664 |
| −1.4381 | 9.3900 | 1.0361 |
| −1.5092 | 9.3900 | 1.1058 |
| −1.5800 | 9.3900 | 1.1754 |
| −1.6524 | 9.3900 | 1.2441 |
| −1.7229 | 9.3900 | 1.3142 |
| −1.7954 | 9.3900 | 1.3817 |
| −1.8684 | 9.3900 | 1.4496 |
| −1.9417 | 9.3900 | 1.5154 |
| −2.0186 | 9.3900 | 1.5788 |

TABLE I-continued

| X | Y | Z |
|---|---|---|
| −2.0939 | 9.3900 | 1.6447 |
| −2.1695 | 9.3900 | 1.7089 |
| −2.2460 | 9.3900 | 1.7730 |
| −2.3212 | 9.3900 | 1.8382 |
| −2.3973 | 9.3900 | 1.9018 |
| −2.4736 | 9.3900 | 1.9654 |
| −2.5512 | 9.3900 | 2.0264 |
| −2.6317 | 9.3900 | 2.0857 |
| −2.7103 | 9.3900 | 2.1339 |
| −2.8109 | 9.3900 | 2.1105 |
| −2.8247 | 9.3900 | 2.0891 |
| −2.8259 | 9.3900 | 2.0873 |
| −0.6434 | 9.4901 | 0.0974 |
| −0.6063 | 9.4901 | 0.1688 |
| −0.6299 | 9.4901 | 0.2702 |
| −0.7017 | 9.4901 | 0.3314 |
| −0.7791 | 9.4901 | 0.3963 |
| −0.8549 | 9.4901 | 0.4604 |
| −0.9312 | 9.4901 | 0.5248 |
| −1.0064 | 9.4901 | 0.5912 |
| −1.0790 | 9.4901 | 0.6603 |
| −1.1505 | 9.4901 | 0.7297 |
| −1.2223 | 9.4901 | 0.7986 |
| −1.2946 | 9.4901 | 0.8673 |
| −1.3663 | 9.4901 | 0.9362 |
| −1.4381 | 9.4901 | 1.0057 |
| −1.5080 | 9.4901 | 1.0765 |
| −1.5789 | 9.4901 | 1.1462 |
| −1.6492 | 9.4901 | 1.2169 |
| −1.7203 | 9.4901 | 1.2864 |
| −1.7911 | 9.4901 | 1.3561 |
| −1.8630 | 9.4901 | 1.4242 |
| −1.9362 | 9.4901 | 1.4908 |
| −2.0111 | 9.4901 | 1.5562 |
| −2.0858 | 9.4901 | 1.6221 |
| −2.1611 | 9.4901 | 1.6870 |
| −2.2366 | 9.4901 | 1.7520 |
| −2.3116 | 9.4901 | 1.8177 |
| −2.3864 | 9.4901 | 1.8829 |
| −2.4626 | 9.4901 | 1.9465 |
| −2.5394 | 9.4901 | 2.0094 |
| −2.6179 | 9.4901 | 2.0699 |
| −2.6982 | 9.4901 | 2.1241 |
| −2.7826 | 9.4901 | 2.1447 |
| −2.8145 | 9.4901 | 2.1181 |
| −0.6280 | 9.5900 | 0.0594 |
| −0.5959 | 9.5900 | 0.1427 |
| −0.6176 | 9.5900 | 0.2307 |
| −0.6897 | 9.5900 | 0.2908 |
| −0.7665 | 9.5900 | 0.3568 |
| −0.8424 | 9.5900 | 0.4202 |
| −0.9197 | 9.5900 | 0.4839 |
| −0.9945 | 9.5900 | 0.5509 |
| −1.0675 | 9.5900 | 0.6189 |
| −1.1403 | 9.5900 | 0.6870 |
| −1.2119 | 9.5900 | 0.7565 |
| −1.2839 | 9.5900 | 0.8253 |
| −1.3559 | 9.5900 | 0.8943 |
| −1.4271 | 9.5900 | 0.9645 |
| −1.4970 | 9.5900 | 1.0354 |
| −1.5672 | 9.5900 | 1.1059 |
| −1.6365 | 9.5900 | 1.1771 |
| −1.7077 | 9.5900 | 1.2467 |
| −1.7774 | 9.5900 | 1.3180 |
| −1.8481 | 9.5900 | 1.3873 |
| −1.9204 | 9.5900 | 1.4555 |
| −1.9929 | 9.5900 | 1.5232 |
| −2.0673 | 9.5900 | 1.5889 |
| −2.1423 | 9.5900 | 1.6548 |
| −2.2167 | 9.5900 | 1.7209 |
| −2.2914 | 9.5900 | 1.7865 |
| −2.3658 | 9.5900 | 1.8526 |
| −2.4404 | 9.5900 | 1.9180 |
| −2.5160 | 9.5900 | 1.9825 |
| −2.5926 | 9.5900 | 2.0440 |
| −2.6738 | 9.5900 | 2.1037 |
| −2.7474 | 9.5900 | 2.1460 |

TABLE I-continued

| X | Y | Z |
|---|---|---|
| −2.9037 | 9.5900 | 2.0449 |
| −2.8593 | 9.5900 | 2.1356 |
| −0.6029 | 9.6900 | 0.0447 |
| −0.5786 | 9.6900 | 0.1120 |
| −0.6022 | 9.6900 | 0.1888 |
| −0.6744 | 9.6900 | 0.2489 |
| −0.7527 | 9.6900 | 0.3124 |
| −0.8292 | 9.6900 | 0.3760 |
| −0.9054 | 9.6900 | 0.4407 |
| −0.9805 | 9.6900 | 0.5064 |
| −1.0546 | 9.6900 | 0.5735 |
| −1.1273 | 9.6900 | 0.6424 |
| −1.1982 | 9.6900 | 0.7122 |
| −1.2703 | 9.6900 | 0.7807 |
| −1.3421 | 9.6900 | 0.8502 |
| −1.4135 | 9.6900 | 0.9203 |
| −1.4831 | 9.6900 | 0.9913 |
| −1.5534 | 9.6900 | 1.0118 |
| −1.6220 | 9.6900 | 1.1338 |
| −1.6920 | 9.6900 | 1.2041 |
| −1.7621 | 9.6900 | 1.2750 |
| −1.8317 | 9.6900 | 1.3458 |
| −1.9019 | 9.6900 | 1.4157 |
| −1.9733 | 9.6900 | 1.4841 |
| −2.0465 | 9.6900 | 1.5513 |
| −2.1194 | 9.6900 | 1.6188 |
| −2.1941 | 9.6900 | 1.6845 |
| −2.2680 | 9.6900 | 1.7513 |
| −2.3422 | 9.6900 | 1.8176 |
| −2.4156 | 9.6900 | 1.8847 |
| −2.4900 | 9.6900 | 1.9501 |
| −2.5656 | 9.6900 | 2.0137 |
| −2.6444 | 9.6900 | 2.0750 |
| −2.7217 | 9.6900 | 2.1302 |
| −2.8191 | 9.6900 | 2.1374 |
| −2.8287 | 9.6900 | 2.1271 |
| −0.6167 | 9.7900 | −0.0303 |
| −0.5768 | 9.7900 | 0.0373 |
| −0.5844 | 9.7900 | 0.1452 |
| −0.6587 | 9.7900 | 0.2011 |
| −0.7368 | 9.7900 | 0.2667 |
| −0.8125 | 9.7900 | 0.3301 |
| −0.8896 | 9.7900 | 0.3939 |
| −0.9651 | 9.7900 | 0.4599 |
| −1.0387 | 9.7900 | 0.5273 |
| −1.1120 | 9.7900 | 0.5951 |
| −1.1839 | 9.7900 | 0.6643 |
| −1.2559 | 9.7900 | 0.7333 |
| −1.3271 | 9.7900 | 0.8035 |
| −1.3981 | 9.7900 | 0.8737 |
| −1.4679 | 9.7900 | 0.9452 |
| −1.5375 | 9.7900 | 1.0164 |
| −1.6066 | 9.7900 | 1.0876 |
| −1.6767 | 9.7900 | 1.1584 |
| −1.7463 | 9.7900 | 1.2301 |
| −1.8148 | 9.7900 | 1.3020 |
| −1.8841 | 9.7900 | 1.3730 |
| −1.9541 | 9.7900 | 1.4433 |
| −2.0251 | 9.7900 | 1.5127 |
| −2.0966 | 9.7900 | 1.5815 |
| −2.1704 | 9.7900 | 1.6480 |
| −2.2444 | 9.7900 | 1.7146 |
| −2.3186 | 9.7900 | 1.7806 |
| −2.3928 | 9.7900 | 1.8478 |
| −2.4649 | 9.7900 | 1.9159 |
| −2.5395 | 9.7900 | 1.9812 |
| −2.6147 | 9.7900 | 2.0448 |
| −2.6941 | 9.7900 | 2.1066 |
| −2.7667 | 9.7900 | 2.1503 |
| −2.9241 | 9.7900 | 2.0486 |
| −2.8791 | 9.7900 | 2.1439 |
| −0.5902 | 9.8900 | −0.0506 |
| −0.5592 | 9.8900 | 0.0253 |
| −0.5805 | 9.8900 | 0.1143 |
| −0.6546 | 9.8900 | 0.1713 |
| −0.7335 | 9.8900 | 0.2336 |
| −0.8136 | 9.8900 | 0.2933 |

TABLE I-continued

| X | Y | Z |
|---|---|---|
| −0.8889 | 9.8900 | 0.3610 |
| −0.9647 | 9.8900 | 0.4268 |
| −1.0394 | 9.8900 | 0.4936 |
| −1.1120 | 9.8900 | 0.5623 |
| −1.1843 | 9.8900 | 0.6310 |
| −1.2557 | 9.8900 | 0.7007 |
| −1.3266 | 9.8900 | 0.7710 |
| −1.3973 | 9.8900 | 0.8419 |
| −1.4665 | 9.8900 | 0.9137 |
| −1.5365 | 9.8900 | 0.9842 |
| −1.6062 | 9.8900 | 1.0555 |
| −1.6753 | 9.8900 | 1.1273 |
| −1.7442 | 9.8900 | 1.1994 |
| −1.8124 | 9.8900 | 1.2723 |
| −1.8799 | 9.8900 | 1.3452 |
| −1.9487 | 9.8900 | 1.4170 |
| −2.0173 | 9.8900 | 1.4886 |
| −2.0885 | 9.8900 | 1.5573 |
| −2.1616 | 9.8900 | 1.6244 |
| −2.2362 | 9.8900 | 1.6903 |
| −2.3105 | 9.8900 | 1.7574 |
| −2.3828 | 9.8900 | 1.8257 |
| −2.4567 | 9.8900 | 1.8922 |
| −2.5293 | 9.8900 | 1.9604 |
| −2.6037 | 9.8900 | 2.0241 |
| −2.6831 | 9.8900 | 2.0897 |
| −2.7514 | 9.8900 | 2.1394 |
| −2.8861 | 9.8900 | 2.1547 |
| −2.8806 | 9.8900 | 2.1632 |
| −0.5823 | 9.9900 | −0.0814 |
| −0.5450 | 9.9900 | −0.0134 |
| −0.5718 | 9.9900 | 0.0823 |
| −0.6476 | 9.9900 | 0.1381 |
| −0.7286 | 9.9900 | 0.1987 |
| −0.8073 | 9.9900 | 0.2597 |
| −0.8846 | 9.9900 | 0.3234 |
| −0.9604 | 9.9900 | 0.3886 |
| −1.0347 | 9.9900 | 0.4555 |
| −1.1079 | 9.9900 | 0.5231 |
| −1.1802 | 9.9900 | 0.5920 |
| −1.2516 | 9.9900 | 0.6617 |
| −1.3222 | 9.9900 | 0.7323 |
| −1.3923 | 9.9900 | 0.8033 |
| −1.4616 | 9.9900 | 0.8748 |
| −1.5312 | 9.9900 | 0.9462 |
| −1.6000 | 9.9900 | 1.0179 |
| −1.6695 | 9.9900 | 1.0890 |
| −1.7382 | 9.9900 | 1.1615 |
| −1.8063 | 9.9900 | 1.2344 |
| −1.8733 | 9.9900 | 1.3079 |
| −1.9411 | 9.9900 | 1.3800 |
| −2.0109 | 9.9900 | 1.4504 |
| −2.0813 | 9.9900 | 1.5204 |
| −2.1523 | 9.9900 | 1.5899 |
| −2.2243 | 9.9900 | 1.6584 |
| −2.2963 | 9.9900 | 1.7271 |
| −2.3684 | 9.9900 | 1.7958 |
| −2.4405 | 9.9900 | 1.8643 |
| −2.5127 | 9.9900 | 1.9324 |
| −2.5858 | 9.9900 | 1.9995 |
| −2.6603 | 9.9900 | 2.0635 |
| −2.7396 | 9.9900 | 2.1231 |
| −2.8160 | 9.9900 | 2.1637 |
| −2.8668 | 9.9900 | 2.1409 |
| −0.5665 | 10.0900 | −0.1080 |
| −0.5387 | 10.0900 | −0.0388 |
| −0.5511 | 10.0900 | 0.0436 |
| −0.6261 | 10.0900 | 0.0436 |
| −0.6261 | 10.0900 | 0.0958 |
| −0.7099 | 10.0900 | 0.1533 |
| −0.7907 | 10.0900 | 0.2123 |
| −0.8682 | 10.9000 | 0.2761 |
| −0.9447 | 10.0900 | 0.3407 |
| −1.0197 | 10.0900 | 0.4071 |
| −1.0937 | 10.0900 | 0.4743 |
| −1.1659 | 10.0900 | 0.5435 |
| −1.2375 | 10.0900 | 0.6130 |

TABLE I-continued

| X | Y | Z |
|---|---|---|
| −1.3077 | 10.0900 | 0.6838 |
| −1.3780 | 10.0900 | 0.7546 |
| −1.4473 | 10.0900 | 0.8266 |
| −1.5170 | 10.0900 | 0.8979 |
| −1.5863 | 10.0900 | 0.9695 |
| −1.6555 | 10.0900 | 1.0411 |
| −1.7241 | 10.0900 | 1.1134 |
| −1.7921 | 10.0900 | 1.1866 |
| −1.8588 | 10.0900 | 1.2608 |
| −1.9263 | 10.0900 | 1.3333 |
| −1.9951 | 10.0900 | 1.4053 |
| −2.0637 | 10.0900 | 1.4770 |
| −2.1338 | 10.0900 | 1.5473 |
| −2.2044 | 10.0900 | 1.6179 |
| −2.2745 | 10.0900 | 1.6885 |
| −2.3453 | 10.0900 | 1.7581 |
| −2.4172 | 10.0900 | 1.8271 |
| −2.4886 | 10.0900 | 1.8966 |
| −2.5602 | 10.0900 | 1.9649 |
| −2.6345 | 10.0900 | 2.0306 |
| −2.7101 | 10.0900 | 2.0940 |
| −2.7899 | 10.0900 | 2.1491 |
| −2.8279 | 10.0900 | 2.1658 |
| −2.8628 | 10.0900 | 2.1661 |
| −2.8780 | 10.0900 | 2.1474 |
| −0.5630 | 10.1900 | −0.1404 |
| −0.5329 | 10.1900 | −0.0766 |
| −0.5467 | 10.1900 | 0.0135 |
| −0.6222 | 10.1900 | 0.0648 |
| −0.7079 | 10.1900 | 0.1196 |
| −0.7893 | 10.1900 | 0.1787 |
| −0.8670 | 10.1900 | 0.2416 |
| −0.9443 | 10.1900 | 0.3045 |
| −1.0199 | 10.1900 | 0.3703 |
| −1.0936 | 10.1900 | 0.4377 |
| −1.1663 | 10.1900 | 0.5062 |
| −1.2373 | 10.1900 | 0.5765 |
| −1.3078 | 10.1900 | 0.6468 |
| −1.3780 | 10.1900 | 0.7178 |
| −1.4469 | 10.1900 | 0.7901 |
| −1.5158 | 10.1900 | 0.8616 |
| −1.5854 | 10.1900 | 0.9330 |
| −1.6545 | 10.1900 | 1.0044 |
| −1.7240 | 10.1900 | 1.0763 |
| −1.7898 | 10.1900 | 1.1517 |
| −1.8559 | 10.1900 | 1.2259 |
| −1.9221 | 10.1900 | 1.2999 |
| −1.9894 | 10.1900 | 1.3727 |
| −2.0580 | 10.1900 | 1.4445 |
| −2.1266 | 10.1900 | 1.5164 |
| −2.1960 | 10.1900 | 1.5879 |
| −2.2647 | 10.1900 | 1.6599 |
| −2.3345 | 10.1900 | 1.7296 |
| −2.4063 | 10.1900 | 1.7989 |
| −2.4764 | 10.1900 | 1.8698 |
| −2.5469 | 10.1900 | 1.9390 |
| −2.6201 | 10.1900 | 2.0059 |
| −2.6944 | 10.1900 | 2.0711 |
| −2.7717 | 10.1900 | 2.1316 |
| −2.8537 | 10.1900 | 2.1746 |
| −2.8701 | 10.1900 | 2.1761 |
| −2.8816 | 10.1900 | 2.1683 |
| −2.9049 | 10.1900 | 2.1373 |
| −0.5569 | 10.2901 | −0.1666 |
| −0.5143 | 10.2901 | −0.0952 |
| −0.5468 | 10.2901 | −0.0123 |
| −0.6272 | 10.2901 | 0.0362 |
| −0.7137 | 10.2901 | 0.0899 |
| −0.7957 | 10.2901 | 0.1486 |
| −0.8735 | 10.2901 | 0.2116 |
| −0.9510 | 10.2901 | 0.2747 |
| −1.0268 | 10.2901 | 0.3402 |
| −1.1013 | 10.2901 | 0.4071 |
| −1.1736 | 10.2901 | 0.4763 |
| −1.2447 | 10.2901 | 0.5460 |
| −1.3159 | 10.2901 | 0.6163 |
| −1.3854 | 10.2901 | 0.6881 |

TABLE I-continued

| X | Y | Z |
|---|---|---|
| −1.4543 | 10.2901 | 0.7600 |
| −1.5236 | 10.2901 | 0.8317 |
| −1.5926 | 10.2901 | 0.9036 |
| −1.6612 | 10.2901 | 0.9756 |
| −1.7301 | 10.2901 | 1.0482 |
| −1.7958 | 10.2901 | 1.1240 |
| −1.8606 | 10.2901 | 1.1995 |
| −1.9265 | 10.2901 | 1.2735 |
| −1.9937 | 10.2901 | 1.3470 |
| −2.0601 | 10.2901 | 1.4211 |
| −2.1275 | 10.2901 | 1.4935 |
| −2.1964 | 10.2901 | 1.5657 |
| −2.2649 | 10.2901 | 1.6378 |
| −2.3350 | 10.2901 | 1.7081 |
| −2.4051 | 10.2901 | 1.7791 |
| −2.4748 | 10.2901 | 1.8502 |
| −2.5450 | 10.2901 | 1.9205 |
| −2.6162 | 10.2901 | 1.9894 |
| −2.6898 | 10.2901 | 2.0556 |
| −2.7650 | 10.2901 | 2.1192 |
| −2.8455 | 10.2901 | 2.1712 |
| −2.8530 | 10.2901 | 2.1746 |
| −2.8878 | 10.2901 | 2.1809 |
| −2.9070 | 10.2901 | 2.1655 |
| −0.5688 | 10.3901 | −0.1980 |
| −0.5341 | 10.3901 | −0.1394 |
| −0.5311 | 10.3901 | −0.0490 |
| −0.6085 | 10.3901 | −0.0054 |
| −0.6986 | 10.3901 | 0.0444 |
| −0.7819 | 10.3901 | 0.1027 |
| −0.8607 | 10.3901 | 0.1650 |
| −0.9390 | 10.3901 | 0.2274 |
| −1.0155 | 10.3901 | 0.2922 |
| −1.0907 | 10.3901 | 0.3587 |
| −1.1635 | 10.3901 | 0.4276 |
| −1.2355 | 10.3901 | 0.4969 |
| −1.3062 | 10.3901 | 0.5678 |
| −1.3762 | 10.3901 | 0.6391 |
| −1.4453 | 10.3901 | 0.7117 |
| −1.5135 | 10.3901 | 0.7843 |
| −1.5828 | 10.3901 | 0.8561 |
| −1.6510 | 10.3901 | 0.9288 |
| −1.7204 | 10.3901 | 1.0011 |
| −1.7856 | 10.3901 | 1.0777 |
| −1.8504 | 10.3901 | 1.1535 |
| −1.9162 | 10.3901 | 1.2286 |
| −1.9813 | 10.3901 | 1.3039 |
| −2.0474 | 10.3901 | 1.3784 |
| −2.1136 | 10.3901 | 1.4528 |
| −2.1806 | 10.3901 | 1.5263 |
| −2.2485 | 10.3901 | 1.5990 |
| −2.3178 | 10.3901 | 1.6705 |
| −2.3875 | 10.3901 | 1.7422 |
| −2.4564 | 10.3901 | 1.8141 |
| −2.5265 | 10.3901 | 1.8847 |
| −2.5966 | 10.3901 | 1.9553 |
| −2.6683 | 10.3901 | 2.0240 |
| −2.7413 | 10.3901 | 2.0906 |
| −2.8180 | 10.3901 | 2.1510 |
| −2.9012 | 10.3901 | 2.1884 |
| −2.9065 | 10.3901 | 2.1887 |
| −2.9154 | 10.3901 | 2.1824 |
| −2.9465 | 10.3901 | 2.1337 |
| −0.5208 | 10.4900 | −0.0913 |
| −0.6092 | 10.4900 | −0.0443 |
| −0.6971 | 10.4900 | 0.0064 |
| −0.7791 | 10.4900 | 0.0664 |
| −0.8597 | 10.4900 | 0.1267 |
| −0.9389 | 10.4900 | 0.1886 |
| −1.0153 | 10.4900 | 0.2533 |
| −1.0905 | 10.4900 | 0.3197 |
| −1.1634 | 10.4900 | 0.3883 |
| −1.2360 | 10.4900 | 0.4571 |
| −1.3065 | 10.4900 | 0.5284 |
| −1.3758 | 10.4900 | 0.6004 |
| −1.4440 | 10.4900 | 0.6731 |
| −1.5128 | 10.4900 | 0.7454 |

TABLE I-continued

| X | Y | Z |
|---|---|---|
| −1.5807 | 10.4900 | 0.8188 |
| −1.6484 | 10.4900 | 0.8918 |
| −1.7165 | 10.4900 | 0.9650 |
| −1.7824 | 10.4900 | 1.0403 |
| −1.8475 | 10.4900 | 1.1158 |
| −1.9121 | 10.4900 | 1.1918 |
| −1.9769 | 10.4900 | 1.2670 |
| −2.0428 | 10.4900 | 1.3419 |
| −2.1076 | 10.4900 | 1.4178 |
| −2.1729 | 10.4900 | 1.4923 |
| −2.2396 | 10.4900 | 1.5661 |
| −2.3073 | 10.4900 | 1.6392 |
| −2.3753 | 10.4900 | 1.7116 |
| −2.4447 | 10.4900 | 1.7832 |
| −2.5132 | 10.4900 | 1.8555 |
| −2.5829 | 10.4900 | 1.9261 |
| −2.6538 | 10.4900 | 1.9961 |
| −2.7250 | 10.4900 | 2.0651 |
| −2.7992 | 10.4900 | 2.1291 |
| −2.8797 | 10.4900 | 2.1830 |
| −2.9164 | 10.4900 | 2.1962 |
| −2.9396 | 10.4900 | 2.1837 |
| −2.9613 | 10.4900 | 2.1458 |
| 0.0012 | 10.5901 | −0.2223 |
| −0.1004 | 10.5901 | −0.2255 |
| −0.2032 | 10.5901 | −0.2165 |
| −0.3033 | 10.5901 | −0.1995 |
| −0.4012 | 10.5901 | −0.1728 |
| −0.4961 | 10.5901 | −0.1360 |
| −0.5856 | 10.5901 | −0.0909 |
| −0.6758 | 10.5901 | −0.0459 |
| −0.7631 | 10.5901 | 0.0082 |
| −0.8416 | 10.5901 | 0.0705 |
| −0.9213 | 10.5901 | 0.1324 |
| −0.9990 | 10.5901 | 0.1963 |
| −1.0737 | 10.5901 | 0.2638 |
| −1.1447 | 10.5901 | 0.3332 |
| −1.2180 | 10.5901 | 0.4004 |
| −1.2888 | 10.5901 | 0.4715 |
| −1.3580 | 10.5901 | 0.5432 |
| −1.4262 | 10.5901 | 0.6161 |
| −1.4941 | 10.5901 | 0.6887 |
| −1.5620 | 10.5901 | 0.7616 |
| −1.6289 | 10.5901 | 0.8353 |
| −1.6958 | 10.5901 | 0.9092 |
| −1.7622 | 10.5901 | 0.9839 |
| −1.8275 | 10.5901 | 1.0595 |
| −1.8917 | 10.5901 | 1.1359 |
| −1.9561 | 10.5901 | 1.2117 |
| −2.0210 | 10.5901 | 1.2871 |
| −2.0854 | 10.5901 | 1.3632 |
| −2.1504 | 10.5901 | 1.4386 |
| −2.2155 | 10.5901 | 1.5138 |
| −2.2811 | 10.5901 | 1.5885 |
| −2.3476 | 10.5901 | 1.6621 |
| −2.4158 | 10.5901 | 1.7344 |
| −2.4840 | 10.5901 | 1.8072 |
| −2.5526 | 10.5901 | 1.8791 |
| −2.6223 | 10.5901 | 1.9499 |
| −2.6928 | 10.5901 | 2.0203 |
| −2.7638 | 10.5901 | 2.0889 |
| −2.8392 | 10.5901 | 2.1515 |
| −2.9206 | 10.5901 | 2.1997 |
| −2.9393 | 10.5901 | 2.2044 |
| −2.9593 | 10.5901 | 2.1923 |
| −2.9822 | 10.5901 | 2.1469 |
| 0.0017 | 10.6900 | −0.2479 |
| −0.1009 | 10.6900 | −0.2527 |
| −0.2041 | 10.6900 | −0.2421 |
| −0.3041 | 10.6900 | −0.2253 |
| −0.4036 | 10.6900 | −0.2008 |
| −0.4967 | 10.6900 | −0.1620 |
| −0.5923 | 10.6900 | −0.1246 |
| −0.6838 | 10.6900 | −0.0785 |
| −0.7699 | 10.6900 | −0.0251 |
| −0.8504 | 10.6900 | 0.0354 |
| −0.9289 | 10.6900 | 0.0977 |

TABLE I-continued

| X | Y | Z |
|---|---|---|
| −1.0067 | 10.6900 | 0.1612 |
| −1.0813 | 10.6900 | 0.2285 |
| −1.1538 | 10.6900 | 0.2975 |
| −1.2252 | 10.6900 | 0.3672 |
| −1.2959 | 10.6900 | 0.4376 |
| −1.3652 | 10.6900 | 0.5097 |
| −1.4330 | 10.6900 | 0.5828 |
| −1.5012 | 10.6900 | 0.6556 |
| −1.5683 | 10.6900 | 0.7297 |
| −1.6346 | 10.6900 | 0.8043 |
| −1.7001 | 10.6900 | 0.8793 |
| −1.7663 | 10.6900 | 0.9541 |
| −1.8308 | 10.6900 | 1.0307 |
| −1.8946 | 10.6900 | 1.1071 |
| −1.9590 | 10.6900 | 1.1833 |
| −2.0228 | 10.6900 | 1.2597 |
| −2.0872 | 10.6900 | 1.3357 |
| −2.1517 | 10.6900 | 1.4119 |
| −2.2163 | 10.6900 | 1.4877 |
| −2.2814 | 10.6900 | 1.5630 |
| −2.3466 | 10.6900 | 1.6378 |
| −2.4135 | 10.6900 | 1.7112 |
| −2.4807 | 10.6900 | 1.7847 |
| −2.5488 | 10.6900 | 1.8572 |
| −2.6176 | 10.6900 | 1.9290 |
| −2.6876 | 10.6900 | 1.9999 |
| −2.7576 | 10.6900 | 2.0700 |
| −2.8311 | 10.6900 | 2.1353 |
| −2.9092 | 10.6900 | 2.1927 |
| −2.9628 | 10.6900 | 2.2110 |
| −2.9786 | 10.6900 | 2.2035 |
| −2.9970 | 10.6900 | 2.1715 |
| 0.0020 | 10.7900 | −0.2726 |
| −0.1006 | 10.7900 | −0.2787 |
| −0.2037 | 10.7900 | −0.2689 |
| −0.3049 | 10.7900 | −0.2556 |
| −0.4056 | 10.7900 | −0.2298 |
| −0.4981 | 10.7900 | −0.1903 |
| −0.5923 | 10.7900 | 0.1519 |
| −0.6843 | 10.7900 | −0.1105 |
| −0.7738 | 10.7900 | −0.0610 |
| −0.8551 | 10.7900 | −0.0013 |
| −0.9345 | 10.7900 | 0.0607 |
| −1.0116 | 10.7900 | 0.1249 |
| −1.0864 | 10.7900 | 0.1917 |
| −1.1590 | 10.7900 | 0.2604 |
| −1.2302 | 10.7900 | 0.3304 |
| −1.3000 | 10.7900 | 0.4017 |
| −1.3687 | 10.7900 | 0.4737 |
| −1.4372 | 10.7900 | 0.5462 |
| −1.5044 | 10.7900 | 0.6200 |
| −1.5710 | 10.7900 | 0.6942 |
| −1.6366 | 10.7900 | 0.7691 |
| −1.7019 | 10.7900 | 0.8441 |
| −1.7668 | 10.7900 | 0.9199 |
| −1.8313 | 10.7900 | 0.9963 |
| −1.8945 | 10.7900 | 1.0733 |
| −1.9584 | 10.7900 | 1.1496 |
| −2.0218 | 10.7900 | 1.2264 |
| −2.0853 | 10.7900 | 1.3032 |
| −2.1485 | 10.7900 | 1.3800 |
| −2.2126 | 10.7900 | 1.4559 |
| −2.2771 | 10.7900 | 1.5317 |
| −2.3417 | 10.7900 | 1.6071 |
| −2.4076 | 10.7900 | 1.6813 |
| −2.4734 | 10.7900 | 1.7561 |
| −2.5399 | 10.7900 | 1.8297 |
| −2.6082 | 10.7900 | 1.9020 |
| −2.6769 | 10.7900 | 1.9738 |
| −2.7466 | 10.7900 | 2.0443 |
| −2.8179 | 10.7900 | 2.1126 |
| −2.8931 | 10.7900 | 2.1756 |
| −2.9744 | 10.7900 | 2.2194 |
| −2.9877 | 10.7900 | 2.2211 |
| −3.0140 | 10.7900 | 2.1961 |
| −3.0301 | 10.7900 | 2.1635 |
| 0.0021 | 10.8901 | −0.2957 |

TABLE I-continued

| X | Y | Z |
|---|---|---|
| −0.1001 | 10.8901 | −0.3029 |
| −0.2032 | 10.8901 | 0.2987 |
| −0.3038 | 10.8901 | 0.2852 |
| −0.4032 | 10.8901 | −0.2592 |
| −0.4958 | 10.8901 | −0.2197 |
| −0.5899 | 10.8901 | −0.1817 |
| −0.6831 | 10.8901 | 0.1422 |
| −0.7723 | 10.8901 | 0.0945 |
| −0.8595 | 10.8901 | 0.0423 |
| −0.9394 | 10.8901 | 0.0217 |
| −1.0164 | 10.8901 | 0.0869 |
| −1.0914 | 10.8901 | 0.1537 |
| −1.1637 | 10.8901 | 0.2233 |
| −1.2340 | 10.8901 | 0.2942 |
| −1.3044 | 10.8901 | 0.3650 |
| −1.3730 | 10.8901 | 0.4376 |
| −1.4407 | 10.8901 | 0.5111 |
| −1.5077 | 10.8901 | 0.5850 |
| −1.5747 | 10.8901 | 0.6592 |
| −1.6402 | 10.8901 | 0.7345 |
| −1.7054 | 10.8901 | 0.8101 |
| −1.7692 | 10.8901 | 0.8871 |
| −1.8325 | 10.8901 | 0.9642 |
| −1.8959 | 10.8901 | 1.0414 |
| −1.9585 | 10.8901 | 1.1189 |
| −2.0221 | 10.8901 | 1.1955 |
| −2.0850 | 10.8901 | 1.2725 |
| −2.1490 | 10.8901 | 1.3490 |
| −2.2123 | 10.8901 | 1.4259 |
| −2.2764 | 10.8901 | 1.5020 |
| −2.3405 | 10.8901 | 1.5786 |
| −2.4039 | 10.8901 | 1.6549 |
| −2.4694 | 10.8901 | 1.7295 |
| −2.5360 | 10.8901 | 1.8041 |
| −2.6021 | 10.8901 | 1.8782 |
| −2.6708 | 10.8901 | 1.9501 |
| −2.7398 | 10.8901 | 2.0218 |
| −2.8102 | 10.8901 | 2.0916 |
| −2.8825 | 10.8901 | 2.1586 |
| −2.9612 | 10.8901 | 2.2150 |
| −2.9979 | 10.8901 | 2.2294 |
| −3.0286 | 10.8901 | 2.2238 |
| −3.0447 | 10.8901 | 2.1994 |
| −0.0006 | 10.9901 | −0.3234 |
| −0.1029 | 10.9901 | −0.3280 |
| −0.2055 | 10.9901 | −0.3248 |
| −0.3058 | 10.9901 | −0.3104 |
| −0.4057 | 10.9901 | −0.2868 |
| −0.4989 | 10.9901 | −0.2482 |
| −0.5947 | 10.9901 | −0.2119 |
| −0.6875 | 10.9901 | −0.1712 |
| −0.7767 | 10.9901 | −0.1253 |
| −0.8650 | 10.9901 | −0.0754 |
| −0.9462 | 10.9901 | −0.0129 |
| −1.0240 | 10.9901 | 0.0517 |
| −1.0982 | 10.9901 | 0.1193 |
| −1.1711 | 10.9901 | 0.1877 |
| −1.2422 | 10.9901 | 0.2583 |
| −1.3114 | 10.9901 | 0.3303 |
| −1.3796 | 10.9901 | 0.4031 |
| −1.4464 | 10.9901 | 0.4772 |
| −1.5124 | 10.9901 | 0.5518 |
| −1.5783 | 10.9901 | 0.6267 |
| −1.6427 | 10.9901 | 0.7028 |
| −1.7072 | 10.9901 | 0.7783 |
| −1.7715 | 10.9901 | 0.8547 |
| −1.8341 | 10.9901 | 0.9323 |
| −1.8974 | 10.9901 | 1.0092 |
| −1.9598 | 10.9901 | 1.0872 |
| −2.0223 | 10.9901 | 1.1642 |
| −2.0862 | 10.9901 | 1.2407 |
| −2.1495 | 10.9901 | 1.3177 |
| −2.2131 | 10.9901 | 1.3945 |
| −2.2763 | 10.9901 | 1.4714 |
| −2.3397 | 10.9901 | 1.5485 |
| −2.4021 | 10.9901 | 1.6257 |
| −2.4663 | 10.9901 | 1.7015 |

TABLE I-continued

| X | Y | Z |
|---|---|---|
| −2.5307 | 10.9901 | 1.7773 |
| −2.5967 | 10.9901 | 1.8515 |
| −2.6641 | 10.9901 | 1.9245 |
| −2.7326 | 10.9901 | 1.9966 |
| −2.8013 | 10.9901 | 2.0683 |
| −2.8723 | 10.9901 | 2.1366 |
| −2.9475 | 10.9901 | 2.2003 |
| −3.0207 | 10.9901 | 2.2396 |
| −3.0573 | 10.9901 | 2.2337 |
| −3.0768 | 10.9901 | 2.2036 |
| 0.0008 | 11.0900 | −0.3399 |
| −0.1016 | 11.0900 | −0.3419 |
| −0.2031 | 11.0900 | −0.3397 |
| −0.3035 | 11.0900 | −0.3320 |
| −0.4057 | 11.0900 | −0.3161 |
| −0.5007 | 11.0900 | −0.2793 |
| −0.5797 | 11.0900 | −0.2515 |
| −0.6728 | 11.0900 | −0.2101 |
| −0.7629 | 11.0900 | −0.1656 |
| −0.8509 | 11.0900 | −0.1171 |
| −0.9370 | 11.0900 | −0.0625 |
| −1.0142 | 11.0900 | 0.0031 |
| −1.0898 | 11.0900 | 0.0703 |
| −1.1630 | 11.0900 | 0.1389 |
| −1.2345 | 11.0900 | 0.2090 |
| −1.3042 | 11.0900 | 0.2810 |
| −1.3720 | 11.0900 | 0.3544 |
| −1.4385 | 11.0900 | 0.4282 |
| −1.5056 | 11.0900 | 0.5025 |
| −1.5699 | 11.0900 | 0.5794 |
| −1.6334 | 11.0900 | 0.6562 |
| −1.6961 | 11.0900 | 0.7333 |
| −1.7606 | 11.0900 | 0.8088 |
| −1.8248 | 11.0900 | 0.8849 |
| −1.8890 | 11.0900 | 0.9626 |
| −1.9481 | 11.0900 | 1.0425 |
| −2.0135 | 11.0900 | 1.1184 |
| −2.0771 | 11.0900 | 1.1972 |
| −2.1396 | 11.0900 | 1.2743 |
| −2.2027 | 11.0900 | 1.3517 |
| −2.2651 | 11.0900 | 1.4295 |
| −2.3279 | 11.0900 | 1.5069 |
| −2.3902 | 11.0900 | 1.5845 |
| −2.4531 | 11.0900 | 1.6614 |
| −2.5172 | 11.0900 | 1.7374 |
| −2.5830 | 11.0900 | 1.8124 |
| −2.6482 | 11.0900 | 1.8876 |
| −2.7152 | 11.0900 | 1.9607 |
| −2.7831 | 11.0900 | 2.0333 |
| −2.8526 | 11.0900 | 2.1036 |
| −2.9255 | 11.0900 | 2.1708 |
| −3.0014 | 11.0900 | 2.2309 |
| −3.0490 | 11.0900 | 2.2522 |
| −3.0733 | 11.0900 | 2.2534 |
| −3.1041 | 11.0900 | 2.2183 |
| −0.0005 | 11.1900 | −0.3733 |
| −0.1038 | 11.1900 | −0.3768 |
| −0.2057 | 11.1900 | −0.3765 |
| −0.3079 | 11.1900 | −0.3654 |
| −0.4070 | 11.1900 | −0.3432 |
| −0.5038 | 11.1900 | −0.3133 |
| −0.5977 | 11.1900 | −0.2760 |
| −0.6894 | 11.1900 | −0.2339 |
| −0.7782 | 11.1900 | −0.1883 |
| −0.8678 | 11.1900 | −0.1422 |
| −0.9531 | 11.1900 | −0.0853 |
| −1.0325 | 11.1900 | −0.0226 |
| −1.1071 | 11.1900 | 0.0447 |
| −1.1805 | 11.1900 | 0.1132 |
| −1.2521 | 11.1900 | 0.1837 |
| −1.3217 | 11.1900 | 0.2558 |
| −1.3894 | 11.1900 | 0.3295 |
| −1.4559 | 11.1900 | 0.4040 |
| −1.5213 | 11.1900 | 0.4797 |
| −1.5848 | 11.1900 | 0.5572 |
| −1.6472 | 11.1900 | 0.6351 |
| −1.7092 | 11.1900 | 0.7131 |

TABLE I-continued

| X | Y | Z |
|---|---|---|
| −1.7716 | 11.1900 | 0.7901 |
| −1.8365 | 11.1900 | 0.8656 |
| −1.9005 | 11.1900 | 0.9430 |
| −1.9628 | 11.1900 | 1.0211 |
| −2.0254 | 11.1900 | 1.0989 |
| −2.0871 | 11.1900 | 1.1773 |
| −2.1495 | 11.1900 | 1.2548 |
| −2.2115 | 11.1900 | 1.3331 |
| −2.2736 | 11.1900 | 1.4109 |
| −2.3363 | 11.1900 | 1.4888 |
| −2.3976 | 11.1900 | 1.5670 |
| −2.4612 | 11.1900 | 1.6435 |
| −2.5241 | 11.1900 | 1.7210 |
| −2.5882 | 11.1900 | 1.7972 |
| −2.6534 | 11.1900 | 1.8724 |
| −2.7199 | 11.1900 | 1.9463 |
| −2.7878 | 11.1900 | 2.0189 |
| −2.8569 | 11.1900 | 2.0903 |
| −2.9271 | 11.1900 | 2.1598 |
| −3.0022 | 11.1900 | 2.2236 |
| −3.0642 | 11.1900 | 2.2600 |
| −3.1133 | 11.1900 | 2.2593 |
| −3.1307 | 11.1900 | 2.2336 |
| 0.0024 | 11.2899 | −0.3988 |
| −0.0989 | 11.2899 | −0.4093 |
| −0.2024 | 11.2899 | −0.4067 |
| −0.3035 | 11.2899 | −0.3946 |
| −0.4020 | 11.2899 | −0.3722 |
| −0.4997 | 11.2899 | −0.3452 |
| −0.5949 | 11.2899 | −0.3090 |
| −0.6870 | 11.2899 | −0.2676 |
| −0.7758 | 11.2899 | −0.2219 |
| −0.8655 | 11.2899 | −0.1765 |
| −0.9522 | 11.2899 | −0.1225 |
| −1.0328 | 11.2899 | −0.0614 |
| −1.1086 | 11.2899 | 0.0046 |
| −1.1828 | 11.2899 | 0.0713 |
| −1.2578 | 11.2899 | 0.1386 |
| −1.3277 | 11.2899 | 0.2120 |
| −1.3940 | 11.2899 | 0.2873 |
| −1.4586 | 11.2899 | 0.3634 |
| −1.5229 | 11.2899 | 0.4397 |
| −1.5859 | 11.2899 | 0.5169 |
| −1.6498 | 11.2899 | 0.5934 |
| −1.7120 | 11.2899 | 0.6729 |
| −1.7696 | 11.2899 | 0.7536 |
| −1.8342 | 11.2899 | 0.8286 |
| −1.8986 | 11.2899 | 0.9071 |
| −1.9617 | 11.2899 | 0.9843 |
| −2.0244 | 11.2899 | 1.0625 |
| −2.0846 | 11.2899 | 1.1422 |
| −2.1463 | 11.2899 | 1.2202 |
| −2.2080 | 11.2899 | 1.2986 |
| −2.2701 | 11.2899 | 1.3767 |
| −2.3316 | 11.2899 | 1.4552 |
| −2.3939 | 11.2899 | 1.5330 |
| −2.4559 | 11.2899 | 1.6110 |
| −2.5183 | 11.2899 | 1.6885 |
| −2.5811 | 11.2899 | 1.7659 |
| −2.6452 | 11.2899 | 1.8417 |
| −2.7112 | 11.2899 | 1.9158 |
| −2.7788 | 11.2899 | 1.9887 |
| −2.8468 | 11.2899 | 2.0612 |
| −2.9163 | 11.2899 | 2.1320 |
| −2.9881 | 11.2899 | 2.2001 |
| −3.0642 | 11.2899 | 2.2591 |
| −3.1209 | 11.2899 | 2.2801 |
| −3.1293 | 11.2899 | 2.2803 |
| −3.1652 | 11.2899 | 2.2356 |
| 0.0017 | 11.3896 | −0.4288 |
| −0.0992 | 11.3896 | −0.4365 |
| −0.2019 | 11.3896 | −0.4352 |
| −0.3031 | 11.3896 | −0.4233 |
| −0.4016 | 11.3896 | −0.4008 |
| −0.4991 | 11.3896 | −0.3742 |
| −0.5948 | 11.3896 | −0.3403 |
| −0.6873 | 11.3896 | −0.3001 |

TABLE I-continued

| X | Y | Z |
|---|---|---|
| −0.7770 | 11.3896 | −0.2554 |
| −0.8658 | 11.3896 | −0.2086 |
| −0.9522 | 11.3896 | −0.1556 |
| −1.0335 | 11.3896 | −0.0964 |
| −1.1118 | 11.3896 | −0.0339 |
| −1.1883 | 11.3896 | 0.0312 |
| −1.2614 | 11.3896 | 0.1007 |
| −1.3312 | 11.3896 | 0.1730 |
| −1.3981 | 11.3896 | 0.2473 |
| −1.4643 | 11.3896 | 0.3217 |
| −1.5294 | 11.3896 | 0.3981 |
| −1.5908 | 11.3896 | 0.4770 |
| −1.6520 | 11.3896 | 0.5564 |
| −1.7097 | 11.3896 | 0.6374 |
| −1.7717 | 11.3896 | 0.7143 |
| −1.8344 | 11.3896 | 0.7925 |
| −1.8957 | 11.3896 | 0.8707 |
| −1.9583 | 11.3896 | 0.9480 |
| −2.0208 | 11.3896 | 1.0264 |
| −2.0805 | 11.3896 | 1.1063 |
| −2.1419 | 11.3896 | 1.1846 |
| −2.2021 | 11.3896 | 1.2637 |
| −2.2646 | 11.3896 | 1.3408 |
| −2.3276 | 11.3896 | 1.4183 |
| −2.3894 | 11.3896 | 1.4975 |
| −2.4473 | 11.3896 | 1.5778 |
| −2.5103 | 11.3896 | 1.6541 |
| −2.5736 | 11.3896 | 1.7320 |
| −2.6371 | 11.3896 | 1.8083 |
| −2.7018 | 11.3896 | 1.8833 |
| −2.7691 | 11.3896 | 1.9562 |
| −2.8370 | 11.3896 | 2.0291 |
| −2.9053 | 11.3896 | 2.1011 |
| −2.9752 | 11.3896 | 2.1715 |
| −3.0476 | 11.3896 | 2.2368 |
| −3.1292 | 11.3896 | 2.2877 |
| −3.1438 | 11.3896 | 2.2937 |
| −3.1627 | 11.3896 | 2.2910 |
| −3.1818 | 11.3896 | 2.2694 |
| 0.0007 | 11.4900 | −0.4616 |
| −0.1005 | 11.4900 | −0.4639 |
| −0.2022 | 11.4900 | −0.4626 |
| −0.3041 | 11.4900 | −0.4503 |
| −0.4029 | 11.4900 | −0.4292 |
| −0.5004 | 11.4900 | −0.4032 |
| −0.5964 | 11.4900 | −0.3707 |
| −0.6895 | 11.4900 | −0.3318 |
| −0.7804 | 11.4900 | −0.2881 |
| −0.8684 | 11.4900 | −0.2396 |
| −0.9542 | 11.4900 | −0.1869 |
| −1.0359 | 11.4900 | −0.1280 |
| −1.1155 | 11.4900 | −0.0668 |
| −1.1914 | 11.4900 | −0.0006 |
| −1.2643 | 11.4900 | 0.0683 |
| −1.3345 | 11.4900 | 0.1405 |
| −1.4017 | 11.4900 | 0.2147 |
| −1.4677 | 11.4900 | 0.2895 |
| −1.5329 | 11.4900 | 0.3656 |
| −1.5941 | 11.4900 | 0.4446 |
| −1.6549 | 11.4900 | 0.5241 |
| −1.7127 | 11.4900 | 0.6054 |
| −1.7724 | 11.4900 | 0.6844 |
| −1.8328 | 11.4900 | 0.7632 |
| −1.8950 | 11.4900 | 0.8402 |
| −1.9586 | 11.4900 | 0.9171 |
| −2.0211 | 11.4900 | 0.9955 |
| −2.0814 | 11.4900 | 1.0748 |
| −2.1429 | 11.4900 | 1.1529 |
| −2.2040 | 11.4900 | 1.2318 |
| −2.2643 | 11.4900 | 1.3119 |
| −2.3225 | 11.4900 | 1.3922 |
| −2.3845 | 11.4900 | 1.4697 |
| −2.4457 | 11.4900 | 1.5488 |
| −2.5068 | 11.4900 | 1.6266 |
| −2.5708 | 11.4900 | 1.7031 |
| −2.6334 | 11.4900 | 1.7807 |
| −2.6980 | 11.4900 | 1.8557 |

TABLE I-continued

| X | Y | Z |
|---|---|---|
| −2.7647 | 11.4900 | 1.9294 |
| −2.8325 | 11.4900 | 2.0023 |
| −2.9004 | 11.4900 | 2.0748 |
| −2.9697 | 11.4900 | 2.1461 |
| −3.0400 | 11.4900 | 2.2155 |
| −3.1152 | 11.4900 | 2.2785 |
| −3.1611 | 11.4900 | 2.3036 |
| −3.1994 | 11.4900 | 2.2980 |
| −3.2133 | 11.4900 | 2.2794 |
| 0.0023 | 11.5901 | −0.4901 |
| −0.1010 | 11.5901 | −0.4979 |
| −0.2040 | 11.5901 | −0.4915 |
| −0.3054 | 11.5901 | −0.4787 |
| −0.4033 | 11.5901 | −0.4546 |
| −0.5014 | 11.5901 | −0.4302 |
| −0.5979 | 11.5901 | −0.4000 |
| −0.6923 | 11.5901 | −0.3641 |
| −0.7837 | 11.5901 | −0.3199 |
| −0.8706 | 11.5901 | −0.2693 |
| −0.9566 | 11.5901 | −0.2167 |
| −1.0390 | 11.5901 | −0.1582 |
| −1.1186 | 11.5901 | −0.0970 |
| −1.1954 | 11.5901 | −0.0316 |
| −1.2686 | 11.5901 | 0.0375 |
| −1.3388 | 11.5901 | 0.1095 |
| −1.4061 | 11.5901 | 0.1841 |
| −1.4720 | 11.5901 | 0.2595 |
| −1.5355 | 11.5901 | 0.3367 |
| −1.5986 | 11.5901 | 0.4138 |
| −1.6598 | 11.5901 | 0.4935 |
| −1.7183 | 11.5901 | 0.5740 |
| −1.7789 | 11.5901 | 0.6527 |
| −1.8393 | 11.5901 | 0.7313 |
| −1.9026 | 11.5901 | 0.8089 |
| −1.9607 | 11.5901 | 0.8907 |
| −2.0228 | 11.5901 | 0.9689 |
| −2.0854 | 11.5901 | 1.0474 |
| −2.1464 | 11.5901 | 1.1259 |
| −2.2079 | 11.5901 | 1.2048 |
| −2.2658 | 11.5901 | 1.2867 |
| −2.3240 | 11.5901 | 1.3671 |
| −2.3841 | 11.5901 | 1.4454 |
| −2.4477 | 11.5901 | 1.5226 |
| −2.5075 | 11.5901 | 1.6023 |
| −2.5705 | 11.5901 | 1.6787 |
| −2.6338 | 11.5901 | 1.7560 |
| −2.6971 | 11.5901 | 1.8322 |
| −2.7632 | 11.5901 | 1.9060 |
| −2.8309 | 11.5901 | 1.9789 |
| −2.8989 | 11.5901 | 2.0515 |
| −2.9671 | 11.5901 | 2.1239 |
| −3.0371 | 11.5901 | 2.1944 |
| −3.1086 | 11.5901 | 2.2617 |
| −3.1880 | 11.5901 | 2.3153 |
| −3.1914 | 11.5901 | 2.3168 |
| −3.2279 | 11.5901 | 2.3147 |
| −3.2470 | 11.5901 | 2.2873 |
| 0.0022 | 11.6900 | −0.5203 |
| −0.1010 | 11.6900 | −0.5272 |
| −0.2041 | 11.6900 | −0.5206 |
| −0.3047 | 11.6900 | −0.5065 |
| −0.4030 | 11.6900 | −0.4846 |
| −0.5005 | 11.6900 | −0.4603 |
| −0.5971 | 11.6900 | −0.4315 |
| −0.6924 | 11.6900 | −0.3967 |
| −0.7838 | 11.6900 | −0.3526 |
| −0.8714 | 11.6900 | −0.3025 |
| −0.9558 | 11.6900 | −0.2478 |
| −1.0377 | 11.6900 | −0.1902 |
| −1.1177 | 11.6900 | −0.1298 |
| −1.1954 | 11.6900 | −0.0661 |
| −1.2691 | 11.6900 | 0.0025 |
| −1.3395 | 11.6900 | 0.0741 |
| −1.4070 | 11.6900 | 0.1484 |
| −1.4726 | 11.6900 | 0.2237 |
| −1.5373 | 11.6900 | 0.3001 |
| −1.5991 | 11.6900 | 0.3784 |

TABLE I-continued

| X | Y | Z |
|---|---|---|
| −1.6599 | 11.6900 | 0.4579 |
| −1.7169 | 11.6900 | 0.5402 |
| −1.7750 | 11.6900 | 0.6200 |
| −1.8350 | 11.6900 | 0.6991 |
| −1.8953 | 11.6900 | 0.7772 |
| −1.9585 | 11.6900 | 0.8544 |
| −2.0188 | 11.6900 | 0.9341 |
| −2.0809 | 11.6900 | 1.0107 |
| −2.1446 | 11.6900 | 1.0887 |
| −2.2014 | 11.6900 | 1.1718 |
| −2.2597 | 11.6900 | 1.2528 |
| −2.3184 | 11.6900 | 1.3332 |
| −2.3776 | 11.6900 | 1.4131 |
| −2.4376 | 11.6900 | 1.4911 |
| −2.5022 | 11.6900 | 1.5669 |
| −2.5636 | 11.6900 | 1.6455 |
| −2.6261 | 11.6900 | 1.7226 |
| −2.6889 | 11.6900 | 1.7993 |
| −2.7541 | 11.6900 | 1.8741 |
| −2.8198 | 11.6900 | 1.9486 |
| −2.8868 | 11.6900 | 2.0212 |
| −2.9563 | 11.6900 | 2.0923 |
| −3.0254 | 11.6900 | 2.1640 |
| −3.0961 | 11.6900 | 2.2329 |
| −3.1698 | 11.6900 | 2.2980 |
| −3.2116 | 11.6900 | 2.3258 |
| −3.2584 | 11.6900 | 2.3310 |
| −3.2858 | 11.6900 | 2.2893 |
| 0.0010 | 11.7900 | −0.5556 |
| −0.1016 | 11.7900 | −0.5582 |
| −0.2044 | 11.7900 | −0.5518 |
| −0.3036 | 11.7900 | −0.5342 |
| −0.4028 | 11.7900 | −0.5149 |
| −0.5007 | 11.7900 | −0.4910 |
| −0.5975 | 11.7900 | −0.4635 |
| −0.6934 | 11.7900 | −0.4291 |
| −0.7844 | 11.7900 | −0.3843 |
| −0.8721 | 11.7900 | −0.3340 |
| −0.9567 | 11.7900 | −0.2796 |
| −1.0394 | 11.7900 | −0.2229 |
| −1.1201 | 11.7900 | −0.1628 |
| −1.1977 | 11.7900 | −0.0988 |
| −1.2720 | 11.7900 | −0.0307 |
| −1.3422 | 11.7900 | 0.0409 |
| −1.4109 | 11.7900 | 0.1144 |
| −1.4760 | 11.7900 | 0.1908 |
| −1.5401 | 11.7900 | 0.2674 |
| −1.6028 | 11.7900 | 0.3454 |
| −1.6634 | 11.7900 | 0.4248 |
| −1.7238 | 11.7900 | 0.5047 |
| −1.7820 | 11.7900 | 0.5857 |
| −1.8417 | 11.7900 | 0.6653 |
| −1.9009 | 11.7900 | 0.7456 |
| −1.9607 | 11.7900 | 0.8250 |
| −2.0210 | 11.7900 | 0.9043 |
| −2.0816 | 11.7900 | 0.9839 |
| −2.1412 | 11.7900 | 1.0639 |
| −2.2011 | 11.7900 | 1.1439 |
| −2.2592 | 11.7900 | 1.2253 |
| −2.3183 | 11.7900 | 1.3045 |
| −2.3805 | 11.7900 | 1.3833 |
| −2.4380 | 11.7900 | 1.4648 |
| −2.4998 | 11.7900 | 1.5429 |
| −2.5621 | 11.7900 | 1.6205 |
| −2.6256 | 11.7900 | 1.6979 |
| −2.6863 | 11.7900 | 1.7764 |
| −2.7527 | 11.7900 | 1.8500 |
| −2.8190 | 11.7900 | 1.9260 |
| −2.8844 | 11.7900 | 2.0000 |
| −2.9533 | 11.7900 | 2.0714 |
| −3.0230 | 11.7900 | 2.1426 |
| −3.0938 | 11.7900 | 2.2122 |
| −3.1663 | 11.7900 | 2.2796 |
| −3.2416 | 11.7900 | 2.3385 |
| −3.2502 | 11.7900 | 2.3430 |
| −3.2861 | 11.7900 | 2.3485 |
| −3.3082 | 11.7900 | 2.3168 |

TABLE I-continued

| X | Y | Z |
|---|---|---|
| 0.0017 | 11.8900 | −0.5824 |
| −0.1024 | 11.8900 | −0.5865 |
| −0.2051 | 11.8900 | −0.5756 |
| −0.3054 | 11.8900 | −0.5611 |
| −0.4044 | 11.8900 | −0.5424 |
| −0.5023 | 11.8900 | −0.5199 |
| −0.5997 | 11.8900 | −0.4941 |
| −0.6964 | 11.8900 | −0.4591 |
| −0.7857 | 11.8900 | −0.4120 |
| −0.8747 | 11.8900 | −0.3635 |
| −0.9616 | 11.8900 | −0.3115 |
| −1.0439 | 11.8900 | −0.2535 |
| −1.1248 | 11.8900 | −0.1941 |
| −1.2024 | 11.8900 | −0.1298 |
| −1.2766 | 11.8900 | −0.0620 |
| −1.3468 | 11.8900 | 0.0103 |
| −1.4139 | 11.8900 | 0.0847 |
| −1.4797 | 11.8900 | 0.1602 |
| −1.5435 | 11.8900 | 0.2371 |
| −1.6060 | 11.8900 | 0.3148 |
| −1.6672 | 11.8900 | 0.3936 |
| −1.7271 | 11.8900 | 0.4735 |
| −1.7866 | 11.8900 | 0.5534 |
| −1.8457 | 11.8900 | 0.6341 |
| −1.9023 | 11.8900 | 0.7156 |
| −1.9623 | 11.8900 | 0.7947 |
| −2.0212 | 11.8900 | 0.8747 |
| −2.0828 | 11.8900 | 0.9536 |
| −2.1401 | 11.8900 | 1.0359 |
| −2.1995 | 11.8900 | 1.1152 |
| −2.2610 | 11.8900 | 1.1947 |
| −2.3170 | 11.8900 | 1.2774 |
| −2.3778 | 11.8900 | 1.3567 |
| −2.4386 | 11.8900 | 1.4364 |
| −2.4988 | 11.8900 | 1.5151 |
| −2.5606 | 11.8900 | 1.5927 |
| −2.6227 | 11.8900 | 1.6711 |
| −2.6828 | 11.8900 | 1.7495 |
| −2.7493 | 11.8900 | 1.8227 |
| −2.8157 | 11.8900 | 1.9006 |
| −2.8762 | 11.8900 | 1.9774 |
| −2.9487 | 11.8900 | 2.0452 |
| −3.0210 | 11.8900 | 2.1198 |
| −3.0920 | 11.8900 | 2.1891 |
| −3.1626 | 11.8900 | 2.2589 |
| −3.2360 | 11.8900 | 2.3248 |
| −3.2858 | 11.8900 | 2.3570 |
| −3.3252 | 11.8900 | 2.3541 |
| −3.3434 | 11.8900 | 2.3266 |
| 0.0012 | 11.9901 | −0.6115 |
| −0.1023 | 11.9901 | −0.6141 |
| −0.2049 | 11.9901 | −0.6030 |
| −0.3043 | 11.9901 | 1.5871 |
| −0.4034 | 11.9901 | −0.5698 |
| −0.5012 | 11.9901 | −0.5480 |
| −0.5996 | 11.9901 | −0.5248 |
| −0.6963 | 11.9901 | −0.4876 |
| −0.7863 | 11.9901 | −0.4424 |
| −0.8752 | 11.9901 | −0.3947 |
| −0.9614 | 11.9901 | −0.3427 |
| −1.0456 | 11.9901 | −0.2875 |
| −1.1270 | 11.9901 | −0.2279 |
| −1.2049 | 11.9901 | −0.1636 |
| −1.2776 | 11.9901 | −0.0942 |
| −1.3473 | 11.9901 | −0.0223 |
| −1.4150 | 11.9901 | 0.0517 |
| −1.4806 | 11.9901 | 0.1274 |
| −1.5448 | 11.9901 | 0.2039 |
| −1.6077 | 11.9901 | 0.2816 |
| −1.6689 | 11.9901 | 0.3605 |
| −1.7285 | 11.9901 | 0.4409 |
| −1.7868 | 11.9901 | 0.5218 |
| −1.8454 | 11.9901 | 0.6022 |
| −1.9038 | 11.9901 | 0.6830 |
| −1.9619 | 11.9901 | 0.7636 |
| −2.0207 | 11.9901 | 0.8435 |
| −2.0811 | 11.9901 | 0.9237 |

TABLE I-continued

| X | Y | Z |
|---|---|---|
| −2.1375 | 11.9901 | 1.0056 |
| −2.1985 | 11.9901 | 1.0838 |
| −2.2587 | 11.9901 | 1.1652 |
| −2.3154 | 11.9901 | 1.2468 |
| −2.3754 | 11.9901 | 1.3259 |
| −2.4352 | 11.9901 | 1.4056 |
| −2.4959 | 11.9901 | 1.4838 |
| −2.5584 | 11.9901 | 1.5611 |
| −2.6202 | 11.9901 | 1.6399 |
| −2.6803 | 11.9901 | 1.7186 |
| −2.7451 | 11.9901 | 1.7934 |
| −2.8107 | 11.9901 | 1.8708 |
| −2.8709 | 11.9901 | 1.9484 |
| −2.9420 | 11.9901 | 2.0176 |
| −3.0131 | 11.9901 | 2.0923 |
| −3.0838 | 11.9901 | 2.1616 |
| −3.1555 | 11.9901 | 2.2304 |
| −3.2282 | 11.9901 | 2.2986 |
| −3.3007 | 11.9901 | 2.3621 |
| −3.3187 | 11.9901 | 2.3720 |
| −3.3562 | 11.9901 | 2.3712 |
| −3.3764 | 11.9901 | 2.3370 |
| 0.0005 | 12.0900 | −0.6404 |
| −0.1018 | 12.0900 | −0.6403 |
| −0.2030 | 12.0900 | −0.6305 |
| −0.3031 | 12.0900 | −0.6173 |
| −0.4022 | 12.0900 | −0.5985 |
| −0.5002 | 12.0900 | −0.5771 |
| −0.5979 | 12.0900 | −0.5514 |
| −0.6944 | 12.0900 | −0.5172 |
| −0.7851 | 12.0900 | −0.4742 |
| −0.8760 | 12.0900 | −0.4292 |
| −0.9621 | 12.0900 | −0.3748 |
| −1.0459 | 12.0900 | −0.3195 |
| −1.1285 | 12.0900 | −0.2614 |
| −1.2061 | 12.0900 | −0.1959 |
| −1.2785 | 12.0900 | −0.1261 |
| −1.3482 | 12.0900 | −0.0542 |
| −1.4160 | 12.0900 | 0.0196 |
| −1.4819 | 12.0900 | 0.0950 |
| −1.5470 | 12.0900 | 0.1711 |
| −1.6096 | 12.0900 | 0.2492 |
| −1.6712 | 12.0900 | 0.3279 |
| −1.7304 | 12.0900 | 0.4086 |
| −1.7886 | 12.0900 | 0.4897 |
| −1.8467 | 12.0900 | 0.5706 |
| −1.9047 | 12.0900 | 0.6515 |
| −1.9631 | 12.0900 | 0.7322 |
| −2.0209 | 12.0900 | 0.8128 |
| −2.0811 | 12.0900 | 0.8927 |
| −2.1383 | 12.0900 | 0.9748 |
| −2.1974 | 12.0900 | 1.0546 |
| −2.2565 | 12.0900 | 1.1351 |
| −2.3156 | 12.0900 | 1.2151 |
| −2.3752 | 12.0900 | 1.2951 |
| −2.4339 | 12.0900 | 1.3757 |
| −2.4941 | 12.0900 | 1.4540 |
| −2.5582 | 12.0900 | 1.5301 |
| −2.6203 | 12.0900 | 1.6094 |
| −2.6795 | 12.0900 | 1.6887 |
| −2.7445 | 12.0900 | 1.7638 |
| −2.8090 | 12.0900 | 1.8426 |
| −2.8692 | 12.0900 | 1.9201 |
| −2.9395 | 12.0900 | 1.9907 |
| −3.0080 | 12.0900 | 2.0672 |
| −3.0785 | 12.0900 | 2.1358 |
| −3.1522 | 12.0900 | 2.2041 |
| −3.2226 | 12.0900 | 2.2740 |
| −3.2966 | 12.0900 | 2.3423 |
| −3.3542 | 12.0900 | 2.3886 |
| −3.3917 | 12.0900 | 2.3858 |
| −3.4052 | 12.0900 | 2.3356 |
| 0.0009 | 12.1900 | −0.6664 |
| −0.1022 | 12.1900 | −0.6677 |
| −0.2036 | 12.1900 | −0.6598 |
| −0.3043 | 12.1900 | −0.6489 |
| −0.4039 | 12.1900 | −0.6293 |

TABLE I-continued

| X | Y | Z |
|---|---|---|
| −0.5020 | 12.1900 | −0.6067 |
| −0.5991 | 12.1900 | −0.5791 |
| −0.6948 | 12.1900 | −0.5461 |
| −0.7874 | 12.1900 | −0.5063 |
| −0.8779 | 12.1900 | −0.4612 |
| −0.9642 | 12.1900 | −0.4093 |
| −1.0486 | 12.1900 | −0.3545 |
| −1.1301 | 12.1900 | −0.2945 |
| −1.2070 | 12.1900 | −0.2288 |
| −1.2787 | 12.1900 | −0.1583 |
| −1.3488 | 12.1900 | −0.0868 |
| −1.4168 | 12.1900 | −0.0132 |
| −1.4828 | 12.1900 | 0.0617 |
| −1.5485 | 12.1900 | 0.1379 |
| −1.6094 | 12.1900 | 0.2170 |
| −1.6732 | 12.1900 | 0.2945 |
| −1.7322 | 12.1900 | 0.3762 |
| −1.7901 | 12.1900 | 0.4574 |
| −1.8485 | 12.1900 | 0.5383 |
| −1.9059 | 12.1900 | 0.6199 |
| −1.9638 | 12.1900 | 0.6996 |
| −2.0256 | 12.1900 | 0.7785 |
| −2.0820 | 12.1900 | 0.8615 |
| −2.1412 | 12.1900 | 0.9425 |
| −2.1987 | 12.1900 | 1.0244 |
| −2.2563 | 12.1900 | 1.1052 |
| −2.3148 | 12.1900 | 1.1856 |
| −2.3739 | 12.1900 | 1.2658 |
| −2.4341 | 12.1900 | 1.3450 |
| −2.4952 | 12.1900 | 1.4237 |
| −2.5565 | 12.1900 | 1.5013 |
| −2.6205 | 12.1900 | 1.5782 |
| −2.6798 | 12.1900 | 1.6583 |
| −2.7445 | 12.1900 | 1.7344 |
| −2.8086 | 12.1900 | 1.8130 |
| −2.8686 | 12.1900 | 1.8911 |
| −2.9365 | 12.1900 | 1.9633 |
| −3.0043 | 12.1900 | 2.0382 |
| −3.0737 | 12.1900 | 2.1081 |
| −3.1459 | 12.1900 | 2.1771 |
| −3.2165 | 12.1900 | 2.2478 |
| −3.2875 | 12.1900 | 2.3159 |
| −3.3621 | 12.1900 | 2.3832 |
| −3.3947 | 12.1900 | 2.4079 |
| −3.4311 | 12.1900 | 2.3955 |
| −3.4379 | 12.1900 | 2.3789 |
| 0.0016 | 12.2900 | −0.6917 |
| −0.1033 | 12.2900 | −0.6960 |
| −0.2053 | 12.2900 | −0.6900 |
| −0.3060 | 12.2900 | −0.6795 |
| −0.4058 | 12.2900 | −0.6603 |
| −0.5037 | 12.2900 | −0.6369 |
| −0.6004 | 12.2900 | −0.6089 |
| −0.6960 | 12.2900 | −0.5763 |
| −0.7893 | 12.2900 | −0.5368 |
| −0.8795 | 12.2900 | −0.4917 |
| −0.9664 | 12.2900 | −0.4409 |
| −1.0505 | 12.2900 | −0.3859 |
| −1.1321 | 12.2900 | −0.3261 |
| −1.2083 | 12.2900 | −0.2599 |
| −1.2807 | 12.2900 | −0.1900 |
| −1.3502 | 12.2900 | −0.1182 |
| −1.4185 | 12.2900 | −0.0451 |
| −1.4850 | 12.2900 | 0.0299 |
| −1.5498 | 12.2900 | 0.1068 |
| −1.6119 | 12.2900 | 0.1842 |
| −1.6765 | 12.2900 | 0.2607 |
| −1.7359 | 12.2900 | 0.3425 |
| −1.7931 | 12.2900 | 0.4244 |
| −1.8503 | 12.2900 | 0.5063 |
| −1.9069 | 12.2900 | 0.5882 |
| −1.9646 | 12.2900 | 0.6691 |
| −2.0231 | 12.2900 | 0.7494 |
| −2.0821 | 12.2900 | 0.8299 |
| −2.1409 | 12.2900 | 0.9106 |
| −2.1992 | 12.2900 | 0.9920 |
| −2.2560 | 12.2900 | 1.0738 |

TABLE I-continued

| X | Y | Z |
|---|---|---|
| −2.3148 | 12.2900 | 1.1541 |
| −2.3735 | 12.2900 | 1.2344 |
| −2.4343 | 12.2900 | 1.3133 |
| −2.4948 | 12.2900 | 1.3922 |
| −2.5570 | 12.2900 | 1.4700 |
| −2.6180 | 12.2900 | 1.5485 |
| −2.6812 | 12.2900 | 1.6248 |
| −2.7448 | 12.2900 | 1.7020 |
| −2.8074 | 12.2900 | 1.7798 |
| −2.8696 | 12.2900 | 1.8575 |
| −2.9326 | 12.2900 | 1.9342 |
| −2.9980 | 12.2900 | 2.0081 |
| −3.0674 | 12.2900 | 2.0790 |
| −3.1383 | 12.2900 | 2.1493 |
| −3.2089 | 12.2900 | 2.2199 |
| −3.2793 | 12.2900 | 2.2899 |
| −3.3514 | 12.2900 | 2.3578 |
| −3.4257 | 12.2900 | 2.4216 |
| −3.4475 | 12.2900 | 2.4337 |
| −3.4650 | 12.2900 | 2.4267 |
| −3.4782 | 12.2900 | 2.3957 |
| 0.0007 | 12.3900 | −0.7322 |
| −0.1021 | 12.3900 | −0.7332 |
| −0.2035 | 12.3900 | −0.7263 |
| −0.3040 | 12.3900 | −0.7146 |
| −0.4034 | 12.3900 | −0.6952 |
| −0.5015 | 12.3900 | −0.6721 |
| −0.5982 | 12.3900 | −0.6429 |
| −0.6930 | 12.3900 | −0.6100 |
| −0.7870 | 12.3900 | −0.5722 |
| −0.8774 | 12.3900 | −0.5259 |
| −0.9644 | 12.3900 | −0.4752 |
| −1.0484 | 12.3900 | −0.4197 |
| −1.1287 | 12.3900 | −0.3589 |
| −1.2058 | 12.3900 | −0.2938 |
| −1.2784 | 12.3900 | −0.2241 |
| −1.3485 | 12.3900 | −0.1525 |
| −1.4167 | 12.3900 | −0.0795 |
| −1.4832 | 12.3900 | −0.0049 |
| −1.5486 | 12.3900 | 0.0706 |
| −1.6137 | 12.3900 | 0.1465 |
| −1.6769 | 12.3900 | 0.2248 |
| −1.7362 | 12.3900 | 0.3059 |
| −1.7933 | 12.3900 | 0.3877 |
| −1.8500 | 12.3900 | 0.4698 |
| −1.9060 | 12.3900 | 0.5524 |
| −1.9617 | 12.3900 | 0.6345 |
| −2.0194 | 12.3900 | 0.7151 |
| −2.0773 | 12.3900 | 0.7963 |
| −2.1357 | 12.3900 | 0.8753 |
| −2.2004 | 12.3900 | 0.9532 |
| −2.2542 | 12.3900 | 1.0411 |
| −2.3162 | 12.3900 | 1.1231 |
| −2.3765 | 12.3900 | 1.2040 |
| −2.4360 | 12.3900 | 1.2835 |
| −2.4971 | 12.3900 | 1.3619 |
| −2.5584 | 12.3900 | 1.4405 |
| −2.6195 | 12.3900 | 1.5185 |
| −2.6826 | 12.3900 | 1.5950 |
| −2.7453 | 12.3900 | 1.6730 |
| −2.8075 | 12.3900 | 1.7505 |
| −2.8712 | 12.3900 | 1.8271 |
| −2.9331 | 12.3900 | 1.9054 |
| −2.9964 | 12.3900 | 1.9809 |
| −3.0639 | 12.3900 | 2.0530 |
| −3.1341 | 12.3900 | 2.1237 |
| −3.2038 | 12.3900 | 2.1951 |
| −3.2732 | 12.3900 | 2.2666 |
| −3.3427 | 12.3900 | 2.3362 |
| −3.4166 | 12.3900 | 2.4043 |
| −3.4846 | 12.3900 | 2.4553 |
| −3.5179 | 12.3900 | 2.4468 |
| −3.5278 | 12.3900 | 2.4089 |
| 0.0056 | 12.4900 | −0.8420 |
| −0.1086 | 12.4900 | −0.8600 |
| −0.2195 | 12.4900 | −0.8288 |
| −0.2642 | 12.4900 | −0.8152 |

TABLE I-continued

| X | Y | Z |
|---|---|---|
| −0.3595 | 12.4900 | −0.7806 |
| −0.4523 | 12.4900 | −0.7443 |
| −0.5458 | 12.4900 | −1.7097 |
| −0.6392 | 12.4900 | −1.6738 |
| −0.7325 | 12.4900 | −0.6365 |
| −0.8237 | 12.4900 | −1.5925 |
| −0.9109 | 12.4900 | −0.5429 |
| −0.9959 | 12.4900 | −1.4895 |
| −1.0780 | 12.4900 | −0.4311 |
| −1.1562 | 12.4900 | −0.3681 |
| −1.2315 | 12.4900 | −0.3014 |
| −1.3032 | 12.4900 | −0.2311 |
| −1.3723 | 12.4900 | −0.1591 |
| −1.4402 | 12.4900 | −0.0861 |
| −1.5063 | 12.4900 | −0.0113 |
| −1.5720 | 12.4900 | 0.0638 |
| −1.6367 | 12.4900 | 0.1402 |
| −1.6989 | 12.4900 | 0.2191 |
| −1.7577 | 12.4900 | 0.3001 |
| −1.8150 | 12.4900 | 0.3816 |
| −1.8713 | 12.4900 | 0.4641 |
| −1.9264 | 12.4900 | 0.5469 |
| −1.9826 | 12.4900 | 0.6289 |
| −2.0391 | 12.4900 | 0.7097 |
| −2.1002 | 12.4900 | 0.7889 |
| −2.1558 | 12.4900 | 0.8720 |
| −2.2172 | 12.4900 | 0.9520 |
| −2.2738 | 12.4900 | 1.0355 |
| −2.3358 | 12.4900 | 1.1137 |
| −2.3966 | 12.4900 | 1.1946 |
| −2.4554 | 12.4900 | 1.2746 |
| −2.5168 | 12.4900 | 1.3526 |
| −2.5786 | 12.4900 | 1.4312 |
| −2.6386 | 12.4900 | 1.5102 |
| −2.7014 | 12.4900 | 1.5866 |
| −2.7649 | 12.4900 | 1.6642 |
| −2.8263 | 12.4900 | 1.7423 |
| −2.8905 | 12.4900 | 1.8187 |
| −2.9520 | 12.4900 | 1.8974 |
| −3.0149 | 12.4900 | 1.9733 |
| −3.0814 | 12.4900 | 2.0465 |
| −3.1510 | 12.4900 | 2.1177 |
| −3.2203 | 12.4900 | 2.1894 |
| −3.2893 | 12.4900 | 2.2619 |
| −3.3559 | 12.4900 | 2.3353 |
| −3.4260 | 12.4900 | 2.4051 |
| −3.4988 | 12.4900 | 2.4650 |
| −3.5435 | 12.4900 | 2.4826 |
| −0.6771 | 12.5900 | −0.7614 |
| −0.7524 | 12.5900 | −0.6971 |
| −0.8329 | 12.5900 | −0.6397 |
| −0.9159 | 12.5900 | −0.5837 |
| −0.9987 | 12.5900 | −0.5273 |
| −1.0796 | 12.5900 | −0.4677 |
| −1.1571 | 12.5900 | −0.4033 |
| −1.2313 | 12.5900 | −0.3355 |
| −1.3022 | 12.5900 | −0.2648 |
| −1.3715 | 12.5900 | −0.1929 |
| −1.4393 | 12.5900 | −0.1198 |
| −1.5057 | 12.5900 | −0.0454 |
| −1.5710 | 12.5900 | 0.0300 |
| −1.6361 | 12.5900 | 0.1062 |
| −1.6981 | 12.5900 | 0.1851 |
| −1.7582 | 12.5900 | 0.2650 |
| −1.8164 | 12.5900 | 0.3463 |
| −1.8729 | 12.5900 | 0.4286 |
| −1.9288 | 12.5900 | 0.5114 |
| −1.9840 | 12.5900 | 0.5939 |
| −2.0411 | 12.5900 | 0.6749 |
| −2.0992 | 12.5900 | 0.7560 |
| −2.1555 | 12.5900 | 0.8380 |
| −2.2144 | 12.5900 | 0.9184 |
| −2.2731 | 12.5900 | 0.9985 |
| −2.3344 | 12.5900 | 1.0767 |
| −2.3952 | 12.5900 | 1.1566 |
| −2.4531 | 12.5900 | 1.2372 |
| −2.5151 | 12.5900 | 1.3148 |

TABLE I-continued

| X | Y | Z |
|---|---|---|
| −2.5765 | 12.5900 | 1.3941 |
| −2.6362 | 12.5900 | 1.4729 |
| −2.6999 | 12.5900 | 1.5491 |
| −2.7619 | 12.5900 | 1.6279 |
| −2.8234 | 12.5900 | 1.7055 |
| −2.8877 | 12.5900 | 1.7819 |
| −2.9495 | 12.5900 | 1.8609 |
| −3.0108 | 12.5900 | 1.9386 |
| −3.0753 | 12.5900 | 2.0131 |
| −3.1431 | 12.5900 | 2.0859 |
| −3.2110 | 12.5900 | 2.1587 |
| −3.2802 | 12.5900 | 2.2300 |
| −3.3495 | 12.5900 | 2.3009 |
| −3.4210 | 12.5900 | 2.3708 |
| −3.4891 | 12.5900 | 2.4437 |
| −3.5474 | 12.5900 | 2.4835 |
| −3.5890 | 12.5900 | 2.4700 |
| −3.6028 | 12.5900 | 2.4256 |
| −0.9428 | 12.6900 | −0.6573 |
| −1.0061 | 12.6900 | −0.5819 |
| −1.0787 | 12.6900 | −0.5148 |
| −1.1537 | 12.6900 | −0.4466 |
| −1.2262 | 12.6900 | −0.3775 |
| −1.2967 | 12.6900 | −0.3063 |
| −1.3650 | 12.6900 | −0.2335 |
| −1.4326 | 12.6900 | −0.1604 |
| −1.4989 | 12.6900 | −0.0860 |
| −1.5639 | 12.6900 | −0.0107 |
| −1.6291 | 12.6900 | 0.0650 |
| −1.6920 | 12.6900 | 0.1433 |
| −1.7522 | 12.6900 | 0.2231 |
| −1.8110 | 12.6900 | 0.3037 |
| −1.8681 | 12.6900 | 0.3853 |
| −1.9243 | 12.6900 | 0.4679 |
| −1.9798 | 12.6900 | 0.5504 |
| −2.0364 | 12.6900 | 0.6318 |
| −2.0934 | 12.6900 | 0.7133 |
| −2.1498 | 12.6900 | 0.7947 |
| −2.2088 | 12.6900 | 0.8747 |
| −2.2681 | 12.6900 | 0.9550 |
| −2.3277 | 12.6900 | 1.0344 |
| −2.3885 | 12.6900 | 1.1132 |
| −2.4480 | 12.6900 | 1.1928 |
| −2.5095 | 12.6900 | 1.2712 |
| −2.5692 | 12.6900 | 1.3511 |
| −2.6302 | 12.6900 | 1.4293 |
| −2.6920 | 12.6900 | 1.5064 |
| −2.7559 | 12.6900 | 1.5836 |
| −2.8155 | 12.6900 | 1.6612 |
| −2.8874 | 12.6900 | 1.7329 |
| −2.9483 | 12.6900 | 1.8246 |
| −3.0058 | 12.6900 | 1.8973 |
| −3.0699 | 12.6900 | 1.9733 |
| −3.1362 | 12.6900 | 2.0471 |
| −3.2027 | 12.6900 | 2.1213 |
| −3.2696 | 12.6900 | 2.1950 |
| −3.3368 | 12.6900 | 2.2675 |
| −3.4079 | 12.6900 | 2.3363 |
| −3.4803 | 12.6900 | 2.4030 |
| −3.5565 | 12.6900 | 2.4702 |
| −3.5911 | 12.6900 | 2.5009 |
| −3.6408 | 12.6900 | 2.4957 |
| −1.1245 | 12.7900 | −0.5556 |
| −1.1816 | 12.7900 | −0.4749 |
| −1.2465 | 12.7900 | −0.4004 |
| −1.3140 | 12.7900 | −0.3259 |
| −1.3807 | 12.7900 | −0.2521 |
| −1.4478 | 12.7900 | −0.1782 |
| −1.5137 | 12.7900 | −0.1032 |
| −1.5788 | 12.7900 | −0.0280 |
| −1.6437 | 12.7900 | 0.0483 |
| −1.7062 | 12.7900 | 0.1272 |
| −1.7654 | 12.7900 | 0.2078 |
| −1.8242 | 12.7900 | 0.2881 |
| −1.8815 | 12.7900 | 0.3698 |
| −1.9379 | 12.7900 | 0.4522 |
| −1.9935 | 12.7900 | 0.5345 |

TABLE I-continued

| X | Y | Z |
|---|---|---|
| −2.0509 | 12.7900 | 0.6158 |
| −2.1071 | 12.7900 | 0.6978 |
| −2.1642 | 12.7900 | 0.7782 |
| −2.2245 | 12.7900 | 0.8573 |
| −2.2845 | 12.7900 | 0.9373 |
| −2.3438 | 12.7900 | 1.0174 |
| −2.4029 | 12.7900 | 1.0969 |
| −2.4634 | 12.7900 | 1.1758 |
| −2.5227 | 12.7900 | 1.2556 |
| −2.5843 | 12.7900 | 1.3336 |
| −2.6446 | 12.7900 | 1.4127 |
| −2.7064 | 12.7900 | 1.4903 |
| −2.7681 | 12.7900 | 1.5672 |
| −2.8340 | 12.7900 | 1.6419 |
| −2.8963 | 12.7900 | 1.7212 |
| −2.9567 | 12.7900 | 1.7999 |
| −3.0191 | 12.7900 | 1.8772 |
| −3.0812 | 12.7900 | 1.9542 |
| −3.1454 | 12.7900 | 2.0292 |
| −3.2119 | 12.7900 | 2.1029 |
| −3.2788 | 12.7900 | 2.1763 |
| −3.3465 | 12.7900 | 2.2484 |
| −3.4155 | 12.7900 | 2.3197 |
| −3.4845 | 12.7900 | 2.3903 |
| −3.5563 | 12.7900 | 2.4585 |
| −3.6284 | 12.7900 | 2.5274 |
| −3.7002 | 12.7900 | 2.5946 |
| −3.7758 | 12.7900 | 2.6592 |
| −3.8491 | 12.7900 | 2.7269 |
| −3.9227 | 12.7900 | 2.7934 |
| −3.9961 | 12.7900 | 2.8613 |
| −4.0234 | 12.7900 | 2.8877 |
| −1.2514 | 12.8900 | −0.4868 |
| −1.2993 | 12.8900 | −0.4000 |
| −1.3584 | 12.8900 | −0.3214 |
| −1.4225 | 12.8900 | −0.2447 |
| −1.4871 | 12.8900 | −0.1692 |
| −1.5516 | 12.8900 | −0.0934 |
| −1.6143 | 12.8900 | −0.0165 |
| −1.6787 | 12.8900 | 0.0601 |
| −1.7388 | 12.8900 | 0.1404 |
| −1.7985 | 12.8900 | 0.2205 |
| −1.8569 | 12.8900 | 0.3014 |
| −1.9138 | 12.8900 | 0.3830 |
| −1.9704 | 12.8900 | 0.4654 |
| −2.0252 | 12.8900 | 0.5479 |
| −2.0833 | 12.8900 | 0.6281 |
| −2.1416 | 12.8900 | 0.7087 |
| −2.2002 | 12.8900 | 0.7888 |
| −2.2596 | 12.8900 | 0.8689 |
| −2.3184 | 12.8900 | 0.9489 |
| −2.3796 | 12.8900 | 1.9275 |
| −2.4386 | 12.8900 | 1.1078 |
| −2.4991 | 12.8900 | 1.1860 |
| −2.5603 | 12.8900 | 1.2652 |
| −2.6194 | 12.8900 | 1.3451 |
| −2.6809 | 12.8900 | 1.4228 |
| −2.7422 | 12.8900 | 1.5010 |
| −2.8047 | 12.8900 | 1.5776 |
| −2.8678 | 12.8900 | 1.6551 |
| −2.9294 | 12.8900 | 1.7332 |
| −2.9925 | 12.8900 | 1.8097 |
| −3.0554 | 12.8900 | 1.8867 |
| −3.1187 | 12.8900 | 1.9631 |
| −3.1827 | 12.8900 | 2.0388 |
| −3.2485 | 12.8900 | 2.1128 |
| −3.3159 | 12.8900 | 2.1854 |
| −3.3844 | 12.8900 | 2.2574 |
| −3.4528 | 12.8900 | 2.3293 |
| −3.5221 | 12.8900 | 2.4002 |
| −3.5915 | 12.8900 | 2.4709 |
| −3.6634 | 12.8900 | 2.5396 |
| −3.7346 | 12.8900 | 2.6093 |
| −3.8060 | 12.8900 | 2.6781 |
| −3.8781 | 12.8900 | 2.7463 |
| −3.9505 | 12.8900 | 2.8142 |
| −4.0229 | 12.8900 | 2.8827 |

TABLE I-continued

| X | Y | Z |
|---|---|---|
| −4.0957 | 12.8900 | 2.9502 |
| −4.1700 | 12.8900 | 3.0158 |
| −4.2452 | 12.8900 | 3.0806 |
| −4.3207 | 12.8990 | 3.1453 |
| −4.3960 | 12.8900 | 3.2099 |
| −4.4721 | 12.8900 | 3.2742 |
| −4.5475 | 12.8900 | 3.3385 |
| −4.6251 | 12.8900 | 3.4006 |
| −4.7020 | 12.8900 | 3.4628 |
| −4.7823 | 12.8900 | 3.5188 |
| −4.8664 | 12.8900 | 3.5678 |
| −4.9502 | 12.8900 | 3.5988 |
| −4.9975 | 12.8900 | 3.5984 |
| −5.0313 | 12.8900 | 3.5702 |
| −1.3677 | 12.9901 | −0.4028 |
| −1.4126 | 12.9901 | −0.3140 |
| −1.4693 | 12.9901 | −0.2336 |
| −1.5317 | 12.9901 | −0.1553 |
| −1.5947 | 12.9901 | −0.0779 |
| −1.6568 | 12.9901 | 0.0001 |
| −1.7188 | 12.9901 | 0.0789 |
| −1.7774 | 12.9901 | 0.1602 |
| −1.8361 | 12.9901 | 0.2404 |
| −1.8941 | 12.9901 | 0.3218 |
| −1.9506 | 12.9901 | 0.4039 |
| −2.0069 | 12.9901 | 0.4858 |
| −2.0650 | 12.9901 | 0.5666 |
| −2.1222 | 12.9901 | 0.6478 |
| −2.1811 | 12.9901 | 0.7277 |
| −2.2394 | 12.9901 | 0.8085 |
| −2.2986 | 12.9901 | 0.8882 |
| −2.3591 | 12.9901 | 0.9671 |
| −2.4201 | 12.9901 | 1.0465 |
| −2.4787 | 12.9901 | 1.1270 |
| −2.5391 | 12.9901 | 1.2055 |
| −2.6009 | 12.9901 | 1.2841 |
| −2.6608 | 12.9901 | 1.3637 |
| −2.7220 | 12.9901 | 1.4418 |
| −2.7838 | 12.9901 | 1.5194 |
| −2.8467 | 12.9901 | 1.5962 |
| −2.9101 | 12.9901 | 1.6730 |
| −2.9736 | 12.9901 | 1.7501 |
| −3.0360 | 12.9901 | 1.8274 |
| −3.1004 | 12.9901 | 1.9035 |
| −3.1626 | 12.9901 | 1.9814 |
| −3.2271 | 12.9901 | 2.0562 |
| −3.2944 | 12.9901 | 2.1294 |
| −3.3627 | 12.9901 | 2.2016 |
| −3.4313 | 12.9901 | 2.2740 |
| −3.4989 | 12.9901 | 2.3468 |
| −3.5681 | 12.9901 | 2.4172 |
| −3.6397 | 12.9901 | 2.4864 |
| −3.7103 | 12.9901 | 2.5565 |
| −3.7818 | 12.9901 | 2.6253 |
| −3.8535 | 12.9901 | 2.6945 |
| −3.9248 | 12.9901 | 2.7637 |
| −3.9965 | 12.9901 | 2.8327 |
| −4.0686 | 12.9901 | 2.9008 |
| −4.1424 | 12.9901 | 2.9673 |
| −4.2164 | 12.9901 | 3.0334 |
| −4.2914 | 12.9901 | 3.0985 |
| −4.3660 | 12.9901 | 3.1643 |
| −4.4411 | 12.9901 | 3.2295 |
| −4.5163 | 12.9901 | 3.2934 |
| −4.5950 | 12.9901 | 3.3549 |
| −4.6708 | 12.9901 | 3.4197 |
| −4.7486 | 12.9901 | 3.4798 |
| −4.8290 | 12.9901 | 3.5367 |
| −4.9126 | 12.9901 | 3.5877 |
| −4.9752 | 12.9901 | 3.6098 |
| −5.0154 | 12.9901 | 3.5961 |
| −5.0464 | 12.9901 | 3.5656 |
| −1.4697 | 13.0900 | −0.3265 |
| −1.5134 | 13.0900 | −0.2375 |
| −1.5678 | 13.0900 | −0.1556 |
| −1.6278 | 13.0900 | −0.0764 |
| −1.6894 | 13.0900 | 0.0028 |

TABLE I-continued

| X | Y | Z |
|---|---|---|
| −1.7482 | 13.0900 | 0.0840 |
| −1.8055 | 13.0900 | 0.1652 |
| −1.8636 | 13.0900 | 0.2460 |
| −1.9209 | 13.0900 | 0.3273 |
| −1.9781 | 13.0900 | 0.4091 |
| −2.0339 | 13.0900 | 0.4914 |
| −2.0920 | 13.0900 | 0.5716 |
| −2.1504 | 13.0900 | 0.6520 |
| −2.2090 | 13.0900 | 0.7323 |
| −2.2672 | 13.0900 | 0.8129 |
| −2.3273 | 13.0900 | 0.8921 |
| −2.3878 | 13.0900 | 0.9712 |
| −2.4483 | 13.0900 | 1.0504 |
| −2.5078 | 13.0900 | 1.1301 |
| −2.5685 | 13.0900 | 1.2085 |
| −2.6296 | 13.0900 | 1.2875 |
| −2.6893 | 13.0900 | 1.3668 |
| −2.7514 | 13.0900 | 1.4437 |
| −2.8148 | 13.0900 | 1.5205 |
| −2.8773 | 13.0900 | 1.5979 |
| −2.9401 | 13.0900 | 1.6750 |
| −3.0029 | 13.0900 | 1.7519 |
| −3.0668 | 13.0900 | 1.8283 |
| −3.1298 | 13.0900 | 1.9054 |
| −3.1930 | 13.0900 | 1.9815 |
| −3.2583 | 13.0900 | 2.0560 |
| −3.3254 | 13.0900 | 2.1293 |
| −3.3930 | 13.0900 | 2.2021 |
| −3.4617 | 13.0900 | 2.2737 |
| −3.5308 | 13.0900 | 2.3450 |
| −3.6004 | 13.0900 | 2.4156 |
| −3.6709 | 13.0900 | 2.4853 |
| −3.7423 | 13.0900 | 2.5540 |
| −3.8144 | 13.0900 | 2.6224 |
| −3.8857 | 13.0900 | 2.6920 |
| −3.9567 | 13.0900 | 2.7615 |
| −4.0278 | 13.0900 | 2.8308 |
| −4.1002 | 13.0900 | 2.8986 |
| −4.1739 | 13.0900 | 2.9652 |
| −4.2477 | 13.0900 | 3.0315 |
| −4.3224 | 13.0900 | 3.0969 |
| −4.3971 | 13.0900 | 3.1623 |
| −4.4720 | 13.0900 | 3.2272 |
| −4.5479 | 13.0900 | 3.2912 |
| −4.6242 | 13.0900 | 3.3551 |
| −4.7005 | 13.0900 | 3.4179 |
| −4.7794 | 13.0900 | 3.4769 |
| −4.8603 | 13.0900 | 3.5340 |
| −4.9422 | 13.0900 | 3.5871 |
| −4.9821 | 13.0900 | 3.6028 |
| −5.0252 | 13.0900 | 3.5849 |
| −5.0672 | 13.0900 | 3.5392 |
| −1.5672 | 13.1900 | −0.2518 |
| −1.6095 | 13.1900 | −0.1618 |
| −1.6618 | 13.1900 | −0.0786 |
| −1.7199 | 13.1900 | 0.0026 |
| −1.7787 | 13.1900 | 0.0840 |
| −1.8357 | 13.1900 | 0.1657 |
| −1.8937 | 13.1900 | 0.2469 |
| −1.9491 | 13.1900 | 0.3298 |
| −2.0056 | 13.1900 | 0.4118 |
| −2.0618 | 13.1900 | 0.4938 |
| −2.1201 | 13.1900 | 0.5741 |
| −2.1781 | 13.1900 | 0.6552 |
| −2.2359 | 13.1900 | 0.7358 |
| −2.2951 | 13.1900 | 0.8159 |
| −2.3546 | 13.1900 | 0.8954 |
| −2.4158 | 13.1900 | 0.9740 |
| −2.4755 | 13.1900 | 1.0537 |
| −2.5365 | 13.1900 | 1.1321 |
| −2.5972 | 13.1900 | 1.2115 |
| −2.6567 | 13.1900 | 1.2910 |
| −2.7186 | 13.1900 | 1.3683 |
| −2.7813 | 13.1900 | 1.4453 |
| −2.8449 | 13.1900 | 1.5218 |
| −2.9076 | 13.1900 | 1.5992 |
| −2.9705 | 13.1900 | 1.6763 |

TABLE I-continued

| X | Y | Z |
|---|---|---|
| −3.0332 | 13.1900 | 1.7536 |
| −3.0964 | 13.1900 | 1.8300 |
| −3.1612 | 13.1900 | 1.9061 |
| −3.2234 | 13.1900 | 1.9826 |
| −3.2922 | 13.1900 | 2.0544 |
| −3.3594 | 13.1900 | 2.1300 |
| −3.4273 | 13.1900 | 2.2019 |
| −3.4963 | 13.1900 | 2.2735 |
| −3.5655 | 13.1900 | 2.3445 |
| −3.6358 | 13.1900 | 2.4145 |
| −3.7066 | 13.1900 | 2.4844 |
| −3.7779 | 13.1900 | 2.5533 |
| −3.8502 | 13.1900 | 2.6216 |
| −3.9217 | 13.1900 | 2.6911 |
| −3.9927 | 13.1900 | 2.7606 |
| −4.0641 | 13.1900 | 2.8294 |
| −4.1370 | 13.1900 | 2.8969 |
| −4.2108 | 13.1900 | 2.9638 |
| −4.2843 | 13.1900 | 3.0306 |
| −4.3589 | 13.1900 | 3.0959 |
| −4.4344 | 13.1900 | 3.1608 |
| −4.5090 | 13.1900 | 3.2266 |
| −4.5844 | 13.1900 | 3.2907 |
| −4.6614 | 13.1900 | 3.3536 |
| −4.7382 | 13.1900 | 3.4165 |
| −4.8160 | 13.1900 | 3.4764 |
| −4.8986 | 13.1900 | 3.5325 |
| −4.9786 | 13.1900 | 3.5826 |
| −4.9896 | 13.1900 | 3.5857 |
| −5.0364 | 13.1900 | 3.5651 |
| −5.0809 | 13.1900 | 3.5161 |
| −1.6583 | 13.2902 | −0.1857 |
| −1.6974 | 13.2902 | −0.0945 |
| −1.7484 | 13.2902 | −0.0103 |
| −1.8054 | 13.2902 | 0.0723 |
| −1.8617 | 13.2902 | 0.1554 |
| −1.9172 | 13.2902 | 0.2381 |
| −1.9731 | 13.2902 | 0.3208 |
| −2.0280 | 13.2902 | 0.4042 |
| −2.0841 | 13.2902 | 0.4863 |
| −2.1410 | 13.2902 | 0.5681 |
| −2.1982 | 13.2902 | 0.6493 |
| −2.2570 | 13.2902 | 0.7292 |
| −2.3170 | 13.2902 | 0.8091 |
| −2.3764 | 13.2902 | 0.8892 |
| −2.4370 | 13.2902 | 0.9684 |
| −2.4970 | 13.2902 | 1.0482 |
| −2.5571 | 13.2902 | 1.1273 |
| −2.6185 | 13.2902 | 1.2057 |
| −2.6801 | 13.2902 | 1.2842 |
| −2.7419 | 13.2902 | 1.3622 |
| −2.8050 | 13.2902 | 1.4391 |
| −2.8686 | 13.2902 | 1.5156 |
| −2.9323 | 13.2902 | 1.5925 |
| −2.9951 | 13.2902 | 1.6701 |
| −3.0580 | 13.2902 | 1.7474 |
| −3.1216 | 13.2902 | 1.8238 |
| −3.1864 | 13.2902 | 1.8997 |
| −3.2500 | 13.2902 | 1.9754 |
| −3.3187 | 13.2902 | 2.0475 |
| −3.3864 | 13.2902 | 2.1218 |
| −3.4550 | 13.2902 | 2.1935 |
| −3.5242 | 13.2902 | 2.2652 |
| −3.5937 | 13.2902 | 2.3361 |
| −3.6643 | 13.2902 | 2.4065 |
| −3.7344 | 13.2902 | 2.4769 |
| −3.8067 | 13.2902 | 2.5450 |
| −3.8789 | 13.2902 | 2.6136 |
| −3.9512 | 13.2902 | 2.6823 |
| −4.0224 | 13.2902 | 2.7523 |
| −4.0936 | 13.2902 | 2.8213 |
| −4.1671 | 13.2902 | 2.8883 |
| −4.2410 | 13.2902 | 2.9554 |
| −4.3146 | 13.2902 | 3.0220 |
| −4.3900 | 13.2902 | 3.0872 |
| −4.4650 | 13.2902 | 3.1524 |
| −4.5415 | 13.2902 | 3.2164 |

TABLE I-continued

| X | Y | Z |
|---|---|---|
| −4.6167 | 13.2902 | 3.2818 |
| −4.6937 | 13.2902 | 3.3446 |
| −4.7708 | 13.2902 | 3.4077 |
| −4.8488 | 13.2902 | 3.4673 |
| −4.9317 | 13.2902 | 3.5243 |
| −4.9890 | 13.2902 | 3.5597 |
| −5.0456 | 13.2902 | 3.5487 |
| −5.0980 | 13.2902 | 3.4900 |
| −1.7537 | 13.3900 | −0.1083 |
| −1.7919 | 13.3900 | −0.0153 |
| −1.8422 | 13.3900 | 0.0698 |
| −1.8972 | 13.3900 | 0.1543 |
| −1.9513 | 13.3900 | 0.2385 |
| −2.0042 | 13.3900 | 0.3226 |
| −2.0598 | 13.3900 | 0.4055 |
| −2.1138 | 13.3900 | 0.4894 |
| −2.1696 | 13.3900 | 0.5711 |
| −2.2276 | 13.3900 | 0.6520 |
| −2.2858 | 13.3900 | 0.7326 |
| −2.3450 | 13.3900 | 0.8126 |
| −2.4051 | 13.3900 | 0.8921 |
| −2.4654 | 13.3900 | 0.9717 |
| −2.5251 | 13.3900 | 1.0513 |
| −2.5859 | 13.3900 | 1.1297 |
| −2.6482 | 13.3900 | 1.2077 |
| −2.7098 | 13.3900 | 1.2861 |
| −2.7720 | 13.3900 | 1.3636 |
| −2.8345 | 13.3900 | 1.4406 |
| −2.8976 | 13.3900 | 1.5173 |
| −2.9604 | 13.3900 | 1.5944 |
| −3.0238 | 13.3900 | 1.6709 |
| −3.0878 | 13.3900 | 1.7471 |
| −3.1513 | 13.3900 | 1.8244 |
| −3.2130 | 13.3900 | 1.9011 |
| −3.2813 | 13.3900 | 1.9728 |
| −3.3499 | 13.3900 | 2.0465 |
| −3.4183 | 13.3900 | 2.1184 |
| −3.4872 | 13.3900 | 2.1902 |
| −3.5560 | 13.3900 | 2.2617 |
| −3.6257 | 13.3900 | 2.3325 |
| −3.6952 | 13.3900 | 2.4032 |
| −3.7666 | 13.3900 | 2.4722 |
| −3.8384 | 13.3900 | 2.5410 |
| −3.9106 | 13.3900 | 2.6093 |
| −3.9822 | 13.3900 | 2.6780 |
| −4.0545 | 13.3900 | 2.7462 |
| −4.1262 | 13.3900 | 2.8154 |
| −4.1989 | 13.3900 | 2.8827 |
| −4.2731 | 13.3900 | 2.9490 |
| −4.3471 | 13.3900 | 3.0153 |
| −4.4220 | 13.3900 | 3.0804 |
| −4.4975 | 13.3900 | 3.1449 |
| −4.5730 | 13.3900 | 3.2094 |
| −4.6495 | 13.3909 | 3.2737 |
| −4.7242 | 13.3900 | 3.3385 |
| −4.8032 | 13.3900 | 3.3984 |
| −4.8821 | 13.3900 | 3.4585 |
| −4.9647 | 13.3900 | 3.5143 |
| −5.0132 | 13.3900 | 3.5419 |
| −5.0591 | 13.3900 | 3.5286 |
| −5.0954 | 13.3900 | 3.4880 |
| −1.8396 | 13.4900 | −0.0638 |
| −1.8704 | 13.4900 | 0.0328 |
| −1.9175 | 13.4900 | 0.1199 |
| −1.9681 | 13.4900 | 0.2046 |
| −2.0196 | 13.4900 | 0.2899 |
| −2.0718 | 13.4900 | 0.374a |
| −2.1244 | 13.4900 | 0.4592 |
| −2.1796 | 13.4900 | 0.5417 |
| −2.2363 | 13.4900 | 0.6236 |
| −2.2933 | 13.4900 | 0.7047 |
| −2.3533 | 13.4900 | 0.7841 |
| −2.4128 | 13.4900 | 0.8645 |
| −2.4728 | 13.4900 | 0.9440 |
| −2.5333 | 13.4900 | 1.0232 |
| −2.5942 | 13.4900 | 1.1019 |
| −2.6556 | 13.4900 | 1.1803 |

TABLE I-continued

| X | Y | Z |
|---|---|---|
| −2.7176 | 13.4900 | 1.2584 |
| −2.7795 | 13.4900 | 1.3365 |
| −2.8415 | 13.4900 | 1.4143 |
| −2.9046 | 13.4900 | 1.4910 |
| −2.9679 | 13.4900 | 1.5679 |
| −3.0317 | 13.4900 | 1.6445 |
| −3.0955 | 13.4900 | 1.7212 |
| −3.1594 | 13.4900 | 1.7981 |
| −3.2217 | 13.4900 | 1.8748 |
| −3.2902 | 13.4900 | 1.9460 |
| −3.3603 | 13.4900 | 2.0190 |
| −3.4271 | 13.4900 | 2.0930 |
| −3.4960 | 13.4900 | 2.1642 |
| −3.5659 | 13.4900 | 2.2355 |
| −3.6350 | 13.4900 | 2.3071 |
| −3.7049 | 13.4900 | 2.3775 |
| −3.7760 | 13.4900 | 2.4471 |
| −3.8478 | 13.4900 | 2.5158 |
| −3.9205 | 13.4900 | 2.5839 |
| −3.9926 | 13.4900 | 2.6530 |
| −4.0647 | 13.4900 | 2.7215 |
| −4.1369 | 13.4900 | 2.7902 |
| −4.2096 | 13.4900 | 2.8578 |
| −4.2841 | 13.4900 | 2.9240 |
| −4.3586 | 13.4900 | 2.9899 |
| −4.4342 | 13.4900 | 3.0542 |
| −4.5106 | 13.4900 | 3.1185 |
| −4.5857 | 13.4900 | 3.1832 |
| −4.6638 | 13.4900 | 3.2449 |
| −4.7403 | 13.4900 | 3.3096 |
| −4.8162 | 13.4900 | 3.3730 |
| −4.8944 | 13.4900 | 3.4327 |
| −4.9763 | 13.4900 | 3.4892 |
| −5.0206 | 13.4900 | 3.5139 |
| −5.0868 | 13.4900 | 3.4914 |
| −5.1302 | 13.4900 | 3.4323 |
| −1.9363 | 13.5900 | 0.0098 |
| −1.9632 | 13.5900 | 0.1084 |
| −2.0072 | 13.5900 | 0.1967 |
| −2.0538 | 13.5900 | 0.2782 |
| −2.1039 | 13.5900 | 0.3645 |
| −2.1544 | 13.5900 | 0.4498 |
| −2.2078 | 13.5900 | 0.5332 |
| −2.2627 | 13.5900 | 0.6158 |
| −2.3192 | 13.5900 | 0.6969 |
| −2.3777 | 13.5900 | 0.7770 |
| −2.4373 | 13.5900 | 0.8570 |
| −2.4967 | 13.5900 | 0.9363 |
| −2.5588 | 13.5900 | 1.0143 |
| −2.6189 | 13.5900 | 1.0936 |
| −2.6808 | 13.5900 | 1.1715 |
| −2.7420 | 13.5900 | 1.2501 |
| −2.8043 | 13.5900 | 1.3276 |
| −2.8656 | 13.5900 | 1.4060 |
| −2.9283 | 13.5900 | 1.4826 |
| −2.9913 | 13.5900 | 1.5596 |
| −3.0547 | 13.5900 | 1.6364 |
| −3.1183 | 13.5900 | 1.7128 |
| −3.1822 | 13.5900 | 1.7888 |
| −3.2475 | 13.5900 | 1.8632 |
| −3.3146 | 13.5900 | 1.9361 |
| −3.3830 | 13.5900 | 2.0081 |
| −3.4522 | 13.5900 | 2.0800 |
| −3.5201 | 13.5900 | 2.1529 |
| −3.5890 | 13.5900 | 2.2243 |
| −3.6580 | 13.5900 | 2.2954 |
| −3.7284 | 13.5900 | 2.3655 |
| −3.7987 | 13.5900 | 2.4359 |
| −3.8704 | 13.5900 | 2.5046 |
| −3.9427 | 13.5900 | 2.5727 |
| −4.0159 | 13.5900 | 2.6405 |
| −4.0877 | 13.5900 | 2.7095 |
| −4.1600 | 13.5900 | 2.7773 |
| −4.2336 | 13.5900 | 2.8442 |
| −4.3076 | 13.5900 | 2.9106 |
| −4.3826 | 13.5900 | 2.9754 |
| −4.4589 | 13.5900 | 3.0395 |

TABLE I-continued

| X | Y | Z |
|---|---|---|
| −4.5343 | 13.5900 | 3.1042 |
| −4.6110 | 13.5900 | 3.1667 |
| −4.6893 | 13.5900 | 3.2275 |
| −4.7684 | 13.5900 | 3.2901 |
| −4.8416 | 13.5900 | 3.3580 |
| −4.9204 | 13.5900 | 3.4183 |
| −5.0031 | 13.5900 | 3.4740 |
| −5.0421 | 13.5900 | 3.4949 |
| −5.0926 | 13.5900 | 3.4788 |
| −5.1399 | 13.5900 | 3.4140 |
| −2.0329 | 13.6901 | 0.0957 |
| −2.0596 | 13.6901 | 0.1945 |
| −2.1023 | 13.6901 | 0.2837 |
| −2.1495 | 13.6901 | 0.3733 |
| −2.1989 | 13.6901 | 0.4593 |
| −2.2508 | 13.6901 | 0.5436 |
| −2.3056 | 13.6901 | 0.6262 |
| −2.3612 | 13.6901 | 0.7082 |
| −2.4193 | 13.6901 | 0.7887 |
| −2.4783 | 13.6901 | 0.8692 |
| −2.5373 | 13.6901 | 0.9490 |
| −2.5983 | 13.6901 | 1.0273 |
| −2.6593 | 13.6901 | 1.1059 |
| −2.7211 | 13.6901 | 1.1839 |
| −2.7829 | 13.6901 | 1.2618 |
| −2.8460 | 13.6901 | 1.3390 |
| −2.9069 | 13.6901 | 1.4179 |
| −2.9692 | 13.6901 | 1.4947 |
| −3.0321 | 13.6901 | 1.5715 |
| −3.0961 | 13.6901 | 1.6478 |
| −3.1600 | 13.6901 | 1.7241 |
| −3.2247 | 13.6901 | 1.7992 |
| −3.2905 | 13.6901 | 1.8734 |
| −3.3573 | 13.6901 | 1.9465 |
| −3.4254 | 13.6901 | 2.0193 |
| −3.4933 | 13.6901 | 2.0920 |
| −3.5625 | 13.6901 | 2.1632 |
| −3.6317 | 13.6901 | 2.2344 |
| −3.7021 | 13.6901 | 2.3043 |
| −3.7725 | 13.6901 | 2.3747 |
| −3.8435 | 13.6901 | 2.4442 |
| −3.9148 | 13.6901 | 2.5134 |
| −3.9862 | 13.6901 | 2.5823 |
| −4.0586 | 13.6901 | 2.6501 |
| −4.1312 | 13.6901 | 2.7177 |
| −4.2046 | 13.6901 | 2.7845 |
| −4.2789 | 13.6901 | 2.8505 |
| −4.3543 | 13.6901 | 2.9157 |
| −4.4291 | 13.6901 | 2.9812 |
| −4.5052 | 13.6901 | 3.0449 |
| −4.5816 | 13.6901 | 3.1088 |
| −4.6576 | 13.6901 | 3.1721 |
| −4.7360 | 13.6901 | 3.2348 |
| −4.8102 | 13.6901 | 3.3011 |
| −4.8896 | 13.6901 | 3.3607 |
| −4.9710 | 13.6901 | 3.4189 |
| −5.0521 | 13.6901 | 3.4687 |
| −5.0572 | 13.6901 | 3.4706 |
| −5.1044 | 13.6901 | 3.4587 |
| −5.1507 | 13.6901 | 3.3952 |
| −2.1339 | 13.7900 | 0.1694 |
| −2.1512 | 13.7900 | 0.2739 |
| −2.1880 | 13.7900 | 0.3655 |
| −2.2272 | 13.7900 | 0.4407 |
| −2.2781 | 13.7900 | 0.5247 |
| −2.3340 | 13.7900 | 0.6072 |
| −2.3862 | 13.7900 | 0.6916 |
| −2.4429 | 13.7900 | 0.7727 |
| −2.5006 | 13.7900 | 0.8540 |
| −2.5604 | 13.7900 | 0.9333 |
| −2.6205 | 13.7900 | 1.0123 |
| −2.6817 | 13.7900 | 1.0904 |
| −2.7430 | 13.7900 | 1.1689 |
| −2.8043 | 13.7900 | 1.2469 |
| −2.8676 | 13.7900 | 1.3240 |
| −2.9284 | 13.7900 | 1.4033 |
| −2.9898 | 13.7900 | 1.4807 |

TABLE I-continued

| X | Y | Z |
|---|---|---|
| −3.0528 | 13.7900 | 1.5574 |
| −3.1165 | 13.7900 | 1.6337 |
| −3.1813 | 13.7900 | 1.7090 |
| −3.2462 | 13.7900 | 1.7845 |
| −3.3112 | 13.7900 | 1.8590 |
| −3.3786 | 13.7900 | 1.9316 |
| −3.4463 | 13.7900 | 2.0048 |
| −3.5141 | 13.7900 | 2.0775 |
| −3.5828 | 13.7900 | 2.1493 |
| −3.6519 | 13.7900 | 2.2207 |
| −3.7218 | 13.7900 | 2.2911 |
| −3.7922 | 13.7900 | 2.3612 |
| −3.8626 | 13.7900 | 2.4313 |
| −3.9340 | 13.7900 | 2.5004 |
| −4.0059 | 13.7900 | 2.5689 |
| −4.0784 | 13.7900 | 2.6368 |
| −4.1514 | 13.7900 | 2.7037 |
| −4.2258 | 13.7900 | 2.7698 |
| −4.3000 | 13.7900 | 2.8361 |
| −4.3754 | 13.7900 | 2.9009 |
| −4.4510 | 13.7900 | 2.9659 |
| −4.5264 | 13.7900 | 3.0303 |
| −4.6030 | 13.7900 | 3.0938 |
| −4.6790 | 13.7900 | 3.1579 |
| −4.7560 | 13.7900 | 3.2205 |
| −4.8334 | 13.7900 | 3.2829 |
| −4.9122 | 13.7900 | 3.3421 |
| −4.9947 | 13.7900 | 3.3985 |
| −5.0747 | 13.7900 | 3.4495 |
| −5.0775 | 13.7900 | 3.4506 |
| −5.1122 | 13.7900 | 3.4418 |
| −5.1453 | 13.7900 | 3.3978 |
| −2.2301 | 13.8900 | 0.2787 |
| −2.2536 | 13.8900 | 0.3820 |
| −2.2922 | 13.8900 | 0.4727 |
| −2.3403 | 13.8900 | 0.5582 |
| −2.3966 | 13.8900 | 0.6403 |
| −2.4500 | 13.8900 | 0.7264 |
| −2.5065 | 13.8900 | 0.8073 |
| −2.5658 | 13.8900 | 0.8877 |
| −2.6251 | 13.8900 | 0.9676 |
| −2.6859 | 13.8900 | 1.0463 |
| −2.7470 | 13.8900 | 1.1248 |
| −2.8089 | 13.8900 | 1.2030 |
| −2.8702 | 13.8900 | 1.2821 |
| −2.9302 | 13.8900 | 1.3614 |
| −2.9922 | 13.8900 | 1.4388 |
| −3.0546 | 13.8900 | 1.5162 |
| −3.1178 | 13.8900 | 1.5929 |
| −3.1817 | 13.8900 | 1.6691 |
| −3.2470 | 13.8900 | 1.7441 |
| −3.3129 | 13.8900 | 1.8186 |
| −3.3793 | 13.8900 | 1.8927 |
| −3.4461 | 13.8900 | 1.9664 |
| −3.5137 | 13.8900 | 2.0393 |
| −3.5824 | 13.8900 | 2.1113 |
| −3.6515 | 13.8900 | 2.1829 |
| −3.7211 | 13.8900 | 2.2538 |
| −3.7911 | 13.8900 | 2.3241 |
| −3.8620 | 13.8900 | 2.3935 |
| −3.9337 | 13.8900 | 2.4626 |
| −4.0057 | 13.8900 | 2.5316 |
| −4.0778 | 13.8900 | 2.5995 |
| −4.1518 | 13.8900 | 2.6656 |
| −4.2254 | 13.8900 | 2.7324 |
| −4.3001 | 13.8900 | 2.7982 |
| −4.3742 | 13.8900 | 2.8651 |
| −4.4492 | 13.8900 | 2.9301 |
| −4.5253 | 13.8900 | 2.9943 |
| −4.6017 | 13.8900 | 3.0580 |
| −4.6783 | 13.8900 | 3.1215 |
| −4.7553 | 13.8900 | 3.1841 |
| −4.8339 | 13.8900 | 3.2451 |
| −4.9126 | 13.8900 | 3.3053 |
| −4.9945 | 13.8900 | 3.3602 |
| −5.0789 | 13.8900 | 3.4142 |
| −5.0934 | 13.8900 | 3.4225 |

TABLE I-continued

| X | Y | Z |
|---|---|---|
| −5.1418 | 13.8900 | 3.3912 |
| −5.1902 | 13.8900 | 3.3191 |
| −2.3405 | 13.9900 | 0.3750 |
| −2.3577 | 13.9900 | 0.4787 |
| −2.3953 | 13.9900 | 0.5694 |
| −2.4360 | 13.9900 | 0.6374 |
| −2.4909 | 13.9900 | 0.7217 |
| −2.5463 | 13.9900 | 0.8037 |
| −2.6061 | 13.9900 | 0.8830 |
| −2.6663 | 13.9900 | 0.9625 |
| −2.7268 | 13.9900 | 1.0416 |
| −2.7878 | 13.9900 | 1.1203 |
| −2.8485 | 13.9900 | 1.1995 |
| −2.9087 | 13.9900 | 1.2793 |
| −2.9684 | 13.9900 | 1.3586 |
| −3.0303 | 13.9900 | 1.4364 |
| −3.0918 | 13.9900 | 1.5141 |
| −3.1564 | 13.9900 | 1.5897 |
| −3.2201 | 13.9900 | 1.6667 |
| −3.2849 | 13.9900 | 1.7417 |
| −3.3515 | 13.9900 | 1.8159 |
| −3.4173 | 13.9900 | 1.8907 |
| −3.4838 | 13.9900 | 1.9643 |
| −3.5521 | 13.9900 | 2.0367 |
| −3.6209 | 13.9900 | 2.1087 |
| −3.6902 | 13.9900 | 2.1800 |
| −3.7603 | 13.9900 | 2.2504 |
| −3.8309 | 13.9900 | 2.3202 |
| −3.9023 | 13.9900 | 2.3894 |
| −3.9739 | 13.9900 | 2.4582 |
| −4.0471 | 13.9900 | 2.5258 |
| −4.1198 | 13.9900 | 2.5927 |
| −4.1964 | 13.9900 | 2.6564 |
| −4.2692 | 13.9900 | 2.7259 |
| −4.3421 | 13.9900 | 2.7933 |
| −4.4177 | 13.9900 | 2.8586 |
| −4.4918 | 13.9900 | 2.9253 |
| −4.5673 | 13.9900 | 2.9893 |
| −4.6439 | 13.9900 | 3.0529 |
| −4.7205 | 13.9900 | 3.1161 |
| −4.7974 | 13.9900 | 3.1784 |
| −4.8764 | 13.9900 | 3.2389 |
| −4.9557 | 13.9900 | 3.2972 |
| −5.0401 | 13.9900 | 3.3529 |
| −5.0996 | 13.9900 | 3.3895 |
| −5.1456 | 13.9900 | 3.3728 |
| −5.1882 | 13.9900 | 3.2974 |
| −2.4614 | 14.0901 | 0.5092 |
| −2.4911 | 14.0901 | 0.6070 |
| −2.5331 | 14.0901 | 0.6954 |
| −2.5835 | 14.0901 | 0.7801 |
| −2.6400 | 14.0901 | 0.8609 |
| −2.6994 | 14.0901 | 0.9409 |
| −2.7596 | 14.0901 | 1.0190 |
| −2.8233 | 14.0901 | 1.0966 |
| −2.8803 | 14.0901 | 1.1796 |
| −2.9396 | 14.0901 | 1.2604 |
| −2.9997 | 14.0901 | 1.3397 |
| −3.0605 | 14.0901 | 1.4179 |
| −3.1227 | 14.0901 | 1.4952 |
| −3.1854 | 14.0901 | 1.5716 |
| −3.2511 | 14.0901 | 1.6467 |
| −3.3153 | 14.0901 | 1.7220 |
| −3.3836 | 14.0901 | 1.7947 |
| −3.4478 | 14.0901 | 1.8716 |
| −3.5142 | 14.0901 | 1.9453 |
| −3.5823 | 14.0901 | 2.0176 |
| −3.6515 | 14.0901 | 2.0893 |
| −3.7205 | 14.0901 | 2.1606 |
| −3.7913 | 14.0901 | 2.2301 |
| −3.8622 | 14.0901 | 2.2997 |
| −3.9344 | 14.0901 | 2.3674 |
| −4.0076 | 14.0901 | 2.4354 |
| −4.0793 | 14.0901 | 2.5043 |
| −4.1527 | 14.0901 | 2.5694 |
| −4.2306 | 14.0901 | 2.6330 |
| −4.3016 | 14.0901 | 2.7040 |

TABLE I-continued

| X | Y | Z |
|---|---|---|
| −4.3762 | 14.0901 | 2.7710 |
| −4.4511 | 14.0901 | 2.8374 |
| −4.5256 | 14.0901 | 2.9037 |
| −4.5998 | 14.0901 | 2.9693 |
| −4.6763 | 14.0901 | 3.0331 |
| −4.7514 | 14.0901 | 3.0977 |
| −4.8296 | 14.0901 | 3.1583 |
| −4.9082 | 14.0901 | 3.2192 |
| −4.9886 | 14.0901 | 3.2758 |
| −5.0730 | 14.0901 | 3.3302 |
| −5.1070 | 14.0901 | 3.3514 |
| −5.1491 | 14.0901 | 3.3550 |
| −5.2002 | 14.0901 | 3.2711 |
| −2.6309 | 14.1900 | 0.6955 |
| −2.6697 | 14.1900 | 0.7890 |
| −2.7169 | 14.1900 | 0.8753 |
| −2.7706 | 14.1900 | 0.9582 |
| −2.8287 | 14.1900 | 1.0384 |
| −2.8885 | 14.1900 | 1.1183 |
| −2.9473 | 14.1900 | 1.1991 |
| −3.0060 | 14.1900 | 1.2795 |
| −3.0660 | 14.1900 | 1.3586 |
| −3.1273 | 14.1900 | 1.4367 |
| −3.1893 | 14.1900 | 1.5140 |
| −3.2533 | 14.1900 | 1.5900 |
| −3.3177 | 14.1900 | 1.6657 |
| −3.3838 | 14.1900 | 1.7402 |
| −3.4495 | 14.1900 | 1.8148 |
| −3.5162 | 14.1900 | 1.8880 |
| −3.5836 | 14.1900 | 1.9608 |
| −3.6523 | 14.1900 | 2.0325 |
| −3.7220 | 14.1900 | 2.1035 |
| −3.7921 | 14.1900 | 2.1739 |
| −3.8629 | 14.1900 | 2.2431 |
| −3.9349 | 14.1900 | 2.3106 |
| −4.0098 | 14.1900 | 2.3765 |
| −4.0822 | 14.1900 | 2.4467 |
| −4.1525 | 14.1900 | 2.5147 |
| −4.2304 | 14.1900 | 2.5770 |
| −4.3053 | 14.1900 | 2.6481 |
| −4.3777 | 14.1900 | 2.7164 |
| −4.4512 | 14.1900 | 2.7831 |
| −4.5262 | 14.1900 | 2.8486 |
| −4.6015 | 14.1900 | 2.9139 |
| −4.6769 | 14.1900 | 2.9783 |
| −4.7536 | 14.1900 | 3.0412 |
| −4.8308 | 14.1900 | 3.1034 |
| −4.9090 | 14.1900 | 3.1647 |
| −4.9876 | 14.1900 | 3.2246 |
| −5.0697 | 14.1900 | 3.2808 |
| −5.1129 | 14.1900 | 3.3078 |
| −5.1608 | 14.1900 | 3.3154 |
| −5.1948 | 14.1900 | 3.2673 |
| −2.9203 | 14.2900 | 1.0327 |
| −2.9708 | 14.2900 | 1.1193 |
| −3.0263 | 14.2900 | 1.2016 |
| −3.0832 | 14.2900 | 1.2839 |
| −3.1411 | 14.2900 | 1.3646 |
| −3.2006 | 14.2900 | 1.4437 |
| −3.2625 | 14.2900 | 1.5212 |
| −3.3253 | 14.2900 | 1.5982 |
| −3.3897 | 14.2900 | 1.6743 |
| −3.4543 | 14.2900 | 1.7499 |
| −3.5205 | 14.2900 | 1.8238 |
| −3.5876 | 14.2900 | 1.8970 |
| −3.6556 | 14.2900 | 1.9698 |
| −3.7241 | 14.2900 | 2.0418 |
| −3.7946 | 14.2900 | 2.1118 |
| −3.8659 | 14.2900 | 2.1819 |
| −3.9359 | 14.2900 | 2.2522 |
| −4.0086 | 14.2900 | 2.3192 |
| −4.0831 | 14.2900 | 2.3865 |
| −4.1542 | 14.2900 | 2.4565 |
| −4.2279 | 14.2900 | 2.5222 |
| −4.3034 | 14.2900 | 2.5878 |
| −4.3774 | 14.2900 | 2.6549 |
| −4.4511 | 14.2900 | 2.7212 |

TABLE I-continued

| X | Y | Z |
|---|---|---|
| −4.5262 | 14.2900 | 2.7866 |
| −4.6015 | 14.2900 | 2.8518 |
| −4.6783 | 14.2900 | 2.9151 |
| −4.7554 | 14.2900 | 2.9785 |
| −4.8323 | 14.2900 | 3.0410 |
| −4.9115 | 14.2900 | 3.1018 |
| −4.9887 | 14.2900 | 3.1631 |
| −5.0714 | 14.2900 | 3.2210 |
| −5.1387 | 14.2900 | 3.2643 |
| −5.1795 | 14.2900 | 3.2577 |
| −5.2153 | 14.2900 | 3.2082 |
| −3.5006 | 14.3900 | 1.6745 |
| −3.5627 | 14.3900 | 1.7528 |
| −3.6254 | 14.3900 | 1.8298 |
| −3.6903 | 14.3900 | 1.9051 |
| −3.7565 | 14.3900 | 1.9794 |
| −3.8237 | 14.3900 | 2.0530 |
| −3.8918 | 14.3900 | 2.1254 |
| −3.9618 | 14.3900 | 2.1958 |
| −4.0334 | 14.3900 | 2.2646 |
| −4.1061 | 14.3900 | 2.3324 |
| −4.1795 | 14.3900 | 2.3995 |
| −4.2539 | 14.3900 | 2.4660 |
| −4.3278 | 14.3900 | 2.5327 |
| −4.4026 | 14.3900 | 2.5984 |
| −4.4774 | 14.3900 | 2.6642 |
| −4.5523 | 14.3900 | 2.7298 |
| −4.6273 | 14.3900 | 2.7956 |
| −4.7028 | 14.3900 | 2.8596 |
| −4.7813 | 14.3900 | 2.9210 |
| −4.8591 | 14.3900 | 2.9835 |
| −4.9379 | 14.3900 | 3.0443 |
| −5.0166 | 14.3900 | 3.1039 |
| −5.0989 | 14.3900 | 3.1627 |
| −5.1577 | 14.3900 | 3.2007 |
| −5.2097 | 14.3900 | 3.1855 |
| −5.2378 | 14.3900 | 3.1173 |
| −0.0021 | 12.4714 | 0.8063 |
| −0.2140 | 12.4782 | 0.8063 |
| −0.4872 | 12.5256 | 0.8063 |
| −0.7314 | 12.5952 | 0.8063 |
| −0.9554 | 12.6898 | 0.8061 |
| −1.2055 | 12.8428 | 0.8063 |
| −1.3727 | 12.9815 | 0.8063 |
| −1.5197 | 13.1330 | 0.8063 |
| −1.6854 | 13.3012 | 0.8063 |
| −1.8363 | 13.4771 | 0.8063 |
| −2.0097 | 13.6514 | 0.8063 |
| −2.1413 | 13.7850 | 0.8063 |
| −2.3519 | 13.9872 | 0.8063 |
| −2.5520 | 14.1228 | 0.8063 |
| −2.6691 | 14.1803 | 0.8063 |
| −2.7468 | 14.2196 | 0.8063 |
| −2.9352 | 14.2792 | 0.8063 |
| −3.0673 | 14.3104 | 0.8063 |
| −3.1912 | 14.3340 | 0.8063 |
| −3.3034 | 14.3509 | 0.8063 |
| −3.4516 | 14.3721 | 0.8063 |
| −3.6269 | 14.3916 | 0.8063 |
| −3.7820 | 14.4078 | 0.8063 |
| −3.9972 | 14.4277 | 0.8063 |
| −4.1765 | 14.4391 | 0.8063 |
| −4.3592 | 14.4460 | 0.8063 |
| −4.4891 | 14.4494 | 0.8063 |
| −4.6969 | 14.4566 | 0.8063 |
| −4.9122 | 14.4524 | 0.8063 |
| −5.0643 | 14.4447 | 0.8063 |
| −5.2064 | 14.4120 | 0.8063 |
| −0.4540 | 10.4663 | 0.8063 |
| −0.3581 | 10.4608 | 0.8063 |
| −0.2262 | 10.4524 | 0.8063 |
| −0.1265 | 10.4440 | 0.8063 |
| −0.0517 | 10.4410 | 0.8063 |
| −0.0009 | 10.4407 | 0.8063 |
| −4.9551 | 12.8543 | 0.8063 |
| −4.7357 | 12.8226 | 0.8063 |
| −4.4884 | 12.7929 | 0.8063 |

TABLE I-continued

| X | Y | Z |
|---|---|---|
| −4.2637 | 12.7690 | 0.8063 |
| −4.0875 | 12.7528 | 0.8063 |
| −3.8871 | 12.7304 | 0.8063 |
| −3.7336 | 12.7002 | 0.8063 |
| −3.6521 | 12.6938 | 0.8063 |
| −3.5970 | 12.6076 | 0.8063 |
| −3.5425 | 12.4462 | 0.8063 |
| −3.4236 | 12.1767 | 0.8063 |
| −3.3306 | 11.8963 | 0.8063 |
| −3.2338 | 11.5870 | 0.8063 |
| −3.1159 | 11.1772 | 0.8063 |
| −3.0553 | 10.9431 | 0.8063 |
| −2.9931 | 10.7038 | 0.8063 |
| −2.9399 | 10.4326 | 0.8063 |
| −2.8984 | 10.1892 | 0.8063 |
| −2.8626 | 9.8936 | 0.8063 |
| −2.8454 | 9.6172 | 0.8063 |
| −2.8348 | 9.3729 | 0.8063 |
| −2.8198 | 8.9739 | 0.8063 |
| −2.8374 | 8.5530 | 0.8063 |
| −2.8685 | 8.1299 | 0.8063 |
| −2.9083 | 7.7393 | 0.8063 |
| −2.9826 | 7.2670 | 0.8063 |
| −3.0595 | 6.9054 | 0.8063 |
| −3.1482 | 6.5665 | 0.8063 |
| −3.2546 | 6.2832 | 0.8063 |
| −3.3732 | 5.9618 | 0.8063 |
| −3.4977 | 5.6397 | 0.8063 |
| −3.6845 | 5.1937 | 0.8063 |
| −3.8092 | 4.9113 | 0.8063 |
| −3.9459 | 4.5780 | 0.8063 |
| −4.0751 | 4.2689 | 0.8063 |
| −4.2200 | 3.9016 | 0.8063 |
| −4.3503 | 3.5892 | 0.8063 |
| −4.4971 | 3.1363 | 0.8063 |
| −4.5801 | 2.8051 | 0.8063 |
| −4.6371 | 2.4509 | 0.8063 |
| −4.6591 | 2.1481 | 0.8063 |
| −4.6578 | 1.8208 | 0.8063 |
| −4.6291 | 1.5584 | 0.8063 |
| −4.5568 | 1.2584 | 0.8063 |
| −4.4664 | 1.0066 | 0.8063 |
| −4.3200 | 0.6732 | 0.8063 |
| −4.1488 | 0.3674 | 0.8063 |
| −4.0180 | 0.1568 | 0.8063 |
| −4.0325 | 0.1859 | 0.8063 |
| −3.8155 | −0.1755 | 0.8063 |
| −3.6754 | −0.4694 | 0.8063 |
| −3.6189 | −0.6947 | 0.8063 |
| −3.5698 | −0.9258 | 0.8063 |
| −3.5423 | −1.1874 | 0.8063 |
| −3.4590 | −1.4650 | 0.8063 |
| −3.3077 | −1.7087 | 0.8063 |
| −3.0851 | −1.9211 | 0.8063 |
| −2.7750 | −2.0534 | 0.8063 |
| −2.4078 | −2.2163 | 0.8063 |
| −2.2583 | −2.1576 | 0.8063 |
| −1.8418 | −2.1577 | 0.8063 |
| −1.4751 | −2.2167 | 0.8063 |
| −1.0558 | −2.2168 | 0.8063 |
| −0.6442 | −2.3063 | 0.8063 |
| −0.2811 | −2.3061 | 0.8063 |
| −0.0124 | −2.3061 | 0.8063 |
| 0.0043 | −2.3061 | 0.8063 |

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. An equine saddle having a tree, said tree having a first surface and a second surface, a cantle, and a head, said cantle and said head being connected by a pair of side bars, the curvature of said tree being defined along X, Y and Z axes by data points, wherein:

said Y axis is a plane along a length, said length being from said cantle to said head, said Y axis containing multiple Y data points corresponding to predetermined calculations, said X axis being at a 90 degree angle to said Y axis, said X axis containing multiple pairs of opposing X data points corresponding to predetermined calculations, said Z axis being at a 90 degree angle to said X axis and said Y axis, said Z axis containing multiple Z data points corresponding to predetermined calculations, wherein said tree is formed from a series of symmetrical arcs defined by said data points, the apex of each of said arcs being a data point on said Z axis and the ends of each of said arcs being a pair of opposing data points on said X axis, wherein each of said arcs has a data point on the Z axis and a pair of opposing data points on the Y axis for each Y data point, thereby forming a three dimensional tree having a height, width and length based on a pair of at least about 6,000 mirror image data points.

2. The equine saddle of claim 1 wherein each of said pair of side bars has a first surface, a second surface, a first edge and a second edge, said second edge of said side bars enclosing an open seating area.

3. The equine saddle of claim 2 further comprising:

a gullet notch, said gullet notch being within said pair of side bars proximate said head;

a gullet plate, said gullet plate having a lip, said lip dimensioned to fit within said gullet notch, said gullet plate being proximate said second surface of said head;

a top plate, said top plate being proximate said first surface of said head.

4. The equine saddle of claim 1 wherein, said data points on said X axis can deviate up to about 30%, said data points along said Y axis can deviate up to about 20%, said data points forming a curvature incorporating at least 6000 of the following relative values of X, Y and Z:

| X | Y | Z | X | Y | Z | X | Y | Z |
|---|---|---|---|---|---|---|---|---|
| 0.0000 | −2.4072 | −3.0050 | −1.8996 | −2.3444 | −2.8050 | −1.4008 | −2.2892 | −2.6049 |
| −0.1002 | −2.4076 | −3.0050 | −1.9978 | −2.3297 | −2.8050 | −1.4996 | −2.2896 | −2.6049 |
| −0.1997 | −2.4094 | −3.0050 | −2.0960 | −2.3119 | −2.8050 | −1.5995 | −2.2837 | −2.6049 |
| −0.2993 | −2.4074 | −3.0050 | −2.1675 | −2.2957 | −2.8050 | −1.7006 | −2.2822 | −2.6049 |
| −0.3992 | −2.4059 | −3.0050 | 0.0000 | −2.3353 | −2.7052 | −1.8007 | −2.2761 | −2.6049 |
| −0.4992 | −2.4026 | −3.0050 | −0.1000 | −2.3355 | −2.7052 | −1.9016 | −2.2748 | −2.6049 |
| −0.5997 | −2.4013 | −3.0050 | −0.1999 | −2.3361 | −2.7052 | −2.0008 | −2.2704 | −2.6049 |
| −0.6331 | −2.4010 | −3.0050 | −0.2996 | −2.3363 | −2.7052 | −2.1011 | −2.2644 | −2.6049 |
| −0.0001 | −2.3991 | −2.9051 | −0.3995 | −2.3358 | −2.7052 | −2.2009 | −2.2592 | −2.6049 |
| −0.1001 | −2.3998 | −2.9051 | −0.4996 | −2.3359 | −2.7052 | −2.3008 | −2.2513 | −2.6049 |
| −0.1998 | −2.4007 | −2.9051 | −0.5993 | −2.3350 | −2.7052 | −2.4008 | −2.2444 | −2.6049 |
| −0.2998 | −2.4003 | −2.9051 | −0.6994 | −2.3337 | −2.7052 | −2.5004 | −2.2356 | −2.6049 |
| −0.4000 | −2.4018 | −2.9051 | −0.7997 | −2.3325 | −2.7052 | −2.5984 | −2.2240 | −2.6049 |
| −0.4995 | −2.4019 | −2.9051 | −0.8999 | −2.3320 | −2.7052 | −2.6904 | −2.1964 | −2.6049 |
| −0.5995 | −2.4016 | −2.9051 | −1.0000 | −2.3311 | −2.7052 | −2.7284 | −2.1744 | −2.6049 |
| −0.6994 | −2.4014 | −2.9051 | −1.1000 | −2.3309 | −2.7052 | −0.0002 | −2.2501 | −2.5049 |
| −0.7993 | −2.4001 | −2.9051 | −1.2000 | −2.3292 | −2.7052 | −0.1001 | −2.2515 | −2.5049 |
| −0.8995 | −2.3991 | −2.9051 | −1.3002 | −2.3282 | −2.7052 | −0.1998 | −2.2520 | −2.5049 |
| −0.9995 | −2.3978 | −2.9051 | −1.4005 | −2.3261 | −2.7052 | −0.2998 | −2.2520 | −2.5049 |
| −1.0997 | −2.3964 | −2.9051 | −1.5006 | −2.3259 | −2.7052 | −0.3997 | −2.2530 | −2.5049 |
| −1.1997 | −2.3948 | −2.9051 | −1.6005 | −2.3224 | −2.7052 | −0.4993 | −2.2524 | −2.5049 |
| −1.2988 | −2.3901 | −2.9051 | −1.7008 | −2.3208 | −2.7052 | −0.5994 | −2.2512 | −2.5049 |
| −1.3982 | −2.3799 | −2.9051 | −1.8008 | −2.3169 | −2.7052 | −0.6996 | −2.2501 | −2.5049 |
| −1.4989 | −2.3710 | −2.9051 | −1.9010 | −2.3135 | −2.7052 | −0.7997 | −2.2492 | −2.5049 |
| −1.5970 | −2.3600 | −2.9051 | −2.0005 | −2.3081 | −2.7052 | −0.8999 | −2.2481 | −2.5049 |
| −1.6390 | −2.3519 | −2.9051 | −2.1007 | −2.3010 | −2.7052 | −1.0001 | −2.2482 | −2.5049 |
| −0.0002 | −2.3707 | −2.8050 | −2.2009 | −2.2956 | −2.7052 | −1.1002 | −2.2477 | −2.5049 |
| −0.1000 | −2.3712 | −2.8050 | −2.2992 | −2.2871 | −2.7052 | −1.2003 | −2.2492 | −2.5049 |
| −0.1998 | −2.3713 | −2.8050 | −2.3973 | −2.2689 | −2.7052 | −1.2998 | −2.2485 | −2.5049 |
| −0.2996 | −2.3712 | −2.8050 | −2.4877 | −2.2429 | −2.7052 | −1.4001 | −2.2479 | −2.5049 |
| −0.3996 | −2.3709 | −2.8050 | −2.4922 | −2.2403 | −2.7052 | −1.5000 | −2.2471 | −2.5049 |
| −0.4996 | −2.3711 | −2.8050 | −0.0006 | −2.2926 | −2.6049 | −1.6000 | −2.2452 | −2.5049 |
| −0.5994 | −2.3704 | −2.8050 | −0.1001 | −2.2951 | −2.6049 | −1.6997 | −2.2424 | −2.5049 |
| −0.6995 | −2.3698 | −2.8050 | −0.1998 | −2.2953 | −2.6049 | −1.7999 | −2.2366 | −2.5049 |
| −0.7995 | −2.3689 | −2.8050 | −0.2997 | −2.2960 | −2.6049 | −1.9004 | −2.2337 | −2.5049 |
| −0.8996 | −2.3674 | −2.8050 | −0.3995 | −2.2956 | −2.6049 | −2.0001 | −2.2286 | −2.5049 |
| −1.0000 | −2.3665 | −2.8050 | −0.4996 | −2.2959 | −2.6049 | −2.1003 | −2.2229 | −2.5049 |
| −1.1000 | −2.3658 | −2.8050 | −0.5992 | −2.2947 | −2.6049 | −2.2004 | −2.2176 | −2.5049 |
| −1.1999 | −2.3634 | −2.8050 | −0.6994 | −2.2931 | −2.6049 | −2.3002 | −2.2113 | −2.5049 |
| −1.3006 | −2.3617 | −2.8050 | −0.7997 | −2.2916 | −2.6049 | −2.4000 | −2.2035 | −2.5049 |
| −1.4008 | −2.3619 | −2.8050 | −0.9001 | −2.2911 | −2.6049 | −2.4999 | −2.1958 | −2.5049 |
| −1.5005 | −2.3596 | −2.8050 | −1.0002 | −2.2912 | −2.6049 | −2.5990 | −2.1862 | −2.5049 |
| −1.6014 | −2.3594 | −2.8050 | −1.1000 | −2.2907 | −2.6049 | −2.7009 | −2.1772 | −2.5049 |
| −1.7003 | −2.3587 | −2.8050 | −1.2000 | −2.2902 | −2.6049 | −2.7923 | −2.1628 | −2.5049 |
| −1.7999 | −2.3516 | −2.8050 | −1.3000 | −2.2889 | −2.6049 | −2.9024 | −2.1484 | −2.5049 |
| −2.8985 | −2.1512 | −2.5049 | −1.1994 | −2.1596 | −2.3049 | −2.3992 | −2.0731 | −2.2052 |
| 0.0003 | −2.2045 | −2.4051 | −1.2993 | −2.1591 | −2.3049 | −2.4990 | −2.0659 | −2.2052 |
| −0.1001 | −2.2059 | −2.4051 | −1.3993 | −2.1597 | −2.3049 | −2.5989 | −2.0579 | −2.2052 |
| −0.1999 | −2.2063 | −2.4051 | −1.499 | −2.1579 | −2.3049 | −2.6987 | −2.0501 | −2.2052 |
| −0.2997 | −2.2068 | −2.4051 | −2.5992 | −2.1573 | −2.3049 | −2.7986 | −2.0412 | −2.2052 |

-continued

| X | Y | Z | X | Y | Z | X | Y | Z |
|---|---|---|---|---|---|---|---|---|
| −0.3996 | −2.2066 | −2.4051 | −1.6991 | −2.1538 | −2.3049 | −2.8982 | −2.0332 | −2.2052 |
| −0.4997 | −2.2071 | −2.4051 | −1.7993 | −2.1515 | −2.3049 | −2.9982 | −2.0226 | −2.2052 |
| −0.5990 | −2.2069 | −2.4051 | −1.8991 | −2.1461 | −2.3049 | −3.0928 | −2.0086 | −2.2052 |
| −0.6992 | −2.2042 | −2.4051 | −1.9994 | −2.1410 | −2.3049 | −3.1724 | −1.9630 | −2.2052 |
| −0.8000 | −2.2051 | −2.4051 | −2.0995 | −2.1362 | −2.3049 | −0.0003 | −2.0470 | −2.1052 |
| −0.8993 | −2.2048 | −2.4051 | −2.1994 | −2.1305 | −2.3049 | −0.1002 | −2.0484 | −2.1052 |
| −0.9998 | −2.2028 | −2.4051 | −2.2995 | −2.1244 | −2.3049 | −0.2000 | −2.0498 | −2.1052 |
| −1.1004 | −2.2050 | −2.4051 | −2.3994 | −2.1182 | −2.3049 | −0.2997 | −2.0505 | −2.1052 |
| −1.1999 | −2.2048 | −2.4051 | −2.4990 | −2.1107 | −2.3049 | −0.3997 | −2.0513 | −2.1052 |
| −1.3002 | −2.2052 | −2.4051 | −2.5989 | −2.1016 | −2.3049 | −0.4995 | −2.20522 | −2.1052 |
| −1.3997 | −2.2056 | −2.4051 | −2.6988 | −2.0937 | −2.3049 | −0.5993 | −2.0525 | −2.1052 |
| −1.4995 | −2.2035 | −2.4051 | −2.7981 | −2.0842 | −2.3049 | −0.6994 | −2.0528 | −2.1052 |
| −1.6000 | −2.2030 | −2.4051 | −2.8986 | −2.0743 | −2.3049 | −0.7993 | −2.0544 | −2.1052 |
| −1.6994 | −2.2009 | −2.4051 | −2.9943 | −2.0631 | −2.3049 | −0.8991 | −2.0552 | −2.1052 |
| −1.7996 | −2.1960 | −2.4051 | −3.0834 | −2.0172 | −2.3049 | −0.9991 | −2.0562 | −2.1052 |
| −1.8995 | −2.1919 | −2.4051 | −3.0902 | −2.0123 | −2.3049 | −1.0990 | −2.0577 | −2.1052 |
| −1.9992 | −2.1845 | −2.4051 | −0.0003 | −2.1019 | −2.2052 | −1.1987 | −2.0593 | −2.1052 |
| −2.0999 | −2.1788 | −2.4051 | −0.1002 | −2.1037 | −2.2052 | −1.2986 | −2.0596 | −2.1052 |
| −2.2000 | −2.1746 | −2.4051 | −0.1999 | −2.1052 | −2.2052 | −1.3982 | −2.0603 | −2.1052 |
| −2.2997 | −2.1687 | −2.4051 | −0.2996 | −2.1052 | −2.2052 | −1.4976 | −2.0584 | −2.1052 |
| −2.3998 | −2.1614 | −2.4051 | −0.3997 | −2.1056 | −2.2052 | −1.5979 | −2.0553 | −2.1052 |
| −2.4995 | −2.1548 | −2.4051 | −0.4996 | −2.1066 | −2.2052 | −1.6982 | −2.0524 | −2.1052 |
| −2.5989 | −2.1449 | −2.4051 | −0.5994 | −2.1071 | −2.2052 | −1.7984 | −2.0493 | −2.1052 |
| −2.6988 | −2.1355 | −2.4051 | −0.6991 | −2.1074 | −2.2052 | −1.8988 | −2.0462 | −2.1052 |
| −2.7988 | −2.1260 | −2.4051 | −0.7992 | −2.1069 | −2.2052 | −1.9989 | −2.0439 | −2.1052 |
| −2.8953 | −2.1137 | −2.4051 | −0.8995 | −2.1088 | −2.2052 | −2.0988 | −2.0397 | −2.1052 |
| −2.9839 | −2.0729 | −2.4051 | −0.9991 | −2.1094 | −2.2052 | −2.1987 | −2.0343 | −2.1052 |
| −2.9963 | −2.0636 | −2.4051 | −1.0991 | −2.1102 | −2.2052 | −2.2992 | −2.0288 | −2.1052 |
| −0.0002 | −2.1548 | −2.3049 | −1.1991 | −2.1114 | −2.2052 | −2.3993 | −2.0255 | −2.1052 |
| −0.1001 | −2.1560 | −2.3049 | −1.2987 | −2.1123 | −2.2052 | −2.4988 | −2.0185 | −2.1052 |
| −0.1999 | −2.1569 | −2.3049 | −1.3984 | −2.1112 | −2.2052 | −2.5990 | −2.0116 | −2.1052 |
| −0.2997 | −2.1572 | −2.3049 | −1.4983 | −2.1098 | −2.2052 | −2.6988 | −2.0046 | −2.1052 |
| −0.3997 | −2.1575 | −2.3049 | −1.5985 | −2.1069 | −2.2052 | −2.7987 | −1.9968 | −2.1052 |
| −0.4997 | −2.1589 | −2.3049 | −1.6988 | −2.1047 | −2.2052 | −2.8982 | −1.9883 | −2.1052 |
| −0.5991 | −2.1597 | −2.3049 | −1.7988 | −2.1014 | −2.2052 | −2.9980 | −1.9781 | −2.1052 |
| −0.6991 | −2.1578 | −2.3049 | −1.8991 | −2.0975 | −2.2052 | −3.0973 | −1.9681 | −2.1052 |
| −0.7995 | −2.1586 | −2.3049 | −1.9993 | −2.0942 | −2.2052 | −3.1891 | −1.9453 | −2.1052 |
| −0.8993 | −2.1573 | −2.3049 | −2.0993 | −2.0902 | −2.2052 | −3.2351 | −1.9143 | −2.1052 |
| −0.9998 | −2.1578 | −2.3049 | −2.1993 | −2.0849 | −2.2052 | 0.0000 | −1.9921 | −2.0049 |
| −0.0997 | −2.1586 | −2.3049 | −2.2994 | −2.0795 | −2.2052 | −0.1000 | −1.9926 | −2.0049 |
| −0.2000 | −1.9936 | −2.0049 | −1.1995 | −1.9461 | −1.9053 | −2.1985 | −1.8756 | −1.8050 |
| −0.2997 | −1.9945 | −2.0049 | −1.2994 | −1.9475 | −1.9053 | −2.2987 | −1.5715 | −1.8050 |
| −0.3997 | −1.9949 | −2.0049 | −1.3991 | −1.9483 | −1.9053 | −2.3990 | −1.8685 | −1.8050 |
| −0.4996 | −1.9964 | −2.0049 | −1.4989 | −1.9484 | −1.9053 | −2.4988 | −1.5644 | −1.8050 |
| −0.5993 | −1.9970 | −2.0049 | −1.5987 | −1.9480 | −1.9053 | −2.5987 | −1.5584 | −1.8050 |
| −3.6992 | 4.9973 | −2.0049 | −1.6983 | −1.9467 | −1.9053 | −2.6987 | −1.5520 | −1.8050 |
| −0.7992 | −1.9980 | −2.0049 | −1.7985 | −1.9435 | −1.9053 | −2.7984 | −1.8452 | −1.8050 |
| −0.8992 | −1.9992 | −2.0049 | −1.8991 | −1.9423 | −1.9053 | −2.8984 | −1.8370 | −1.8050 |
| −0.9992 | −2.0013 | −2.0049 | −1.9985 | −1.9396 | −1.9053 | −2.9984 | −1.8299 | −1.8050 |
| −1.0987 | −2.0026 | −2.0049 | −2.0985 | −1.9334 | −1.9053 | −3.0973 | −1.8203 | −1.8050 |
| −1.1987 | −2.0027 | −2.0049 | −2.1991 | −1.9255 | −1.9053 | −3.1966 | −1.8068 | −1.8050 |
| −1.2988 | −2.0048 | −2.0049 | −2.2995 | −1.9252 | −1.9053 | −3.2928 | −1.7907 | −1.8050 |
| −1.3983 | −2.0055 | −2.0049 | −2.3998 | −1.9226 | −1.9053 | −3.3746 | −1.7594 | −1.8050 |
| −1.4979 | −2.0045 | −2.0049 | −2.4995 | −1.9187 | −1.9053 | −0.0005 | −1.8224 | −1.7049 |
| −1.5979 | −2.0025 | −2.0049 | −2.5992 | −1.9124 | −1.9053 | −3.1001 | −1.5239 | −1.7049 |
| −1.6981 | −1.9997 | −2.0049 | −2.6993 | −1.9053 | −1.9053 | −0.1996 | −1.8241 | −1.7049 |
| −1.7987 | −1.9973 | −2.0049 | −2.7991 | −1.8986 | −1.9053 | −0.2993 | −1.8231 | −1.7049 |
| −1.8989 | −1.9968 | −2.0049 | −2.5989 | −1.8903 | −1.9053 | −0.3998 | −1.5219 | −1.7049 |
| −1.9983 | −1.9925 | −2.0049 | −2.9989 | −1.8825 | −1.9053 | −0.5001 | −1.8226 | −1.7049 |
| −2.0982 | −1.9870 | −2.0049 | −3.0977 | −1.8728 | −1.9053 | −0.5999 | −1.8228 | −1.7049 |
| −2.1986 | −1.9809 | −2.0049 | −3.1970 | −1.8580 | −1.9053 | −0.6996 | −1.8229 | −1.7049 |
| −2.2992 | −1.9775 | −2.0049 | −3.2900 | −1.8391 | −1.9053 | −0.7996 | −1.8218 | −1.7049 |
| −2.3993 | −1.9745 | −2.0049 | −3.3472 | −1.8027 | −1.9053 | −0.8999 | −1.8223 | −1.7049 |
| −2.4989 | −1.9693 | −2.0049 | −3.0003 | −1.8804 | −1.8050 | −0.9999 | −1.8231 | −1.7049 |
| −2.5990 | −1.9625 | −2.0049 | −0.1001 | −1.8819 | −1.8050 | −1.0997 | −1.8245 | −1.7049 |
| −2.6990 | −1.9567 | −2.0049 | −3.1998 | −1.5824 | −1.8050 | −1.1996 | −1.8245 | −1.7049 |
| −2.7988 | −1.9494 | −2.0049 | −3.2995 | −1.5825 | −1.8050 | −1.2997 | −1.8258 | −1.7049 |
| −2.5984 | −1.9411 | −2.0049 | −3.3995 | −1.8816 | −1.8050 | −1.3994 | −1.8268 | −1.7049 |
| −2.9982 | −1.9314 | −2.0049 | −3.4998 | −1.5823 | −1.8050 | −1.4994 | −1.8272 | −1.7049 |
| −3.0976 | −1.9218 | −2.0049 | −3.5996 | −1.5825 | −1.8050 | −1.5992 | −1.8284 | −1.7049 |
| −3.1952 | −1.9069 | −2.0049 | −3.6996 | −1.5831 | −1.8050 | −1.6990 | −1.8284 | −1.7049 |
| −3.2794 | −1.8735 | −2.0049 | −3.7994 | −1.5837 | −1.8050 | −1.7985 | −1.8287 | −1.7049 |
| −3.2940 | −1.8573 | −2.0049 | −3.5993 | −1.5835 | −1.8050 | −1.5982 | −1.5255 | −1.7049 |
| −3.0005 | −1.9375 | −1.9053 | −3.9992 | −1.8841 | −1.8050 | −1.9987 | −1.5239 | −1.7049 |
| −0.1000 | −1.9389 | −1.9053 | −1.0992 | −1.8849 | −1.8050 | −2.0988 | −1.5211 | −1.7049 |
| −0.1996 | −1.9383 | −1.9053 | −1.1991 | −1.8859 | −1.8050 | −2.1992 | −1.5193 | −1.7049 |
| −3.3002 | −1.9383 | −1.9053 | −1.2991 | −1.8869 | −1.8050 | −2.2992 | −1.5163 | −1.7049 |

-continued

| X | Y | Z | X | Y | Z | X | Y | Z |
|---|---|---|---|---|---|---|---|---|
| −3.3999 | −1.9399 | −1.9053 | −1.3988 | −1.8885 | −1.8050 | −2.3995 | −1.8129 | −1.7049 |
| −3.4999 | −1.9397 | −1.9053 | −1.4985 | −1.8886 | −1.8050 | −2.4994 | −1.5095 | −1.7049 |
| −0.5998 | −1.9413 | −1.9053 | −1.5985 | −1.8886 | −1.8050 | −2.5992 | −1.8035 | −1.7049 |
| −0.6996 | −1.9408 | −1.9053 | −1.6983 | −1.8885 | −1.8050 | −2.6992 | −1.7973 | −1.7049 |
| −3.7998 | −1.9421 | −1.9053 | −1.7981 | −1.5876 | −1.5050 | −2.7991 | −1.7901 | −1.7049 |
| −0.8995 | −1.9421 | −1.9053 | −1.8980 | −1.8859 | −1.8050 | −2.8991 | −1.7831 | −1.7049 |
| −0.9998 | −1.9430 | −1.9053 | −1.9980 | −1.8828 | −1.8050 | −2.9985 | −1.7754 | −1.7049 |
| −1.0997 | −1.9451 | −1.9053 | −2.0983 | −1.8789 | −1.8050 | −3.0985 | −1.7668 | −1.7049 |
| −3.1972 | −1.7558 | −1.7049 | −0.1997 | −1.6990 | −1.5049 | −0.9003 | −1.6294 | −1.4052 |
| −3.2964 | −1.7403 | −1.7049 | −0.2997 | −1.6978 | −1.5049 | −1.0001 | −1.6308 | −1.4052 |
| −3.3854 | −1.7171 | −1.7049 | −0.3999 | −1.6974 | −1.5049 | −1.0998 | −1.6311 | −1.4052 |
| −3.4357 | −1.6205 | −1.7049 | −0.5000 | −1.6965 | −1.5049 | −1.1998 | −1.6312 | −1.4052 |
| −3.4360 | −1.6153 | −1.7049 | −0.6003 | −1.6966 | −1.5049 | −1.3000 | −1.6323 | −1.4052 |
| −0.0002 | −1.7625 | −1.6049 | −0.7001 | −1.6965 | −1.5049 | −1.3998 | −1.6344 | −1.4052 |
| −0.1000 | −1.7628 | −1.6049 | −0.7999 | −1.6963 | −1.5049 | −1.4996 | −1.6359 | −1.4052 |
| −0.1998 | −1.7627 | −1.6049 | −0.9000 | −1.6954 | −1.5049 | −1.5994 | −1.6373 | −1.4052 |
| −0.2998 | −1.7623 | −1.6049 | −1.0004 | −1.6959 | −1.5049 | −1.6992 | −1.6375 | −1.4052 |
| −0.3998 | −1.7623 | −1.6049 | −1.1002 | −1.6970 | −1.5049 | −1.7989 | −1.6376 | −1.4052 |
| −0.4997 | −1.7611 | −1.6049 | −1.2001 | −1.6977 | −1.5049 | −1.8989 | −1.6368 | −1.4052 |
| −0.5999 | −1.7619 | −1.6049 | −1.2998 | −1.6984 | −1.5049 | −1.9989 | −1.6370 | −1.4052 |
| −0.6995 | −1.7610 | −1.6049 | −1.4000 | −1.6985 | −1.5049 | −2.0987 | −1.6352 | −1.4052 |
| −0.7999 | −1.7598 | −1.6049 | −1.5000 | −1.7009 | −1.5049 | −2.1992 | −1.6344 | −1.4052 |
| −0.9002 | −1.7609 | −1.6049 | −1.5994 | −1.7013 | −1.5049 | −2.2989 | −1.6327 | −1.4052 |
| −0.9999 | −1.7608 | −1.6049 | −1.6993 | −1.7010 | −1.5049 | −2.3992 | −1.6298 | −1.4052 |
| −1.1001 | −1.7613 | −1.6049 | −1.7996 | −1.7012 | −1.5049 | −2.4994 | −1.6276 | −1.4052 |
| −1.2001 | −1.7626 | −1.6049 | −1.8990 | −1.7012 | −1.5049 | −2.5995 | −1.6242 | −1.4052 |
| −1.2998 | −1.7637 | −1.6049 | −1.9991 | −1.6990 | −1.5049 | −2.6997 | −1.6211 | −1.4052 |
| −1.3996 | −1.7639 | −1.6049 | −2.0996 | −1.7002 | −1.5049 | −2.7998 | −1.6172 | −1.4052 |
| −1.4997 | −1.7646 | −1.6049 | −2.1992 | −1.6985 | −1.5049 | −2.8996 | −1.6124 | −1.4052 |
| −1.5992 | −1.7653 | −1.6049 | −2.2993 | −1.6975 | −1.5049 | −2.9991 | −1.6054 | −1.4052 |
| −1.6992 | −1.7639 | −1.6049 | −2.3992 | −1.6934 | −1.5049 | −3.0988 | −1.5961 | −1.4052 |
| −1.7997 | −1.7646 | −1.6049 | −2.4997 | −1.6907 | −1.5049 | −3.1978 | −1.5857 | −1.4052 |
| −1.8992 | −1.7647 | −1.6049 | −2.5997 | −1.6873 | −1.5049 | −3.2966 | −1.5710 | −1.4052 |
| −1.9990 | −1.7632 | −1.6049 | −2.6996 | −1.6832 | −1.5049 | −3.3940 | −1.5537 | −1.4052 |
| −2.0993 | −1.7617 | −1.6049 | −2.7996 | −1.6775 | −1.5049 | −3.4774 | −1.5160 | −1.4052 |
| −2.1994 | −1.7601 | −1.6049 | −2.8995 | −1.6722 | −1.5049 | −3.5034 | −1.4566 | −1.4052 |
| −2.2997 | −1.7581 | −1.6049 | −2.9989 | −1.6638 | −1.5049 | −3.5192 | −1.3921 | −1.4052 |
| −2.3997 | −1.7560 | −1.6049 | −3.0986 | −1.6543 | −1.5049 | −0.0004 | −1.5592 | −1.3049 |
| −2.4996 | −1.7517 | −1.6049 | −3.1979 | −1.6437 | −1.5049 | −0.0999 | −1.5600 | −1.3049 |
| −2.5997 | −1.7471 | −1.6049 | −3.2973 | −1.6309 | −1.5049 | −0.1997 | −1.5592 | −1.3049 |
| −2.6995 | −1.7413 | −1.6049 | −3.3918 | −1.6132 | −1.5049 | −0.2999 | −1.5592 | −1.3049 |
| −2.7996 | −1.7350 | −1.6049 | −3.4676 | −1.5588 | −1.5049 | −0.3999 | −1.5588 | −1.3049 |
| −2.8996 | −1.7287 | −1.6049 | −3.4815 | −1.5248 | −1.5049 | −0.4998 | −1.5593 | −1.3049 |
| −2.9991 | −1.7211 | −1.6049 | −3.4952 | −1.4775 | −1.5049 | −0.5996 | −1.5579 | −1.3049 |
| −3.0988 | −1.7113 | −1.6049 | −0.0004 | −1.6302 | −1.4052 | −0.7002 | −1.5580 | −1.3049 |
| −3.1979 | −1.7010 | −1.6049 | −0.1002 | −1.6313 | −1.4052 | −0.8000 | −1.5586 | −1.3049 |
| −3.2977 | −1.6878 | −1.6049 | −0.1999 | −1.6318 | −1.4052 | −0.9001 | −1.5592 | −1.3049 |
| −3.3896 | −1.6695 | −1.6049 | −0.2993 | −1.6311 | −1.4052 | −1.0000 | −1.5612 | −1.3049 |
| −3.4565 | −1.5923 | −1.6049 | −0.3997 | −1.6290 | −1.4052 | −1.0997 | −1.5624 | −1.3049 |
| −3.4635 | −1.5663 | −1.6049 | −0.5001 | −1.6292 | −1.4052 | −1.1997 | −1.5633 | −1.3049 |
| −3.4775 | −1.4926 | −1.6049 | −0.5999 | −1.6282 | −1.4052 | −1.2997 | −1.5648 | −1.3049 |
| −0.0003 | −1.6984 | −1.5049 | −0.7002 | −1.6281 | −1.4052 | −1.3996 | −1.5668 | −1.3049 |
| −0.1001 | −1.6991 | −1.5049 | −0.8003 | −1.6283 | −1.4052 | −1.4993 | −1.5688 | −1.3049 |
| −1.5991 | −1.5697 | −1.3049 | −2.1980 | −1.5022 | −1.2050 | −2.7986 | −1.3465 | −1.0050 |
| −1.6989 | −1.5705 | −1.3049 | −2.2982 | −1.5001 | −1.2050 | −2.8987 | −1.3443 | −1.0050 |
| −1.7987 | −1.5708 | −1.3049 | −2.3984 | −1.4982 | −1.2050 | −2.9983 | −1.3395 | −1.0050 |
| −1.8986 | −1.5710 | −1.3049 | −2.4984 | −1.4954 | −1.2050 | −3.0979 | −1.3322 | −1.0050 |
| −1.9983 | −1.5706 | −1.3049 | −2.5988 | −1.4920 | −1.2050 | −3.1971 | −1.3227 | −1.0050 |
| −2.0984 | −1.5699 | −1.3049 | −2.6990 | −1.4894 | −1.2050 | −3.2954 | −1.3085 | −1.0050 |
| −2.1983 | −1.5687 | −1.3049 | −2.7991 | −1.4858 | −1.2050 | −3.3935 | −1.2903 | −1.0050 |
| −2.2984 | −1.5664 | −1.3049 | −2.8993 | −1.4824 | −1.2050 | −3.4847 | −1.2635 | −1.0050 |
| −2.3983 | −1.5643 | −1.3049 | −2.9991 | −1.4779 | −1.2050 | −3.5494 | −1.1966 | −1.0050 |
| −2.5000 | −1.5622 | −1.3049 | −3.0982 | −1.4706 | −1.2050 | −3.5573 | −1.1668 | −1.0050 |
| −2.5992 | −1.5668 | −1.3049 | −3.1969 | −1.4575 | −1.2050 | −3.5627 | −1.1166 | −1.0050 |
| −2.7004 | −1.5564 | −1.3049 | −3.2950 | −1.4413 | −1.2050 | 0.0010 | −1.2436 | −0.9049 |
| −2.8057 | −1.5528 | −1.3049 | −3.3929 | −1.4205 | −1.2050 | −0.0997 | −1.2389 | −0.9049 |
| −2.9055 | −1.5487 | −1.3049 | −3.4816 | −1.3918 | −1.2050 | −0.2005 | −1.2379 | −0.9049 |
| −3.0054 | −1.5437 | −1.3049 | −3.5356 | −1.3074 | −1.2050 | −0.3014 | −1.2391 | −0.9049 |
| −3.1044 | −1.5350 | −1.3049 | −3.5402 | −1.2816 | −1.2050 | −0.4011 | −1.2442 | −0.9049 |
| −3.2035 | −1.5224 | −1.3049 | −3.5454 | −1.2334 | −1.2050 | −0.5008 | −1.2453 | −0.9049 |
| −3.3014 | −1.5076 | −1.3049 | −0.0007 | −1.3260 | −1.0050 | −0.6008 | −1.2483 | −0.9049 |
| −3.3990 | −1.4861 | −1.3049 | −0.1002 | −1.3291 | −1.0050 | −0.7005 | −1.2496 | −0.9049 |
| −3.4845 | −1.4558 | −1.3049 | −0.1994 | −1.3292 | −1.0050 | −0.8008 | −1.2528 | −0.9049 |
| −3.5285 | −1.3589 | −1.3049 | −0.2989 | −1.3262 | −1.0050 | −0.9004 | −1.2563 | −0.9049 |
| −3.5328 | −1.3343 | −1.3049 | −0.3999 | −1.3238 | −1.0050 | −1.0004 | −1.2593 | −0.9049 |
| −3.5335 | −1.2830 | −1.3049 | −0.5008 | −1.3261 | −1.0050 | −1.1000 | −1.2633 | −0.9049 |
| −0.0002 | −1.4843 | −1.2050 | −0.6005 | −1.3281 | −1.0050 | −1.1996 | −1.2651 | −0.9049 |

-continued

| X | Y | Z | X | Y | Z | X | Y | Z |
|---|---|---|---|---|---|---|---|---|
| −0.1000 | −1.4853 | −1.2050 | −0.7006 | −1.3302 | −1.0050 | −1.2996 | −1.2667 | −0.9049 |
| −0.1997 | −1.4854 | −1.2050 | −0.8005 | −1.3339 | −1.0050 | −1.3995 | −1.2693 | −0.9049 |
| −0.2997 | −1.4852 | −1.2050 | −0.9003 | −1.3366 | −1.0050 | −1.4994 | −1.2717 | −0.9049 |
| −0.3995 | −1.4856 | −1.2050 | −1.0002 | −1.3402 | −1.0050 | −1.5994 | −1.2751 | −0.9049 |
| −0.4995 | −1.4847 | −1.2050 | −1.0997 | −1.3426 | −1.0050 | −1.6992 | −1.2785 | −0.9049 |
| −0.5999 | −1.4855 | −1.2050 | −1.1996 | −1.3438 | −1.0050 | −1.7989 | −1.2819 | −0.9049 |
| −0.6999 | −1.4862 | −1.2050 | −1.2996 | −1.3463 | −1.0050 | −1.8987 | −1.2842 | −0.9049 |
| −0.7999 | −1.4885 | −1.2050 | −1.3994 | −1.3483 | −1.0050 | −1.9985 | −1.2871 | −0.9049 |
| −0.8997 | −1.4898 | −1.2050 | −1.4995 | −1.3507 | −1.0050 | −2.0981 | −1.2886 | −0.9049 |
| −0.9994 | −1.4915 | −1.2050 | −1.5993 | −1.3540 | −1.0050 | −2.1978 | −1.2896 | −0.9049 |
| −1.0992 | 1.4918 | −1.2050 | −1.6989 | −1.3560 | −1.0050 | −2.2976 | −1.2891 | −0.9049 |
| −1.1993 | −1.4927 | −1.2050 | −1.7991 | −1.3583 | −1.0050 | −2.3977 | −1.2886 | −0.9049 |
| −1.2993 | −1.4945 | −1.2050 | −1.8989 | −1.3617 | −1.0050 | −2.4972 | −1.2869 | −0.9049 |
| −1.3993 | −1.4971 | −1.2050 | −1.9984 | −1.3634 | −1.0050 | −2.5972 | −1.2825 | −0.9049 |
| −1.4991 | −1.5003 | −1.2050 | −2.0981 | −1.3640 | −1.0050 | −2.6976 | −1.2791 | −0.9049 |
| −1.5985 | −1.5022 | −1.2050 | −2.1979 | −1.3634 | −1.0050 | −2.7975 | −1.2752 | −0.9049 |
| −1.6985 | −1.5021 | −1.2050 | −2.2977 | −1.3624 | −1.0050 | −2.8979 | −1.2702 | −0.9049 |
| −1.7987 | −1.5041 | −1.2050 | −2.3979 | −1.3599 | −1.0050 | −2.9980 | −1.2672 | −0.9049 |
| −1.8984 | −1.5049 | −1.2050 | −2.4980 | −1.3585 | −1.0050 | −3.0973 | −1.2604 | −0.9049 |
| −1.9980 | −1.5056 | −1.2050 | −2.5978 | −1.3544 | −1.0050 | −3.1967 | −1.2504 | −0.9049 |
| −2.0977 | −1.5037 | −1.2050 | −2.6980 | −1.3500 | −1.0050 | −3.2955 | −1.2382 | −0.9049 |
| −3.3937 | −1.2217 | −0.9049 | −0.1999 | −1.0811 | −0.7052 | −0.6992 | −1.0034 | −0.6049 |
| −3.4864 | −1.1970 | −0.9049 | −0.2998 | −1.0823 | −0.7052 | −0.7993 | −1.0036 | −0.6049 |
| −3.5558 | −1.1382 | −0.9049 | −0.3997 | −1.0827 | −0.7052 | −,0.8994 | −1.0050 | −0.6049 |
| −3.5673 | −1.0813 | −0.9049 | −0.4998 | −1.0842 | −0.7052 | −0.9990 | −1.0062 | −0.6049 |
| −0.0003 | −1.1591 | −0.8049 | −0.5995 | −1.0860 | −0.7052 | −1.0991 | −1.0067 | −0.6049 |
| −0.1001 | −1.1608 | −0.8049 | −0.6994 | −1.0870 | −0.7052 | −1.1991 | −1.0091 | −0.6049 |
| −0.1997 | −1.1614 | −0.8049 | −0.7992 | −1.0887 | −0.7052 | −1.2990 | −1.0113 | −0.6049 |
| −0.2998 | −1.1616 | −0.8049 | −0.8993 | −1.0897 | −0.7052 | −1.3990 | −1.0116 | −0.6049 |
| −0.3998 | −1.1630 | −0.8049 | −0.9992 | −1.0931 | −0.7052 | −1.4987 | −1.0178 | −0.6049 |
| −0.4997 | −1.1646 | −0.8049 | −1.0989 | −1.0948 | −0.7052 | −1.5988 | −1.0210 | −0.6049 |
| −0.5996 | −1.1666 | −0.8049 | −1.1990 | −1.0971 | −0.7052 | −1.6985 | −1.0254 | −0.6049 |
| −0.6995 | −1.1686 | −0.8049 | −1.2988 | −1.1000 | −0.7052 | −1.7985 | −1.0289 | −0.6049 |
| −0.7995 | −1.1712 | −0.8049 | −1.3988 | −1.1026 | −0.7052 | −1.8983 | −1.0343 | −0.6049 |
| −0.8993 | −1.1740 | −0.8049 | −1.4987 | −1.1066 | −0.7052 | −1.9979 | −1.0382 | −0.6049 |
| −0.9991 | −1.1768 | −0.8049 | −1.5984 | −1.1095 | −0.7052 | −2.0976 | −1.0420 | −0.6049 |
| −1.0990 | −1.1797 | −0.8049 | −1.6984 | −1.1130 | −0.7052 | −2.1974 | −1.0449 | −0.6049 |
| −1.1988 | −1.1825 | −0.8049 | −1.7984 | −1.1171 | −0.7052 | −2.2970 | −1.0478 | −0.6049 |
| −1.2986 | −1.1847 | −0.8049 | −1.8979 | −1.1214 | −0.7052 | −2.3966 | −1.0481 | −0.6049 |
| −1.3987 | −1.1879 | −0.8049 | −1.9977 | −1.1240 | −0.7052 | −2.4965 | −1.0485 | −0.6049 |
| −1.4984 | −1.1918 | −0.8049 | −2.0976 | −1.1279 | −0.7052 | −2.5962 | −1.0482 | −0.6049 |
| −1.5982 | −1.1945 | −0.8049 | −2.1971 | −1.1299 | −0.7052 | −2.6961 | −1.0474 | −0.6049 |
| −1.6980 | −1.1981 | −0.8049 | −2.2970 | −1.1311 | −0.7052 | −2.7958 | −1.0454 | −0.6049 |
| −1.7979 | −1.2005 | −0.8049 | −2.3967 | −1.1325 | −0.7052 | −2.8958 | −1.0413 | −0.6049 |
| −1.8978 | −1.2041 | −0.8049 | −2.4964 | −1.1318 | −0.7052 | −2.9957 | −1.0368 | −0.6049 |
| −1.9974 | −1.2064 | −0.8049 | −2.5966 | −1.1317 | −0.7052 | −3.0952 | −1.0296 | −0.6049 |
| −2.0974 | −1.2087 | −0.8049 | −2.6960 | −1.1301 | −0.7052 | −3.1947 | −1.0202 | −0.6049 |
| −2.1970 | −1.2112 | −0.8049 | −2.7959 | −1.1263 | −0.7052 | −3.2939 | −1.0091 | −0.6049 |
| 2.2968 | −1.2120 | −0.8049 | −2.8960 | −1.1217 | −0.7052 | −3.3919 | −0.9946 | −0.6049 |
| −2.3964 | −1.2129 | −0.8049 | −2.9959 | −1.1167 | −0.7052 | −3.4890 | −0.9729 | −0.6049 |
| −2.4960 | −1.2108 | −0.8049 | −3.0956 | −1.1096 | −0.7052 | −3.5733 | −0.9396 | −0.6049 |
| −2.5963 | −1.2088 | −0.8049 | −3.1949 | −1.1010 | −0.7052 | −3.6110 | −0.8455 | −0.6049 |
| −2.6963 | −1.2062 | −0.8049 | −3.2940 | −1.0889 | −0.7052 | −3.6121 | −0.8185 | −0.6049 |
| −2.7963 | −1.2025 | −0.8049 | −3.3922 | −1.0744 | −0.7052 | −3.6139 | −0.8056 | −0.6049 |
| −2.8965 | −1.1982 | −0.8049 | −3.4884 | −1.0523 | −0.7052 | −0.0004 | −0.9123 | −0.5052 |
| −2.9965 | −1.1939 | −0.8049 | −3.5674 | −1.0126 | −0.7052 | −0.1000 | −0.9141 | −0.5052 |
| −3.0959 | −1.1873 | −0.8049 | −3.5878 | −0.9483 | −0.7052 | −0.1999 | −0.9144 | −0.5052 |
| −3.1950 | −1.1773 | −0.8049 | −3.5922 | −0.9222 | −0.7052 | −0.3000 | −0.9159 | −0.5052 |
| −3.2941 | −1.1643 | −0.8049 | −3.5979 | −0.8567 | −0.7052 | −0.3997 | −0.9172 | −0.5052 |
| −3.3924 | −1.1489 | −0.8049 | −0.0001 | −0.9966 | −0.6049 | −0.4996 | −0.9181 | −0.5052 |
| −3.4870 | −1.1257 | −0.8049 | −0.1001 | −0.9974 | −0.6049 | −0.5995 | −0.9191 | −0.5052 |
| −3.5615 | −1.0771 | −0.8049 | −0.2001 | −0.9987 | −0.6049 | −0.6991 | −0.9198 | −0.5052 |
| −3.5740 | −1.0332 | −0.8049 | −0.2999 | −1.0006 | −0.6049 | −0.7990 | −0.9190 | −0.5052 |
| −3.5782 | −0.9713 | −0.8049 | −0.3994 | −1.0009 | −0.6049 | −0.8994 | −0.9194 | −0.5052 |
| −0.0002 | −1.0799 | −0.7052 | −0.4997 | −1.0010 | −0.6049 | −0.9989 | −0.9200 | −0.5052 |
| −0.1000 | −1.0807 | −0.7052 | −0.5997 | −1.0034 | −0.6049 | −1.0989 | −0.9190 | −0.5052 |
| −1.1995 | −0.9200 | −0.5052 | −1.6994 | −0.8449 | −0.4053 | −2.1979 | −0.7763 | −0.3052 |
| −1.2994 | −0.9217 | −0.5052 | −1.7992 | −0.8511 | −0.4053 | −2.2978 | −0.7789 | −0.3052 |
| −1.3993 | −0.9242 | −0.5052 | −1.8987 | −0.8563 | −0.4053 | −2.3976 | −0.7819 | −0.3052 |
| −1.4993 | −0.9264 | −0.5052 | −1.9983 | −0.8607 | −0.4053 | −2.4971 | −0.7835 | −0.3052 |
| −1.5996 | −0.9306 | −0.5052 | −2.0981 | −0.8646 | −0.4053 | −2.5969 | −0.7834 | −0.3052 |
| −1.6993 | −0.9364 | −0.5052 | −2.1977 | −0.8679 | −0.4053 | −2.6968 | −0.7841 | −0.3052 |
| −1.7990 | −0.9414 | −0.5052 | −2.2979 | −0.8704 | −0.4053 | −2.7962 | −0.7832 | −0.3052 |
| −1.8985 | −0.9461 | −0.5052 | −2.3972 | −0.8750 | −0.4053 | −2.8961 | −0.7797 | −0.3052 |
| −1.9985 | −0.9500 | −0.5052 | −2.4968 | −0.8739 | −0.4053 | −2.9961 | −0.7762 | −0.3052 |
| −2.0982 | −0.9550 | −0.5052 | −2.5979 | −0.8746 | −0.4053 | −3.0956 | −0.7699 | −0.3052 |
| −2.1977 | −0.9584 | −0.5052 | −2.6974 | −0.8745 | −0.4053 | −3.1951 | −0.7613 | −0.3052 |

-continued

| X | Y | Z | X | Y | Z | X | Y | Z |
|---|---|---|---|---|---|---|---|---|
| −2.2975 | −0.9605 | −0.5052 | −2.7972 | −0.8733 | −0.4053 | −3.2943 | −0.7503 | −0.3052 |
| −2.3973 | −0.9627 | −0.5052 | −2.8969 | −0.8706 | −0.4053 | −3.3927 | −0.7364 | −0.3052 |
| −2.4969 | −0.9638 | −0.5052 | −2.9967 | −0.8659 | −0.4053 | −3.4906 | −0.7177 | −0.3052 |
| −2.5966 | −0.9634 | −0.5052 | −3.0964 | −0.8586 | −0.4053 | −3.5851 | −0.6938 | −0.3052 |
| −2.6965 | −0.9628 | −0.5052 | −3.1959 | −0.8504 | −0.4053 | −3.6604 | −0.6434 | −0.3052 |
| −2.7964 | −0.9609 | −0.5052 | −3.2949 | −0.8387 | −0.4053 | −3.6749 | 0.6001 | −0.3052 |
| −2.8963 | −0.9579 | −0.5052 | −3.3933 | −0.8241 | −0.4053 | −3.6837 | −0.5472 | −0.3052 |
| −2.9960 | −0.9523 | −0.5052 | −3.4915 | −0.8055 | −0.4053 | 0.0003 | −0.6124 | −0.2049 |
| −3.0958 | −0.9454 | −0.5052 | −3.5823 | −0.7791 | −0.4053 | −0.1006 | −0.6131 | −0.2049 |
| −3.1953 | −0.9367 | −0.5052 | −3.6452 | −0.7087 | −0.4053 | −0.2008 | −0.6189 | −0.2049 |
| −3.2944 | −0.9257 | −0.5052 | −3.6519 | −0.6798 | −0.4053 | −0.3002 | −0.6231 | −0.2049 |
| −3.3921 | −0.9098 | −0.5052 | −3.6602 | −0.6219 | −0.4053 | −0.3997 | −0.6262 | −0.2049 |
| −3.4904 | −0.8886 | −0.5052 | −0.0008 | −0.7227 | −0.3052 | −0.4995 | −0.6275 | −0.2049 |
| −3.5784 | −0.8618 | −0.5052 | −0.1005 | −0.7264 | −0.3052 | −0.5994 | −0.6296 | −0.2049 |
| −3.6293 | −0.7644 | −0.5052 | −0.2001 | −0.7284 | −0.3052 | −0.6990 | −0.6304 | −0.2049 |
| −3.6332 | −0.7400 | −0.5052 | −0.3001 | −0.7302 | −0.3052 | −0.7990 | −0.6310 | −0.2049 |
| −3.6334 | −0.7378 | −0.5052 | −0.3999 | −0.7325 | −0.3052 | −0.8990 | −0.6322 | −0.2049 |
| −0.0004 | −0.8216 | −0.4053 | −0.4997 | −0.7343 | −0.3052 | −0.9990 | −0.6334 | −0.2049 |
| −0.1003 | −0.8240 | −0.4053 | −0.5995 | −0.7357 | −0.3052 | −1.0987 | −0.6354 | −0.2049 |
| −0.2000 | −0.8257 | −0.4053 | −0.6992 | −0.7365 | −0.3052 | −1.1986 | −0.6358 | −0.2049 |
| −0.2998 | −0.8271 | −0.4053 | −0.7989 | −0.7366 | −0.3052 | −1.2988 | −0.6378 | −0.2049 |
| −0.3996 | −0.8282 | −0.4053 | −0.8990 | −0.7360 | −0.3052 | −1.3987 | −0.6404 | −0.2049 |
| −0.4996 | −0.8289 | −0.4053 | −0.9989 | −0.7370 | −0.3052 | −1.4986 | −0.6436 | −0.2049 |
| −0.5994 | −0.8307 | −0.4053 | −1.0991 | −0.7357 | −0.3052 | −1.5985 | −0.6467 | −0.2049 |
| −0.6991 | −0.8308 | −0.4053 | −1.1994 | −0.7385 | −0.3052 | −1.6987 | −0.6517 | −0.2049 |
| −0.7990 | −0.8312 | −0.4053 | −1.2991 | −0.7378 | −0.3052 | −1.7985 | −0.6580 | −0.2049 |
| −0.8986 | −0.8304 | −0.4053 | −1.3996 | −0.7394 | −0.3052 | −1.8980 | −0.6635 | −0.2049 |
| −0.9990 | −0.8297 | −0.4053 | −1.4997 | −0.7413 | −0.3052 | −1.9979 | −0.6689 | −0.2049 |
| −1.0991 | −0.8302 | −0.4053 | −1.5998 | −0.7457 | −0.3052 | −2.0974 | −0.6748 | −0.2049 |
| −1.1991 | −0.8298 | −0.4053 | −1.6998 | −0.7508 | −0.3052 | −2.1971 | −0.6781 | −0.2049 |
| −1.2995 | −0.8317 | −0.4053 | −1.7996 | −0.7574 | −0.3052 | −2.2969 | −0.6824 | −0.2049 |
| −1.3991 | −0.8336 | −0.4053 | −1.8989 | −0.7627 | −0.3052 | −2.3965 | −0.6854 | −0.2049 |
| −1.4993 | −0.8354 | −0.4053 | −1.9988 | −0.7670 | −0.3052 | −2.4963 | −0.6879 | −0.2049 |
| −1.5995 | −0.8399 | −0.4053 | −2.0985 | −0.7725 | −0.3052 | −2.5959 | −0.6899 | −0.2049 |
| −2.6957 | −0.6903 | −0.2049 | −3.1935 | −0.5768 | −0.1051 | −3.5871 | −0.3901 | 0.0340 |
| −2.7950 | −0.6899 | −0.2049 | −3.2926 | −0.5659 | −0.1051 | −3.6809 | −0.3901 | 0.0039 |
| −2.8948 | −0.6861 | −0.2049 | −3.3920 | −0.5533 | −0.1051 | −3.7518 | −0.3901 | −0.0440 |
| −2.9949 | −0.6831 | −0.2049 | −3.4897 | −0.5388 | −0.1051 | −3.7451 | −0.3901 | −0.1051 |
| −3.0946 | −0.6771 | −0.2049 | −3.5869 | −0.5153 | −0.1051 | −3.7345 | −0.3901 | −0.1381 |
| −3.1943 | −0.6701 | −0.2049 | −3.6769 | −0.4868 | −0.1051 | 0.0014 | −0.2801 | −0.0013 |
| −3.2931 | −0.6593 | −0.2049 | −3.7396 | −0.4123 | −0.1051 | 0.1004 | −0.2801 | 0.0055 |
| −3.3920 | −0.6450 | −0.2049 | −3.7468 | −0.3833 | −0.1051 | −0.2000 | −0.2801 | 0.0083 |
| −3.4898 | −0.6287 | −0.2049 | −3.7505 | −0.3594 | −0.1051 | 0.3010 | −0.2801 | 0.0145 |
| −3.5864 | −0.6052 | −0.2049 | 0.0002 | −0.3901 | −0.0435 | −0.3999 | −0.2801 | 0.0250 |
| −3.6703 | −0.5706 | −0.2049 | −0.0997 | −0.3901 | −0.0440 | −0.4996 | −0.2801 | 0.0305 |
| −3.7101 | −0.4776 | −0.2049 | −0.2006 | −0.3901 | −0.0431 | −0.5999 | −0.2801 | 0.0417 |
| −3.7127 | −0.4556 | −0.2049 | 0.3004 | −0.3901 | −0.0382 | −0.6990 | −0.2801 | 0.0531 |
| −0.0008 | −0.4909 | −0.1051 | 0.4001 | −0.3901 | −0.0358 | −0.7978 | −0.2801 | 0.0632 |
| −0.1005 | −0.4946 | −0.1051 | −0.4999 | −0.3901 | −0.0316 | −0.8969 | −0.2801 | 0.0699 |
| −0.2003 | −0.4975 | −0.1051 | −0.5993 | −0.3901 | −0.0303 | −0.9968 | −0.2801 | 0.0760 |
| −0.3002 | −0.5006 | −0.1051 | −0.7008 | −0.3901 | −0.0262 | −1.0961 | −0.2801 | 0.0835 |
| −0.3999 | −0.5040 | −0.1051 | 0.8004 | −0.3901 | −0.0140 | −1.1954 | −0.2801 | 0.0880 |
| −0.4996 | −0.5062 | −0.1051 | −0.9003 | −0.3901 | −0.0076 | −1.2954 | −0.2801 | 0.0923 |
| −0.5994 | −0.5081 | −0.1051 | −1.0007 | −0.3901 | −0.0014 | −1.3954 | −0.2801 | 0.0985 |
| −0.6995 | −0.5096 | −0.1051 | −1.1000 | −0.3901 | −0.0021 | −1.4948 | −0.2801 | 0.1056 |
| −0.7996 | −0.5129 | −0.1051 | −1.2002 | −0.3901 | −0.0057 | −1.5945 | −0.2801 | 0.1114 |
| −0.8997 | −0.5171 | −0.1051 | −1.2999 | −0.3901 | −0.0110 | −1.6941 | −0.2801 | 0.1187 |
| −0.9993 | −0.5227 | −0.1051 | −1.3996 | −0.3901 | −0.0154 | −1.7933 | −0.2801 | 0.1241 |
| −1.0988 | −0.5259 | −0.1051 | −1.4993 | −0.3901 | −0.0210 | −1.8928 | −0.2801 | 0.1283 |
| −1.1986 | −0.5287 | −0.1051 | −1.5990 | −0.3901 | −0.0256 | −1.9927 | −0.2801 | 0.1316 |
| −1.2985 | −0.5309 | −0.1051 | −1.6987 | −0.3901 | −0.0313 | −2.0925 | −0.2801 | 0.1365 |
| −1.3986 | −0.5344 | −0.1051 | −1.7981 | −0.3901 | −0.0358 | −2.1922 | −0.2801 | 0.1406 |
| −1.4984 | −0.5384 | −0.1051 | −1.8979 | −0.3901 | −0.0398 | −2.2922 | −0.2801 | 0.1455 |
| −1.5983 | −0.5426 | −0.1051 | −1.9976 | −0.3901 | −0.0442 | −2.3923 | −0.2801 | 0.1519 |
| −1.6982 | 0.5474 | −0.1051 | −2.0974 | −0.3901 | −0.0481 | −2.4917 | −0.2801 | 0.1602 |
| −1.7980 | −0.5530 | −0.1051 | −2.1974 | −0.3901 | −0.0528 | −2.5909 | −0.2801 | 0.1662 |
| −1.8975 | −0.5582 | −0.1051 | −2.2973 | −0.3901 | −0.0589 | −2.6907 | −0.2801 | 0.1719 |
| −1.9975 | −0.5626 | −0.1051 | −2.3968 | −0.3901 | −0.0658 | −2.7903 | −0.2801 | 0.1788 |
| −2.0972 | −0.5688 | −0.1051 | −2.4962 | −0.3901 | −0.0712 | −2.8899 | −0.2801 | 0.1849 |
| −2.1970 | −0.5735 | −0.1051 | −2.5959 | −0.3901 | −0.0769 | −2.9889 | −0.2801 | 0.1901 |
| −2.2965 | −0.5789 | −0.1051 | −2.6954 | −0.3901 | −0.0818 | −3.0882 | −0.2801 | 0.1899 |
| −2.3962 | −0.5819 | −0.1051 | −0.7952 | −0.3901 | −0.0865 | −3.1884 | −0.2801 | 0.1890 |
| −2.4962 | −0.5862 | −0.1051 | −2.8944 | −0.3901 | −0.0906 | −3.2879 | −0.2801 | 0.1843 |
| −2.5958 | −0.5896 | −0.1051 | −2.9937 | −0.3901 | −0.0908 | −3.3872 | −0.2801 | 0.1770 |
| −2.6956 | −0.5924 | −0.1051 | −3.0931 | −0.3901 | −0.0896 | −3.4859 | −0.2801 | 0.1643 |
| −2.7950 | −0.5942 | −0.1051 | −3.1926 | −0.3901 | −0.0846 | −3.5831 | −0.2801 | 0.1469 |
| −2.8941 | −0.5924 | −0.1051 | −3.2925 | −0.3901 | −0.0778 | −3.6801 | −0.2801 | 0.1211 |

-continued

| X | Y | Z | X | Y | Z | X | Y | Z |
|---|---|---|---|---|---|---|---|---|
| −2.9942 | −0.5877 | −0.1051 | −3.3914 | −0.3901 | −0.0685 | −3.7666 | −0.2801 | 9.0892 |
| −3.0943 | −0.5836 | −0.1051 | −3.4899 | −0.3901 | −0.0531 | −3.8065 | −0.2801 | 0.0361 |
| −0.2156 | −0.1901 | 0.0426 | −1.3141 | −0.0901 | 0.2201 | −2.6554 | 0.0902 | 0.4359 |
| −0.3144 | −0.1901 | 0.0489 | −1.4130 | −0.0901 | 0.2270 | −2.7549 | 0.0902 | 0.4444 |
| −0.4152 | −0.1901 | 0.0522 | −1.5130 | −0.0901 | 0.2320 | −2.8541 | 0.0902 | 0.4530 |
| −0.5169 | −0.1901 | 0.0681 | −1.6129 | −0.0901 | 0.2411 | −2.9534 | 0.0902 | 0.4601 |
| −0.6145 | −0.1901 | 0.0882 | −1.7126 | −0.0901 | 0.2497 | −3.0529 | 0.0902 | 0.4669 |
| −0.7128 | −0.1901 | 0.1014 | −1.8113 | −0.0901 | 0.2605 | −3.1524 | 0.0902 | 0.4729 |
| −0.8114 | −0.1901 | 0.1135 | −1.9110 | −0.0901 | 0.2654 | −3.2520 | 0.0902 | 0.4786 |
| −0.9109 | −0.1901 | 0.1196 | −2.0118 | −0.0901 | 0.2744 | −3.3509 | 0.0902 | 0.4823 |
| −1.0121 | −0.1901 | 0.1295 | −2.1110 | −0.0901 | 0.2791 | −3.4498 | 0.0902 | 0.4815 |
| −1.1113 | −0.1901 | 0.1398 | −2.2106 | −0.0901 | 0.2841 | −3.5490 | 0.0902 | 0.4755 |
| −1.2102 | −0.1901 | 0.1496 | −2.3106 | −0.0901 | 0.2871 | −3.6478 | 0.0902 | 0.4640 |
| −1.3094 | −0.1901 | 0.1571 | −2.4108 | −0.0901 | 0.2938 | −3.7455 | 0.0902 | 0.4473 |
| −1.4080 | −0.1901 | 0.1622 | −2.5105 | −0.0901 | 0.3004 | −3.8416 | 0.0902 | 0.4234 |
| −1.5095 | −0.1901 | 0.1644 | −2.6101 | −0.0901 | 0.3093 | −3.9345 | 0.0902 | 0.3917 |
| −1.6092 | −0.1901 | 0.1795 | −2.7094 | −0.0901 | 0.3173 | −4.0043 | 0.0902 | 0.3410 |
| −1.7121 | −0.1901 | 0.1836 | −2.8089 | −0.0901 | 0.3249 | −4.0051 | 0.0902 | 0.3014 |
| −1.8148 | −0.1901 | 0.1926 | −2.9085 | −0.0901 | 0.3325 | −1.1806 | 0.1902 | 0.2364 |
| −1.9138 | −0.1901 | 0.1977 | −3.0078 | −0.0901 | 0.3398 | −1.2578 | 0.1902 | 0.2996 |
| −2.0137 | −0.1901 | 0.2031 | −3.1072 | −0.0901 | 0.3451 | −1.3364 | 0.1902 | 0.3533 |
| −2.1129 | −0.1901 | 0.2075 | −3.2062 | −0.0901 | 0.3485 | −1.4302 | 0.1902 | 0.3785 |
| −2.2128 | −0.1901 | 0.2098 | −3.3057 | −0.0901 | 0.3474 | −1.4846 | 0.1902 | 0.3892 |
| −2.3132 | −0.1901 | 0.2147 | −3.4050 | −0.0901 | 0.3454 | −1.5825 | 0.1902 | 0.4081 |
| −2.4131 | −0.1901 | 0.2219 | −3.5040 | −0.0901 | 0.3359 | −1.6804 | 0.1902 | 0.4224 |
| −2.5125 | −0.1901 | 0.2297 | −3.6029 | −0.0901 | 0.3232 | −1.7793 | 0.1902 | 0.4343 |
| −2.6119 | −0.1901 | 0.2365 | −3.6993 | −0.0901 | 0.3022 | −1.8781 | 0.1902 | 0.4444 |
| −2.7115 | −0.1901 | 0.2440 | −3.7959 | −0.0901 | 0.2739 | −1.9773 | 0.1902 | 0.4521 |
| −2.8109 | −0.1901 | 0.2511 | −3.8791 | −0.0901 | 0.2396 | −2.0766 | 0.1902 | 0.4593 |
| −2.9106 | −0.1901 | 0.2580 | −3.9067 | −0.0901 | 0.1766 | −2.1761 | 0.1902 | 0.4646 |
| −3.0098 | −0.1901 | 0.2644 | −1.0271 | 0.0902 | 0.1918 | −2.2760 | 0.1902 | 0.4708 |
| −3.1088 | −0.1901 | 0.2675 | −1.1047 | 0.0902 | 0.2494 | −2.3757 | 0.1902 | 0.4776 |
| −3.2082 | −0.1901 | 0.2671 | −1.1960 | 0.0902 | 0.2875 | −2.4752 | 0.1902 | 0.4852 |
| −3.3078 | −0.1901 | 0.2646 | −1.2654 | 0.0902 | 0.3090 | −2.5749 | 0.1902 | 0.4920 |
| −3.4071 | −0.1901 | 0.2590 | −1.3619 | 0.0902 | 0.3253 | −2.6745 | 0.1902 | 0.5002 |
| −3.5058 | −0.1901 | 0.2481 | −1.4627 | 0.0902 | 0.3406 | −2.7740 | 0.1902 | 0.5081 |
| −3.6033 | −0.1901 | 0.2306 | −1.5615 | 0.0902 | 0.3521 | −2.8734 | 0.1902 | 0.5172 |
| −3.7010 | −0.1901 | 0.2082 | −1.6603 | 0.0902 | 0.3636 | −2.9725 | 0.1902 | 0.5249 |
| −3.7916 | −0.1901 | 0.1785 | −1.7596 | 0.0902 | 0.3719 | −3.0723 | 0.1902 | 0.5315 |
| −3.8510 | −0.1901 | 0.1076 | −1.8589 | 0.0902 | 0.3814 | −3.1713 | 0.1902 | 0.5387 |
| −3.8492 | −0.1901 | 0.0780 | −1.9580 | 0.0902 | 0.3883 | −3.2712 | 0.1902 | 0.5423 |
| −0.7272 | −0.0901 | 0.1183 | −2.0576 | 0.0902 | 0.3940 | −3.3710 | 0.1902 | 0.5499 |
| −0.8220 | −0.0901 | 0.1464 | −2.1573 | 0.0902 | 0.3998 | −3.4693 | 0.1902 | 0.5524 |
| −0.9189 | −0.0901 | 0.1673 | −2.2570 | 0.0902 | 0.4062 | −3.5680 | 0.1902 | 0.5479 |
| −1.0159 | −0.0901 | 0.1862 | −2.3564 | 0.0902 | 0.4127 | −3.6668 | 0.1902 | 0.5374 |
| −1.1147 | −0.0901 | 0.1966 | −2.4563 | 0.0902 | 0.4189 | −3.7651 | 0.1902 | 0.5220 |
| −1.2157 | −0.0901 | 0.2103 | −2.5561 | 0.0902 | 0.4274 | −3.8615 | 0.1902 | 0.5003 |
| −3.9565 | 0.1902 | 0.4700 | −2.2991 | 0.3901 | 0.5894 | −3.8439 | 0.4902 | 0.7358 |
| −4.0368 | 0.1902 | 0.4308 | −2.3982 | 0.3901 | 0.5982 | −3.9415 | 0.4902 | 0.7180 |
| −4.0586 | 0.1902 | 0.3656 | −2.4976 | 0.3901 | 0.6055 | −4.0363 | 0.4902 | 0.6913 |
| −1.3520 | 0.2901 | 0.2963 | −2.5972 | 0.3901 | 0.6126 | −4.1283 | 0.4902 | 0.6556 |
| −1.4139 | 0.2901 | 0.3704 | −2.6969 | 0.3901 | 0.6203 | −4.2033 | 0.4902 | 0.6050 |
| −1.4961 | 0.2901 | 0.4227 | −2.7963 | 0.3901 | 0.6285 | −4.2264 | 0.4902 | 0.5274 |
| −1.5489 | 0.2901 | 0.4393 | −2.8958 | 0.3901 | 0.6366 | −1.7496 | 0.5902 | 0.5406 |
| −1.6021 | 0.2901 | 0.4521 | −2.9952 | 0.3901 | 0.6450 | −1.8196 | 0.5902 | 0.6038 |
| −1.6997 | 0.2901 | 0.4731 | −3.0944 | 0.3901 | 0.6535 | −1.9177 | 0.5902 | 0.6358 |
| −1.7970 | 0.2901 | 0.4896 | −3.1941 | 0.3901 | 0.6612 | −1.9631 | 0.5902 | 0.6474 |
| −1.8956 | 0.2901 | 0.5015 | −3.2933 | 0.3901 | 0.6705 | −2.0596 | 0.5902 | 0.6654 |
| −1.9945 | 0.2901 | 0.5121 | −3.3925 | 0.3901 | 0.6767 | −2.1583 | 0.5902 | 0.6807 |
| −2.0932 | 0.2901 | 0.5195 | −3.4917 | 0.3901 | 0.6818 | −2.2567 | 0.5902 | 0.6930 |
| −2.1931 | 0.2901 | 0.5246 | −3.5911 | 0.3901 | 0.6834 | −2.3557 | 0.5902 | 0.7024 |
| −2.2930 | 0.2901 | 0.5324 | −3.6895 | 0.3901 | 0.6824 | −2.4550 | 0.5902 | 0.7113 |
| −2.3924 | 0.2901 | 0.5395 | −3.7877 | 0.3901 | 0.6707 | −2.5542 | 0.5902 | 0.7189 |
| −2.4919 | 0.2901 | 0.5469 | −3.8859 | 0.3901 | 0.6530 | −2.6540 | 0.5902 | 0.7257 |
| −2.5915 | 0.2901 | 0.5539 | −3.9806 | 0.3901 | 0.6267 | −2.7536 | 0.5902 | 0.7343 |
| −2.6911 | 0.2901 | 0.5621 | −4.0733 | 0.3901 | 0.5909 | −2.8530 | 0.5902 | 0.7418 |
| −2.7905 | 0.2901 | 0.5701 | −4.1483 | 0.3901 | 0.5432 | −2.9527 | 0.5902 | 0.7506 |
| −2.8899 | 0.2901 | 0.5783 | −4.1613 | 0.3901 | 0.5130 | −3.0521 | 0.5902 | 0.7596 |
| −2.9894 | 0.2901 | 0.5862 | −1.6136 | 0.4902 | 0.4326 | −3.1518 | 0.5902 | 0.7688 |
| −3.0889 | 0.2901 | 0.5949 | −1.6666 | 0.4902 | 0.5104 | −3.2509 | 0.5902 | 0.7800 |
| −3.1878 | 0.2901 | 0.6025 | −1.7585 | 0.4902 | 0.5588 | −3.3499 | 0.5902 | 0.7891 |
| −3.2874 | 0.2901 | 0.6077 | −1.7958 | 0.4902 | 0.5702 | −3.4489 | 0.5902 | 0.7974 |
| −3.3870 | 0.2901 | 0.6137 | −1.8628 | 0.4902 | 0.5888 | −3.5481 | 0.5902 | 0.8017 |
| −3.4860 | 0.2901 | 0.6175 | −1.9595 | 0.4902 | 0.6076 | −3.6474 | 0.5902 | 0.8043 |
| −3.5849 | 0.2901 | 0.6172 | −2.0578 | 0.4902 | 0.6228 | −3.7473 | 0.5902 | 0.8046 |
| −3.6837 | 0.2901 | 0.6106 | −2.1564 | 0.4902 | 0.6331 | −3.8457 | 0.5902 | 0.8041 |
| −3.7812 | 0.2901 | 0.5969 | −2.2556 | 0.4902 | 0.6426 | −3.9434 | 0.5902 | 0.7910 |

-continued

| X | Y | Z | X | Y | Z | X | Y | Z |
|---|---|---|---|---|---|---|---|---|
| −3.8774 | 0.2901 | 0.5734 | −2.3548 | 0.4902 | 0.6507 | −4.0401 | 0.5902 | 0.7693 |
| −3.9747 | 0.2901 | 0.5467 | −2.4543 | 0.4902 | 0.6588 | −4.1346 | 0.5902 | 0.7395 |
| −4.0615 | 0.2901 | 0.5103 | −2.5537 | 0.4902 | 0.6660 | −4.2212 | 0.5902 | 0.6997 |
| −4.1099 | 0.2901 | 0.4300 | −2.6532 | 0.4902 | 0.6730 | −4.2772 | 0.5902 | 0.6287 |
| −4.1100 | 0.2901 | 0.4229 | −2.7530 | 0.4902 | 0.6804 | −4.2791 | 0.5902 | 0.5925 |
| −1.4798 | 0.3901 | 0.3408 | −2.8523 | 0.4902 | 0.6890 | −1.8144 | 0.6901 | 0.5504 |
| −1.5350 | 0.3901 | 0.4205 | −2.9519 | 0.4902 | 0.6959 | −1.8574 | 0.6901 | 0.6305 |
| −1.6102 | 0.3901 | 0.4807 | −3.0518 | 0.4902 | 0.7056 | −1.9648 | 0.6901 | 0.6764 |
| −1.6641 | 0.3901 | 0.5010 | −3.1508 | 0.4902 | 0.7154 | −1.9972 | 0.6901 | 0.6871 |
| −1.7084 | 0.3901 | 0.5135 | −3.2503 | 0.4902 | 0.7237 | −2.0915 | 0.6901 | 0.7104 |
| −1.8053 | 0.3901 | 0.5368 | −3.3496 | 0.4902 | 0.7331 | −2.1897 | 0.6901 | 0.7258 |
| −1.9025 | 0.3901 | 0.5541 | −3.4487 | 0.4902 | 0.7402 | −2.2888 | 0.6901 | 0.7418 |
| −2.0008 | 0.3901 | 0.5670 | −3.5478 | 0.4902 | 0.7453 | −2.3873 | 0.6901 | 0.7533 |
| −2.0992 | 0.3901 | 0.5757 | −3.6473 | 0.4902 | 0.7473 | −2.4862 | 0.6901 | 0.7634 |
| −2.1990 | 0.3901 | 0.5807 | −3.7458 | 0.4902 | 0.7470 | −2.5858 | 0.6901 | 0.7710 |
| −2.6854 | 0.6901 | 0.7812 | −4.3433 | 0.7901 | 0.8097 | −3.2271 | 0.9901 | 0.9704 |
| −2.7846 | 0.6901 | 0.7910 | −4.3762 | 0.7901 | 0.7253 | −3.3267 | 0.9901 | 0.9802 |
| −2.8833 | 0.6901 | 0.8004 | −4.3758 | 0.7901 | 0.7137 | −3.4256 | 0.9901 | 0.9915 |
| −2.9833 | 0.6901 | 0.8063 | −1.9713 | 0.8900 | 0.6520 | −3.5244 | 0.9901 | 0.9994 |
| −3.0828 | 0.6901 | 0.8168 | −2.0187 | 0.8900 | 0.7324 | −3.6239 | 0.9901 | 1.0054 |
| −3.1823 | 0.6901 | 0.8238 | −2.1206 | 0.8900 | 0.7783 | −3.7232 | 0.9901 | 1.0102 |
| −3.2821 | 0.6901 | 0.8348 | −2.1540 | 0.8900 | 0.7879 | −3.8231 | 0.9901 | 1.0138 |
| −3.3809 | 0.6901 | 0.3449 | −2.2411 | 0.8900 | 0.8104 | −3.9225 | 0.9901 | 1.0189 |
| −3.4798 | 0.6901 | 0.8535 | −0.3380 | 0.8900 | 0.8295 | −4.0213 | 0.9901 | 1.0193 |
| −3.5789 | 0.6901 | 0.8581 | −2.4362 | 0.8900 | 0.8449 | −4.1201 | 0.9901 | 1.0145 |
| −3.6784 | 0.6901 | 0.8603 | −2.5348 | 0.8900 | 0.8589 | −4.2175 | 0.9901 | 1.0015 |
| −3.7782 | 0.6901 | 0.8615 | −2.6334 | 0.8900 | 0.8709 | −4.3121 | 0.9901 | 0.9754 |
| −3.8773 | 0.6901 | 0.8616 | −2.7325 | 0.8900 | 0.8810 | −4.4013 | 0.9901 | 0.9383 |
| −3.9750 | 0.6901 | 0.8541 | −2.8316 | 0.8900 | 0.8912 | −4.4624 | 0.9901 | 0.8769 |
| −4.0716 | 0.6901 | 0.8354 | −2.9308 | 0.8900 | 0.9002 | −4.4613 | 0.9901 | 0.8438 |
| −4.1669 | 0.6901 | 0.8086 | −3.0303 | 0.8900 | 0.9096 | −2.1132 | 1.0900 | 0.7573 |
| −4.2568 | 0.6901 | 0.7716 | −3.1293 | 0.8900 | 0.9183 | −2.1609 | 1.0900 | 0.8369 |
| −4.3239 | 0.6901 | 0.7147 | −3.2292 | 0.8900 | 0.9250 | −2.2697 | 1.0900 | 0.8778 |
| −4.3283 | 0.6901 | 0.6583 | −3.3288 | 0.8900 | 0.9368 | −2.3028 | 1.0900 | 0.8863 |
| −1.9000 | 0.7901 | 0.6149 | −3.4276 | 0.8900 | 0.9465 | −2.3999 | 1.0900 | 0.9097 |
| −1.9505 | 0.7901 | 0.6914 | −3.5266 | 0.8900 | 0.9543 | −2.4970 | 1.0900 | 0.9295 |
| −2.0572 | 0.7901 | 0.7321 | −3−0.6258 | 0.8900 | 0.9594 | −2.5947 | 1.0900 | 0.9455 |
| −2.0916 | 0.7901 | 0.7436 | −3.7254 | 0.8900 | 0.9632 | −2.6932 | 1.0900 | 0.9585 |
| −2.1870 | 0.7901 | 0.7646 | −3.8249 | 0.8900 | 0.9663 | −2.7921 | 1.0900 | 0.9698 |
| −2.2869 | 0.7901 | 0.7825 | −3.9247 | 0.8900 | 0.9678 | −2.8921 | 1.0900 | 0.9799 |
| −2.3851 | 0.7901 | 0.7969 | −4.0232 | 0.8900 | 0.9682 | −2.9905 | 1.0900 | 0.9894 |
| −2.4837 | 0.7901 | 0.8092 | −4.1209 | 0.8900 | 0.9572 | −3.0898 | 1.0900 | 0.9996 |
| −2.5828 | 0.7901 | 0.8198 | −4.2164 | 0.8900 | 0.9365 | −3.1890 | 1.0900 | 1.0098 |
| −2.6819 | 0.7901 | 0.8305 | −4.3138 | 0.8900 | 0.9055 | −3.2882 | 1.0900 | 1.0202 |
| −2.7811 | 0.7901 | 0.8404 | −4.3893 | 0.8900 | 0.8689 | −3.3874 | 1.0900 | 1.0300 |
| −2.8804 | 0.7901 | 0.8506 | −4.4583 | 0.8900 | 0.7639 | −3.4865 | 1.0900 | 1.0394 |
| −2.9795 | 0.7901 | 0.8600 | −4.4588 | 0.8900 | 0.7729 | −3.5856 | 1.0900 | 1.0466 |
| −3.0789 | 0.7901 | 0.8683 | −2.0518 | 0.9901 | 0.7128 | −3.6851 | 1.0900 | 1.0531 |
| −3.1782 | 0.7901 | 0.8765 | −2.0995 | 0.9901 | 0.7917 | −3.7845 | 1.0900 | 1.0590 |
| −3.2779 | 0.7901 | 0.8838 | −2.2084 | 0.9901 | 0.8329 | −3.8839 | 1.0900 | 1.0636 |
| −3.3776 | 0.7901 | 0.8941 | −2.2417 | 0.9901 | 0.8421 | −3.9835 | 1.0900 | 1.0672 |
| −3.4764 | 0.7901 | 0.9035 | −2.3378 | 0.9901 | 0.8644 | −4.0825 | 1.0900 | 1.0685 |
| −3.5753 | 0.7901 | 0.9095 | −2.4357 | 0.9901 | 0.8819 | −4.1811 | 1.0900 | 1.0636 |
| −3.6746 | 0.7901 | 0.9119 | −2.5338 | 0.9901 | 0.8986 | −4.2777 | 1.0900 | 1.0501 |
| −3.7746 | 0.7901 | 0.9129 | −2.6319 | 0.9901 | 0.9124 | −4.3717 | 1.0900 | 1.0216 |
| −3.8746 | 0.7901 | 0.9156 | −2.7306 | 0.9901 | 0.9236 | −4.4554 | 1.0900 | 0.9822 |
| −3.9730 | 0.7901 | 0.9152 | −2.8298 | 0.9901 | 0.9333 | −4.5023 | 1.0900 | 0.9046 |
| −4.0705 | 0.7901 | 0.9039 | −2.9291 | 0.9901 | 0.9429 | −2.1976 | 1.1900 | 0.8670 |
| −4.1665 | 0.7901 | 0.8811 | −3.0284 | 0.9901 | 0.9520 | −2.2862 | 1.1900 | 0.9080 |
| −4.2619 | 0.7901 | 0.8518 | −3.1277 | 0.9901 | 0.9612 | −2.3812 | 1.1900 | 0.9354 |
| −2.4787 | 1.1900 | 0.9600 | −4.2908 | 1.2901 | 1.1563 | −3.4706 | 1.4900 | 1.1912 |
| −2.5760 | 1.1900 | 0.9777 | 4.3872 | 1.2901 | 1.1396 | −3.5701 | 1.4900 | 1.2010 |
| −2.6743 | 1.1900 | 0.9931 | −4.4784 | 1.2901 | 1.1066 | −3.6694 | 1.4900 | 1.2102 |
| −2.7730 | 1.1900 | 1.0051 | −4.5508 | 1.2901 | 1.0557 | −3.7689 | 1.4900 | 1.2207 |
| −2.8719 | 1.1900 | 1.0170 | 4.5668 | 1.2901 | 1.0018 | −3.8677 | 1.4900 | 1.2308 |
| −2.9708 | 1.1900 | 1.0279 | −2.2700 | 1.3901 | 0.8737 | −3.9669 | 1.4900 | 1.2375 |
| −3.0698 | 1.1900 | 1.0383 | −2.3138 | 1.3901 | 0.9552 | −4.0665 | 1.4900 | 1.2441 |
| −3.1691 | 1.1900 | 1.0481 | −2.4230 | 1.3901 | 1.0002 | −4.1646 | 1.4900 | 1.2473 |
| −3.2684 | 1.1900 | 1.0590 | −2.4556 | 1.3901 | 1.0103 | −4.2649 | 1.4900 | 1.2429 |
| −3.3674 | 1.1900 | 1.0696 | −2.5509 | 1.3901 | 1.0349 | −4.3657 | 1.4900 | 1.2441 |
| −3.4665 | 1.1900 | 1.0787 | −2.6478 | 1.3901 | 1.0556 | −4.4630 | 1.4900 | 1.2264 |
| −3.5658 | 1.1900 | 1.0874 | −2.7456 | 1.3901 | 1.0718 | −4.5458 | 1.4900 | 1.1917 |
| −3.6650 | 1.1900 | 1.0953 | −2.8442 | 1.3901 | 1.0866 | −4.5998 | 1.4900 | 1.1476 |
| −3.7644 | 1.1900 | 1.1020 | −2.9426 | 1.3901 | 1.1008 | −4.6163 | 1.4900 | 1.1006 |
| −3.8639 | 1.1900 | 1.1081 | −3.0413 | 1.3901 | 1.1127 | −2.3601 | 1.5901 | 0.9490 |
| −3.9632 | 1.1900 | 1.1131 | −3.1404 | 1.3901 | 1.1235 | −2.4063 | 1.5901 | 1.0333 |
| −4.0624 | 1.1900 | 1.1150 | −3.2396 | 1.3901 | 1.1338 | −2.5151 | 1.5901 | 1.0777 |

-continued

| X | Y | Z | X | Y | Z | X | Y | Z |
|---|---|---|---|---|---|---|---|---|
| −4.1617 | 1.1900 | 1.1139 | −3.3389 | 1.3901 | 1.1437 | −2.5481 | 1.5901 | 1.0874 |
| −4.2600 | 1.1900 | 1.1081 | −3.4381 | 1.3901 | 1.1532 | −2.6440 | 1.5901 | 1.1118 |
| −4.3562 | 1.1900 | 1.0891 | −3.5376 | 1.3901 | 1.1617 | −2.7411 | 1.5901 | 1.1309 |
| −4.4482 | 1.1900 | 1.0559 | −3.6371 | 1.3901 | 1.1715 | −2.8394 | 1.5901 | 1.1474 |
| −4.5213 | 1.1900 | 1.0062 | −3.7362 | 1.3901 | 1.1810 | −2.9377 | 1.5901 | 1.1636 |
| −4.5358 | 1.1900 | 0.9616 | −3.8355 | 1.3901 | 1.1897 | −3.0360 | 1.5901 | 1.1776 |
| −2.2230 | 1.2901 | 0.8426 | −3.9347 | 1.3901 | 1.1973 | −3.1351 | 1.5901 | 1.1904 |
| −2.2733 | 1.2901 | 0.9210 | −4.0339 | 1.3901 | 1.2020 | −3.2336 | 1.5901 | 1.2036 |
| −2.3800 | 1.2901 | 0.9619 | −4.1329 | 1.3901 | 1.2037 | −3.3326 | 1.5901 | 1.2134 |
| −2.4143 | 1.2901 | 0.9726 | −4.2329 | 1.3901 | 1.2018 | −3.4319 | 1.5901 | 1.2233 |
| −2.5094 | 1.2901 | 0.9975 | −4.3319 | 1.3901 | 1.2009 | −3.5310 | 1.5901 | 1.2324 |
| −2.6061 | 1.2901 | 1.0173 | −4.4278 | 1.3901 | 1.1836 | −3.6306 | 1.5901 | 1.2415 |
| −2.7041 | 1.2901 | 1.0320 | −4.5176 | 1.3901 | 1.1484 | −3.7300 | 1.5901 | 1.2524 |
| −2.8031 | 1.2901 | 1.0462 | −4.5797 | 1.3901 | 1.1003 | −3.8290 | 1.5901 | 1.2625 |
| −2.9018 | 1.2901 | 1.0591 | −4.5922 | 1.3901 | 1.0558 | −3.9282 | 1.5901 | 1.2718 |
| −3.0005 | 1.2901 | 1.0711 | −2.3168 | 1.4900 | 0.8911 | −4.0272 | 1.5901 | 1.2803 |
| −3.9995 | 1.2901 | 1.0811 | −2.3395 | 1.4900 | 0.9787 | −4.1263 | 1.5901 | 1.2852 |
| −3.1988 | 1.2901 | 1.0917 | −2.4639 | 1.4900 | 1.0377 | −4.2252 | 1.5901 | 1.2871 |
| −3.2980 | 1.2901 | 1.1019 | −2.4937 | 1.4900 | 1.0466 | −4.3252 | 1.5901 | 1.2849 |
| −3.3973 | 1.2901 | 1.1115 | −2.5839 | 1.4900 | 1.0709 | −4.4237 | 1.5901 | 1.2833 |
| −3.4965 | 1.2901 | 1.1208 | −2.6803 | 1.4900 | 1.0916 | −4.5184 | 1.5901 | 1.2606 |
| −3.5961 | 1.2901 | 1.1289 | −2.7785 | 1.4900 | 1.1071 | −4.5827 | 1.5901 | 1.2235 |
| −3.6956 | 1.2901 | 1.1384 | −2.8774 | 1.4900 | 1.1234 | −4.6350 | 1.5901 | 1.1499 |
| −3.7945 | 1.2901 | 1.1467 | −2.9755 | 1.4900 | 1.1385 | −2.3985 | 1.6900 | 0.9713 |
| −3.8941 | 1.2901 | 1.1531 | −3.0742 | 1.4900 | 1.1511 | −2.4265 | 1.6900 | 1.0610 |
| −3.9933 | 1.2901 | 1.1597 | −3.1730 | 1.4900 | 1.1631 | −2.5556 | 1.6900 | 1.1141 |
| −4.0920 | 1.2901 | 1.1611 | −3.2721 | 1.4900 | 1.1734 | −2.5867 | 1.6900 | 1.1229 |
| −4.1919 | 1.2901 | 1.1590 | −3.3711 | 1.4900 | 1.1832 | −2.6828 | 1.6900 | 1.1478 |
| −2.7799 | 1.6900 | 1.1674 | −4.5277 | 1.7901 | 1.3501 | −3.6711 | 1.9900 | 1.3729 |
| −2.8779 | 1.6900 | 1.1843 | −4.6121 | 1.7901 | 1.3075 | −3.7701 | 1.9900 | 1.3848 |
| −2.9764 | 1.6900 | 1.1989 | −4.6465 | 1.7901 | 1.2744 | −3.8691 | 1.9900 | 1.3971 |
| −3.0750 | 1.6900 | 1.2134 | −4.6557 | 1.7901 | 1.2100 | −3.9678 | 1.9900 | 1.4086 |
| −3.1737 | 1.6900 | 1.2268 | −2.4682 | 1.8901 | 1.0340 | −4.0669 | 1.9900 | 1.4182 |
| −3.2725 | 1.6900 | 1.2395 | −2.4701 | 1.8901 | 1.0778 | −4.1661 | 1.9900 | 1.4276 |
| −3.3712 | 1.6900 | 1.2504 | −2.4942 | 1.8901 | 1.1338 | −4.2649 | 1.9900 | 1.4353 |
| −3.4705 | 1.6900 | 1.2600 | −2.5768 | 1.8901 | 1.1692 | −4.3638 | 1.9900 | 1.4387 |
| −3.5694 | 1.6900 | 1.2690 | −2.6731 | 1.8901 | 1.1977 | −4.4623 | 1.9900 | 1.4371 |
| −3.6694 | 1.6900 | 1.2760 | −2.7699 | 1.8901 | 1.2198 | −4.5580 | 1.9900 | 1.4219 |
| −3.7694 | 1.6900 | 1.2885 | −2.8672 | 1.8901 | 1.2392 | −4.6357 | 1.9900 | 1.3776 |
| −3.8681 | 1.6900 | 1.3011 | −2.9652 | 1.8901 | 1.2539 | −4.6618 | 1.9900 | 1.3194 |
| −3.9670 | 1.6900 | 1.3107 | −3.0641 | 1.8901 | 1.2677 | −2.5175 | 2.0900 | 1.0781 |
| −4.0660 | 1.6900 | 1.3191 | −3.1628 | 1.8901 | 1.2818 | −2.5172 | 2.0900 | 1.1370 |
| −4.1652 | 1.6900 | 1.3244 | −3.2614 | 1.8901 | 1.2943 | −2.5385 | 2.0900 | 1.1965 |
| −4.2643 | 1.6900 | 1.3275 | −3.3605 | 1.8901 | 1.3057 | −2.6207 | 2.0900 | 1.2311 |
| −4.3638 | 1.6900 | 1.3268 | −3.4595 | 1.8901 | 1.3168 | −2.7168 | 2.0900 | 1.2603 |
| −4.4614 | 1.6900 | 1.3216 | −3.5588 | 1.8901 | 1.3277 | −2.8132 | 2.0900 | 1.2817 |
| −4.5541 | 1.6900 | 1.2939 | −3.6581 | 1.8901 | 1.3400 | −2.9109 | 2.0900 | 1.3003 |
| −4.6120 | 1.6900 | 1.2545 | −3.7569 | 1.8901 | 1.3532 | −3.0092 | 2.0900 | 1.3144 |
| −4.6407 | 1.6900 | 1.2220 | −3.8556 | 1.8901 | 1.3652 | −3.1082 | 2.0900 | 1.3290 |
| 4.6479 | 1.6900 | 1.1641 | −3.9545 | 1.8901 | 1.3759 | −3.2064 | 2.0900 | 1.3439 |
| −2.4342 | 1.7901 | 0.9917 | −4.0535 | 1.8901 | 1.3857 | −3.3051 | 2.0900 | 1.3559 |
| −2.4365 | 1.7901 | 1.0480 | −4.1526 | 1.8901 | 1.3942 | −3.4042 | 2.0900 | 1.3679 |
| −2.4741 | 1.7901 | 1.1041 | −4.2516 | 1.8901 | 1.4011 | −3.5034 | 2.0900 | 1.3305 |
| −2.5598 | 1.7901 | 1.1394 | −4.3505 | 1.8901 | 1.4040 | −3.6022 | 2.0900 | 1.3940 |
| −2.6555 | 1.7901 | 1.1678 | −4.4492 | 1.8901 | 1.4017 | −3.7009 | 2.0900 | 1.4065 |
| −2.7519 | 1.7901 | 1.1898 | −4.5445 | 1.8901 | 1.3373 | −3.7999 | 2.0900 | 1.4184 |
| −2.8494 | 1.7901 | 1.2087 | −4.6264 | 1.8901 | 1.3417 | −3.8989 | 2.0900 | 1.4307 |
| −2.9473 | 1.7901 | 1.2242 | −4.6535 | 1.8901 | 1.3098 | −3.9975 | 2.0900 | 1.4423 |
| −3.0460 | 1.7901 | 1.2379 | −4.6608 | 1.8901 | 1.2577 | −4.0967 | 2.0900 | 1.4519 |
| −3.1449 | 1.7901 | 1.2517 | −2.4951 | 1.9900 | 1.0546 | −4.1960 | 2.0900 | 1.4623 |
| −3.2434 | 1.7901 | 1.2655 | −2.4917 | 1.9900 | 1.1113 | −4.2948 | 2.0900 | 1.4709 |
| −3.3422 | 1.7901 | 1.2753 | −2.5088 | 1.9900 | 1.1598 | −4.3935 | 2.0900 | 1.4754 |
| −3.4417 | 1.7901 | 1.2863 | −2.5890 | 1.9900 | 1.1972 | −4.4909 | 2.0900 | 1.4717 |
| −3.5406 | 1.7901 | 1.2974 | −2.6865 | 1.9900 | 1.2249 | −4.5837 | 2.0900 | 1.4487 |
| −3.6402 | 1.7901 | 1.3073 | −2.7838 | 1.9900 | 1.2498 | −4.6451 | 2.0900 | 1.4075 |
| −3.7390 | 1.7901 | 1.3200 | −2.8809 | 1.9900 | 1.2633 | −4.6606 | 2.0900 | 1.3590 |
| −3.8381 | 1.7901 | 1.3287 | −2.9789 | 1.9900 | 1.2838 | −2.5315 | 2.1902 | 1.0987 |
| −3.9379 | 1.7901 | 1.3399 | −3.0779 | 1.9900 | 1.2961 | −2.5310 | 2.1902 | 1.1665 |
| −4.0365 | 1.7901 | 1.3513 | −3.1767 | 1.9900 | 1.3104 | −2.5572 | 2.1902 | 1.2281 |
| −4.1353 | 1.7901 | 1.3592 | −3.2757 | 1.9900 | 1.3223 | −2.6412 | 2.1902 | 1.2607 |
| −4.2343 | 1.7901 | 1.3647 | −3.3746 | 1.9900 | 1.3363 | −2.7383 | 2.1902 | 1.2876 |
| −4.3335 | 1.7901 | 1.3663 | −3.4733 | 1.9900 | 1.3484 | −2.8350 | 2.1902 | 1.3102 |
| −4.4323 | 1.7901 | 1.3645 | −3.5723 | 1.9900 | 1.3609 | −2.9324 | 2.1902 | 1.3283 |
| −3.0309 | 2.1902 | 1.3431 | −2.5482 | 2.3901 | 1.2261 | 4.4303 | 2.4901 | 1.6062 |
| −3.1294 | 2.1902 | 1.3584 | −2.5807 | 2.3901 | 1.2837 | 4.5263 | 2.4901 | 1.5912 |
| −3.2280 | 2.1902 | 1.3714 | −2.6663 | 2.3901 | 1.3158 | −4.6064 | 2.4901 | 1.5548 |
| −3.3267 | 2.1902 | 1.3843 | −2.7631 | 2.3901 | 1.3417 | −4.6317 | 2.4901 | 1.4970 |

-continued

| X | Y | Z | X | Y | Z | X | Y | Z |
|---|---|---|---|---|---|---|---|---|
| −3.4259 | 2.1902 | 1.3964 | −2.8599 | 2.3901 | 1.3619 | −2.5455 | 2.5900 | 1.2052 |
| −3.5247 | 2.1902 | 1.4101 | −2.9578 | 2.3901 | 1.3790 | −2.5403 | 2.5900 | 1.2668 |
| −3.6238 | 2.1902 | 1.4229 | −3.0566 | 2.3901 | 1.3951 | −2.5714 | 2.5900 | 1.3250 |
| −3.7222 | 2.1902 | 1.4382 | −3.1542 | 2.3901 | 1.4134 | −2.6570 | 2.5900 | 1.3569 |
| −3.8209 | 2.1902 | 1.4504 | −3.2524 | 2.3901 | 1.4263 | −2.7532 | 2.5900 | 1.3838 |
| −3.9196 | 2.1902 | 1.4641 | −3.3521 | 2.3901 | 1.4397 | −2.8502 | 2.5900 | 1.4036 |
| −4.0181 | 2.1902 | 1.4742 | −3.4504 | 2.3901 | 1.4542 | −2.9482 | 2.5900 | 1.4245 |
| −4.1180 | 2.1902 | 1.4834 | −3.5492 | 2.3901 | 1.4664 | −3.0460 | 2.5900 | 1.4422 |
| −4.2171 | 2.1902 | 1.4961 | −3.6487 | 2.3901 | 1.4809 | −3.1433 | 2.5900 | 1.4604 |
| −4.3156 | 2.1902 | 1.5055 | −3.7468 | 2.3901 | 1.4980 | −3.2418 | 2.5900 | 1.4723 |
| −4.4142 | 2.1902 | 1.5104 | −3.8451 | 2.3901 | 1.5123 | −3.3420 | 2.5900 | 1.4864 |
| −4.5106 | 2.1902 | 1.5045 | −3.9440 | 2.3901 | 1.5262 | −3.4406 | 2.5900 | 1.5015 |
| −4.6007 | 2.1902 | 1.4736 | −4.0426 | 2.3901 | 1.5401 | −3.5393 | 2.5900 | 1.5171 |
| −4.6449 | 2.1902 | 1.4406 | −4.1414 | 2.3901 | 1.5525 | −3.6378 | 2.5900 | 1.5342 |
| −4.6573 | 2.1902 | 1.3958 | −4.2404 | 2.3901 | 1.5654 | −3.7359 | 2.5900 | 1.5518 |
| −2.5424 | 2.2901 | 1.1450 | −4.3382 | 2.3901 | 1.5762 | −3.8340 | 2.5900 | 1.5690 |
| −2.5418 | 2.2901 | 1.2002 | −4.4360 | 2.3901 | 1.5758 | −3.9318 | 2.5900 | 1.5848 |
| −2.5766 | 2.2901 | 1.2597 | −4.5322 | 2.3901 | 1.5617 | −4.0306 | 2.5900 | 1.5982 |
| −2.6627 | 2.2901 | 1.2915 | −4.6133 | 2.3901 | 1.5253 | −4.1292 | 2.5900 | 1.6126 |
| −2.7594 | 2.2901 | 1.3177 | −4.6425 | 2.3901 | 1.4672 | −4.2282 | 2.5900 | 1.6246 |
| −2.8559 | 2.2901 | 1.3378 | −2.5490 | 2.4901 | 1.1919 | −4.3261 | 2.5900 | 1.6365 |
| −2.9539 | 2.2901 | 1.3546 | −2.5480 | 2.4901 | 1.2482 | −4.4233 | 2.5900 | 1.6361 |
| −3.0522 | 2.2901 | 1.3702 | −2.5773 | 2.4901 | 1.3056 | −4.5189 | 2.5900 | 1.6193 |
| −3.1507 | 2.2901 | 1.3856 | −2.6624 | 2.4901 | 1.3366 | −4.5979 | 2.5900 | 1.5820 |
| −3.2489 | 2.2901 | 1.4004 | −2.7592 | 2.4901 | 1.3631 | −4.6191 | 2.5900 | 1.5175 |
| −3.3479 | 2.2901 | 1.4123 | −2.8555 | 2.4901 | 1.3839 | −2.5375 | 2.6901 | 1.2031 |
| −3.4468 | 2.2901 | 1.4259 | −2.9538 | 2.4901 | 1.4020 | −2.5321 | 2.6901 | 1.2708 |
| −3.5458 | 2.2901 | 1.4387 | −3.0515 | 2.4901 | 1.4214 | −2.5601 | 2.6901 | 1.3426 |
| −3.6444 | 2.2901 | 1.4541 | −3.1488 | 2.4901 | 1.4379 | −2.6445 | 2.6901 | 1.3747 |
| −3.7430 | 2.2901 | 1.4682 | −3.2470 | 2.4901 | 1.4497 | −2.7411 | 2.6901 | 1.4023 |
| −3.8413 | 2.2901 | 1.4830 | −3.3469 | 2.4901 | 1.4599 | −2.8378 | 2.6901 | 1.4238 |
| −3.9399 | 2.2901 | 1.4943 | −3.4461 | 2.4901 | 1.4760 | −2.9355 | 2.6901 | 1.4452 |
| −4.0395 | 2.2901 | 1.5063 | −3.5448 | 2.4901 | 1.4915 | −3.0331 | 2.6901 | 1.4642 |
| −4.1384 | 2.2901 | 1.5201 | −3.6434 | 2.4901 | 1.5084 | −3.1305 | 2.6901 | 1.4821 |
| −4.2369 | 2.2901 | 1.5326 | −3.7412 | 2.4901 | 1.5252 | −3.2292 | 2.6901 | 1.4951 |
| −4.3351 | 2.2901 | 1.5417 | −3.8397 | 2.4901 | 1.5398 | −3.3281 | 2.6901 | 1.5100 |
| −4.4333 | 2.2901 | 1.5430 | −3.9379 | 2.4901 | 1.5537 | −3.4268 | 2.6901 | 1.5244 |
| −4.5298 | 2.2901 | 1.5323 | −4.0375 | 2.4901 | 1.5657 | −3.5260 | 2.6901 | 1.5401 |
| −4.6130 | 2.2901 | 1.4974 | −4.1359 | 2.4901 | 1.5819 | −3.6242 | 2.6901 | 1.5590 |
| −4.6515 | 2.2901 | 1.4369 | −4.2348 | 2.4901 | 1.5932 | −3.7222 | 2.6901 | 1.5768 |
| −2.5489 | 2.3901 | 1.1615 | −4.3329 | 2.4901 | 1.6057 | −3.8205 | 2.6901 | 1.5945 |
| −3.9183 | 2.6901 | 1.6117 | −3.4051 | 2.8899 | 1.5744 | −2.8601 | 3.0900 | 1.5135 |
| −4.0168 | 2.6901 | 1.6258 | −3.5036 | 2.8899 | 1.5902 | −2.9561 | 3.0900 | 1.5381 |
| −4.1153 | 2.6901 | 1.6394 | −3.6022 | 2.8899 | 1.6077 | −3.0529 | 3.0900 | 1.5597 |
| −4.2145 | 2.6901 | 1.6514 | −3.7003 | 2.8899 | 1.6258 | −3.1503 | 3.0900 | 1.5795 |
| −4.3125 | 2.6901 | 1.6641 | −3.7979 | 2.8899 | 1.6432 | −3.2481 | 3.0900 | 1.5968 |
| −4.4097 | 2.6901 | 1.6641 | −3.8967 | 2.8899 | 1.6578 | −3.3462 | 3.0900 | 1.6121 |
| −4.5050 | 2.6901 | 1.6465 | −3.9950 | 2.8899 | 1.6761 | −3.4455 | 3.0900 | 1.6268 |
| −4.5805 | 2.6901 | 1.6104 | −4.0929 | 2.8899 | 1.6914 | −3.5442 | 3.0900 | 1.6461 |
| −4.6028 | 2.6901 | 1.5564 | −4.1916 | 2.8899 | 1.7059 | −3.6417 | 3.0900 | 1.6658 |
| −2.5205 | 2.7901 | 1.2814 | −4.2891 | 2.8899 | 1.7174 | −3.7394 | 3.0900 | 1.6833 |
| −2.5244 | 2.7901 | 1.3195 | −4.3862 | 2.8899 | 1.7152 | −3.8375 | 3.0900 | 1.6995 |
| −2.5494 | 2.7901 | 1.3608 | −4.4804 | 2.8899 | 1.6941 | −3.9359 | 3.0900 | 1.7167 |
| −2.6349 | 2.7901 | 1.3923 | −4.5469 | 2.8899 | 1.6577 | −4.0343 | 3.0900 | 1.7323 |
| −2.7310 | 2.7901 | 1.4206 | −4.5597 | 2.8899 | 1.6226 | −4.1328 | 3.0900 | 1.7493 |
| −2.8271 | 2.7901 | 1.4429 | −2.4893 | 2.9900 | 1.2816 | −4.2300 | 3.0900 | 1.7632 |
| −2.9249 | 2.7901 | 1.4655 | −2.4912 | 2.9900 | 1.3409 | −4.3272 | 3.0900 | 1.7647 |
| −3.0213 | 2.7901 | 1.4869 | −2.5173 | 2.9900 | 1.3920 | −4.4216 | 3.0900 | 1.7647 |
| −3.1193 | 2.7901 | 1.5032 | −2.6019 | 2.9900 | 1.4233 | −4.4896 | 3.0900 | 1.7114 |
| −3.2177 | 2.7901 | 1.5195 | −2.6985 | 2.9900 | 1.4514 | −4.5123 | 3.0900 | 1.6587 |
| −3.3168 | 2.7901 | 1.5329 | −2.7948 | 2.9900 | 1.4755 | −2.4354 | 3.1901 | 1.3332 |
| −3.4156 | 2.7901 | 1.5507 | −2.8918 | 2.9900 | 1.5001 | −2.4392 | 3.1901 | 1.3692 |
| −3.5136 | 2.7901 | 1.5673 | −2.9879 | 2.9900 | 1.5244 | −2.4767 | 3.1901 | 1.4178 |
| −3.6121 | 2.7901 | 1.5844 | −3.0852 | 2.9900 | 1.5439 | −2.5639 | 3.1901 | 1.4510 |
| −3.7101 | 2.7901 | 1.6017 | −3.1829 | 2.9900 | 1.5626 | −2.6598 | 3.1901 | 1.4801 |
| −3.8083 | 2.7901 | 1.6180 | −3.2809 | 2.9900 | 1.5790 | −2.7557 | 3.1901 | 1.5056 |
| −3.9066 | 2.7901 | 1.6343 | −3.3793 | 2.9900 | 1.5952 | −2.8523 | 3.1901 | 1.5306 |
| −4.0049 | 2.7901 | 1.6501 | −3.4778 | 2.9900 | 1.6111 | −2.9485 | 3.1901 | 1.5561 |
| −4.1033 | 2.7901 | 1.6650 | −3.5761 | 2.9900 | 1.6288 | −3.0450 | 3.1901 | 1.5795 |
| −4.2019 | 2.7901 | 1.6782 | −3.6744 | 2.9900 | 1.6454 | −3.1416 | 3.1901 | 1.6003 |
| −4.3001 | 2.7901 | 1.6899 | −3.7728 | 2.9900 | 1.6634 | −3.2397 | 3.1901 | 1.6164 |
| −4.3969 | 2.7901 | 1.6912 | −3.8707 | 2.9900 | 1.6818 | −3.3383 | 3.1901 | 1.6346 |
| −4.4920 | 2.7901 | 1.6721 | −3.9686 | 2.9900 | 1.6986 | −3.4359 | 3.1901 | 1.6533 |
| −4.5587 | 2.7901 | 1.6421 | −4.0669 | 2.9900 | 1.7137 | −3.5341 | 3.1901 | 1.6701 |
| −4.5839 | 2.7901 | 1.5863 | −4.1657 | 2.9900 | 1.7280 | −3.6323 | 3.1901 | 1.6880 |
| −2.5058 | 2.8899 | 1.2796 | −4.2631 | 2.9900 | 1.7408 | −3.7307 | 3.1901 | 1.7050 |
| −2.5143 | 2.8899 | 1.3269 | −4.3604 | 2.9900 | 1.7399 | −3.8285 | 3.1901 | 1.7236 |

-continued

| X | Y | Z | X | Y | Z | X | Y | Z |
|---|---|---|---|---|---|---|---|---|
| −2.5416 | 2.8899 | 1.3795 | −4.4545 | 2.9900 | 1.7206 | −3.9268 | 3.1901 | 1.7394 |
| −2.6262 | 2.8899 | 1.4103 | −4.5225 | 2.9900 | 1.6816 | −4.0252 | 3.1901 | 1.7574 |
| −2.7229 | 2.8899 | 1.4381 | −4.5390 | 2.9900 | 1.6346 | −4.1229 | 3.1901 | 1.7737 |
| −2.8190 | 2.8899 | 1.4621 | −2.4704 | 3.0900 | 1.3115 | −4.2203 | 3.1901 | 1.7859 |
| −2.9160 | 2.8899 | 1.4853 | −2.4704 | 3.0900 | 1.3545 | −4.3175 | 3.1901 | 1.7855 |
| −3.0128 | 2.8899 | 1.5070 | −2.4883 | 3.0900 | 1.4013 | −4.4106 | 3.1901 | 1.7644 |
| −3.1103 | 2.8899 | 1.5255 | −2.5710 | 3.0900 | 1.4329 | −4.4669 | 3.1901 | 1.7291 |
| −3.2082 | 2.8899 | 1.5424 | −2.6671 | 3.0900 | 1.4630 | −4.4752 | 3.1901 | 1.6924 |
| −3.3066 | 2.8899 | 1.5582 | −2.7630 | 3.9900 | 1.4873 | −2.4123 | 3.2900 | 1.3299 |
| −2.4153 | 3.2900 | 1.3804 | −4.2541 | 3.3900 | 1.8271 | −3.6873 | 3.5901 | 1.7902 |
| −2.4393 | 3.2900 | 1.4235 | −4.3467 | 3.3900 | 1.8092 | −3.7852 | 3.5901 | 1.8099 |
| −2.5236 | 3.2900 | 1.4569 | −4.4083 | 3.3900 | 1.7637 | −3.8827 | 3.5901 | 1.8293 |
| −2.6194 | 3.2900 | 1.4875 | −4.4225 | 3.3900 | 1.7201 | −3.9800 | 3.5901 | 1.8471 |
| −2.7149 | 3.2900 | 1.5136 | −2.3525 | 3.4900 | 1.3628 | −4.0779 | 3.5901 | 1.8594 |
| −2.8114 | 3.2900 | 1.5394 | −2.3532 | 3.4900 | 1.4054 | −4.1752 | 3.5901 | 1.8641 |
| −2.9076 | 3.2900 | 1.5652 | −2.3936 | 3.4900 | 1.4471 | −4.2695 | 3.5901 | 1.8498 |
| −3.0038 | 3.2900 | 1.5897 | −2.4828 | 3.4900 | 1.4809 | −4.3349 | 3.5901 | 1.8114 |
| −3.1006 | 3.2900 | 1.6119 | −2.5778 | 3.4900 | 1.5115 | −4.3521 | 3.5901 | 1.7646 |
| −3.1979 | 3.2900 | 1.6327 | −2.6731 | 3.4900 | 1.5380 | −2.2872 | 3.6900 | 1.3831 |
| −3.2952 | 3.2900 | 1.6521 | −2.7696 | 3.4900 | 1.5647 | −2.2879 | 3.6900 | 1.4237 |
| −3.3933 | 3.2900 | 1.6697 | −2.8655 | 3.4900 | 1.5919 | −2.3103 | 3.6900 | 1.4542 |
| −3.4914 | 3.2900 | 1.6886 | −2.9612 | 3.4900 | 1.6185 | −2.3957 | 3.6900 | 1.4894 |
| −3.5887 | 3.2900 | 1.7063 | −3.0575 | 3.4900 | 1.6421 | −2.4908 | 3.6900 | 1.5215 |
| −3.6877 | 3.2900 | 1.7212 | −3.1544 | 3.4900 | 1.6642 | −2.5860 | 3.6900 | 1.5488 |
| −3.7860 | 3.2900 | 1.7405 | −3.2517 | 3.4900 | 1.6848 | −2.6822 | 3.6900 | 1.5761 |
| −3.8840 | 3.2900 | 1.7576 | −3.3492 | 3.4900 | 1.7048 | −2.7780 | 3.6900 | 1.6042 |
| −3.9821 | 3.2900 | 1.7762 | −3.4469 | 3.4900 | 1.7242 | −2.8737 | 3.6900 | 1.6322 |
| −4.0798 | 3.2900 | 1.7934 | −3.5446 | 3.4900 | 1.7429 | −2.9692 | 3.6900 | 1.6594 |
| −4.1771 | 3.2900 | 1.8065 | −3.6428 | 3.4900 | 1.7606 | −3.0654 | 3.6900 | 1.6831 |
| −4.2746 | 3.2900 | 1.8079 | −3.7410 | 3.4900 | 1.7794 | −3.1625 | 3.6900 | 1.7055 |
| −4.3685 | 3.2900 | 1.7917 | −3.8388 | 3.4900 | 1.7989 | −3.2595 | 3.6900 | 1.7266 |
| −4.4377 | 3.2900 | 1.7486 | −3.9363 | 3.4900 | 1.8176 | −3.3573 | 3.6900 | 1.7459 |
| −4.4517 | 3.2900 | 1.7188 | −4.0342 | 3.4900 | 1.8334 | −3.4549 | 3.6900 | 1.7665 |
| −2.3834 | 3.3900 | 1.3571 | −4.1317 | 3.4900 | 1.8452 | −3.5524 | 3.6900 | 1.7862 |
| −2.3851 | 3.3900 | 1.3883 | −4.2293 | 3.4900 | 1.8453 | −3.6500 | 3.6900 | 1.8059 |
| −2.4190 | 3.3900 | 1.4366 | −4.3210 | 3.4900 | 1.8258 | −3.7478 | 3.6900 | 1.8249 |
| −2.5055 | 3.3900 | 1.4702 | −4.3766 | 3.4900 | 1.7817 | −3.8456 | 3.6900 | 1.8439 |
| −2.6012 | 3.3900 | 1.5003 | −4.3875 | 3.4900 | 1.7407 | −3.9431 | 3.6900 | 1.8616 |
| −2.6966 | 3.3900 | 1.5269 | −2.3224 | 3.5901 | 1.3766 | −4.0411 | 3.6900 | 1.8749 |
| −2.7930 | 3.3900 | 1.5528 | −2.3236 | 3.5901 | 1.4088 | −4.1385 | 3.6900 | 1.8803 |
| −2.8891 | 3.3900 | 1.5794 | −2.3461 | 3.5901 | 1.4485 | −4.2328 | 3.6900 | 1.8669 |
| −2.9849 | 3.3900 | 1.6053 | −2.4305 | 3.5901 | 1.4830 | −4.2983 | 3.6900 | 1.8282 |
| −3.0813 | 3.3900 | 1.6282 | −2.5262 | 3.5901 | 1.5143 | −4.3111 | 3.6900 | 1.7989 |
| −3.1783 | 3.3900 | 1.6495 | −2.6215 | 3.5901 | 1.5415 | −2.2554 | 3.7901 | 1.3890 |
| −3.2757 | 3.3900 | 1.6693 | −2.7178 | 3.5901 | 1.5684 | −2.2560 | 3.7901 | 1.4229 |
| −3.3735 | 3.3900 | 1.6886 | −2.8137 | 3.5901 | 1.5963 | −2.2934 | 3.7901 | 1.4692 |
| −3.4711 | 3.3900 | 1.7081 | −2.9093 | 3.5901 | 1.6237 | −2.3810 | 3.7901 | 1.5038 |
| −3.5691 | 3.3900 | 1.7255 | −3.0052 | 3.5901 | 1.6493 | −2.4765 | 3.7901 | 1.5342 |
| −3.6674 | 3.3900 | 1.7435 | −3.1016 | 3.5901 | 1.6725 | −2.5720 | 3.7901 | 1.5623 |
| −3.7653 | 3.3900 | 1.7621 | −3.1989 | 3.5901 | 1.6934 | −2.6680 | 3.7901 | 1.5894 |
| −3.8633 | 3.3900 | 1.7802 | −3.2963 | 3.5901 | 1.7142 | −2.7639 | 3.7901 | 1.6179 |
| −3.9610 | 3.3900 | 1.7980 | −3.3940 | 3.5901 | 1.7338 | −2.8590 | 3.7901 | 1.6470 |
| −4.0593 | 3.3900 | 1.8131 | −3.4917 | 3.5901 | 1.7534 | −2.9545 | 3.7901 | 1.6739 |
| −4.1566 | 3.3900 | 1.8266 | −3.5892 | 3.5901 | 1.7724 | −3.0503 | 3.7901 | 1.6988 |
| −3.1477 | 3.7901 | 1.7213 | −2.6819 | 3.9901 | 1.6288 | −2.1382 | 4.1902 | 1.4826 |
| −3.2438 | 3.7901 | 1.7467 | −2.7773 | 3.9901 | 1.6577 | −2.2209 | 4.1902 | 1.5209 |
| −3.3404 | 3.7901 | 1.7662 | −2.8727 | 3.9901 | 1.6862 | −2.3161 | 4.1902 | 1.5539 |
| −3.4388 | 3.7901 | 1.7834 | −2.9680 | 3.9901 | 1.7138 | −2.4113 | 4.1902 | 1.5835 |
| −3.5373 | 3.7901 | 1.8022 | −3.0640 | 3.9901 | 1.7382 | −2.5070 | 4.1902 | 1.6115 |
| −3.6349 | 3.7901 | 1.8237 | −3.1607 | 3.9901 | 1.7607 | −2.6029 | 4.1902 | 1.6398 |
| −3.7320 | 3.7901 | 1.8437 | −3.2581 | 3.9901 | 1.7818 | −2.6984 | 4.1902 | 1.6689 |
| −3.8299 | 3.7901 | 1.8618 | −3.3553 | 3.9901 | 1.8035 | −2.7937 | 4.1902 | 1.6973 |
| −3.9274 | 3.7901 | 1.8795 | −3.4527 | 3.9901 | 1.8248 | −2.8895 | 4.1902 | 1.7250 |
| −4.0252 | 3.7901 | 1.8911 | −3.5500 | 3.9901 | 1.8466 | −2.9851 | 4.1902 | 1.7524 |
| −4.1226 | 3.7901 | 1.8944 | −3.6472 | 3.9901 | 1.8682 | −3.0812 | 4.1902 | 1.7775 |
| −4.2142 | 3.7901 | 1.5771 | −3.7443 | 3.9901 | 1.8883 | −3.1776 | 4.1902 | 1.8013 |
| −4.2658 | 3.7901 | 1.8332 | −3.8422 | 3.9901 | 1.9052 | −3.2748 | 4.1902 | 1.8233 |
| −4.2703 | 3.7901 | 1.8219 | −3.9400 | 3.9901 | 1.9186 | −3.3717 | 4.1902 | 1.8464 |
| −2.2218 | 3.8901 | 1.3810 | −4.0377 | 3.9901 | 1.9234 | −3.4691 | 4.1902 | 1.8679 |
| −2.2197 | 3.8901 | 1.4276 | −4.1301 | 3.9901 | 1.9088 | −3.5663 | 4.1902 | 1.8911 |
| −2.2483 | 3.8901 | 1.4711 | −4.1866 | 3.9901 | 1.8640 | −3.6631 | 4.1902 | 1.9123 |
| −2.3336 | 3.8901 | 1.5060 | −4.1908 | 3.9901 | 1.8511 | −3.7609 | 4.1902 | 1.9303 |
| −2.4292 | 3.8901 | 1.5372 | −2.1470 | 4.0900 | 1.3967 | −3.8577 | 4.1902 | 1.9435 |
| −2.5243 | 3.8901 | 1.5653 | −2.1506 | 4.0900 | 1.4299 | −3.9592 | 4.1902 | 1.9493 |
| −2.6208 | 3.8901 | 1.5921 | −2.1798 | 4.0900 | 1.4830 | −4.0441 | 4.1902 | 1.9395 |
| −2.7160 | 3.8901 | 1.6222 | −2.2644 | 4.0900 | 1.5183 | −4.1449 | 4.1902 | 1.8973 |
| −2.8115 | 3.8901 | 1.6506 | −2.3596 | 4.0900 | 1.5505 | −4.1430 | 4.1902 | 1.9011 |

-continued

| X | Y | Z | X | Y | Z | X | Y | Z |
|---|---|---|---|---|---|---|---|---|
| −2.9067 | 3.8901 | 1.6795 | −2.4551 | 4.0900 | 1.5795 | −2.0796 | 4.2901 | 1.4272 |
| −3.0023 | 3.8901 | 1.7052 | −2.5486 | 4.0900 | 1.6064 | −2.0758 | 4.2901 | 1.4505 |
| −3.0989 | 3.8901 | 1.7284 | −2.6497 | 4.0900 | 1.6228 | −2.1027 | 4.2901 | 1.4878 |
| −3.1960 | 3.8901 | 1.7504 | −2.7522 | 4.0900 | 1.6678 | −2.1879 | 4.2901 | 1.5263 |
| −3.2931 | 3.8901 | 1.7720 | −2.8256 | 4.0900 | 1.6891 | −2.2823 | 4.2901 | 1.5601 |
| −3.3904 | 3.8901 | 1.7926 | −2.9235 | 4.0900 | 1.7180 | −2.3769 | 4.2901 | 1.5900 |
| −3.4879 | 3.8901 | 1.8128 | −3.0187 | 4.0900 | 1.7441 | −2.4725 | 4.2901 | 1.6184 |
| −3.5855 | 3.8901 | 1.8338 | −3.1154 | 4.0900 | 1.7675 | −2.5681 | 4.2901 | 1.6475 |
| −3.6825 | 3.8901 | 1.8552 | −3.2120 | 4.0900 | 1.7904 | −2.6633 | 4.2901 | 1.6764 |
| −3.7799 | 3.8901 | 1.8738 | −3.3094 | 4.0900 | 1.8116 | −2.7590 | 4.2901 | 1.7046 |
| −3.8780 | 3.8901 | 1.8907 | −3.4064 | 4.0900 | 1.8345 | −2.8545 | 4.2901 | 1.7326 |
| −3.9756 | 3.8901 | 1.9047 | −3.5036 | 4.0900 | 1.8556 | −2.9503 | 4.2901 | 1.7600 |
| −4.0736 | 3.8901 | 1.9095 | −3.6010 | 4.0900 | 1.8780 | −3.0461 | 4.2901 | 1.7864 |
| −4.1646 | 3.8901 | 1.8958 | −3.6978 | 4.0900 | 1.8994 | −3.1424 | 4.2901 | 1.8109 |
| −4.2314 | 3.8901 | 1.8407 | −3.7950 | 4.0900 | 1.9175 | −3.2389 | 4.2901 | 1.8347 |
| −2.1866 | 3.9901 | 1.3813 | −3.8929 | 4.0900 | 1.9304 | −3.3360 | 4.2901 | 1.8568 |
| −2.1850 | 3.9901 | 1.4278 | −3.9907 | 4.0900 | 1.9363 | −3.4331 | 4.2901 | 1.8798 |
| −2.2144 | 3.9901 | 1.4776 | −4.0838 | 4.0900 | 1.9241 | −3.5302 | 4.2901 | 1.9024 |
| −2.2995 | 3.9901 | 1.5123 | −4.1460 | 4.0900 | 1.8767 | −3.6271 | 4.2901 | 1.9243 |
| −2.3952 | 3.9901 | 1.5438 | −4.1533 | 4.0900 | 1.8511 | −3.7245 | 4.2901 | 1.9429 |
| −2.4904 | 3.9901 | 1.5727 | −2.1134 | 4.1902 | 1.4154 | −3.8218 | 4.2901 | 1.9568 |
| −2.5862 | 3.9901 | 1.6005 | −2.1169 | 4.1902 | 1.4442 | −3.9200 | 4.2901 | 1.9615 |
| −4.0111 | 4.2901 | 1.9480 | −3.4419 | 4.4902 | 1.9204 | −2.8887 | 4.6902 | 1.8094 |
| −4.0664 | 4.2901 | 1.8924 | −3.5384 | 4.4902 | 1.9433 | −2.9844 | 4.6902 | 1.8372 |
| −4.0687 | 4.2901 | 1.8851 | −3.6360 | 4.4902 | 1.9622 | −3.0799 | 4.6902 | 1.8648 |
| −2.0408 | 4.3901 | 1.4369 | −3.7332 | 4.4902 | 1.9789 | −3.1756 | 4.6902 | 1.8912 |
| −2.0409 | 4.3901 | 1.4535 | −3.8306 | 4.4902 | 1.9845 | −3.2720 | 4.6902 | 1.9158 |
| −2.0617 | 4.3901 | 1.4902 | −3.9230 | 4.4902 | 1.9704 | −3.3687 | 4.6902 | 1.9398 |
| −2.1450 | 4.3901 | 1.5281 | −3.9784 | 4.4902 | 1.9279 | −3.4654 | 4.6902 | 1.9629 |
| −2.2393 | 4.3901 | 1.5629 | −3.9821 | 4.4902 | 1.9177 | −3.5623 | 4.6902 | 1.9835 |
| −2.3336 | 4.3901 | 1.5929 | −1.9648 | 4.5901 | 1.4212 | −3.6597 | 4.6902 | 1.9996 |
| −2.4290 | 4.3901 | 1.6220 | −1.9630 | 4.5901 | 1.4557 | −3.7566 | 4.6902 | 2.0060 |
| −2.5244 | 4.3901 | 1.6510 | −1.9860 | 4.5901 | 1.4918 | −3.8483 | 4.6902 | 1.9880 |
| −2.6196 | 4.3901 | 1.6801 | −2.0694 | 4.5901 | 1.5325 | −3.8926 | 4.6902 | 1.9543 |
| −2.7151 | 4.3901 | 1.7087 | −2.1629 | 4.5901 | 1.5693 | −3.9028 | 4.6902 | 1.9226 |
| −2.8107 | 4.3901 | 1.7369 | −2.2565 | 4.5901 | 1.6013 | −1.8933 | 4.7901 | 1.4280 |
| −2.9063 | 4.3901 | 1.7648 | −2.3515 | 4.5901 | 1.6314 | −1.8923 | 4.7901 | 1.4524 |
| −3.0019 | 4.3901 | 1.7921 | −2.4465 | 4.5901 | 1.6608 | −1.9086 | 4.7901 | 1.4921 |
| −3.0979 | 4.3901 | 1.8176 | −2.5420 | 4.5901 | 1.6898 | −1.9893 | 4.7901 | 1.5323 |
| −3.1944 | 4.3901 | 1.8415 | −2.6369 | 4.5901 | 1.7196 | −2.0823 | 4.7901 | 1.5712 |
| −3.2912 | 4.3901 | 1.8651 | −2.7325 | 4.5901 | 1.7474 | −2.1750 | 4.7901 | 1.6048 |
| −3.3883 | 4.3901 | 1.8882 | −2.8278 | 4.5901 | 1.7765 | −2.2691 | 4.7901 | 1.6366 |
| −3.4851 | 4.3901 | 1.9119 | −2.9234 | 4.5901 | 1.8033 | −2.3638 | 4.7901 | 1.6662 |
| −3.5821 | 4.3901 | 1.9333 | −3.0193 | 4.5901 | 1.8310 | −2.4590 | 4.7901 | 1.6962 |
| −3.6794 | 4.3901 | 1.9531 | −3.1148 | 4.5901 | 1.8576 | −2.5538 | 4.7901 | 1.7266 |
| −3.7766 | 4.3901 | 1.9681 | −3.2112 | 4.5901 | 1.8824 | −2.6487 | 4.7901 | 1.7560 |
| −3.8744 | 4.3901 | 1.9735 | −3.3077 | 4.5901 | 1.9066 | −2.7440 | 4.7901 | 1.7843 |
| −3.9663 | 4.3901 | 1.9595 | −3.4048 | 4.5901 | 1.9301 | −2.8396 | 4.7901 | 1.8123 |
| −4.0220 | 4.3901 | 1.9136 | −3.5013 | 4.5901 | 1.9532 | −2.9346 | 4.7901 | 1.8402 |
| −4.0288 | 4.3901 | 1.8898 | −3.5987 | 4.5901 | 1.9724 | −3.0313 | 4.7901 | 1.8653 |
| −1.9989 | 4.4902 | 1.4132 | −3.6960 | 4.5901 | 1.9895 | −3.1270 | 4.7901 | 1.8944 |
| −2.0014 | 4.4902 | 1.4495 | −3.7927 | 4.5901 | 1.9953 | −3.2227 | 4.7901 | 1.9201 |
| −2.0219 | 4.4902 | 1.4908 | −3.8843 | 4.5901 | 1.9769 | −3.3193 | 4.7901 | 1.9452 |
| −2.1039 | 4.4902 | 1.5291 | −3.9308 | 4.5901 | 1.9435 | −3.4156 | 4.7901 | 1.9689 |
| −2.1980 | 4.4902 | 1.5653 | −3.9450 | 4.5901 | 1.9122 | −3.5125 | 4.7901 | 1.9898 |
| −2.2916 | 4.4902 | 1.5967 | −1.9247 | 4.6902 | 1.4384 | −3.6097 | 4.7901 | 2.0067 |
| −2.3868 | 4.4902 | 1.6262 | −1.9266 | 4.6902 | 1.4524 | −3.7070 | 4.7901 | 2.0151 |
| −2.4820 | 4.4902 | 1.6555 | −1.9525 | 4.6902 | 1.4957 | −3.7993 | 4.7901 | 2.0025 |
| −2.5775 | 4.4902 | 1.6842 | −2.0357 | 4.6902 | 1.5359 | −3.8518 | 4.7901 | 1.9622 |
| −2.6728 | 4.4902 | 1.7137 | −2.1292 | 4.6902 | 1.5730 | −3.8608 | 4.7901 | 1.9320 |
| −2.7678 | 4.4902 | 1.7422 | −2.2224 | 4.6902 | 1.6061 | −1.8555 | 4.8908 | 1.4522 |
| −2.8642 | 4.4902 | 1.7686 | −2.3171 | 4.6902 | 1.6366 | −1.8526 | 4.8908 | 1.4606 |
| −2.9596 | 4.4902 | 1.7974 | −2.4122 | 4.6902 | 1.6660 | −1.8724 | 4.8908 | 1.4904 |
| −3.0554 | 4.4902 | 1.8234 | −2.5076 | 4.6902 | 1.6957 | −1.9553 | 4.8908 | 1.5351 |
| −3.1514 | 4.4902 | 1.8494 | −2.6025 | 4.6902 | 1.7254 | −2.0476 | 4.8908 | 1.5726 |
| −3.2480 | 4.4902 | 1.8732 | −2.6977 | 4.6902 | 1.7544 | −2.1400 | 4.8908 | 1.6075 |
| −3.3448 | 4.4902 | 1.8970 | −2.7928 | 4.6902 | 1.7826 | −2.2340 | 4.8908 | 1.6400 |
| −2.3286 | 4.8908 | 1.6708 | −1.8013 | 5.0901 | 1.4870 | −3.6435 | 5.1901 | 2.0343 |
| −2.4236 | 4.8908 | 1.7008 | −1.8860 | 5.0901 | 1.5333 | −3.6912 | 5.1901 | 1.9708 |
| −2.5189 | 4.8908 | 1.7305 | −1.9772 | 5.0901 | 1.5727 | −1.7148 | 5.2901 | 1.4194 |
| −2.6135 | 4.8908 | 1.7612 | −2.0698 | 5.0901 | 1.6092 | −1.7119 | 5.2901 | 1.4469 |
| −2.7087 | 4.8908 | 1.7896 | −2.1631 | 5.0901 | 1.6431 | −1.7383 | 5.2901 | 1.4856 |
| −2.8041 | 4.8908 | 1.8183 | −2.2569 | 5.0901 | 1.6762 | −1.8208 | 5.2901 | 1.5308 |
| −2.8996 | 4.8908 | 1.8461 | −2.3511 | 5.0901 | 1.7076 | −1.9122 | 5.2901 | 1.5719 |
| −2.9952 | 4.8908 | 1.8740 | −2.4459 | 5.0901 | 1.7378 | −2.0037 | 5.2901 | 1.6095 |
| −3.0910 | 4.8908 | 1.9013 | −2.5410 | 5.0901 | 1.7677 | −2.0971 | 5.2901 | 1.6442 |
| −3.1870 | 4.8908 | 1.9278 | −2.6359 | 5.0901 | 1.7981 | −2.1902 | 5.2901 | 1.6799 |

-continued

| X | Y | Z | X | Y | Z | X | Y | Z |
|---|---|---|---|---|---|---|---|---|
| −3.2832 | 4.8908 | 1.9538 | −2.7308 | 5.0901 | 1.8276 | −2.2836 | 5.2901 | 1.7130 |
| −3.3793 | 4.8908 | 1.9783 | −2.8261 | 5.0901 | 1.8561 | −2.3780 | 5.2901 | 1.7444 |
| −3.4761 | 4.8908 | 1.9995 | −2.9218 | 5.0901 | 1.8845 | −2.4727 | 5.2901 | 1.7750 |
| −3.5732 | 4.8908 | 2.0163 | −3.0175 | 5.0901 | 1.9127 | −2.5679 | 5.2901 | 1.8049 |
| −3.6709 | 4.8908 | 2.0241 | −3.1131 | 5.0901 | 1.9409 | −2.6629 | 5.2901 | 1.8357 |
| −3.7620 | 4.8908 | 2.0113 | −3.2087 | 5.0901 | 1.9683 | −2.7577 | 5.2901 | 1.8662 |
| −3.8122 | 4.8908 | 1.9657 | −3.3046 | 5.0901 | 1.9940 | −2.8527 | 5.2901 | 1.8959 |
| −3.8191 | 4.8908 | 1.9436 | −3.4010 | 5.0901 | 2.0163 | −2.9481 | 5.2901 | 1.9246 |
| −1.8195 | 4.9900 | 1.4307 | −3.4979 | 5.0901 | 2.0334 | −3.0438 | 5.2901 | 1.9526 |
| −1.8168 | 4.9900 | 1.4527 | −3.5952 | 5.0901 | 2.0402 | −3.1394 | 5.2901 | 1.9810 |
| −1.8433 | 4.9900 | 1.4940 | −3.6850 | 5.0901 | 2.0259 | −3.2347 | 5.2901 | 2.0080 |
| −1.9267 | 4.9900 | 1.5367 | −3.7299 | 5.0901 | 1.9782 | −3.3311 | 5.2901 | 2.0305 |
| −2.0191 | 4.9900 | 1.5756 | −3.7358 | 5.0901 | 1.9564 | −3.4276 | 5.2901 | 2.0482 |
| −2.1111 | 4.9900 | 1.6114 | −1.7490 | 5.1901 | 1.4306 | −3.5255 | 5.2901 | 2.0540 |
| −2.2053 | 4.9900 | 1.6445 | −1.7448 | 5.1901 | 1.4528 | −3.6120 | 5.2901 | 2.0378 |
| −2.2998 | 4.9900 | 1.6755 | −1.7657 | 5.1901 | 1.4851 | −3.6503 | 5.2901 | 1.9733 |
| −2.3946 | 4.9900 | 1.7063 | −1.8477 | 5.1901 | 1.5296 | −1.6825 | 5.3900 | 1.3968 |
| −2.4894 | 4.9900 | 1.7369 | −1.9398 | 5.1901 | 1.5695 | −1.6783 | 5.3900 | 1.4411 |
| −2.5843 | 4.9900 | 1.7667 | −2.0323 | 5.1901 | 1.6072 | −1.7014 | 5.3900 | 1.4795 |
| −2.6796 | 4.9900 | 1.7959 | −2.1249 | 5.1901 | 1.6430 | −1.7826 | 5.3900 | 1.5251 |
| −2.7748 | 4.9900 | 1.8250 | −2.2182 | 5.1901 | 1.6768 | −1.8734 | 5.3900 | 1.5674 |
| −2.8703 | 4.9900 | 1.8532 | −2.3123 | 5.1901 | 1.7083 | −1.9650 | 5.3900 | 1.6053 |
| −2.9662 | 4.9900 | 1.8813 | −2.4068 | 5.1901 | 1.7398 | −2.0574 | 5.3900 | 1.6422 |
| −3.0616 | 4.9900 | 1.9093 | −2.5017 | 5.1901 | 1.7703 | −2.1503 | 5.3900 | 1.6776 |
| −3.1581 | 4.9900 | 1.9351 | −2.5967 | 5.1901 | 1.8003 | −2.2437 | 5.3900 | 1.7116 |
| −3.2540 | 4.9900 | 1.9633 | −2.6917 | 5.1901 | 1.8304 | −2.3377 | 5.3900 | 1.7439 |
| −3.3498 | 4.9900 | 1.9880 | −2.7868 | 5.1901 | 1.8600 | −2.4322 | 5.3900 | 1.7751 |
| −3.4469 | 4.9900 | 2.0089 | −2.8821 | 5.1901 | 1.8890 | −2.5270 | 5.3900 | 1.8064 |
| −3.5438 | 4.9900 | 2.0259 | −2.9777 | 5.1901 | 1.9172 | −2.6215 | 5.3900 | 1.8375 |
| −3.6417 | 4.9900 | 2.0323 | −3.0734 | 5.1901 | 1.9459 | −2.7165 | 5.3900 | 1.8678 |
| −3.7306 | 4.9900 | 2.0179 | −3.1689 | 5.1901 | 1.9739 | −2.8113 | 5.3900 | 1.8983 |
| −3.7731 | 4.9900 | 1.9652 | −3.2645 | 5.1901 | 2.0001 | −2.9066 | 5.3900 | 1.9270 |
| −3.7783 | 4.9900 | 1.9429 | −3.3612 | 5.1901 | 2.0222 | −3.0023 | 5.3900 | 1.9559 |
| −1.7798 | 5.0901 | 1.4410 | −3.4578 | 5.1901 | 2.0410 | −3.0974 | 5.3900 | 1.9844 |
| −1.7776 | 5.0901 | 1.4626 | −3.5555 | 5.1901 | 2.0480 | −3.1934 | 5.3900 | 2.0105 |
| −3.2894 | 5.3900 | 2.0358 | −2.8407 | 5.5900 | 1.9370 | −2.4929 | 5.7901 | 1.8473 |
| −3.3853 | 5.3900 | 2.0545 | −2.9356 | 5.5900 | 1.9673 | −2.5878 | 5.7901 | 1.8785 |
| −3.4827 | 5.3900 | 2.0597 | −3.0306 | 5.5900 | 1.9964 | −2.6817 | 5.7901 | 1.9122 |
| −3.5693 | 5.3900 | 2.0443 | −3.1261 | 5.5900 | 2.0235 | −2.7764 | 5.7901 | 1.9431 |
| −3.6053 | 5.3900 | 1.9843 | −3.2223 | 5.5900 | 2.0491 | −2.8710 | 5.7901 | 1.9752 |
| −3.6084 | 5.3900 | 1.9738 | −3.3170 | 5.5900 | 2.0692 | −2.9655 | 5.7901 | 2.0052 |
| −1.6519 | 5.4901 | 1.4057 | −3.4161 | 5.5900 | 2.0688 | −3.0609 | 5.7901 | 2.0328 |
| −1.6480 | 5.4901 | 1.4335 | −3.4878 | 5.5900 | 2.0555 | −3.1570 | 5.7901 | 2.0574 |
| −1.6724 | 5.4901 | 1.4772 | −3.5254 | 5.5900 | 1.9842 | −3.2529 | 5.7901 | 2.0766 |
| −1.7540 | 5.4901 | 1.5227 | −1.5981 | 5.6902 | 1.3980 | −3.3481 | 5.7901 | 2.0771 |
| −1.8444 | 5.4901 | 1.5658 | −1.5968 | 5.6902 | 1.4227 | −3.4207 | 5.7901 | 2.0481 |
| −1.9357 | 5.4901 | 1.6038 | −1.6245 | 5.6902 | 1.4753 | −3.4403 | 5.7901 | 2.0132 |
| −2.0277 | 5.4901 | 1.6421 | −1.7056 | 5.6902 | 1.5213 | −1.5457 | 5.8901 | 1.3933 |
| −2.1203 | 5.4901 | 1.6779 | −1.7963 | 5.6902 | 1.5644 | −1.5419 | 5.8901 | 1.4170 |
| −2.2133 | 5.4901 | 1.7132 | −1.8869 | 5.6902 | 1.6049 | −1.5734 | 5.8901 | 1.4597 |
| −2.3069 | 5.4901 | 1.7465 | −1.9787 | 5.6902 | 1.6430 | −1.6537 | 5.8901 | 1.5131 |
| −2.4009 | 5.4901 | 1.7784 | −2.0709 | 5.6902 | 1.6802 | −1.7419 | 5.8901 | 1.5579 |
| −2.4956 | 5.4901 | 1.8095 | −2.1635 | 5.6902 | 1.7164 | −1.8331 | 5.8901 | 1.5984 |
| −2.5900 | 5.4901 | 1.8410 | −2.2564 | 5.6902 | 1.7519 | −1.9243 | 5.8901 | 1.6382 |
| −2.6849 | 5.4901 | 1.8718 | −2.3497 | 5.6902 | 1.7855 | −2.0159 | 5.8901 | 1.6769 |
| −2.7797 | 5.4901 | 1.9028 | −2.4438 | 5.6902 | 1.8178 | −2.1080 | 5.8901 | 1.7145 |
| −2.8749 | 5.4901 | 1.9328 | −2.5380 | 5.6902 | 1.8500 | −2.2005 | 5.8901 | 1.7512 |
| −2.9699 | 5.4901 | 1.9627 | −2.6325 | 5.6902 | 1.8816 | −2.2933 | 5.8901 | 1.7868 |
| −3.0652 | 5.4901 | 1.9910 | −2.7268 | 5.6902 | 1.9137 | −2.3864 | 5.8901 | 1.8214 |
| −3.1612 | 5.4901 | 2.0174 | −2.8215 | 5.6902 | 1.9441 | −2.4802 | 5.8901 | 1.8546 |
| −3.2573 | 5.4901 | 2.0432 | −2.9161 | 5.6902 | 1.9762 | −2.5743 | 5.8901 | 1.8877 |
| −3.3524 | 5.4901 | 2.0625 | −3.0107 | 5.6902 | 2.0055 | −2.6685 | 5.8901 | 1.9204 |
| −3.4501 | 5.4901 | 2.0643 | −3.1062 | 5.6902 | 2.0319 | −2.7627 | 5.8901 | 1.9531 |
| −3.5325 | 5.4901 | 2.0489 | −3.2025 | 5.6902 | 2.0556 | −2.8570 | 5.8901 | 1.9842 |
| −3.5613 | 5.4901 | 1.9967 | −3.2982 | 5.6902 | 2.0734 | −2.9518 | 5.8901 | 2.0132 |
| −1.6248 | 5.5900 | 1.3899 | −3.3940 | 5.6902 | 2.0713 | −3.0476 | 5.8901 | 2.0396 |
| −1.6240 | 5.5900 | 1.4270 | −3.4623 | 5.6902 | 2.0468 | −3.1436 | 5.8901 | 2.0650 |
| −1.6437 | 5.5900 | 1.4736 | −3.4846 | 5.6902 | 1.9871 | −3.2390 | 5.8901 | 2.0832 |
| −1.7229 | 5.5900 | 1.5189 | −1.5711 | 5.7901 | 1.4014 | −3.3332 | 5.8901 | 2.0780 |
| −1.8135 | 5.5900 | 1.5626 | −1.5678 | 5.7901 | 1.4230 | −3.3874 | 5.8901 | 2.0519 |
| −1.9043 | 5.5900 | 1.6019 | −1.5858 | 5.7901 | 1.4600 | −3.4062 | 5.8901 | 2.0027 |
| −1.9964 | 5.5900 | 1.6396 | −1.6643 | 5.7901 | 1.5092 | −1.5154 | 5.9900 | 1.3730 |
| −2.0885 | 5.5900 | 1.6768 | −1.7541 | 5.7901 | 1.5541 | −1.5140 | 5.9900 | 1.4012 |
| −2.1815 | 5.5900 | 1.7122 | −1.8446 | 5.7901 | 1.5952 | −1.5449 | 5.9900 | 1.4480 |
| −2.2746 | 5.5900 | 1.7470 | −1.9360 | 5.7901 | 1.6342 | −1.6226 | 5.9900 | 1.5040 |
| −2.3683 | 5.5900 | 1.7798 | −2.0279 | 5.7901 | 1.6724 | −1.7105 | 5.9900 | 1.5501 |
| −2.4624 | 5.5900 | 1.5115 | −2.1200 | 5.7901 | 1.7098 | −1.8015 | 5.9900 | 1.5920 |

-continued

| X | Y | Z | X | Y | Z | X | Y | Z |
|---|---|---|---|---|---|---|---|---|
| −2.5570 | 5.5900 | 1.8428 | −2.2127 | 5.7901 | 1.7460 | −1.8924 | 5.9900 | 1.6324 |
| −2.6514 | 5.5900 | 1.8750 | −2.3056 | 5.7901 | 1.7812 | −1.9838 | 5.9900 | 1.6718 |
| −2.7459 | 5.5900 | 1.9062 | −2.3993 | 5.7901 | 1.8145 | −2.0755 | 5.9900 | 1.7105 |
| −2.1675 | 5.9900 | 1.7482 | −1.8373 | 6.1900 | 1.6221 | −1.5866 | 6.3900 | 1.5048 |
| −2.2602 | 5.9900 | 1.7845 | −1.9283 | 6.1900 | 1.6628 | −1.6736 | 6.3900 | 1.5530 |
| −2.3529 | 5.9900 | 1.8200 | −2.0193 | 6.1900 | 1.7030 | −1.7619 | 6.3900 | 1.5967 |
| −2.4462 | 5.9900 | 1.8541 | −2.1107 | 6.1900 | 1.7422 | −1.8525 | 6.3900 | 1.6384 |
| −2.5401 | 5.9900 | 1.8880 | −2.2026 | 6.1900 | 1.7806 | −1.9426 | 6.3900 | 1.6808 |
| −2.6337 | 5.9900 | 1.9218 | −2.2944 | 6.1900 | 1.8185 | −2.0333 | 6.3900 | 1.7219 |
| −2.7283 | 5.9900 | 1.9539 | −2.3871 | 6.1900 | 1.8543 | −2.1237 | 6.3900 | 1.7635 |
| −2.8223 | 5.9900 | 1.9873 | −2.4802 | 6.1900 | 1.8896 | −2.2150 | 6.3900 | 1.8026 |
| −2.9166 | 5.9900 | 2.0175 | −2.5737 | 6.1900 | 1.9240 | −2.3065 | 6.3900 | 1.8417 |
| −3.0120 | 5.9900 | 2.0450 | −2.6677 | 6.1900 | 1.9580 | −2.3983 | 6.3900 | 1.8791 |
| −3.1080 | 5.9900 | 2.0694 | −2.7611 | 6.1900 | 1.9921 | −2.4911 | 6.3900 | 1.9151 |
| −3.2043 | 5.9900 | 2.0869 | −2.8553 | 6.1900 | 2.0232 | −2.5836 | 6.3900 | 1.9507 |
| −3.2968 | 5.9900 | 2.0832 | −2.9503 | 6.1900 | 2.0515 | −2.6778 | 6.3900 | 1.9836 |
| −3.3532 | 5.9900 | 2.0465 | −3.0463 | 6.1900 | 2.0757 | −2.7707 | 6.3900 | 2.0187 |
| −3.3708 | 5.9900 | 1.9926 | −3.1430 | 6.1900 | 2.0941 | −2.8651 | 6.3900 | 2.0472 |
| −1.4859 | 6.0900 | 1.3687 | −3.2329 | 6.1900 | 2.0902 | −2.9613 | 6.3900 | 2.0738 |
| −1.4822 | 6.0900 | 1.3924 | −3.2805 | 6.1900 | 2.0428 | −3.0569 | 6.3900 | 2.0961 |
| −1.5132 | 6.0900 | 1.4382 | −3.2891 | 6.1900 | 2.0230 | −3.1489 | 6.3900 | 2.0957 |
| −1.5922 | 6.0900 | 1.4933 | −3.2976 | 6.1900 | 1.9777 | −3.1999 | 6.3900 | 2.0595 |
| −1.6788 | 6.0900 | 1.5415 | −1.4337 | 6.2901 | 1.3417 | −1.3586 | 6.4901 | 1.2572 |
| −1.7683 | 6.0900 | 1.5841 | −1.4294 | 6.2901 | 1.3680 | −1.3407 | 6.4901 | 1.2928 |
| −1.8590 | 6.0900 | 1.6256 | −1.4613 | 6.2901 | 1.4194 | −1.4074 | 6.4901 | 1.3836 |
| −1.9503 | 6.0900 | 1.6650 | −1.5401 | 6.2901 | 1.4738 | −1.4836 | 6.4901 | 1.4459 |
| −2.0415 | 6.0900 | 1.7048 | −1.6262 | 6.2901 | 1.5238 | −1.5674 | 6.4901 | 1.4975 |
| −2.1336 | 6.0900 | 1.7424 | −1.7138 | 6.2901 | 1.5693 | −1.6551 | 6.4901 | 1.5456 |
| −2.2255 | 6.0900 | 1.7809 | −1.8041 | 6.2901 | 1.6115 | −1.7429 | 6.4901 | 1.5909 |
| −2.3177 | 6.0900 | 1.8176 | −1.8941 | 6.2901 | 1.6542 | −1.8327 | 6.4901 | 1.6336 |
| −2.4105 | 6.0900 | 1.8527 | −1.9850 | 6.2901 | 1.6944 | −1.9225 | 6.4901 | 1.6767 |
| −2.5042 | 6.0900 | 1.8868 | −2.0760 | 6.2901 | 1.7348 | −2.0127 | 6.4901 | 1.7188 |
| −2.5978 | 6.0900 | 1.9212 | −2.1675 | 6.2901 | 1.7742 | −2.1030 | 6.4901 | 1.7605 |
| −2.6916 | 6.0900 | 1.9549 | −2.2590 | 6.2901 | 1.8131 | −2.1939 | 6.4901 | 1.8008 |
| −2.7854 | 6.0900 | 1.9880 | −2.3514 | 6.2901 | 1.8502 | −2.2850 | 6.4901 | 1.8407 |
| −2.8798 | 6.0900 | 2.0186 | −2.4441 | 6.2901 | 1.8869 | −2.3766 | 6.4901 | 1.8793 |
| −2.9750 | 6.0900 | 2.0473 | −2.5367 | 6.2901 | 1.9224 | −2.4686 | 6.4901 | 1.9168 |
| −3.0705 | 6.0900 | 2.0725 | −2.6308 | 6.2901 | 1.9562 | −2.5613 | 6.4901 | 1.9525 |
| −3.1672 | 6.0900 | 2.0902 | −2.7239 | 6.2901 | 1.9919 | −2.6545 | 6.4901 | 1.9874 |
| −3.2586 | 6.0900 | 2.0883 | −2.8179 | 6.2901 | 2.0233 | −2.7475 | 6.4901 | 2.0214 |
| −3.3182 | 6.0900 | 2.0418 | −2.9128 | 6.2901 | 2.0520 | −2.8416 | 6.4901 | 2.0512 |
| −3.3357 | 6.0900 | 1.9854 | −3.0088 | 6.2901 | 2.0766 | −2.9371 | 6.4901 | 2.0773 |
| −1.4614 | 6.1900 | 1.3543 | −3.1051 | 6.2901 | 2.0965 | −3.0333 | 6.4901 | 2.0979 |
| −1.4569 | 6.1900 | 1.3779 | −3.1967 | 6.2901 | 2.0922 | −3.1223 | 6.4901 | 2.0958 |
| −1.4937 | 6.1900 | 1.4278 | −3.2404 | 6.2901 | 2.0485 | −3.1685 | 6.4901 | 2.0508 |
| −1.5707 | 6.1900 | 1.4881 | −3.2570 | 6.2901 | 2.0036 | −1.3149 | 6.5900 | 1.2426 |
| −1.6570 | 6.1900 | 1.5363 | −1.4221 | 6.3900 | 1.3962 | −1.2996 | 6.5900 | 1.2889 |
| −1.7470 | 6.1900 | 1.5808 | −1.5018 | 6.3900 | 1.4544 | −1.3460 | 6.5900 | 1.3539 |
| −1.4263 | 6.5900 | 1.4094 | −1.2476 | 6.7901 | 1.1267 | −2.9038 | 6.8900 | 2.0966 |
| −1.5094 | 6.5900 | 1.4644 | −1.2270 | 6.7901 | 1.2149 | −2.9939 | 6.8900 | 2.0966 |
| −1.5940 | 6.5900 | 1.5146 | −1.2602 | 6.7901 | 1.3033 | −3.0568 | 6.8900 | 2.0387 |
| −1.6813 | 6.5900 | 1.5615 | −1.3374 | 6.7901 | 1.3554 | −1.1696 | 6.9902 | 1.0793 |
| −1.7697 | 6.5900 | 1.6062 | −1.4252 | 6.7901 | 1.4061 | −1.1614 | 6.9902 | 1.1388 |
| −1.8595 | 6.5900 | 1.6494 | −1.5095 | 6.7901 | 1.4625 | −1.1754 | 6.9902 | 1.2297 |
| −1.9492 | 6.5900 | 1.6933 | −1.5942 | 6.7901 | 1.5143 | −1.2469 | 6.9902 | 1.2851 |
| −2.0388 | 6.5900 | 1.7365 | −1.6803 | 6.7901 | 1.5622 | −1.3352 | 6.9902 | 1.3355 |
| −2.1291 | 6.5900 | 1.7779 | −1.7696 | 6.7901 | 1.6062 | −1.4224 | 6.9902 | 1.3949 |
| −2.2199 | 6.5900 | 1.8188 | −1.8581 | 6.7901 | 1.6525 | −1.5038 | 6.9902 | 1.4521 |
| −2.3108 | 6.5900 | 1.8591 | −1.9472 | 6.7901 | 1.6967 | −1.5872 | 6.9902 | 1.5049 |
| −2.4021 | 6.5900 | 1.8981 | −2.0363 | 6.7901 | 1.7414 | −1.6730 | 6.9902 | 1.5546 |
| −2.4941 | 6.5900 | 1.9357 | −2.1257 | 6.7901 | 1.7848 | −1.7599 | 6.9902 | 1.6018 |
| −2.5864 | 6.5900 | 1.9724 | −2.2151 | 6.7901 | 1.8279 | −1.8486 | 6.9902 | 1.6473 |
| −2.6791 | 6.5900 | 2.0073 | −2.3061 | 6.7901 | 1.8688 | −1.9369 | 6.9902 | 1.6937 |
| −2.7728 | 6.5900 | 2.0402 | −2.3959 | 6.7901 | 1.9107 | −2.0255 | 6.9902 | 1.7391 |
| −2.8665 | 6.5900 | 2.0687 | −2.4878 | 6.7901 | 1.9484 | −2.1141 | 6.9902 | 1.7844 |
| −2.9656 | 6.5900 | 2.0937 | −2.5792 | 6.7901 | 1.9877 | −2.2031 | 6.9902 | 1.8288 |
| −3.0505 | 6.5900 | 2.1032 | −2.6713 | 6.7901 | 2.0233 | −2.2921 | 6.9902 | 1.8735 |
| −3.1683 | 6.5900 | 2.0655 | −2.7648 | 6.7901 | 2.0571 | −2.3811 | 6.9902 | 1.9170 |
| −3.1662 | 6.5900 | 2.0699 | −2.8579 | 6.7901 | 2.0853 | −2.4718 | 6.9902 | 1.9576 |
| −1.2691 | 6.6901 | 1.2035 | −2.9561 | 6.7901 | 2.0981 | −2.5623 | 6.9902 | 1.9979 |
| −1.2594 | 6.6901 | 1.2567 | −3.0424 | 6.7901 | 2.0914 | −2.6542 | 6.9902 | 2.0346 |
| −1.2890 | 6.6901 | 1.3263 | −3.0604 | 6.7901 | 2.0747 | −2.7471 | 6.9902 | 2.0692 |
| −1.3685 | 6.6901 | 1.3757 | −1.2136 | 6.8900 | 1.0946 | −2.8407 | 6.9902 | 2.0975 |
| −1.4549 | 6.6901 | 1.4288 | −1.1874 | 6.8900 | 1.1838 | −2.9344 | 6.9902 | 2.1071 |
| −1.5385 | 6.6901 | 1.4820 | −1.2187 | 6.8900 | 1.2667 | −3.0080 | 6.9902 | 2.0802 |
| −1.6240 | 6.6901 | 1.5316 | −1.2940 | 6.8900 | 1.3212 | −3.0223 | 6.9902 | 2.0614 |
| −1.7115 | 6.6901 | 1.5776 | −1.3827 | 6.8900 | 1.3714 | −1.1600 | 7.0899 | 0.9987 |

-continued

| X | Y | Z | X | Y | Z | X | Y | Z |
|---|---|---|---|---|---|---|---|---|
| −1.8013 | 6.6901 | 1.6205 | −1.4671 | 6.8900 | 1.4332 | −1.1285 | 7.0899 | 1.0726 |
| −1.8912 | 6.6901 | 1.6651 | −1.5522 | 6.8900 | 1.4871 | −1.1688 | 7.0899 | 1.2196 |
| −1.9799 | 6.6901 | 1.7108 | −1.6378 | 6.8900 | 1.5370 | −1.2442 | 7.0899 | 1.2753 |
| −2.0690 | 6.6901 | 1.7543 | −1.7257 | 6.8900 | 1.5832 | −1.3311 | 7.0899 | 1.3268 |
| −2.1592 | 6.6901 | 1.7966 | −1.8139 | 6.8900 | 1.6296 | −1.4162 | 7.0899 | 1.3853 |
| −2.2497 | 6.6901 | 1.8380 | −1.9025 | 6.8900 | 1.6751 | −1.4976 | 7.0899 | 1.4427 |
| −2.3406 | 6.6901 | 1.8788 | −1.9913 | 6.8900 | 1.7204 | −1.5802 | 7.0899 | 1.4969 |
| −2.4313 | 6.6901 | 1.9189 | −2.0802 | 6.8900 | 1.7652 | −1.6652 | 7.0399 | 1.5478 |
| −2.5236 | 6.6901 | 1.9560 | −2.1695 | 6.8900 | 1.8091 | −1.7515 | 7.0899 | 1.5948 |
| −2.6157 | 6.6901 | 1.9935 | −2.2592 | 6.8900 | 1.8526 | −1.8422 | 7.0899 | 1.6384 |
| −2.7086 | 6.6901 | 2.0282 | −2.3486 | 6.8900 | 1.8958 | −1.9291 | 7.0899 | 1.6889 |
| −2.8020 | 6.6901 | 2.0601 | −2.4391 | 6.8900 | 1.9367 | −2.0182 | 7.0899 | 1.7350 |
| −2.8976 | 6.6901 | 2.0845 | −2.5298 | 6.8900 | 1.9759 | −2.1066 | 7.0899 | 1.7816 |
| −2.9936 | 6.6901 | 2.1012 | −2.6229 | 6.8900 | 2.0111 | −2.1952 | 7.0899 | 1.8270 |
| −3.0794 | 6.6901 | 2.0878 | −2.7153 | 6.8900 | 2.0489 | −2.2836 | 7.0899 | 1.8730 |
| −3.0983 | 6.6901 | 2.0614 | −2.8074 | 6.8900 | 2.0798 | −2.3723 | 7.0899 | 1.9176 |
| −2.4618 | 7.0899 | 1.9604 | −2.0251 | 7.2901 | 1.7380 | −1.4271 | 7.4900 | 1.3714 |
| −2.5520 | 7.0899 | 2.0013 | −2.1131 | 7.2901 | 1.7847 | −1.5086 | 7.4900 | 1.4282 |
| −2.6435 | 7.0899 | 2.0398 | −2.2008 | 7.2901 | 1.8326 | −1.5909 | 7.4900 | 1.4830 |
| −2.7356 | 7.0899 | 2.0151 | −2.2884 | 7.2901 | 1.8799 | −1.6759 | 7.4900 | 1.5340 |
| −2.8301 | 7.0899 | 2.1025 | −2.3761 | 7.2901 | 1.9269 | −1.7617 | 7.4900 | 1.5842 |
| −2.9212 | 7.0899 | 2.1119 | −2.4643 | 7.2901 | 1.9722 | −1.8482 | 7.4900 | 1.6333 |
| −2.9960 | 7.0899 | 2.0768 | −2.5536 | 7.2901 | 2.0153 | −1.9352 | 7.4900 | 1.6817 |
| −1.1407 | 7.1901 | 0.9526 | −2.6439 | 7.2901 | 2.0557 | −2.0222 | 7.4900 | 1.7302 |
| −1.0986 | 7.1901 | 1.0382 | −2.7361 | 7.2901 | 2.0905 | −2.1096 | 7.4900 | 1.7780 |
| −1.1393 | 7.1901 | 1.1890 | −2.8298 | 7.2901 | 2.1163 | −2.1965 | 7.4900 | 1.8268 |
| −1.2142 | 7.1901 | 1.2463 | −2.9177 | 7.2901 | 2.1151 | −2.2839 | 7.4900 | 1.8743 |
| −1.2995 | 7.1901 | 1.2999 | −2.9556 | 7.2901 | 2.0805 | −2.3711 | 7.4900 | 1.9230 |
| −1.3837 | 7.1901 | 1.3574 | −1.0824 | 7.3901 | 0.8964 | −2.4574 | 7.4900 | 1.9722 |
| −1.4649 | 7.1901 | 1.4153 | −1.0432 | 7.3901 | 0.9892 | −2.5444 | 7.4900 | 2.0194 |
| −1.5463 | 7.1901 | 1.4712 | −1.0663 | 7.3901 | 1.0977 | −2.6328 | 7.4900 | 2.0629 |
| −1.6306 | 7.1901 | 1.5233 | −1.1352 | 7.3901 | 1.1621 | −2.7242 | 7.4900 | 2.0995 |
| −1.7157 | 7.1901 | 1.5736 | −1.2127 | 7.3901 | 1.2241 | −2.8159 | 7.4900 | 2.1233 |
| −1.8037 | 7.1901 | 1.6196 | −1.2948 | 7.3901 | 1.2797 | −2.9020 | 7.4900 | 2.1041 |
| −1.8918 | 7.1901 | 1.6673 | −1.3763 | 7.3901 | 1.3407 | −2.9211 | 7.4900 | 2.0805 |
| −1.9794 | 7.1901 | 1.7146 | −1.4558 | 7.3901 | 1.3991 | −1.0332 | 7.5900 | 0.8227 |
| −2.0675 | 7.1901 | 1.7612 | −1.5382 | 7.3901 | 1.4546 | −0.9901 | 7.5900 | 0.9174 |
| −2.1555 | 7.1901 | 1.8082 | −1.6210 | 7.3901 | 1.5084 | −0.9912 | 7.5900 | 1.0238 |
| −2.2434 | 7.1901 | 1.8549 | −1.7065 | 7.3901 | 1.5583 | −1.0628 | 7.5900 | 1.0812 |
| −2.3316 | 7.1901 | 1.9007 | −1.7931 | 7.3901 | 1.6074 | −1.1421 | 7.5900 | 1.1439 |
| −2.4205 | 7.1901 | 1.9453 | −1.8803 | 7.3901 | 1.6553 | −1.2212 | 7.5900 | 1.2032 |
| −2.5097 | 7.1901 | 1.9887 | −1.9678 | 7.3901 | 1.7035 | −1.3006 | 7.5900 | 1.2648 |
| −2.5998 | 7.1901 | 2.0298 | −2.0551 | 7.3901 | 1.7518 | −1.3781 | 7.5900 | 1.3269 |
| −2.5914 | 7.1901 | 2.0669 | −2.1418 | 7.3901 | 1.8006 | −1.4579 | 7.5900 | 1.3852 |
| −2.7846 | 7.1901 | 2.0987 | −2.2294 | 7.3901 | 1.8474 | −1.5395 | 7.5900 | 1.4408 |
| −2.8782 | 7.1901 | 2.1170 | −2.3173 | 7.3901 | 1.8947 | −1.6241 | 7.5900 | 1.4931 |
| −2.9622 | 7.1901 | 2.0964 | −2.4045 | 7.3901 | 1.9425 | −1.7078 | 7.5900 | 1.5471 |
| −2.9737 | 7.1901 | 2.0802 | −2.4922 | 7.3901 | 1.9890 | −1.7929 | 7.5900 | 1.5970 |
| −1.0978 | 7.2901 | 0.9434 | −2.5804 | 7.3901 | 2.0337 | −1.8805 | 7.5900 | 1.6448 |
| −1.0741 | 7.2901 | 1.0042 | −2.6707 | 7.3901 | 2.0729 | −1.9674 | 7.5900 | 1.6946 |
| −1.1074 | 7.2901 | 1.1496 | −2.7636 | 7.3901 | 2.1055 | −2.0537 | 7.5900 | 1.7444 |
| −1.1800 | 7.2901 | 1.2095 | −2.8546 | 7.3901 | 2.1226 | −2.1401 | 7.5900 | 1.7921 |
| −1.2636 | 7.2901 | 1.2660 | −2.9369 | 7.3901 | 2.0821 | −2.2295 | 7.5900 | 1.8383 |
| −1.3457 | 7.2901 | 1.3261 | −2.9400 | 7.3901 | 2.0772 | −2.3144 | 7.5900 | 1.8921 |
| −1.4266 | 7.2901 | 1.3839 | −1.0555 | 7.4900 | 0.8661 | −2.4013 | 7.5900 | 1.9422 |
| −1.5079 | 7.2901 | 1.4409 | −1.0136 | 7.4900 | 0.9601 | −2.4871 | 7.5900 | 1.9925 |
| −1.5911 | 7.2901 | 1.4945 | −1.0320 | 7.4900 | 1.0678 | −2.5740 | 7.5900 | 2.0391 |
| −1.6761 | 7.2901 | 1.5457 | −1.1073 | 7.4900 | 1.1251 | −2.6630 | 7.5900 | 2.0813 |
| −1.7625 | 7.2901 | 1.5943 | −1.1832 | 7.4900 | 1.1910 | −2.7552 | 7.5900 | 2.1142 |
| −1.8503 | 7.2901 | 1.6419 | −1.2661 | 7.4900 | 1.2479 | −2.8440 | 7.5900 | 2.1239 |
| −1.9378 | 7.2901 | 1.6901 | −1.3472 | 7.4900 | 1.3123 | −2.9023 | 7.5900 | 2.0869 |
| −1.0102 | 7.6901 | 0.7908 | −2.2415 | 7.7901 | 1.8511 | −1.4451 | 7.9900 | 1.3272 |
| −0.9631 | 7.6901 | 0.8850 | −2.3263 | 7.7901 | 1.9021 | −1.5237 | 7.9900 | 1.3886 |
| −0.9731 | 7.6901 | 0.9949 | −2.4133 | 7.7901 | 1.9502 | −1.6032 | 7.9900 | 1.4474 |
| −1.0455 | 7.6901 | 1.0535 | −2.5000 | 7.7901 | 2.0000 | −1.6845 | 7.9900 | 1.5036 |
| −1.1232 | 7.6901 | 1.1176 | −2.5859 | 7.7901 | 2.0490 | −1.7682 | 7.9900 | 1.5569 |
| −1.2020 | 7.6901 | 1.1772 | −2.6747 | 7.7901 | 2.0915 | −1.8521 | 7.9900 | 1.6104 |
| −1.2806 | 7.6901 | 1.2396 | −2.7654 | 7.7901 | 2.1226 | −1.9370 | 7.9900 | 1.6623 |
| −1.3583 | 7.6901 | 1.3014 | −2.8515 | 7.7901 | 2.1179 | −2.0219 | 7.9900 | 1.7148 |
| −1.4377 | 7.6901 | 1.3610 | −2.8736 | 7.7901 | 2.0930 | −2.1065 | 7.9900 | 1.7670 |
| −1.5179 | 7.6901 | 1.4185 | −0.9551 | 7.8900 | 0.7295 | −2.1916 | 7.9900 | 1.8184 |
| −1.6015 | 7.6901 | 1.4710 | −0.9182 | 7.8900 | 0.8025 | −2.2770 | 7.9900 | 1.8696 |
| −1.6872 | 7.6901 | 1.5233 | −0.9395 | 7.8900 | 0.9332 | −2.3623 | 7.9900 | 1.9207 |
| −1.7703 | 7.6901 | 1.5771 | −1.0120 | 7.8900 | 0.9932 | −2.4476 | 7.9900 | 1.9718 |
| −1.8564 | 7.6901 | 1.6262 | −1.0906 | 7.8900 | 1.0567 | −2.5329 | 7.9900 | 2.0229 |
| −1.9433 | 7.6901 | 1.6768 | −1.1670 | 7.8900 | 1.1203 | −2.6185 | 7.9900 | 2.0720 |
| −2.0291 | 7.6901 | 1.7272 | −1.2444 | 7.8900 | 1.1830 | −2.7073 | 7.9900 | 2.1126 |

-continued

| X | Y | Z | X | Y | Z | X | Y | Z |
|---|---|---|---|---|---|---|---|---|
| −2.1154 | 7.6901 | 1.7763 | −1.3214 | 7.8900 | 1.2460 | −2.7947 | 7.9900 | 2.1285 |
| −2.2024 | 7.6901 | 1.8257 | −1.4001 | 7.8900 | 1.3066 | −2.8534 | 7.9900 | 2.0940 |
| −2.2876 | 7.6901 | 1.8789 | −1.4796 | 7.8900 | 1.3669 | −0.9033 | 8.0901 | 0.6622 |
| −2.3711 | 7.6901 | 1.9312 | −1.5586 | 7.8900 | 1.4266 | −0.8644 | 8.0901 | 0.7634 |
| −2.4586 | 7.6901 | 1.9782 | −1.6400 | 7.8900 | 1.4825 | −0.8817 | 8.0901 | 0.8495 |
| −2.5460 | 7.6901 | 2.0282 | −1.7236 | 7.8900 | 1.5353 | −0.9513 | 8.0901 | 0.9116 |
| −2.6332 | 7.6901 | 2.0729 | −1.8094 | 7.8900 | 1.5859 | −1.0288 | 8.0901 | 0.9760 |
| −2.7244 | 7.6901 | 2.1095 | −1.8945 | 7.8900 | 1.6386 | −1.1052 | 8.0901 | 1.0395 |
| −2.8145 | 7.6901 | 2.1271 | −1.9796 | 7.8900 | 1.6905 | −1.1819 | 8.0901 | 1.1026 |
| −2.8852 | 7.6901 | 2.0930 | −2.0644 | 7.8900 | 1.7426 | −1.2594 | 8.0901 | 1.1650 |
| −2.8893 | 7.6901 | 2.0851 | −2.1501 | 7.8900 | 1.7935 | −1.3362 | 8.0901 | 1.2284 |
| −0.9856 | 7.7901 | 0.7567 | −2.2351 | 7.8900 | 1.8459 | −1.4143 | 8.0901 | 1.2898 |
| −0.9429 | 7.7901 | 0.8436 | −2.3201 | 7.8900 | 1.8971 | −1.4927 | 8.0901 | 1.3513 |
| −0.9400 | 7.7901 | 0.9496 | −2.4059 | 7.8900 | 1.9473 | −1.5710 | 8.0901 | 1.4121 |
| −1.0103 | 7.7901 | 1.0080 | −2.4919 | 7.8900 | 1.9977 | −1.6507 | 8.0901 | 1.4711 |
| −1.0890 | 7.7901 | 1.0721 | −2.5777 | 7.8900 | 2.0470 | −1.7315 | 8.0901 | 1.5281 |
| −1.1661 | 7.7901 | 1.1342 | −2.6657 | 7.8900 | 2.0914 | −1.8149 | 8.0901 | 1.5821 |
| −1.2446 | 7.7901 | 1.1959 | −2.7555 | 7.8900 | 2.1235 | −1.8983 | 8.0901 | 1.6364 |
| −1.3224 | 7.7901 | 1.2586 | −2.8419 | 7.8900 | 2.1174 | −1.9830 | 8.0901 | 1.6887 |
| −1.4007 | 7.7901 | 1.3198 | −2.8673 | 7.8900 | 2.0856 | −2.0677 | 8.0901 | 1.7409 |
| −1.4803 | 7.7901 | 1.3791 | −0.9185 | 7.9900 | 0.7120 | −2.1531 | 8.0901 | 1.7927 |
| −1.5611 | 7.7901 | 1.4365 | −0.8844 | 7.9900 | 0.7915 | −2.2375 | 8.0901 | 1.8460 |
| −1.6440 | 7.7901 | 1.4906 | −0.9086 | 7.9900 | 0.8904 | −2.3223 | 8.0901 | 1.8981 |
| −1.7283 | 7.7901 | 1.5430 | −0.9795 | 7.9900 | 0.9522 | −2.4065 | 8.0901 | 1.9506 |
| −1.8137 | 7.7901 | 1.5939 | −1.0575 | 7.9900 | 1.0157 | −2.4926 | 8.0901 | 2.0010 |
| −1.8998 | 7.7901 | 1.6442 | −1.1345 | 7.9900 | 1.0786 | −2.5769 | 8.0901 | 2.0522 |
| −1.9860 | 7.7901 | 1.6951 | −1.2113 | 7.9900 | 1.1419 | −2.6665 | 8.0901 | 2.1001 |
| −2.0708 | 7.7901 | 1.7477 | −1.2888 | 7.9900 | 1.2045 | −2.7461 | 8.0901 | 2.1300 |
| −2.1563 | 7.7901 | 1.7987 | −1.3656 | 7.9900 | 1.2573 | −2.8695 | 8.0901 | 2.1149 |
| −2.8580 | 8.0901 | 2.1387 | −1.9182 | 8.2900 | 1.6371 | −0.9495 | 8.4901 | 0.8224 |
| −0.8692 | 8.1900 | 0.6398 | −2.0023 | 8.2900 | 1.6910 | −1.0235 | 8.4901 | 0.8891 |
| −0.8448 | 8.1900 | 0.7003 | −2.0858 | 8.2900 | 1.7456 | −1.0990 | 8.4901 | 0.9541 |
| −0.8676 | 8.1900 | 0.8184 | −2.1692 | 8.2900 | 1.8000 | −1.1751 | 8.4901 | 1.0183 |
| −0.9383 | 8.1900 | 0.8811 | −2.2528 | 8.2900 | 1.8547 | −1.2511 | 8.4901 | 1.0830 |
| −1.0145 | 8.1900 | 0.9468 | −2.3352 | 8.2900 | 1.9101 | −1.3254 | 8.4901 | 1.1496 |
| −1.0908 | 8.1900 | 1.0103 | −2.4192 | 8.2900 | 1.9630 | −1.3999 | 8.4901 | 1.2147 |
| −1.1672 | 8.1900 | 1.0739 | −2.5039 | 8.2900 | 2.0154 | −1.4772 | 8.4901 | 1.2776 |
| −1.2451 | 8.1900 | 1.1361 | −2.5888 | 8.2900 | 2.0663 | −1.5536 | 8.4901 | 1.3414 |
| −1.3214 | 8.1900 | 1.2004 | −2.6761 | 8.2900 | 2.1116 | −1.6311 | 8.4901 | 1.4033 |
| −1.3989 | 8.1900 | 1.2628 | −2.7625 | 8.2900 | 2.1345 | −1.7092 | 8.4901 | 1.4650 |
| −1.4761 | 8.1900 | 1.3255 | −2.8160 | 8.2900 | 2.1122 | −1.7875 | 8.4901 | 1.5259 |
| −1.5549 | 8.1900 | 1.3863 | −0.8218 | 8.3900 | 0.5677 | −1.8670 | 8.4901 | 1.5850 |
| −1.6329 | 8.1900 | 1.4479 | −0.7917 | 8.3900 | 0.6381 | −1.9483 | 8.4901 | 1.6419 |
| −1.7130 | 8.1900 | 1.5059 | −0.8374 | 8.3900 | 0.7447 | −2.0307 | 8.4901 | 1.6982 |
| −1.7946 | 8.1900 | 1.5625 | −0.9116 | 8.3900 | 0.8083 | −2.1127 | 8.4901 | 1.7548 |
| −1.8770 | 8.1900 | 1.6176 | −0.9850 | 8.3900 | 0.8779 | −2.1950 | 8.4901 | 1.8107 |
| −1.9615 | 8.1900 | 1.6704 | −1.0586 | 8.3900 | 0.9434 | −2.2773 | 8.4901 | 1.8675 |
| −2.0457 | 8.1900 | 1.7240 | −1.1350 | 8.3900 | 1.0071 | −2.3581 | 8.4901 | 1.9258 |
| −2.1300 | 8.1900 | 1.7770 | −1.2119 | 8.3900 | 1.0709 | −2.4394 | 8.4901 | 1.9817 |
| −2.2141 | 8.1900 | 1.8308 | −1.2876 | 8.3900 | 1.1361 | −2.5237 | 8.4901 | 2.0337 |
| −2.2980 | 8.1900 | 1.8843 | −1.3628 | 8.3900 | 1.2012 | −2.6094 | 8.4901 | 2.0840 |
| −2.3821 | 8.1900 | 1.9374 | −1.4390 | 8.3900 | 1.2650 | −2.6958 | 8.4901 | 2.1261 |
| −2.4670 | 8.1900 | 1.9893 | −1.5164 | 8.3900 | 1.3275 | −2.7841 | 8.4901 | 2.1302 |
| −2.5518 | 8.1900 | 2.0412 | −1.5944 | 8.3900 | 1.3898 | −2.8154 | 8.4901 | 2.0968 |
| −2.6376 | 8.1900 | 2.0897 | −1.6718 | 8.3900 | 1.4515 | −0.7848 | 8.5900 | 0.4795 |
| −2.7263 | 8.1900 | 2.1259 | −1.7524 | 8.3900 | 1.5100 | −0.7552 | 8.5900 | 0.5499 |
| −2.8130 | 8.1900 | 2.1207 | −1.8313 | 8.3900 | 1.5707 | −0.7687 | 8.5900 | 0.6364 |
| −2.8256 | 8.1900 | 2.1089 | −1.9128 | 8.3900 | 1.6266 | −0.8404 | 8.5900 | 0.6961 |
| −0.8625 | 8.2900 | 0.5807 | −1.9966 | 8.3900 | 1.6815 | −0.9160 | 8.5900 | 0.7649 |
| −0.8198 | 8.2900 | 0.6580 | −2.0791 | 8.3900 | 1.7376 | −0.9891 | 8.5900 | 0.8319 |
| −0.8357 | 8.2900 | 0.7681 | −2.1624 | 8.3900 | 1.7922 | −1.0630 | 8.5900 | 0.8988 |
| −0.9074 | 8.2900 | 0.8295 | −2.2454 | 8.3900 | 1.8483 | −1.1375 | 8.5900 | 0.9643 |
| −0.9821 | 8.2900 | 0.8982 | −2.3271 | 8.3900 | 1.9050 | −1.2132 | 8.5900 | 1.0294 |
| −1.0570 | 8.2900 | 0.9628 | −2.4099 | 8.3900 | 1.9591 | −1.2871 | 8.5900 | 1.0960 |
| −1.1329 | 8.2900 | 1.0268 | −2.4941 | 8.3900 | 2.0130 | −1.3626 | 8.5900 | 1.1607 |
| −1.2111 | 8.2900 | 1.0890 | −2.5780 | 8.3900 | 2.0638 | −1.4371 | 8.5900 | 1.2267 |
| −1.2869 | 8.2900 | 1.1543 | −2.6680 | 8.3900 | 2.1117 | −1.5139 | 8.5900 | 1.2899 |
| −1.3635 | 8.2900 | 1.2178 | −2.7468 | 8.3900 | 2.1375 | −1.5897 | 8.5900 | 1.3544 |
| −1.4402 | 8.2900 | 1.2815 | −2.8533 | 8.3900 | 2.1187 | −1.6671 | 8.5900 | 1.4167 |
| −1.5180 | 8.2900 | 1.3436 | −2.8468 | 8.3900 | 2.1267 | −1.7439 | 8.5900 | 1.4797 |
| −1.5958 | 8.2900 | 1.4058 | −0.8087 | 8.4901 | 0.5163 | −1.8225 | 8.5900 | 1.5400 |
| −1.6745 | 8.2900 | 1.4665 | −0.7769 | 8.4901 | 0.5709 | −1.9015 | 8.5900 | 1.5997 |
| −1.7539 | 8.2900 | 1.5259 | −0.8013 | 8.4901 | 0.6911 | −1.9834 | 8.5900 | 1.6562 |
| −1.8350 | 8.2900 | 1.5826 | −0.8759 | 8.4901 | 0.7514 | −2.0651 | 8.5900 | 1.7141 |
| −2.1460 | 8.5900 | 1.7720 | −0.9721 | 8.7900 | 0.7622 | −2.0670 | 8.8901 | 1.6874 |
| −2.2277 | 8.5900 | 1.8291 | −1.0454 | 8.7900 | 0.8307 | −2.1467 | 8.8901 | 1.7474 |
| −2.3089 | 8.5900 | 1.8867 | −1.1183 | 8.7900 | 0.8986 | −2.2256 | 8.8901 | 1.8080 |

-continued

| X | Y | Z | X | Y | Z | X | Y | Z |
|---|---|---|---|---|---|---|---|---|
| −2.3903 | 8.5900 | 1.9439 | −1.1920 | 8.7900 | 0.9652 | −2.3049 | 8.8901 | 1.8678 |
| −2.4716 | 8.5900 | 2.0011 | −1.2660 | 8.7900 | 1.0313 | −2.3844 | 8.8901 | 1.9273 |
| −2.5540 | 8.5900 | 2.0535 | −1.3404 | 8.7900 | 1.0976 | −2.4647 | 8.8901 | 1.9861 |
| −2.6428 | 8.5900 | 2.1041 | −1.4138 | 8.7900 | 1.1643 | −2.5447 | 8.8901 | 2.0423 |
| −2.7205 | 8.5900 | 2.1372 | −1.4891 | 8.7900 | 1.2292 | −2.6312 | 8.8901 | 2.0964 |
| −2.8514 | 8.5900 | 2.1078 | −1.5641 | 8.7900 | 1.2952 | −2.7055 | 8.8901 | 2.1353 |
| −2.8372 | 8.5900 | 2.1286 | −1.6388 | 8.7909 | 1.3603 | −2.8463 | 8.8901 | 2.1033 |
| −0.7808 | 8.6900 | 0.4090 | −1.7148 | 8.7900 | 1.4243 | −2.8244 | 8.8901 | 2.1365 |
| −0.7390 | 8.6900 | 0.5021 | −1.7909 | 8.7900 | 1.4881 | −0.7101 | 8.9901 | 0.3113 |
| −0.7608 | 8.6900 | 0.6021 | −1.8679 | 8.7900 | 1.5503 | −0.6792 | 8.9901 | 0.3664 |
| −0.8324 | 8.6900 | 0.6632 | −1.9460 | 8.7900 | 1.6111 | −0.7073 | 8.9901 | 0.4784 |
| −0.9088 | 8.6900 | 0.7305 | −2.0268 | 8.7900 | 1.6693 | −0.7784 | 8.9901 | 0.5407 |
| −0.9818 | 8.6900 | 0.7984 | −2.1067 | 8.7900 | 1.7289 | −0.8563 | 8.9901 | 0.6050 |
| −1.0552 | 8.6900 | 0.8662 | −2.1870 | 8.7900 | 1.7876 | −0.9310 | 8.9901 | 0.6718 |
| −1.1282 | 8.6900 | 0.9332 | −2.2668 | 8.7900 | 1.8470 | −1.0038 | 8.9901 | 0.7404 |
| −1.2035 | 8.6900 | 0.9981 | −2.3469 | 8.7900 | 1.9057 | −1.0753 | 8.9901 | 0.8098 |
| −1.2780 | 8.6900 | 1.0648 | −2.4273 | 8.7900 | 1.9641 | −1.1483 | 8.9901 | 0.8773 |
| −1.3515 | 8.6900 | 1.1312 | −2.5081 | 8.7900 | 2.0210 | −1.2212 | 8.9901 | 0.9450 |
| −1.4269 | 8.6900 | 1.1960 | −2.5914 | 8.7900 | 2.0744 | −1.2950 | 8.9901 | 1.0117 |
| −1.5022 | 8.6900 | 1.2615 | −2.6764 | 8.7900 | 2.1210 | −1.3683 | 8.9901 | 1.0796 |
| −1.5777 | 8.6900 | 1.3261 | −2.7634 | 8.7900 | 2.1346 | −1.4408 | 8.9901 | 1.1472 |
| −1.6536 | 8.6900 | 1.3902 | −2.7997 | 8.7900 | 2.1082 | −1.5154 | 8.9901 | 1.2130 |
| −1.7302 | 8.6900 | 1.4534 | −0.7290 | 8.8901 | 0.3491 | −1.5895 | 8.9901 | 1.2801 |
| −1.8075 | 8.6900 | 1.5157 | −0.7002 | 8.8901 | 0.4205 | −1.6629 | 8.9901 | 1.3470 |
| −1.8856 | 8.6900 | 1.5769 | −0.7181 | 8.8901 | 0.5118 | −1.7371 | 8.9901 | 1.4129 |
| −1.9653 | 8.6900 | 1.6356 | −0.7886 | 8.8901 | 0.5717 | −1.8122 | 8.9901 | 1.4776 |
| −2.0470 | 8.6900 | 1.6930 | −0.8698 | 8.8901 | 0.6342 | −1.8882 | 8.9901 | 1.5411 |
| −2.1276 | 8.6900 | 1.7520 | −0.9421 | 8.8901 | 0.7073 | −1.9656 | 8.9901 | 1.6027 |
| −2.2080 | 8.6900 | 1.8104 | −1.0162 | 8.8901 | 0.7767 | −2.0455 | 8.9901 | 1.6622 |
| −2.2889 | 8.6900 | 1.8684 | −1.0887 | 8.8901 | 0.8455 | −2.1240 | 8.9901 | 1.7241 |
| −2.3693 | 8.6900 | 1.9269 | −1.1612 | 8.8901 | 0.9132 | −2.2019 | 8.9901 | 1.7856 |
| −2.4510 | 8.6900 | 1.9836 | −1.2352 | 8.8901 | 0.9794 | −2.2806 | 8.9901 | 1.8462 |
| −2.5323 | 8.6900 | 2.0398 | −1.3094 | 8.8901 | 1.0461 | −2.3596 | 8.9901 | 1.9065 |
| −2.6172 | 8.6900 | 2.0910 | −1.3825 | 8.8901 | 1.1135 | −2.4388 | 8.9901 | 1.9668 |
| −2.7017 | 8.6900 | 2.1314 | −1.4563 | 8.8901 | 1.1798 | −2.5182 | 8.9901 | 2.0256 |
| −2.7927 | 8.6900 | 2.1177 | −1.5309 | 8.8901 | 1.2457 | −2.6008 | 8.9901 | 2.0800 |
| −2.8034 | 8.6900 | 2.1045 | −1.6056 | 8.8901 | 1.3116 | −2.6848 | 8.9901 | 2.1270 |
| −0.7423 | 8.7900 | 0.4034 | −1.6801 | 8.8901 | 1.3776 | −2.7706 | 8.9901 | 2.1369 |
| −0.7183 | 8.7900 | 0.4533 | −1.7546 | 8.8901 | 1.4428 | −2.7893 | 8.9901 | 2.1177 |
| −0.7496 | 8.7900 | 0.5659 | −1.8316 | 8.8901 | 1.5051 | −0.6864 | 9.0901 | 0.2798 |
| −0.8207 | 8.7900 | 0.6288 | −1.9081 | 8.8901 | 1.5683 | −0.6630 | 9.0901 | 0.3423 |
| −0.8995 | 8.7900 | 0.6926 | −1.9866 | 8.8901 | 1.6285 | −0.6794 | 9.0901 | 0.4292 |
| −0.7497 | 9.0901 | 0.4903 | −1.6916 | 9.1901 | 1.3288 | −2.5846 | 9.2901 | 2.0573 |
| −0.8275 | 9.0901 | 0.5547 | −1.7645 | 9.1901 | 1.3962 | −2.6665 | 9.2901 | 2.1122 |
| −0.9033 | 9.0901 | 0.6195 | −1.8380 | 9.1901 | 1.4625 | −2.7502 | 9.2901 | 2.1441 |
| −0.9776 | 9.0901 | 0.6871 | −1.9131 | 9.1901 | 1.5272 | −2.8095 | 9.2901 | 2.1017 |
| −1.0495 | 9.0901 | 0.7562 | −1.9888 | 9.1901 | 1.5914 | −2.8095 | 9.2901 | 2.1016 |
| −1.1221 | 9.0901 | 0.8242 | −2.0663 | 9.1901 | 1.6533 | −0.6544 | 9.3900 | 0.1361 |
| −1.1948 | 9.0901 | 0.8924 | −2.1444 | 9.1901 | 1.7151 | −0.6211 | 9.3900 | 0.2133 |
| −1.2674 | 9.0901 | 0.9601 | −2.2226 | 9.1901 | 1.7772 | −0.6328 | 9.3900 | 0.2997 |
| −1.3412 | 9.0901 | 1.0271 | −2.2990 | 9.1901 | 1.8410 | −0.7034 | 9.3900 | 0.3601 |
| −1.4135 | 9.0901 | 1.0958 | −2.3761 | 9.1901 | 1.9033 | −0.7797 | 9.3900 | 0.4266 |
| −1.4858 | 9.0901 | 1.1636 | −2.4539 | 9.1901 | 1.9652 | −0.8556 | 9.3900 | 0.4901 |
| −1.5592 | 9.0901 | 1.2308 | −2.5319 | 9.1901 | 2.0252 | −0.9316 | 9.3900 | 0.5551 |
| −1.6330 | 9.0901 | 1.2977 | −2.6144 | 9.1901 | 2.0818 | −1.0067 | 9.3900 | 0.6215 |
| −1.7063 | 9.0901 | 1.3651 | −2.6937 | 9.1901 | 2.1308 | −1.0787 | 9.3900 | 0.6912 |
| −1.7796 | 9.0901 | 1.4317 | −2.7949 | 9.1901 | 2.1157 | −1.1503 | 9.3900 | 0.7604 |
| −1.8549 | 9.0901 | 1.4959 | −2.8098 | 9.1901 | 2.0947 | −1.2216 | 9.3900 | 0.8299 |
| −1.9314 | 9.0901 | 1.5594 | −2.8115 | 9.1901 | 2.0922 | −1.2942 | 9.3900 | 0.8977 |
| −2.0083 | 9.0901 | 1.6220 | −0.6666 | 9.2901 | 0.1804 | −1.3669 | 9.3900 | 0.9664 |
| −2.0870 | 9.0901 | 1.6829 | −0.6319 | 9.2901 | 9.2517 | −1.4381 | 9.3900 | 1.0361 |
| −2.1655 | 9.0901 | 1.7448 | −0.6521 | 9.2901 | 0.3466 | −1.5092 | 9.3900 | 1.1058 |
| −2.2432 | 9.0901 | 1.8070 | −0.7231 | 9.2901 | 0.4082 | −1.5800 | 9.3900 | 1.1754 |
| −2.3214 | 9.0901 | 1.8681 | −0.8000 | 9.2901 | 0.4735 | −1.6524 | 9.3900 | 1.2441 |
| −2.3999 | 9.0901 | 1.9295 | −0.8755 | 9.2901 | 0.5377 | −1.7229 | 9.3900 | 1.3142 |
| −2.4779 | 9.0901 | 1.9909 | −0.9510 | 9.2901 | 0.6026 | −1.7954 | 9.3900 | 1.3817 |
| −2.5581 | 9.0901 | 2.0475 | −1.0262 | 9.2901 | 0.6695 | −1.8684 | 9.3900 | 1.4496 |
| −2.6428 | 9.0901 | 2.1035 | −1.0960 | 9.2901 | 0.7411 | −1.9417 | 9.3900 | 1.5154 |
| −2.7175 | 9.0901 | 2.1414 | −1.1690 | 9.2901 | 0.8099 | −2.0186 | 9.3900 | 1.5788 |
| −2.8586 | 9.0901 | 2.0797 | −1.2407 | 9.2901 | 0.8790 | −2.0939 | 9.3900 | 1.6447 |
| −2.8343 | 9.0901 | 2.1243 | −1.3141 | 9.2901 | 0.9462 | −2.1695 | 9.3900 | 1.7089 |
| −0.6802 | 9.1901 | 0.2216 | −1.3860 | 9.2901 | 1.0155 | −2.2460 | 9.3900 | 1.7730 |
| −0.6455 | 9.1901 | 0.3055 | −1.4576 | 9.2901 | 1.0841 | −2.3212 | 9.3900 | 1.8382 |
| −0.6664 | 9.1901 | 0.3911 | −1.5296 | 9.2901 | 1.1528 | −2.3973 | 9.3900 | 1.9018 |
| −0.7383 | 9.1901 | 0.4514 | −1.6013 | 9.2901 | 1.2217 | −2.4736 | 9.3900 | 1.9654 |
| −0.5158 | 9.1901 | 0.5163 | −1.6738 | 9.2901 | 1.2898 | −2.5512 | 9.3900 | 2.0264 |
| −0.8917 | 9.1901 | 0.5807 | −1.7461 | 9.2901 | 1.3578 | −2.6317 | 9.3900 | 2.0857 |

-continued

| X | Y | Z | X | Y | Z | X | Y | Z |
|---|---|---|---|---|---|---|---|---|
| −0.9665 | 9.1901 | 0.6476 | −4.8196 | 9.2901 | 1.4244 | −2.7103 | 9.3900 | 2.1339 |
| −1.0390 | 9.1901 | 0.7158 | −1.8934 | 9.2901 | 1.4909 | −2.8109 | 9.3900 | 2.1105 |
| −1.1116 | 9.1901 | 0.7841 | −1.9677 | 9.2901 | 1.5565 | −2.8247 | 9.3900 | 2.0891 |
| −1.1836 | 9.1901 | 0.8531 | −2.0436 | 9.2901 | 1.6204 | −2.8259 | 9.3900 | 2.0873 |
| −1.2561 | 9.1901 | 0.9210 | −2.1209 | 9.2901 | 1.6830 | −0.6434 | 9.4901 | 0.0974 |
| −1.3288 | 9.1901 | 0.9891 | −2.1984 | 9.2901 | 1.7461 | −0.6063 | 9.4901 | 0.1688 |
| −1.4011 | 9.1901 | 1.0576 | −2.2743 | 9.2901 | 1.8108 | −0.6299 | 9.4901 | 0.2702 |
| −1.4728 | 9.1901 | 1.1263 | −2.3507 | 9.2901 | 1.8739 | −0.7017 | 9.4901 | 0.3314 |
| −1.5452 | 9.1901 | 1.1941 | −2.4279 | 9.2901 | 1.9365 | −0.7791 | 9.4901 | 0.3963 |
| −1.6184 | 9.1901 | 1.2613 | −2.5050 | 9.2901 | 1.9989 | −0.8549 | 9.4901 | 0.4604 |
| −0.9312 | 9.4901 | 0.5248 | −1.7774 | 9.5900 | 1.3180 | −2.5656 | 9.6900 | 2.0137 |
| −1.0064 | 9.4901 | 0.5912 | −1.8481 | 9.5900 | 1.3873 | −2.6444 | 9.6900 | 2.0750 |
| −1.0790 | 9.4901 | 0.6603 | −1.9204 | 9.5900 | 1.4555 | −2.7217 | 9.6900 | 2.1302 |
| −1.1505 | 9.4901 | 0.7297 | −1.9929 | 9.5900 | 1.5232 | −2.8191 | 9.6900 | 2.1374 |
| −1.2223 | 9.4901 | 0.7986 | −2.0673 | 9.5900 | 1.5889 | −2.8287 | 9.6900 | 2.1271 |
| −1.2946 | 9.4901 | 0.8673 | −2.1423 | 9.5900 | 1.6548 | −0.6167 | 9.7900 | 0.0303 |
| −1.3663 | 9.4901 | 0.9362 | −2.2167 | 9.5900 | 1.7209 | −0.5768 | 9.7900 | 0.0373 |
| −1.4381 | 9.4901 | 1.0057 | −2.2914 | 9.5900 | 1.7865 | −0.5844 | 9.7900 | 0.1452 |
| −1.5080 | 9.4901 | 1.0765 | −2.3658 | 9.5900 | 1.8526 | −0.6587 | 9.7900 | 0.2011 |
| −1.5789 | 9.4901 | 1.1462 | −2.4404 | 9.5900 | 1.9189 | −0.7368 | 9.7900 | 0.2667 |
| −1.6492 | 9.4901 | 1.2169 | −2.5160 | 9.5900 | 1.9825 | −0.8125 | 9.7900 | 0.3301 |
| −1.7203 | 9.4901 | 1.2864 | −2.5926 | 9.5900 | 2.0440 | −0.8896 | 9.7900 | 0.3939 |
| −1.7911 | 9.4901 | 1.3561 | −2.6738 | 9.5900 | 2.1037 | −0.9651 | 9.7900 | 0.4599 |
| −1.8630 | 9.4901 | 1.4242 | −2.7474 | 9.5900 | 2.1460 | −1.0387 | 9.7900 | 0.5273 |
| −1.9362 | 9.4901 | 1.4908 | −2.9037 | 9.5900 | 2.0449 | −1.1120 | 9.7900 | 0.5951 |
| −2.0111 | 9.4901 | 1.5562 | −2.8593 | 9.5900 | 2.1356 | −1.1839 | 9.7900 | 0.6643 |
| −2.0858 | 9.4901 | 1.6221 | −0.6029 | 9.6900 | 0.0447 | −1.2559 | 9.7900 | 0.7333 |
| −2.1611 | 9.4901 | 1.6870 | −0.5786 | 9.6900 | 0.1120 | −1.3271 | 9.7900 | 0.8035 |
| −2.2366 | 9.4901 | 1.7520 | −0.6022 | 9.6900 | 0.1888 | −1.3981 | 9.7900 | 0.8737 |
| −2.3116 | 9.4901 | 1.8177 | −0.6744 | 9.6900 | 0.2489 | −1.4679 | 9.7900 | 0.9452 |
| −2.3864 | 9.4901 | 1.8829 | −0.7527 | 9.6900 | 0.3124 | −1.5375 | 9.7900 | 1.0164 |
| −2.4626 | 9.4901 | 1.9465 | −0.8292 | 9.6900 | 0.3760 | −1.6066 | 9.7900 | 1.0876 |
| −2.5394 | 9.4901 | 2.0094 | −0.9054 | 9.6900 | 0.4407 | −1.6767 | 9.7900 | 1.1584 |
| −2.6179 | 9.4901 | 2.0699 | −0.9805 | 9.6900 | 0.5064 | −1.7463 | 9.7900 | 1.2301 |
| −2.6982 | 9.4901 | 2.1241 | −1.0546 | 9.6900 | 0.5735 | −1.8148 | 9.7900 | 1.3020 |
| −2.7826 | 9.4901 | 2.1447 | −1.1273 | 9.6900 | 0.6424 | −1.8841 | 9.7900 | 1.3730 |
| −2.8145 | 9.4901 | 2.1181 | −1.1982 | 9.6900 | 0.7122 | −1.9541 | 9.7900 | 1.4433 |
| −0.6220 | 9.5900 | 0.0594 | −1.2703 | 9.6900 | 0.7807 | −2.0251 | 9.7900 | 1.5127 |
| −0.5959 | 9.5900 | 0.1427 | −1.3421 | 9.6900 | 0.8502 | −2.0966 | 9.7900 | 1.5815 |
| −0.6176 | 9.5900 | 0.2307 | −1.4135 | 9.6900 | 0.9203 | −2.1704 | 9.7900 | 1.6480 |
| −0.6897 | 9.5900 | 0.2908 | −1.4831 | 9.6900 | 0.9913 | −2.2444 | 9.7900 | 1.7146 |
| −0.7665 | 9.5900 | 0.3568 | −1.5534 | 9.6900 | 1.0618 | −2.3186 | 9.7900 | 1.7806 |
| −0.8424 | 9.5900 | 0.4202 | −1.6220 | 9.6900 | 1.1338 | −2.3928 | 9.7900 | 1.8478 |
| −0.9197 | 9.5900 | 0.4839 | −1.6920 | 9.6900 | 1.2041 | −2.4649 | 9.7900 | 1.9159 |
| −0.9945 | 9.5900 | 0.5509 | −1.7621 | 9.6900 | 1.2750 | −2.5395 | 9.7900 | 1.9812 |
| −1.0675 | 9.5900 | 0.6189 | −1.8317 | 9.6900 | 1.3458 | −2.6147 | 9.7900 | 2.0448 |
| −1.1403 | 9.5900 | 0.6870 | −1.9019 | 9.6900 | 1.4157 | −2.6941 | 9.7900 | 2.1066 |
| −1.2119 | 9.5900 | 0.7565 | −1.9733 | 9.6900 | 1.4841 | −2.7667 | 9.7900 | 2.1503 |
| −1.2839 | 9.5900 | 0.8253 | −1.0465 | 9.6900 | 1.5513 | −2.9241 | 9.7900 | 2.0486 |
| −1.3559 | 9.5900 | 0.8943 | −2.1194 | 9.6900 | 1.6188 | −2.8791 | 9.7900 | 2.1439 |
| −1.4271 | 9.5900 | 0.9645 | −2.1941 | 9.6900 | 1.6845 | −0.5902 | 9.8900 | 0.0506 |
| −1.4970 | 9.5900 | 1.0354 | −2.2680 | 9.6900 | 1.7513 | −0.5592 | 9.8900 | 0.0253 |
| −1.5672 | 9.5900 | 1.1059 | −2.3422 | 9.6900 | 1.8176 | −0.5805 | 9.8900 | 0.1143 |
| −1.6365 | 9.5900 | 1.1771 | −2.4156 | 9.6900 | 1.8847 | −0.6546 | 9.8900 | 0.1713 |
| −1.7077 | 9.5900 | 1.2467 | −2.4900 | 9.6900 | 1.9501 | −0.7335 | 9.8900 | 0.2336 |
| −0.8136 | 9.8900 | 0.2933 | −1.5312 | 9.9900 | 0.9462 | −2.2044 | 10.0900 | 1.6179 |
| −0.8889 | 9.8900 | 0.3610 | −1.6000 | 9.9900 | 1.0179 | −2.2745 | 10.0900 | 1.6885 |
| −0.9641 | 9.8900 | 0.4268 | −1.6695 | 9.9900 | 1.0890 | −2.3453 | 10.0900 | 1.7581 |
| −1.0394 | 9.8900 | 0.4936 | −1.7382 | 9.9900 | 1.1615 | −2.4172 | 10.0900 | 1.8271 |
| −1.1120 | 9.8900 | 0.5623 | −1.8063 | 9.9900 | 1.2344 | −2.4886 | 10.0900 | 1.8966 |
| −1.1843 | 9.8900 | 0.6310 | −1.8733 | 9.9900 | 1.3079 | −2.5602 | 10.0900 | 1.9649 |
| −1.2557 | 9.8900 | 0.7007 | −1.9411 | 9.9900 | 1.3800 | −2.6345 | 10.0900 | 2.0306 |
| −1.3266 | 9.8900 | 0.7710 | −2.0109 | 9.9900 | 1.4504 | −2.7101 | 10.0900 | 2.0940 |
| −1.3973 | 9.8900 | 0.8419 | −2.0813 | 9.9900 | 1.5204 | −2.7899 | 10.0900 | 2.1491 |
| −1.4665 | 9.8900 | 0.9137 | −2.1523 | 9.9900 | 1.5899 | −2.8279 | 10.0900 | 2.1658 |
| −1.5365 | 9.8900 | 0.9842 | −2.2243 | 9.9900 | 1.5584 | −2.8628 | 10.0900 | 2.1661 |
| −1.6062 | 9.8900 | 1.0555 | −2.2963 | 9.9900 | 1.7271 | −2.8780 | 10.0900 | 2.1474 |
| −1.6753 | 9.8900 | 1.1273 | −2.3684 | 9.9900 | 1.7958 | −0.5630 | 10.1900 | −0.1404 |
| −1.7442 | 9.8900 | 1.1994 | −2.4405 | 9.9900 | 1.8643 | −0.5329 | 10.1900 | −0.0766 |
| −1.8124 | 9.8900 | 4.2723 | −2.5127 | 9.9900 | 1.9324 | −0.5467 | 10.1900 | 0.0135 |
| −1.8799 | 9.8900 | 1.3452 | −2.5858 | 9.9900 | 1.9995 | −0.6222 | 10.1900 | 0.0648 |
| −1.9487 | 9.8900 | 1.4170 | −2.6603 | 9.9900 | 2.0635 | −0.7079 | 10.1900 | 0.1196 |
| −2.0173 | 9.8900 | 1.4886 | −2.7396 | 9.9900 | 2.1231 | −0.7893 | 10.1900 | 0.1787 |
| −2.0885 | 9.8900 | 1.5573 | −2.8160 | 9.9900 | 2.1637 | −0.8670 | 10.1900 | 0.2416 |
| −2.1616 | 9.8900 | 1.6244 | −2.8668 | 9.9900 | 2.1409 | −0.9443 | 10.1900 | 0.3045 |
| −2.2362 | 9.8900 | 1.6903 | 0.5665 | 10.0900 | −0.1080 | −1.0199 | 10.1900 | 0.3703 |
| −2.3105 | 9.8900 | 1.7574 | −0.5387 | 10.0900 | −0.0388 | −1.0936 | 10.1900 | 0.4377 |

-continued

| X | Y | Z | X | Y | Z | X | Y | Z |
|---|---|---|---|---|---|---|---|---|
| −2.3828 | 9.8900 | 1.8257 | −0.5511 | 10.0900 | 0.0436 | −1.1663 | 10.1900 | 0.5062 |
| −2.4567 | 9.8900 | 1.8922 | −0.6261 | 10.0900 | 0.0958 | −1.2373 | 10.1900 | 0.5765 |
| −2.5293 | 9.8900 | 1.9604 | −0.7099 | 10.0900 | 0.1533 | −1.3078 | 10.1900 | 0.6468 |
| −2.6037 | 9.8900 | 2.0241 | −0.7907 | 10.0900 | 0.2123 | −1.3780 | 10.1900 | 0.7178 |
| −2.6831 | 9.8900 | 2.0897 | −0.8682 | 10.0900 | 0.2761 | −1.4469 | 10.1900 | 0.7901 |
| −2.7514 | 9.8900 | 2.1394 | −0.9447 | 10.0900 | 0.3407 | −1.5158 | 10.1900 | 0.8616 |
| −2.8861 | 9.8900 | 2.1547 | −1.0197 | 10.0900 | 0.4071 | −1.5854 | 10.1900 | 0.9330 |
| −2.8806 | 9.8900 | 2.1632 | −1.0937 | 10.0900 | 0.4743 | −1.6545 | 10.1900 | 1.0044 |
| −0.5823 | 9.9900 | −0.0814 | −1.1659 | 10.0900 | 0.5435 | −1.7240 | 10.1900 | 1.0763 |
| −0.5450 | 9.9900 | −0.0134 | −1.2375 | 10.0900 | 0.6130 | −1.7898 | 10.1900 | 1.1517 |
| −0.5718 | 9.9900 | 0.0823 | −1.3077 | 10.0900 | 0.6838 | −1.8559 | 10.1900 | 1.2259 |
| −3.6476 | 9.9900 | 0.1381 | −1.3780 | 10.0900 | 0.7546 | −1.9221 | 10.1900 | 1.2999 |
| −0.7286 | 9.9900 | 0.1987 | −1.4473 | 10.0900 | 0.8266 | −1.9894 | 10.1900 | 1.3727 |
| −0.8073 | 9.9900 | 0.2597 | −1.5170 | 10.0900 | 0.8979 | −2.0580 | 10.1900 | 1.4445 |
| −0.8846 | 9.9900 | 0.3234 | −1.5863 | 10.0900 | 0.9695 | −2.1266 | 10.1900 | 1.5164 |
| −0.9604 | 9.9900 | 0.3886 | −1.6555 | 10.0900 | 1.0411 | −2.1960 | 10.1900 | 1.5879 |
| −1.0347 | 9.9900 | 0.4555 | −1.7241 | 10.0900 | 1.1134 | −2.2647 | 10.1900 | 1.6599 |
| −1.1079 | 9.9900 | 0.5231 | −1.7921 | 10.0900 | 1.1866 | −2.3345 | 10.1900 | 1.7296 |
| −1.1802 | 9.9900 | 0.5920 | −1.8582 | 10.0900 | 1.2608 | −2.4063 | 10.1900 | 1.7989 |
| −1.2516 | 9.9900 | 0.6617 | −1.9263 | 10.0900 | 1.3333 | −2.4764 | 10.1900 | 1.8698 |
| −1.3222 | 9.9900 | 0.7323 | −1.9951 | 10.0900 | 1.4053 | −2.5469 | 10.1900 | 1.9390 |
| −1.3923 | 9.9900 | 0.8033 | −2.0637 | 10.0900 | 1.4770 | −2.6201 | 10.1900 | 2.0059 |
| −1.4616 | 9.9900 | 0.8748 | −2.1338 | 10.0900 | 1.5473 | −2.6944 | 10.1900 | 2.0711 |
| −2.7717 | 10.1900 | 2.1316 | −0.5311 | 10.3901 | −0.0490 | −1.1634 | 10.4900 | 0.3883 |
| −2.8537 | 10.1900 | 2.1746 | −0.6085 | 10.3901 | −0.0054 | −1.2360 | 10.4900 | 0.4571 |
| −2.8701 | 10.1900 | 2.1761 | −0.6986 | 10.3901 | 0.0444 | −1.3065 | 10.4900 | 0.5284 |
| −2.8816 | 10.1900 | 2.1683 | −0.7819 | 10.3901 | 0.1027 | −1.3758 | 10.4900 | 0.6004 |
| −2.9049 | 10.1900 | 2.1373 | −0.8607 | 10.3901 | 0.1650 | −1.4440 | 10.4900 | 0.6731 |
| 0.5569 | 10.2901 | −0.1666 | −0.9390 | 10.3901 | 0.2274 | −1.5128 | 10.4900 | 0.7454 |
| −0.5143 | 10.2901 | −0.0952 | 1.0155 | 10.3901 | 0.2922 | −1.5807 | 10.4900 | 0.8188 |
| −0.5468 | 10.2901 | −0.0123 | −1.0907 | 10.3901 | 0.3587 | −1.6484 | 10.4900 | 0.8918 |
| −0.6272 | 10.2901 | 0.0362 | −1.1635 | 10.3901 | 0.4276 | −1.7165 | 10.4900 | 0.9650 |
| −0.7137 | 10.2901 | 0.0899 | −1.2355 | 10.3901 | 0.4969 | −1.7824 | 10.4900 | 1.0403 |
| −0.7957 | 10.2901 | 0.1486 | −1.3062 | 10.3901 | 0.5678 | −1.8475 | 10.4900 | 1.1158 |
| −0.8735 | 10.2901 | 0.2116 | −1.3762 | 10.3901 | 0.6391 | −1.9121 | 10.4900 | 1.1918 |
| −0.9510 | 10.2901 | 0.2747 | −1.4453 | 10.3901 | 0.7117 | −1.9769 | 10.4900 | 1.2670 |
| −1.0268 | 10.2901 | 0.3402 | −1.5135 | 10.3901 | 0.7843 | −2.0428 | 10.4900 | 1.3419 |
| −1.1013 | 10.2901 | 0.4071 | −1.5828 | 10.3901 | 0.8561 | −2.1076 | 10.4900 | 1.4178 |
| −1.1736 | 10.2901 | 0.4763 | −1.6510 | 10.3901 | 0.9288 | −2.1729 | 10.4900 | 1.4923 |
| −1.2447 | 10.2901 | 0.5460 | −1.7204 | 10.3901 | 1.0011 | −2.2396 | 10.4900 | 1.5661 |
| −1.3159 | 10.2901 | 0.6163 | −0.7856 | 10.3901 | 1.0777 | −2.3073 | 10.4900 | 1.6392 |
| −1.3854 | 10.2901 | 0.6881 | −1.8504 | 10.3901 | 1.1535 | −2.3753 | 10.4900 | 1.7116 |
| −1.4543 | 10.2901 | 0.7600 | −1.9162 | 10.3901 | 1.2286 | −2.4447 | 10.4900 | 1.7832 |
| −1.5236 | 10.2901 | 0.8317 | −1.9813 | 10.3901 | 1.3039 | −2.5132 | 10.4900 | 1.8555 |
| −1.5926 | 10.2901 | 0.9036 | −2.0474 | 10.3901 | 1.3784 | −2.5829 | 10.4900 | 1.9261 |
| −1.6612 | 10.2901 | 0.9756 | −2.1136 | 10.3901 | 1.4528 | −2.6538 | 10.4900 | 1.9961 |
| −1.7301 | 10.2901 | 1.0482 | −2.1806 | 10.3901 | 1.5263 | −2.7250 | 10.4900 | 2.0651 |
| −1.7958 | 10.2901 | 1.1240 | −2.2485 | 10.3901 | 1.5990 | −2.7992 | 10.4900 | 2.1291 |
| −1.8606 | 10.2901 | 1.1995 | −2.3178 | 10.3901 | 1.6705 | −2.8797 | 10.4900 | 2.1830 |
| −1.9265 | 10.2901 | 1.2735 | −2.3875 | 10.3901 | 1.7422 | −2.9164 | 10.4900 | 2.1962 |
| −1.9937 | 10.2901 | 1.3470 | −2.4564 | 10.3901 | 1.8141 | −2.9396 | 10.4900 | 2.1837 |
| −2.0601 | 10.2901 | 1.4211 | −2.5265 | 10.3901 | 1.8847 | −2.9613 | 10.4900 | 2.1458 |
| −2.1275 | 10.2901 | 1.4935 | −2.5966 | 10.3901 | 1.9553 | 0.0012 | 10.5901 | −0.2223 |
| −2.1964 | 10.2901 | 1.5657 | −2.6683 | 10.3901 | 2.0240 | −0.1004 | 10.5901 | −0.2255 |
| −2.2649 | 10.2901 | 1.6378 | −2.7413 | 10.3901 | 2.0906 | −0.2032 | 10.5901 | −0.2165 |
| −2.3350 | 10.2901 | 1.7081 | −2.8180 | 10.3901 | 2.1510 | −0.3033 | 10.5901 | −0.1995 |
| −2.4051 | 10.2901 | 1.7791 | −2.9012 | 10.3901 | 2.1884 | −0.4019 | 10.5901 | −0.1728 |
| −2.4748 | 10.2901 | 1.8502 | −2.9065 | 10.3901 | 2.1887 | −0.4961 | 10.5901 | −0.1360 |
| −2.5450 | 10.2901 | 1.9205 | −2.9154 | 10.3901 | 2.1824 | −0.5856 | 10.5901 | −0.0909 |
| −2.6162 | 10.2901 | 1.9894 | −2.9465 | 10.3901 | 2.1337 | −0.6758 | 10.5901 | −0.0459 |
| −2.6898 | 10.2901 | 2.0556 | −0.5208 | 10.4900 | −0.0913 | −0.7631 | 10.5901 | 0.0082 |
| −2.7650 | 10.2901 | 2.1192 | −0.6092 | 10.4900 | −0.0443 | −0.8416 | 10.5901 | 0.0705 |
| −2.8455 | 10.2901 | 2.1712 | −0.6971 | 10.4900 | 0.0064 | −0.9213 | 10.5901 | 0.1324 |
| −2.8530 | 10.2901 | 2.1746 | −0.7791 | 10.4900 | 0.0664 | −0.9990 | 10.5901 | 0.1963 |
| −2.8878 | 10.2901 | 2.1809 | −0.8597 | 10.4900 | 0.1267 | −1.0737 | 10.5901 | 0.2638 |
| −2.9070 | 10.2901 | 2.1655 | −0.9389 | 10.4900 | 0.1886 | −1.1447 | 10.5901 | 0.3332 |
| −0.5688 | 10.3901 | −0.1980 | −1.0153 | 10.4900 | 0.2533 | −1.2180 | 10.5901 | 0.4004 |
| −0.5341 | 10.3901 | −0.1394 | −1.0905 | 10.4900 | 0.3197 | −1.2888 | 10.5901 | 0.4715 |
| −1.3580 | 10.5901 | 0.5432 | −1.5012 | 10.6900 | 0.6556 | −1.6366 | 10.7900 | 0.7691 |
| −1.4262 | 10.5901 | 0.6161 | −1.5683 | 10.6900 | 0.7297 | −1.7019 | 10.7900 | 0.8441 |
| −1.4941 | 10.5901 | 0.6887 | −1.6346 | 10.6900 | 0.8043 | −1.7668 | 10.7900 | 0.9199 |
| −1.5620 | 10.5901 | 0.7616 | −1.7001 | 10.6900 | 0.8793 | −1.8313 | 10.7900 | 0.9963 |
| −1.6289 | 10.5901 | 0.8353 | −1.7663 | 10.6900 | 0.9541 | −1.8945 | 10.7900 | 1.0733 |
| −1.6958 | 10.5901 | 0.9092 | −1.8308 | 10.6900 | 1.0307 | −1.9584 | 10.7900 | 1.1496 |
| −1.7622 | 10.5901 | 0.9839 | −1.8946 | 10.6900 | 1.1071 | −2.0218 | 10.7900 | 1.2264 |
| −1.8275 | 10.5901 | 1.0595 | −1.9590 | 10.6900 | 1.1833 | −2.0853 | 10.7900 | 1.3032 |
| −1.8917 | 10.5901 | 1.1359 | −2.0228 | 10.6900 | 1.2597 | −2.1485 | 10.7900 | 1.3800 |

-continued

| X | Y | Z | X | Y | Z | X | Y | Z |
|---|---|---|---|---|---|---|---|---|
| −1.9561 | 10.5901 | 1.2117 | −2.0872 | 10.6900 | 1.3357 | −2.2126 | 10.7900 | 1.4559 |
| −2.0210 | 10.5901 | 1.2871 | −2.1517 | 10.6900 | 1.4119 | −2.2771 | 10.7900 | 1.5317 |
| −2.0854 | 10.5901 | 1.3632 | −2.2163 | 10.6900 | 1.4877 | −2.3417 | 10.7900 | 1.6071 |
| −2.1504 | 10.5901 | 1.4386 | −2.2814 | 10.6900 | 1.5630 | −2.4076 | 10.7900 | 1.6813 |
| −2.2155 | 10.5001 | 1.5138 | −2.3466 | 10.6900 | 1.6378 | −2.4734 | 10.7900 | 1.7561 |
| −2.2811 | 10.5901 | 1.5885 | −2.4135 | 10.6900 | 1.7112 | −2.5399 | 10.7900 | 1.8297 |
| −2.3476 | 10.5901 | 1.6621 | −2.4807 | 10.6900 | 1.7847 | −2.6082 | 10.7900 | 1.9020 |
| −2.4158 | 10.5901 | 1.7344 | −2.5488 | 10.6900 | 1.8572 | −2.6769 | 10.7900 | 1.9738 |
| −2.4840 | 10.5901 | 1.8072 | −2.6176 | 10.6900 | 1.9290 | −2.7466 | 10.7900 | 2.0443 |
| −2.5526 | 10.5901 | 1.8791 | −2.6876 | 10.6900 | 1.9999 | −2.8179 | 10.7900 | 2.1126 |
| −2.6223 | 10.5901 | 1.9499 | −2.7576 | 10.6900 | 2.0700 | −2.8931 | 10.7900 | 2.1756 |
| −2.6928 | 10.5901 | 2.0203 | −2.8311 | 10.6900 | 2.1353 | −2.9744 | 10.7900 | 2.2194 |
| −2.7638 | 10.5901 | 2.0889 | −2.9092 | 10.6900 | 2.1927 | −2.9877 | 10.7900 | 2.2211 |
| −2.8392 | 10.5901 | 2.1515 | −2.9628 | 10.6900 | 2.2110 | −3.0140 | 10.7900 | 2.1961 |
| −2.9206 | 10.5901 | 2.1997 | −2.9786 | 10.6900 | 2.2035 | −3.0301 | 10.7900 | 2.1635 |
| −2.9393 | 10.5901 | 2.2044 | −2.9970 | 10.6900 | 2.1715 | 0.0021 | 10.8901 | −0.2957 |
| −2.9593 | 10.5901 | 2.1923 | 0.0020 | 10.7900 | −0.2726 | −0.1001 | 10.8901 | −0.3029 |
| −2.9822 | 10.5901 | 2.1469 | −0.1006 | 10.7900 | −0.2787 | −0.2032 | 10.8901 | −0.2987 |
| 0.0017 | 10.6900 | −0.2479 | −0.2037 | 10.7900 | −0.2689 | −0.3038 | 10.8901 | −0.2852 |
| −0.1009 | 10.6900 | −0.2527 | −0.3049 | 10.7900 | −0.2556 | −0.4032 | 10.8901 | −0.2592 |
| −0.2041 | 10.6900 | −0.2421 | −0.4056 | 10.7900 | −0.2298 | −0.4958 | 10.8901 | −0.2197 |
| −0.3041 | 10.6900 | −0.2253 | −0.4981 | 10.7900 | −0.1903 | −0.5899 | 10.8901 | −0.1817 |
| −0.4036 | 10.6900 | −0.2008 | −0.5923 | 10.7900 | −0.1519 | −0.6831 | 10.8901 | −0.1422 |
| −0.4967 | 10.6900 | −0.1620 | −0.6843 | 10.7900 | −0.1105 | −0.7723 | 10.8901 | −0.0945 |
| −0.5923 | 10.6900 | −0.1246 | −0.7738 | 10.7900 | −0.0610 | −0.8595 | 10.8901 | −0.0423 |
| −0.6838 | 10.6900 | −0.0785 | −0.8551 | 10.7900 | −0.0013 | −0.9394 | 10.8901 | 0.0217 |
| −0.7699 | 10.6900 | −0.0251 | −0.9345 | 10.7900 | 0.0607 | −1.0164 | 10.8901 | 0.0869 |
| −0.8504 | 10.6900 | 0.0354 | −1.0116 | 10.7900 | 0.1249 | −1.0914 | 10.8901 | 0.1537 |
| −0.9289 | 10.6900 | 0.0977 | −1.0864 | 10.7900 | 0.1917 | −1.1637 | 10.8901 | 0.2233 |
| −1.0067 | 10.6900 | 0.1612 | −1.1590 | 10.7900 | 0.2604 | −1.2340 | 10.8901 | 0.2942 |
| −1.0813 | 10.6900 | 0.2285 | −1.2302 | 10.7900 | 0.3304 | −1.3044 | 10.8901 | 0.3650 |
| −1.1538 | 10.6900 | 0.2975 | −1.3000 | 10.7900 | 0.4017 | −1.3730 | 10.8901 | 0.4376 |
| −1.2252 | 10.6900 | 0.3672 | −1.3687 | 10.7900 | 0.4737 | −1.4407 | 10.8901 | 0.5111 |
| −1.2959 | 10.6900 | 0.4376 | −1.4372 | 10.7900 | 0.5462 | −1.5077 | 10.8901 | 0.5850 |
| −1.3652 | 10.6900 | 0.5097 | −1.5044 | 10.7900 | 0.6200 | −1.5747 | 10.8901 | 0.6592 |
| −1.4330 | 10.6900 | 0.5828 | −1.5710 | 10.7900 | 0.6942 | −1.6402 | 10.8901 | 0.7345 |
| −1.7054 | 10.8901 | 0.8101 | −1.7715 | 10.9901 | 0.8547 | −1.8248 | 11.0900 | 0.8849 |
| −1.7692 | 10.8901 | 0.8871 | −1.8341 | 10.9901 | 0.9323 | −1.8890 | 11.0900 | 0.9626 |
| −1.8325 | 10.8901 | 0.9642 | −1.8974 | 10.9901 | 1.0092 | −1.9481 | 11.0900 | 1.0425 |
| −1.8959 | 10.8901 | 1.0414 | −1.9598 | 10.9901 | 1.0872 | −2.0135 | 11.0900 | 1.1184 |
| −1.9585 | 10.8901 | 1.1189 | −2.0223 | 10.9901 | 1.1642 | −2.0771 | 11.0900 | 1.1972 |
| −2.0221 | 10.8901 | 1.1955 | −2.0862 | 10.9901 | 1.2407 | −2.1396 | 11.0900 | 1.2743 |
| −2.0850 | 10.8901 | 1.2725 | −2.1495 | 10.9901 | 1.3177 | −2.2027 | 11.0900 | 1.3517 |
| −2.1490 | 10.8901 | 1.3490 | −2.2131 | 10.9901 | 1.3945 | −2.2651 | 11.0900 | 1.4295 |
| −2.2123 | 10.8901 | 1.4259 | −2.2763 | 10.9901 | 1.4714 | −2.3279 | 11.0900 | 1.5069 |
| −2.2764 | 10.8901 | 1.5020 | −2.3397 | 10.9901 | 1.5485 | −2.3902 | 11.0900 | 1.5845 |
| −2.3405 | 10.8901 | 1.5786 | −2.4021 | 10.9901 | 1.6257 | −2.4531 | 11.0900 | 1.6614 |
| −2.4039 | 10.8901 | 1.6549 | −2.4663 | 10.9901 | 1.7015 | −2.5172 | 11.0900 | 1.7374 |
| −2.4694 | 10.8901 | 1.7295 | −2.5307 | 10.9901 | 1.7773 | −2.5830 | 11.0900 | 1.8124 |
| −2.5360 | 10.8901 | 1.8041 | −2.5967 | 10.9901 | 1.8515 | −2.6482 | 11.0900 | 1.8876 |
| −2.6021 | 10.8901 | 1.8782 | −2.6641 | 10.9901 | 1.9245 | −2.7152 | 11.0900 | 1.9607 |
| −2.6708 | 10.8901 | 1.9501 | −2.7326 | 10.9901 | 1.9966 | −2.7831 | 11.0900 | 2.0333 |
| −2.7398 | 10.8901 | 2.0218 | −2.8013 | 10.9901 | 2.0683 | −2.8526 | 11.0900 | 2.1036 |
| −2.8102 | 10.8901 | 2.0916 | −2.8723 | 10.9901 | 2.1366 | −2.925$ | 11.0900 | 2.1708 |
| −2.8825 | 10.8901 | 2.1586 | −2.9475 | 10.9901 | 2.2003 | −3.0014 | 11.0900 | 2.2309 |
| −2.9612 | 10.8901 | 2.2150 | −3.0207 | 10.9901 | 2.2396 | −3.0490 | 11.0900 | 2.2522 |
| −2.9979 | 10.8901 | 2.2294 | −3.0573 | 10.9901 | 2.2337 | −3.0733 | 11.0900 | 2.2534 |
| −3.0286 | 10.8901 | 2.2238 | −3.0768 | 10.9901 | 2.2036 | −3.1041 | 11.0900 | 2.2183 |
| −3.0447 | 10.8901 | 2.1994 | 0.0008 | 11.0900 | −0.3399 | −0.0005 | 11.1900 | −0.3733 |
| −0.0006 | 10.9901 | −0.3234 | −0.1016 | 11.0900 | −0.3419 | −0.1038 | 11.1900 | −0.3768 |
| −0.1029 | 10.9901 | −0.3280 | −0.2031 | 11.0900 | −0.3397 | −0.2057 | 11.1900 | −0.3765 |
| −0.2055 | 10.9901 | −0.3248 | −0.3035 | 11.0900 | −0.3320 | −0.3079 | 11.1900 | −0.3654 |
| −0.3058 | 10.9901 | −0.3104 | −0.4057 | 11.0900 | −0.3161 | −0.4070 | 11.1900 | −0.3432 |
| −0.4057 | 10.9901 | −0.2868 | −0.5007 | 11.0900 | −0.2793 | −0.5038 | 11.1900 | −0.3133 |
| −0.4989 | 10.9901 | −0.2482 | −0.5797 | 11.0900 | −0.2515 | −0.5977 | 11.1900 | −0.2760 |
| −0.5947 | 10.9901 | −0.2119 | −0.6728 | 11.0900 | −0.2101 | −0.6894 | 11.1900 | −0.2339 |
| −0.6875 | 10.9901 | −0.1712 | −0.7629 | 11.0900 | −0.1656 | −0.7782 | 11.1900 | −0.1883 |
| −0.7767 | 10.9901 | −0.1253 | −0.8509 | 11.0900 | −0.1171 | −0.8678 | 11.1900 | −0.1422 |
| −0.8650 | 10.9901 | −0.0754 | −0.9370 | 11.0900 | −0.0625 | −0.9531 | 11.1900 | −0.0853 |
| −0.9462 | 10.9901 | −0.0129 | −1.0142 | 11.0900 | 0.0031 | −1.0325 | 11.1900 | −0.0226 |
| −1.0240 | 10.9901 | 0.0517 | −1.0898 | 11.0900 | 0.0703 | −1.1071 | 11.1900 | 0.0447 |
| −1.0982 | 10.9901 | 0.1193 | −1.1630 | 11.0900 | 0.1389 | −1.1805 | 11.1900 | 0.1132 |
| −1.1711 | 10.9901 | 0.1877 | −1.2345 | 11.0900 | 0.2090 | −1.2521 | 11.1900 | 0.1837 |
| −1.2422 | 10.9901 | 0.2583 | −1.3042 | 11.0900 | 0.2810 | −1.3217 | 11.1900 | 0.2558 |
| −1.3114 | 10.9901 | 0.3303 | −1.3720 | 11.0900 | 0.3544 | −1.3894 | 11.1900 | 0.3295 |
| −1.3796 | 10.9901 | 0.4031 | −1.4385 | 11.0900 | 0.4282 | −1.4559 | 11.1900 | 0.4040 |
| −1.4464 | 10.9901 | 0.4772 | −1.5056 | 11.0900 | 0.5025 | −1.5213 | 11.1900 | 0.4797 |

-continued

| X | Y | Z | X | Y | Z | X | Y | Z |
|---|---|---|---|---|---|---|---|---|
| −1.5124 | 10.9901 | 0.5518 | −1.5699 | 11.0900 | 0.5794 | −1.5848 | 11.1900 | 0.5572 |
| −1.5783 | 10.9901 | 0.6267 | −1.6334 | 11.0900 | 0.6562 | −1.6472 | 11.1900 | 0.6351 |
| −1.6427 | 10.9901 | 0.7028 | −1.6961 | 11.0900 | 0.7333 | −1.7092 | 11.1900 | 0.7131 |
| −1.7072 | 10.9901 | 0.7783 | −1.7606 | 11.0900 | 0.8088 | −1.7716 | 11.1900 | 0.7901 |
| −1.8365 | 11.1900 | 0.8656 | −1.8342 | 11.2899 | 0.8286 | −1.7717 | 11.3896 | 0.7143 |
| −1.9005 | 11.1900 | 0.9430 | −1.8986 | 11.2899 | 0.9071 | −1.8344 | 11.3896 | 0.7925 |
| −1.9628 | 11.1900 | 1.0211 | −1.9617 | 11.2899 | 0.9843 | −1.8957 | 11.3896 | 0.8707 |
| −2.0254 | 11.1900 | 1.0989 | −2.0244 | 11.2899 | 1.0625 | −1.9583 | 11.3896 | 0.9480 |
| −2.0871 | 11.1900 | 1.1773 | −2.0846 | 11.2899 | 1.1422 | −2.0208 | 11.3896 | 1.0264 |
| −2.1495 | 11.1900 | 1.2548 | −2.1463 | 11.2899 | 1.2202 | −2.0805 | 11.3896 | 1.1063 |
| −2.2115 | 11.1900 | 1.3331 | −2.2080 | 11.2899 | 1.2986 | −2.1419 | 11.3896 | 1.1846 |
| −2.2736 | 11.1900 | 1.4109 | −2.2701 | 11.2899 | 1.3767 | −2.2021 | 11.3896 | 1.2637 |
| −2.3363 | 11.1900 | 1.4888 | −2.3316 | 11.2899 | 1.4552 | −2.2646 | 11.3896 | 1.3408 |
| −2.3976 | 11.1900 | 1.5670 | −2.3939 | 11.2899 | 1.5330 | −2.3276 | 11.3896 | 1.4183 |
| −2.4612 | 11.1900 | 1.6435 | −2.4559 | 11.2899 | 1.6110 | −2.3894 | 11.3896 | 1.4975 |
| −2.5241 | 11.1900 | 1.7210 | −2.5183 | 11.2899 | 1.6885 | −2.4473 | 11.3896 | 1.5778 |
| −2.5882 | 11.1900 | 1.7972 | −2.5811 | 11.2899 | 1.7659 | −2.5103 | 11.3896 | 1.6541 |
| −2.6534 | 11.1900 | 1.8724 | −2.6452 | 11.2899 | 1.8417 | −2.5736 | 11.3896 | 1.7320 |
| −2.7199 | 11.1900 | 1.9463 | −2.7112 | 11.2899 | 1.9158 | −2.6371 | 11.3896 | 1.8083 |
| −2.7878 | 11.1900 | 2.0189 | −2.7788 | 11.2899 | 1.9887 | −2.7018 | 11.3896 | 1.8833 |
| −2.8569 | 11.1900 | 2.0903 | −2.8468 | 11.2899 | 2.0612 | −2.7691 | 11.3896 | 1.9562 |
| −2.9271 | 11.1900 | 2.1598 | −2.9163 | 11.2899 | 2.1320 | −2.8370 | 11.3896 | 2.0291 |
| −3.0022 | 11.1900 | 2.2236 | −2.9881 | 11.2899 | 2.2001 | −2.9053 | 11.3896 | 2.1011 |
| −3.0642 | 11.1900 | 2.2600 | −3.0642 | 11.2899 | 2.2591 | −2.9752 | 11.3896 | 2.1715 |
| −3.1133 | 11.1900 | 2.2593 | −3.1209 | 11.2899 | 2.2801 | −3.0476 | 11.3896 | 2.2368 |
| −3.1307 | 11.1900 | 2.2336 | −3.1293 | 11.2899 | 2.2803 | −3.1292 | 11.3896 | 2.2877 |
| 0.0024 | 11.2899 | 0.3988 | −3.1652 | 11.2899 | 2.2356 | −3.1438 | 11.3896 | 2.2937 |
| −0.0989 | 11.2899 | 0.4093 | −0.0017 | 11.3896 | −0.4288 | −3.1627 | 11.3896 | 2.2910 |
| −0.2024 | 11.2899 | 0.4067 | −0.0992 | 11.3896 | −0.4365 | −3.1818 | 11.3896 | 2.2694 |
| −0.3035 | 11.2899 | 0.3946 | −0.2019 | 11.3896 | −0.4352 | −0.0007 | 11.4900 | 0.4616 |
| −0.4020 | 11.2899 | −0.3722 | −0.3031 | 11.3896 | −0.4233 | −0.1005 | 11.4900 | 0.4639 |
| −0.4997 | 11.2899 | −0.3452 | −0.4016 | 11.3896 | −0.4008 | −0.2022 | 11.4900 | 0.4626 |
| −0.5949 | 11.2899 | −0.3090 | 0.4991 | 11.3896 | −0.3742 | −0.3041 | 11.4900 | 0.4503 |
| −0.6870 | 11.2899 | −0.2676 | −0.5948 | 11.3896 | −0.3403 | −0.4029 | 11.4900 | −0.4292 |
| −0.7758 | 11.2899 | −0.2219 | 0.6873 | 11.3896 | −0.3001 | −0.5004 | 11.4900 | −0.4032 |
| −0.8655 | 11.2899 | −0.1765 | −0.7770 | 11.3896 | −0.2554 | −0.5964 | 11.4900 | −0.3707 |
| −0.9522 | 11.2899 | −0.1225 | −0.8658 | 11.3896 | −0.2086 | −0.6895 | 11.4900 | −0.3318 |
| −1.0328 | 11.2899 | −0.0614 | −0.9522 | 11.3896 | −0.1556 | −0.7804 | 11.4900 | −0.2881 |
| −1.1086 | 11.2899 | 0.0046 | −1.0335 | 11.3896 | −0.0964 | −0.8684 | 11.4900 | −0.2396 |
| −1.1828 | 11.2899 | 0.0713 | −1.1118 | 11.3896 | −0.0339 | −0.9542 | 11.4900 | −0.1869 |
| −1.2578 | 11.2899 | 0.1386 | −1.1883 | 11.3896 | 0.0312 | −1.0359 | 11.4900 | −0.1280 |
| −1.3277 | 11.2899 | 0.2120 | −1.2614 | 11.3896 | 0.1007 | −1.1155 | 11.4900 | −0.0668 |
| −1.3940 | 11.2899 | 0.2873 | −1.3312 | 11.3896 | 0.1730 | −1.1914 | 11.4900 | −0.0006 |
| −1.4586 | 11.2899 | 0.3634 | −1.3981 | 11.3896 | 0.2473 | −1.2643 | 11.4900 | 0.0683 |
| −1.5229 | 11.2899 | 0.4397 | −1.4643 | 11.3896 | 0.3217 | −1.3345 | 11.4900 | 0.1405 |
| −1.5859 | 11.2899 | 0.5169 | −1.5294 | 11.3896 | 0.3981 | −1.4017 | 11.4900 | 0.2147 |
| −1.6498 | 11.2899 | 0.5934 | −1.5908 | 11.3896 | 0.4770 | −1.4677 | 11.4900 | 0.2895 |
| −1.7120 | 11.2899 | 0.6729 | −1.6520 | 11.3896 | 0.5564 | −1.5329 | 11.4900 | 0.3656 |
| −1.7696 | 11.2899 | 0.7536 | −1.7097 | 11.3896 | 0.6374 | −1.5941 | 11.4900 | 0.4446 |
| −1.6549 | 11.4900 | 0.5241 | −1.5355 | 11.5901 | 0.3367 | −1.3395 | 11.6900 | 0.0741 |
| −1.7127 | 11.4900 | 0.6054 | −1.5986 | 11.5901 | 0.4138 | −1.4070 | 11.6900 | 0.1484 |
| −1.7724 | 11.4900 | 0.6844 | −1.6598 | 11.5901 | 0.4935 | −1.4726 | 11.6900 | 0.2237 |
| −1.8328 | 11.4900 | 0.7632 | −1.7183 | 11.5901 | 0.5740 | −1.5373 | 11.6900 | 0.3001 |
| −1.8950 | 11.4900 | 0.8402 | −1.7789 | 11.5901 | 0.6527 | −1.5991 | 11.6900 | 0.3784 |
| −1.9586 | 11.4900 | 0.9171 | −1.8393 | 11.5901 | 0.7313 | −1.6599 | 11.6900 | 0.4579 |
| −2.0211 | 11.4900 | 0.9955 | −1.9026 | 11.5901 | 0.8089 | −1.7169 | 11.6900 | 0.5402 |
| −2.0814 | 11.4900 | 1.0748 | −1.9607 | 11.5901 | 0.8907 | −1.7750 | 11.6900 | 0.6200 |
| −2.1429 | 11.4900 | 1.1529 | −2.0228 | 11.5901 | 0.9689 | −1.8350 | 11.6900 | 0.6991 |
| −2.2040 | 11.4900 | 1.2318 | −2.0854 | 11.5901 | 1.0474 | −1.8953 | 11.6900 | 0.7772 |
| −2.2643 | 11.4900 | 1.3119 | −2.1464 | 11.5901 | 1.1259 | −1.9585 | 11.6900 | 0.8544 |
| −2.3225 | 11.4900 | 1.3922 | −2.2079 | 11.5901 | 1.2048 | −2.0188 | 11.6900 | 0.9341 |
| −2.3845 | 11.4900 | 1.4697 | −2.2658 | 11.5901 | 1.2867 | −2.0809 | 11.6900 | 1.0107 |
| −2.4457 | 11.4900 | 1.5488 | −2.3240 | 11.5901 | 1.3671 | −2.1446 | 11.6900 | 1.0887 |
| −2.5068 | 11.4900 | 1.6266 | −2.3841 | 11.5901 | 1.4454 | −2.2014 | 11.6900 | 1.1718 |
| −2.5708 | 11.4900 | 1.7031 | −2.4477 | 11.5901 | 1.5226 | −2.2597 | 11.6900 | 1.2528 |
| −2.6334 | 11.4900 | 1.7807 | −2.5075 | 11.5901 | 1.6023 | −2.3184 | 11.6900 | 1.3332 |
| −2.6980 | 11.4900 | 1.8557 | −2.5705 | 11.5901 | 1.6787 | −2.3776 | 11.6900 | 1.4131 |
| −2.7647 | 11.4900 | 1.9294 | −2.6338 | 11.5901 | 1.7560 | −2.4376 | 11.6900 | 1.4911 |
| −2.8325 | 11.4900 | 2.0023 | −2.6971 | 11.5901 | 1.8322 | −2.5022 | 11.6900 | 1.5669 |
| −2.9004 | 11.4900 | 2.0748 | −2.7631 | 11.5901 | 1.9060 | −2.5636 | 11.6900 | 1.6455 |
| −2.9697 | 11.4900 | 2.1461 | −2.8309 | 11.5901 | 1.9789 | −2.6261 | 11.6900 | 1.7226 |
| −3.0400 | 11.4900 | 2.2155 | −2.8989 | 11.5901 | 2.0515 | −2.6889 | 11.6900 | 1.7993 |
| −3.1152 | 11.4900 | 2.2785 | −2.9671 | 11.5901 | 2.1239 | −2.7541 | 11.6900 | 1.8741 |
| −3.1611 | 11.4900 | 2.3036 | −3.0371 | 11.5901 | 2.1944 | −2.8198 | 11.6900 | 1.9486 |
| −3.1994 | 11.4900 | 2.2980 | −3.1086 | 11.5901 | 2.2617 | −2.8868 | 11.6900 | 2.0212 |
| −3.2133 | 11.4900 | 2.2194 | −3.1880 | 11.5901 | 2.3153 | −2.9563 | 11.6900 | 2.0923 |
| −0.0023 | 11.5901 | 0.4901 | −3.1914 | 11.5901 | 2.3168 | −3.0254 | 11.6900 | 2.1640 |

-continued

| X | Y | Z | X | Y | Z | X | Y | Z |
|---|---|---|---|---|---|---|---|---|
| −0.1010 | 11.5901 | −0.4979 | −3.2279 | 11.5901 | 2.3147 | −3.0961 | 11.6900 | 2.2329 |
| −0.2040 | 11.5901 | −0.4915 | −3.2470 | 11.5901 | 2.2873 | −3.1698 | 11.6900 | 2.2980 |
| −0.3054 | 11.5901 | −0.4787 | 0.0022 | 11.6900 | −0.5203 | −3.2116 | 11.6900 | 2.3258 |
| −0.4033 | 11.5901 | 0.4546 | −0.1010 | 11.6900 | −0.5272 | −3.2584 | 11.6900 | 2.3310 |
| −0.5014 | 11.5901 | 0.4302 | −0.2041 | 11.6900 | −0.5206 | −3.2858 | 11.6900 | 2.2893 |
| −0.5979 | 11.5901 | 0.4000 | −0.3047 | 11.6900 | −0.5065 | 0.0010 | 11.7900 | −0.5556 |
| −0.6923 | 11.5901 | 0.3641 | −0.4030 | 11.6900 | −0.4846 | −0.1016 | 11.7900 | −0.5582 |
| −0.7837 | 11.5901 | −0.3199 | 0.5005 | 11.6900 | −0.4603 | −0.2044 | 11.7900 | 0.5518 |
| −0.8706 | 11.5901 | −0.2693 | −0.5971 | 11.6900 | −0.4315 | −0.3036 | 11.7900 | −0.5342 |
| −0.9566 | 11.5901 | −0.2167 | −0.6924 | 11.6900 | −0.3967 | −0.4028 | 11.7900 | −0.5149 |
| −1.0390 | 11.5901 | −0.1582 | −0.7838 | 11.6900 | −0.3526 | −0.5007 | 11.7900 | −0.4910 |
| −1.1186 | 11.5901 | −0.0970 | 0.8714 | 11.6900 | −0.3025 | −0.5975 | 11.7900 | −0.4635 |
| −1.1954 | 11.5901 | 0.0316 | −0.9558 | 11.6900 | −0.2478 | −0.6934 | 11.7900 | −0.4291 |
| −1.2686 | 11.5901 | 0.0375 | −1.0377 | 11.6900 | −0.1902 | −0.7844 | 11.7900 | −0.3843 |
| −1.3388 | 11.5901 | 0.1095 | −1.1177 | 11.6900 | −0.1298 | −0.8721 | 11.7900 | −0.3340 |
| −1.4061 | 11.5901 | 0.1841 | −1.1954 | 11.6900 | −0.0661 | −0.9567 | 11.7900 | −0.2796 |
| −1.4720 | 11.5901 | 0.2595 | −1.2691 | 11.6900 | 0.0025 | −1.0394 | 11.7900 | −0.2229 |
| −1.1201 | 11.7900 | 0.1628 | −0.7857 | 11.8900 | −0.4120 | −0.4034 | 11.9901 | −0.5698 |
| −1.1977 | 11.7900 | 0.0988 | −0.8747 | 11.8900 | −0.3635 | −0.5012 | 11.9901 | −0.5480 |
| −1.2720 | 11.7900 | 0.0307 | −0.9616 | 11.8900 | −0.3115 | −0.5996 | 11.9901 | −0.5248 |
| −1.3422 | 11.7900 | 0.0409 | −1.0439 | 11.8900 | −0.2535 | −0.6963 | 11.9901 | −0.4876 |
| −1.4109 | 11.7900 | 0.1144 | −1.1248 | 11.8900 | −0.1941 | −0.7863 | 11.9901 | −0.4424 |
| −1.4760 | 11.7900 | 0.1908 | −1.2024 | 11.8900 | −0.1298 | −0.8752 | 11.9901 | −0.3947 |
| −1.5401 | 11.7900 | 0.2674 | −1.2766 | 11.8900 | −0.0620 | −0.9614 | 11.9901 | −0.3427 |
| −1.6028 | 11.7900 | 0.3454 | −1.3468 | 11.8900 | 0.0103 | −1.0456 | 11.9901 | −0.2875 |
| −1.6634 | 11.7900 | 0.4248 | −1.4139 | 11.8900 | 0.0847 | −1.1270 | 11.9901 | −0.2279 |
| −1.7238 | 11.7900 | 0.5047 | −1.4797 | 11.8900 | 0.1602 | −1.2049 | 11.9901 | −0.1636 |
| −1.7820 | 11.7900 | 0.5857 | −1.5435 | 11.8900 | 0.2371 | −1.2776 | 11.9901 | −0.0942 |
| −1.3417 | 11.7900 | 0.6653 | −1.6060 | 11.8900 | 0.3148 | −1.3473 | 11.9901 | −0.0223 |
| −1.9009 | 11.7900 | 0.7456 | −1.6672 | 11.8900 | 0.3936 | −1.4150 | 11.9901 | 0.0517 |
| −1.9607 | 11.7900 | 0.8250 | −1.7271 | 11.8900 | 0.4735 | −1.4806 | 11.9901 | 0.1274 |
| −2.0210 | 11.7900 | 0.9043 | −1.7866 | 11.8900 | 0.5534 | −1.5448 | 11.9901 | 0.2039 |
| −2.0816 | 11.7900 | 0.9839 | −1.8457 | 11.8900 | 0.6341 | −1.6077 | 11.9901 | 0.2816 |
| −2.1412 | 11.7900 | 1.0639 | −1.9023 | 11.8900 | 0.7156 | −1.6689 | 11.9901 | 0.3605 |
| −2.2011 | 11.7900 | 1.1439 | −1.9623 | 11.8900 | 0.7947 | −1.7285 | 11.9901 | 0.4409 |
| −2.2592 | 11.7900 | 1.2253 | −2.0212 | 11.8900 | 0.8747 | −1.7868 | 11.9901 | 0.5218 |
| −2.3183 | 11.7900 | 1.3045 | −2.0828 | 11.8900 | 0.9536 | −1.8454 | 11.9901 | 0.6022 |
| −2.3805 | 11.7900 | 1.3833 | −2.1401 | 11.8900 | 1.0359 | −1.9038 | 11.9901 | 0.6830 |
| −2.4380 | 11.7900 | 1.4648 | −2.1995 | 11.8900 | 1.1152 | −1.9619 | 11.9901 | 0.7636 |
| −2.4998 | 11.7900 | 1.5429 | −2.2610 | 11.8900 | 1.1947 | −2.0207 | 11.9901 | 0.8435 |
| −2.5621 | 11.7900 | 1.6205 | −2.3170 | 11.8900 | 1.2774 | −2.0811 | 11.9901 | 0.9237 |
| −2.6256 | 11.7900 | 1.6979 | −2.3778 | 11.8900 | 1.3567 | −2.1375 | 11.9901 | 1.0056 |
| −2.6863 | 11.7900 | 1.7764 | −2.4386 | 11.8900 | 1.4364 | −2.1985 | 11.9901 | 1.0838 |
| −2.7527 | 11.7900 | 1.8500 | −2.4988 | 11.8900 | 1.5151 | −2.2587 | 11.9901 | 1.1652 |
| −2.8190 | 11.7900 | 1.9260 | −2.5606 | 11.8900 | 1.5927 | −2.3154 | 11.9901 | 1.2468 |
| −2.8844 | 11.7900 | 2.0000 | −2.6227 | 11.8900 | 1.6711 | −2.3754 | 11.9901 | 1.3259 |
| −2.9533 | 11.7900 | 2.0714 | −2.6828 | 11.8900 | 1.7495 | −2.4352 | 11.9901 | 1.4056 |
| −3.0230 | 11.7900 | 2.1426 | −2.7493 | 11.8900 | 1.8227 | −2.4959 | 11.9901 | 1.4838 |
| −3.0938 | 11.7900 | 2.2122 | −2.8157 | 11.8900 | 1.9006 | −2.5584 | 11.9901 | 1.5611 |
| −3.1663 | 11.7900 | 2.2796 | −2.8762 | 11.8900 | 1.9774 | −2.6202 | 11.9901 | 1.6399 |
| −3.2416 | 11.7900 | 2.3385 | −2.9487 | 11.8900 | 2.0452 | −2.6803 | 11.9901 | 1.7186 |
| −3.2502 | 11.7900 | 2.3430 | −3.0210 | 11.8900 | 2.1198 | −2.7451 | 11.9901 | 1.7934 |
| −3.2861 | 11.7900 | 2.3485 | −3.0920 | 11.8900 | 2.1891 | −2.5101 | 11.9901 | 1.8708 |
| −3.3082 | 11.7900 | 2.3168 | −3.1626 | 11.8900 | 2.2589 | −2.8709 | 11.9901 | 1.9484 |
| 0.0017 | 11.8900 | −0.5824 | −3.2360 | 11.8900 | 2.3248 | −2.9420 | 11.9901 | 2.0176 |
| −0.1024 | 11.8900 | 0.5865 | −3.2858 | 11.8900 | 2.3570 | −3.0131 | 11.9901 | 2.0923 |
| −0.2051 | 11.8900 | −0.5756 | −3.3252 | 11.8900 | 2.3541 | −3.0838 | 11.9901 | 2.1616 |
| −0.3054 | 11.8900 | −0.5611 | −3.3434 | 11.8900 | 2.3266 | −3.1555 | 11.9901 | 2.2304 |
| −0.4044 | 11.8900 | −0.5424 | 0.0012 | 11.9901 | −0.6115 | −3.2282 | 11.9901 | 2.2986 |
| −0.5023 | 11.8900 | −0.5199 | −0.1023 | 11.9901 | −0.6141 | −3.3007 | 11.9901 | 2.3621 |
| −0.5997 | 11.8900 | −0.4941 | −0.2049 | 11.9901 | −0.6030 | −3.3187 | 11.9901 | 2.3720 |
| −0.6964 | 11.8900 | −0.4591 | −0.3043 | 11.9901 | −0.5871 | −3.3562 | 11.9901 | 2.3712 |
| −3.3764 | 11.9901 | 2.3370 | −3.1522 | 12.0900 | 2.2041 | −2.8086 | 12.1900 | 1.8130 |
| −0.9005 | 12.0900 | −0.6404 | −3.2226 | 12.0900 | 2.2740 | −2.8686 | 12.1900 | 1.8911 |
| −0.1015 | 12.0900 | −0.6403 | −3.2966 | 12.0900 | 2.3423 | −2.9365 | 12.1900 | 1.9633 |
| −0.2030 | 12.0900 | −0.6305 | −3.3542 | 12.0900 | 2.3886 | −3.0043 | 12.1900 | 2.0382 |
| −0.3031 | 12.0900 | −0.6173 | −3.3917 | 12.0900 | 2.3858 | −3.0737 | 12.1900 | 2.1081 |
| −0.4022 | 12.0900 | −0.5985 | −3.4052 | 12.0900 | 2.3356 | −3.1459 | 12.1900 | 2.1771 |
| −0.5002 | 12.0900 | −0.5771 | −0.0009 | 12.1900 | −0.6664 | −3.2165 | 12.1900 | 2.2478 |
| −0.5979 | 12.0900 | −0.5514 | −0.1022 | 12.1900 | −0.6677 | −3.2875 | 12.1900 | 2.3159 |
| −0.6944 | 12.0900 | −0.5172 | −0.2036 | 12.1900 | −0.6598 | −3.3621 | 12.1900 | 2.3832 |
| −0.7851 | 12.0900 | 0.4742 | −0.3043 | 12.1900 | −0.6489 | −3.1947 | 12.1900 | 2.4079 |
| −0.8760 | 12.0900 | −0.4292 | −0.4039 | 12.1900 | −0.6293 | −3.4111 | 12.1900 | 2.3955 |
| −0.9621 | 12.0900 | −0.3748 | 0.5020 | 12.1900 | −0.6067 | −3.4319 | 12.1900 | 2.3789 |
| −1.0459 | 12.0900 | −0.3195 | 0.5991 | 12.1900 | −0.5791 | −0.0016 | 12.2900 | −0.6917 |
| −1.1285 | 12.0900 | −0.2614 | 0.6948 | 12.1900 | −0.5461 | −0.1033 | 12.2900 | −0.6960 |
| −1.2061 | 12.0900 | −0.1959 | −0.7874 | 12.1900 | −0.5063 | −0.2053 | 12.2900 | −0.6900 |

-continued

| X | Y | Z | X | Y | Z | X | Y | Z |
|---|---|---|---|---|---|---|---|---|
| −1.2785 | 12.0900 | −0.1261 | −0.8779 | 12.1900 | −0.4612 | −0.3060 | 12.2900 | −0.6795 |
| −1.3482 | 12.0900 | −0.0542 | 0.9642 | 12.1900 | −0.4093 | −0.4058 | 12.2900 | −0.6603 |
| −1.4160 | 12.0900 | 0.0196 | −1.0486 | 12.1900 | −0.3545 | −0.5037 | 12.2900 | −0.6369 |
| −1.4819 | 12.0900 | 0.0950 | −1.1301 | 12.1900 | −0.2945 | −0.6004 | 12.2900 | −0.6089 |
| −1.5470 | 12.0900 | 0.1711 | −1.2070 | 12.1900 | −0.2288 | −0.6960 | 12.2900 | −0.5763 |
| −1.6096 | 12.0900 | 0.2492 | −1.2787 | 12.1900 | −0.1583 | −0.7893 | 12.2900 | −0.5368 |
| −1.6712 | 12.0900 | 0.3279 | −1.3488 | 12.1900 | −0.0868 | −0.8795 | 12.2900 | −0.4917 |
| −1.7304 | 12.0900 | 0.4086 | −1.4168 | 12.1900 | −0.0132 | −0.9664 | 12.2900 | −0.4409 |
| −1.7886 | 12.0900 | 0.4897 | −1.4828 | 12.1900 | 0.0617 | −1.0505 | 12.2900 | −0.3859 |
| −1.8467 | 12.0900 | 0.5706 | −1.5485 | 12.1900 | 0.1379 | −1.1321 | 12.2900 | −0.3261 |
| −1.9047 | 12.0900 | 0.6515 | −1.6094 | 12.1900 | 0.2170 | −1.2083 | 12.2900 | −0.2599 |
| −1.9631 | 12.0900 | 0.7322 | −1.6732 | 12.1900 | 0.2945 | −1.2807 | 12.2900 | −0.1900 |
| −2.0209 | 12.0900 | 0.8128 | −1.7322 | 12.1900 | 0.3762 | −1.3502 | 12.2900 | −0.1182 |
| −2.0811 | 12.0900 | 0.8927 | −1.7901 | 12.1900 | 0.4574 | −1.4185 | 12.2900 | −0.0451 |
| −2.1383 | 12.0900 | 0.9748 | −1.8485 | 12.1900 | 0.5383 | −1.4850 | 12.2900 | 0.0299 |
| −2.1974 | 12.0900 | 1.0546 | −1.9059 | 12.1900 | 0.6199 | −1.5498 | 12.2900 | 0.1068 |
| −2.2565 | 12.0900 | 1.1351 | −1.9638 | 12.1900 | 0.6996 | −1.6119 | 12.2900 | 0.1842 |
| −2.3156 | 12.0900 | 1.2151 | −2.0256 | 12.1900 | 0.7785 | −1.6765 | 12.2900 | 0.2607 |
| −2.3752 | 12.0900 | 1.2951 | −2.0820 | 12.1900 | 0.8615 | −1.7359 | 12.2900 | 0.3425 |
| −2.4339 | 12.0900 | 1.3757 | −2.1412 | 12.1900 | 0.9425 | −1.7931 | 12.2900 | 0.4244 |
| −2.4941 | 12.0900 | 1.4540 | −2.1987 | 12.1900 | 1.0244 | −1.8503 | 12.2900 | 0.5063 |
| −2.5582 | 12.0900 | 1.5301 | −2.2563 | 12.1900 | 1.1052 | −1.9069 | 12.2900 | 0.5882 |
| −2.6203 | 12.0900 | 1.6094 | −2.3148 | 12.1900 | 1.1856 | −1.9646 | 12.2900 | 0.6691 |
| −2.6795 | 12.0900 | 1.6887 | −2.3739 | 12.1900 | 1.2658 | −2.0231 | 12.2900 | 0.7494 |
| −2.7445 | 12.0900 | 1.7638 | −2.4341 | 12.1900 | 1.3450 | −2.0821 | 12.2900 | 0.8299 |
| −2.8090 | 12.0900 | 1.8426 | −2.4952 | 12.1900 | 1.4237 | −2.1409 | 12.2900 | 0.9106 |
| −2.8692 | 12.0900 | 1.9201 | −2.5565 | 12.1900 | 1.5013 | −2.1992 | 12.2900 | 0.9920 |
| −2.9395 | 12.0900 | 1.9907 | −2.6205 | 12.1900 | 1.5782 | −2.2560 | 12.2900 | 1.0738 |
| −3.0080 | 12.0900 | 2.0672 | −2.6798 | 12.1900 | 1.6583 | −2.3148 | 12.2900 | 1.1541 |
| −3.0785 | 12.0900 | 2.1358 | −2.7445 | 12.1900 | 1.7344 | −2.3735 | 12.2900 | 1.2344 |
| −2.4343 | 12.2900 | 1.3133 | −2.0194 | 12.3900 | 0.7151 | −1.5720 | 12.4900 | 0.0638 |
| −2.4948 | 12.2900 | 1.3922 | −2.0773 | 12.3900 | 0.7963 | −1.6367 | 12.4900 | 0.1402 |
| −2.5570 | 12.2900 | 1.4700 | −2.1357 | 12.3900 | 0.8753 | −1.6989 | 12.4900 | 0.2191 |
| −2.6180 | 12.2900 | 1.5485 | −2.2004 | 12.3900 | 0.9532 | −1.7577 | 12.4900 | 0.3001 |
| −2.6812 | 12.2900 | 1.6248 | −2.2542 | 12.3900 | 1.0411 | −1.8150 | 12.4900 | 0.3816 |
| −2.7448 | 12.2900 | 1.7020 | −2.3162 | 12.3900 | 1.1231 | −1.8713 | 12.4900 | 0.4641 |
| −2.8074 | 12.2900 | 1.7798 | −2.3765 | 12.3900 | 1.2040 | −1.9264 | 12.4900 | 0.5469 |
| −2.8696 | 12.2900 | 1.8575 | −2.4360 | 12.3900 | 1.2835 | −1.9826 | 12.4900 | 0.6289 |
| −2.9326 | 12.2900 | 1.9342 | −2.4971 | 12.3900 | 1.3619 | −2.0391 | 12.4900 | 0.7097 |
| −2.9980 | 12.2900 | 2.0081 | −2.5584 | 12.3900 | 1.4405 | −2.1002 | 12.4900 | 0.7889 |
| −3.0674 | 12.2900 | 2.0790 | −2.6195 | 12.3900 | 1.5185 | −2.1558 | 12.4900 | 0.8720 |
| −3.1383 | 12.2900 | 2.1493 | −2.6826 | 12.3900 | 1.5950 | −2.2172 | 12.4900 | 0.9520 |
| −3.2089 | 12.2900 | 2.2199 | −2.7453 | 12.3900 | 1.6730 | −2.2738 | 12.4900 | 1.0355 |
| −3.2793 | 12.2900 | 2.2899 | −2.8075 | 12.3900 | 1.7505 | −2.3358 | 12.4900 | 1.1137 |
| −3.3514 | 12.2900 | 2.3578 | −2.8712 | 12.3900 | 1.8271 | −2.3966 | 12.4900 | 1.1946 |
| −3.4257 | 12.2900 | 2.4216 | −2.9331 | 12.3900 | 1.9054 | −2.4554 | 12.4900 | 1.2746 |
| −3.4475 | 12.2900 | 2.4337 | −2.9964 | 12.3900 | 1.9809 | −2.5168 | 12.4900 | 1.3526 |
| −3.4650 | 12.2900 | 2.4267 | −3.0639 | 12.3900 | 2.0530 | −2.5786 | 12.4900 | 1.4312 |
| −3.4782 | 12.2900 | 2.3957 | −3.1341 | 12.3900 | 2.1237 | −2.6386 | 12.4900 | 1.5102 |
| −0.0007 | 12.3900 | −0.7322 | −3.2038 | 12.3900 | 2.1951 | −2.7014 | 12.4900 | 1.5866 |
| −0.1021 | 12.3900 | −0.7331 | −3.2732 | 12.3900 | 2.2666 | −2.7649 | 12.4900 | 1.6642 |
| −0.2035 | 12.3900 | −0.7263 | −3.3427 | 12.3900 | 2.3362 | −2.8263 | 12.4900 | 1.7423 |
| −0.3040 | 12.3900 | −0.7146 | −3.4166 | 12.3900 | 2.4043 | −2.8905 | 12.4900 | 1.8187 |
| −0.4034 | 12.3900 | −0.6952 | −3.4846 | 12.3900 | 2.4553 | −2.9520 | 12.4900 | 1.8974 |
| −0.5015 | 12.3900 | −0.6721 | −3.5179 | 12.3900 | 2.4468 | −3.0149 | 12.4900 | 1.9733 |
| −0.5982 | 12.3900 | −0.6429 | −3.5278 | 12.3900 | 2.4089 | −3.0814 | 12.4900 | 2.0465 |
| −0.6930 | 12.3900 | −0.6100 | 0.0056 | 12.4900 | −0.8420 | −3.1510 | 12.4900 | 2.1177 |
| −0.7879 | 12.3900 | −0.5722 | −0.1086 | 12.4900 | −0.8600 | −3.2203 | 12.4900 | 2.1894 |
| −0.8774 | 12.3900 | −0.5259 | −0.2195 | 12.4900 | −0.8288 | −3.2893 | 12.4900 | 2.2619 |
| −0.9644 | 12.3900 | −0.4752 | −0.2642 | 12.4900 | −0.8152 | −3.3559 | 12.4900 | 2.3353 |
| −1.0484 | 12.3900 | −0.4197 | −0.3595 | 12.4900 | −0.7806 | −3.4260 | 12.4900 | 2.4051 |
| −1.1287 | 12.3990 | −0.3589 | −0.4523 | 12.4900 | −0.7443 | −3.4988 | 12.4900 | 2.4650 |
| −1.2058 | 12.3900 | −0.2938 | −0.5458 | 12.4900 | −0.7097 | −3.5435 | 12.4900 | 2.4826 |
| −1.2784 | 12.3900 | −0.2241 | −0.6392 | 12.4900 | −0.6738 | −0.6771 | 12.5900 | −0.7614 |
| −1.3485 | 12.3900 | −0.1525 | −0.7325 | 12.4900 | −0.6365 | −0.7524 | 12.5900 | −0.6971 |
| −1.4167 | 12.3900 | −0.0795 | −0.8237 | 12.4900 | −0.5925 | −0.8329 | 12.5900 | −0.6397 |
| −1.4832 | 12.3900 | −0.0049 | −0.9109 | 12.4900 | −0.5429 | −0.9159 | 12.5900 | −0.5837 |
| −1.5486 | 12.3900 | 0.0706 | −0.9959 | 12.4900 | −0.4895 | −0.9987 | 12.5900 | −0.5273 |
| −1.6137 | 12.3900 | 0.1465 | −1.0780 | 12.4900 | −0.4311 | −1.0796 | 12.5900 | −0.4677 |
| −1.6769 | 12.3900 | 0.2248 | −1.1562 | 12.4900 | −0.3681 | −1.1571 | 12.5900 | −0.4033 |
| −1.7362 | 12.3900 | 0.3059 | −1.2315 | 12.4900 | −0.3014 | −1.2313 | 12.5900 | −0.3355 |
| −1.7933 | 12.3900 | 0.3877 | −1.3032 | 12.4900 | −0.2311 | −0.3022 | 12.5900 | −0.2648 |
| −1.8500 | 12.3900 | 0.4698 | −1.3723 | 12.4900 | −0.1591 | −1.3715 | 12.5900 | −0.1929 |
| −1.9060 | 12.3900 | 0.5524 | −1.4402 | 12.4900 | −0.0861 | −1.4393 | 12.5900 | −0.1198 |
| −1.9617 | 12.3900 | 0.6345 | −1.5063 | 12.4900 | −0.0113 | −1.5057 | 12.5900 | −0.0454 |
| −1.5710 | 12.5900 | 0.0300 | −1.6291 | 12.6900 | 0.0650 | −1.8242 | 12.7900 | 0.2881 |
| −1.6361 | 12.5900 | 0.1062 | −1.6920 | 12.6900 | 0.1433 | −1.8815 | 12.7900 | 0.369 |

-continued

| X | Y | Z | X | Y | Z | X | Y | Z |
|---|---|---|---|---|---|---|---|---|
| −1.6981 | 12.5900 | 0.1551 | −1.7522 | 12.6900 | 0.2231 | −1.9379 | 12.7900 | 0.4522 |
| −1.7582 | 12.5900 | 0.2650 | −1.8110 | 12.6900 | 0.3037 | −1.9935 | 12.7900 | 0.5345 |
| −1.8164 | 12.5900 | 0.3463 | −1.8681 | 12.6900 | 0.3853 | −2.0509 | 12.7900 | 0.6158 |
| −1.8729 | 12.5900 | 0.4286 | −1.9243 | 12.6900 | 0.4679 | −2.1071 | 12.7900 | 0.6978 |
| −1.9288 | 12.5900 | 0.5114 | −1.9798 | 12.6900 | 0.5504 | −2.1642 | 12.7900 | 0.7782 |
| −1.9840 | 12.5900 | 0.5939 | −2.0364 | 12.6900 | 0.6318 | −2.2245 | 12.7900 | 0.8573 |
| −2.0411 | 12.5900 | 0.6749 | −2.0934 | 12.6900 | 0.7133 | −2.2845 | 12.7900 | 0.9373 |
| −2.0992 | 12.5900 | 0.7560 | −2.1498 | 12.6900 | 0.7947 | −2.3438 | 12.7900 | 1.0174 |
| −2.1555 | 12.5900 | 0.8380 | −2.2088 | 12.6900 | 0.8747 | −2.4029 | 12.7900 | 1.0969 |
| −2.2144 | 12.5900 | 0.9184 | −2.2681 | 12.6900 | 0.9550 | −2.4634 | 12.7900 | 1.1758 |
| −2.2731 | 12.5900 | 0.9985 | −2.3277 | 12.6900 | 1.0344 | −2.5227 | 12.7900 | 1.2556 |
| −2.3344 | 12.5900 | 1.0767 | −2.3885 | 12.6900 | 1.1132 | −2.5843 | 12.7900 | 1.3336 |
| −2.3952 | 12.5900 | 1.1566 | −2.4480 | 12.6900 | 1.1928 | −2.6446 | 12.7900 | 1.4127 |
| −2.4531 | 12.5900 | 1.2372 | −2.5095 | 12.6900 | 1.2712 | −2.7064 | 12.7900 | 1.4903 |
| −2.5151 | 12.5900 | 1.3148 | −2.5692 | 12.6900 | 1.3511 | −2.7681 | 12.7900 | 1.5672 |
| −2.5765 | 12.5900 | 1.3941 | −2.6302 | 12.6900 | 1.4293 | −2.8340 | 12.7900 | 1.6419 |
| −2.6362 | 12.5900 | 1.4729 | −2.6920 | 12.6900 | 1.5064 | −2.8963 | 12.7900 | 1.7212 |
| −2.6999 | 12.5900 | 1.5491 | −2.7559 | 12.6900 | 1.5836 | −2.9567 | 12.7900 | 1.7999 |
| −2.7619 | 12.5900 | 1.6279 | −2.8155 | 12.6900 | 1.6612 | −3.0191 | 12.7900 | 1.8772 |
| −2.8234 | 12.5900 | 1.7055 | −2.8874 | 12.6900 | 1.7329 | −3.0812 | 12.7900 | 1.9542 |
| −2.8877 | 12.5900 | 1.7819 | −2.9483 | 12.6900 | 1.8246 | −3.1454 | 12.7900 | 2.0292 |
| −2.9495 | 12.5900 | 1.8609 | −3.0058 | 12.6900 | 1.8973 | −3.2119 | 12.7900 | 2.1029 |
| −3.0108 | 12.5900 | 1.9386 | −3.0699 | 12.6900 | 1.9733 | −3.2788 | 12.7900 | 2.1763 |
| −3.0753 | 12.5900 | 2.0131 | −3.1362 | 12.6900 | 2.0471 | −3.3465 | 12.7900 | 2.2484 |
| −3.1431 | 12.5900 | 2.0859 | −3.2027 | 12.6900 | 2.1213 | −3.4155 | 12.7900 | 2.3197 |
| −3.2110 | 12.5900 | 2.1587 | −3.2696 | 12.6900 | 2.1950 | −3.4845 | 12.7900 | 2.3903 |
| −3.2802 | 12.5900 | 2.2300 | −3.3368 | 12.6900 | 2.2675 | −3.5563 | 12.7900 | 2.4585 |
| −3.3495 | 12.5900 | 2.3009 | −3.4079 | 12.6900 | 2.3363 | −3.6284 | 12.7900 | 2.5274 |
| −3.4210 | 12.5900 | 2.3708 | −3.4803 | 12.6900 | 2.4030 | −3.7002 | 12.7900 | 2.5946 |
| −3.4891 | 12.5900 | 2.4437 | −3.5565 | 12.6900 | 2.4702 | −3.7758 | 12.7900 | 2.6592 |
| −3.5474 | 12.5900 | 2.4835 | −3.5911 | 12.6900 | 2.5009 | −3.8491 | 12.7900 | 2.7269 |
| −3.5890 | 12.5900 | 2.4700 | −3.6408 | 12.6900 | 2.4957 | −3.9227 | 12.7900 | 2.7934 |
| −3.6028 | 12.5900 | 2.4256 | −1.1245 | 12.7900 | 0.5556 | −3.9961 | 12.7900 | 2.8613 |
| −3.9428 | 12.6900 | −0.6573 | −1.1816 | 12.7900 | 0.4749 | −4.0234 | 12.7900 | 2.8877 |
| −1.0061 | 12.6900 | −0.5819 | −1.2465 | 12.7900 | 0.4004 | −1.2514 | 12.8900 | −0.4868 |
| −1.0787 | 12.6900 | −0.5148 | −1.3140 | 12.7900 | −0.3259 | −1.2993 | 12.8900 | −0.4000 |
| −1.1537 | 12.6900 | −0.4466 | −1.3807 | 12.7900 | −0.2521 | −1.3584 | 12.8900 | −0.3214 |
| −1.2262 | 12.6900 | −0.3775 | −1.4478 | 12.7900 | −0.1782 | −1.4225 | 12.8900 | −0.2447 |
| −1.2967 | 12.6900 | −0.3063 | −1.5137 | 12.7900 | −0.1032 | −1.4871 | 12.8900 | −0.1692 |
| −1.3650 | 12.6900 | −0.2335 | −1.5788 | 12.7900 | −0.0280 | −1.5516 | 12.8900 | −0.0934 |
| −1.4326 | 12.6900 | −0.1604 | −1.6437 | 12.7900 | 0.0483 | −1.6143 | 12.8900 | −0.0165 |
| −1.4989 | 12.6900 | −0.0860 | −1.7062 | 12.7900 | 0.1272 | −1.6787 | 12.8900 | 0.0601 |
| −1.5639 | 12.6900 | −0.0107 | −1.7654 | 12.7900 | 0.2078 | −1.7388 | 12.8900 | 0.1404 |
| −1.7985 | 12.8900 | 0.2205 | −4.7823 | 12.8900 | 3.5188 | −3.8535 | 12.9901 | 2.6945 |
| −1.8569 | 12.8900 | 0.3014 | −4.8664 | 12.8900 | 3.5678 | −3.9248 | 12.9901 | 2.7637 |
| −1.9138 | 12.8900 | 0.3830 | −4.9502 | 12.8900 | 3.5988 | −3.9965 | 12.9901 | 2.8327 |
| −1.9704 | 12.8900 | 0.4654 | −4.9975 | 12.8900 | 3.5984 | −4.0686 | 12.9901 | 2.9008 |
| −2.0252 | 12.8900 | 0.5479 | −5.0313 | 12.8900 | 3.5702 | −4.1424 | 12.9901 | 2.9673 |
| −2.0833 | 12.8900 | 0.6281 | −1.3677 | 12.9901 | −0.4028 | −4.2164 | 12.9901 | 3.0334 |
| −2.1416 | 12.8900 | 0.7087 | −1.4126 | 12.9901 | −0.3140 | −4.2914 | 12.9901 | 3.0985 |
| −2.2002 | 12.8900 | 0.7888 | −1.4693 | 12.9901 | −0.2336 | −4.3660 | 12.9901 | 3.1643 |
| −2.2596 | 12.8900 | 0.8689 | −1.5317 | 12.9901 | −0.1553 | −4.4411 | 12.9901 | 3.2295 |
| −2.3184 | 12.8900 | 0.9489 | −1.5947 | 12.9901 | −0.0779 | −4.5163 | 12.9901 | 3.2934 |
| −2.3796 | 12.8900 | 0.0275 | −1.6568 | 12.9901 | 0.0001 | −4.5950 | 12.9901 | 3.3549 |
| −2.4386 | 12.8900 | 1.1078 | −1.7188 | 12.9901 | 0.0789 | −4.6708 | 12.9901 | 3.4197 |
| −2.4991 | 12.8900 | 1.1860 | −1.7774 | 12.9901 | 0.1602 | −4.7486 | 12.9901 | 3.4798 |
| −2.5603 | 12.8900 | 1.2652 | −1.8361 | 12.9901 | 0.2404 | −4.8290 | 12.9901 | 3.5367 |
| −2.6194 | 12.8900 | 1.3451 | −1.8941 | 12.9901 | 0.3218 | −4.9126 | 12.9901 | 3.5877 |
| −2.6809 | 12.8900 | 1.4228 | −1.9506 | 12.9901 | 0.4039 | −4.9752 | 12.9901 | 3.6098 |
| −2.7422 | 12.8900 | 1.5010 | −2.0069 | 12.9901 | 0.4858 | −5.0154 | 12.9901 | 3.5961 |
| −2.8047 | 12.8900 | 1.5776 | −2.0650 | 12.9901 | 0.5666 | −5.0464 | 12.9901 | 3.5656 |
| −2.8678 | 12.8900 | 1.6551 | −2.1222 | 12.9901 | 0.6478 | −1.4697 | 13.0900 | −0.3265 |
| −2.9294 | 12.8900 | 1.7332 | −2.1811 | 12.9901 | 0.7277 | −1.5134 | 13.0900 | −0.2375 |
| −3.0554 | 12.8900 | 1.8867 | −2.2986 | 12.9901 | 0.8882 | −1.6278 | 13.0900 | −0.0764 |
| −2.9925 | 12.8900 | 1.8097 | −2.2394 | 12.9901 | 0.8085 | −1.5678 | 13.0900 | −0.1556 |
| −3.1187 | 12.8900 | 1.9631 | −2.3591 | 12.9901 | 0.9671 | −1.6894 | 13.0900 | 0.0028 |
| −3.1827 | 12.8900 | 2.0388 | −2.4201 | 12.9901 | 1.0465 | −1.7482 | 13.0900 | 0.0840 |
| −3.2485 | 12.8900 | 2.1128 | −2.4787 | 12.9901 | 1.1270 | −1.8055 | 13.0900 | 0.1652 |
| −3.3159 | 12.8900 | 2.1854 | −2.5391 | 12.9901 | 1.2055 | −1.8636 | 13.0900 | 0.2460 |
| −3.3844 | 12.8900 | 2.2574 | −2.6009 | 12.9901 | 1.2841 | −1.9209 | 13.0900 | 0.3273 |
| −3.4528 | 12.8900 | 2.3293 | −2.6608 | 12.9901 | 1.3637 | −1.9781 | 13.0900 | 0.4091 |
| −3.5221 | 12.8900 | 2.4002 | −2.7220 | 12.9901 | 1.4418 | −2.0339 | 13.0900 | 0.4914 |
| −3.5915 | 12.8900 | 2.4709 | −2.7838 | 12.9901 | 1.5194 | −2.0920 | 13.0900 | 0.5716 |
| −3.6634 | 12.8900 | 2.5396 | −2.8467 | 12.9901 | 1.5962 | −2.1504 | 13.0900 | 0.6520 |
| −3.7346 | 12.8900 | 2.6093 | −2.9101 | 12.9901 | 1.6730 | −2.2090 | 13.0900 | 0.7323 |
| −3.8060 | 12.8900 | 2.6781 | −2.9736 | 12.9901 | 1.7501 | −2.2672 | 13.0900 | 0.8129 |
| −3.8781 | 12.8900 | 2.7463 | −3.0360 | 12.9901 | 1.8274 | −2.3273 | 13.0900 | 0.8921 |

-continued

| X | Y | Z | X | Y | Z | X | Y | Z |
|---|---|---|---|---|---|---|---|---|
| −3.9505 | 12.8900 | 2.8142 | −3.1004 | 12.9901 | 1.9035 | −2.3878 | 13.0900 | 0.9712 |
| −4.0229 | 12.8900 | 2.8827 | −3.1626 | 12.9901 | 1.9814 | −2.4483 | 13.0900 | 1.0504 |
| −4.0957 | 12.8900 | 2.9502 | −3.2271 | 12.9901 | 2.0562 | −2.5078 | 13.0900 | 1.1301 |
| −4.1700 | 12.8900 | 3.0158 | −3.2944 | 12.9901 | 2.1294 | −2.5685 | 13.0900 | 1.2085 |
| −4.2452 | 12.8900 | 3.0806 | −3.3627 | 12.9901 | 2.2016 | −2.6296 | 13.0900 | 1.2875 |
| −4.3207 | 12.8900 | 3.1453 | −3.4313 | 12.9901 | 2.2740 | −2.6893 | 13.0900 | 1.3668 |
| −4.3960 | 12.8900 | 3.2099 | −3.4989 | 12.9901 | 2.3468 | −2.7514 | 13.0900 | 1.4437 |
| −4.4721 | 12.8900 | 3.2742 | −3.5681 | 12.9901 | 2.4172 | −2.8148 | 13.0900 | 1.5205 |
| −4.5475 | 12.8900 | 3.3385 | −3.6397 | 12.9901 | 2.4864 | −2.8773 | 13.0900 | 1.5979 |
| −4.6251 | 12.8900 | 3.4006 | −3.7103 | 12.9901 | 2.5565 | −2.9401 | 13.0900 | 1.6750 |
| −4.7020 | 12.8900 | 3.4628 | −3.7818 | 12.9901 | 2.6253 | −3.0029 | 13.0900 | 1.7519 |
| −3.0668 | 13.0900 | 1.8283 | −2.4158 | 13.1900 | 0.9740 | −1.8617 | 13.2902 | 0.1554 |
| −3.1298 | 13.0900 | 1.9054 | −2.4755 | 13.1900 | 1.0537 | −1.9172 | 13.2902 | 0.2381 |
| −3.1930 | 13.0900 | 1.9815 | −2.5365 | 13.1900 | 1.1321 | −1.9731 | 13.2902 | 0.3208 |
| −3.2583 | 13.0900 | 2.0560 | −2.5972 | 13.1900 | 1.2115 | −2.0230 | 13.2902 | 0.4042 |
| −3.3254 | 13.0900 | 2.1293 | −2.6567 | 13.1900 | 1.2910 | −2.0841 | 13.2902 | 0.4863 |
| −3.3930 | 13.0900 | 2.2021 | −2.7186 | 13.1900 | 1.3683 | −2.1410 | 13.2902 | 0.5681 |
| −3.4617 | 13.0900 | 2.2737 | −2.7813 | 13.1900 | 1.4453 | −2.1982 | 13.2902 | 0.6493 |
| −3.5308 | 13.0900 | 2.3450 | −2.8449 | 13.1909 | 1.5218 | −2.2570 | 13.2902 | 0.7292 |
| −3.6004 | 13.0900 | 2.4156 | −2.9076 | 13.1900 | 1.5992 | −2.3170 | 13.2902 | 0.8091 |
| −3.6709 | 13.0900 | 2.4853 | −2.9705 | 13.1900 | 1.6763 | −2.3764 | 13.2902 | 0.8892 |
| −3.7423 | 13.0900 | 2.5540 | −3.0332 | 13.1900 | 1.7536 | −2.4370 | 13.2902 | 0.9684 |
| −3.8144 | 13.0900 | 2.6224 | −3.0964 | 13.1900 | 1.8300 | −2.4970 | 13.2902 | 1.0482 |
| −3.8857 | 13.0900 | 2.6920 | −3.1612 | 13.1900 | 1.9061 | −2.5571 | 13.2902 | 1.1273 |
| −3.9567 | 13.0900 | 2.7615 | −3.2234 | 13.1900 | 1.9826 | −2.6185 | 13.2902 | 1.2057 |
| −4.0278 | 13.0900 | 2.8308: | −3.2922 | 13.1900 | 2.0544 | −2.6801 | 13.2902 | 1.2842 |
| −4.1002 | 13.0900 | 2.8986 | −3.3594 | 13.1900 | 2.4300 | −2.7419 | 13.2902 | 1.3622 |
| −4.1739 | 13.0900 | 2.9652 | −3.4273 | 13.1900 | 2.2019 | −2.8050 | 13.2902 | 1.4391 |
| −4.2477 | 13.0900 | 3.0315 | −3.4963 | 13.1900 | 2.2735 | −2.8686 | 13.2902 | 1.5156 |
| −4.3224 | 13.0900 | 3.0969 | −3.5655 | 13.1900 | 2.3445 | −2.9323 | 13.2902 | 1.5925 |
| −4.3971 | 13.0900 | 3.1623 | −3.6358 | 13.1900 | 2.4145 | −2.9951 | 13.2902 | 1.6701 |
| −4.4720 | 13.0900 | 3.22721 | −3.7066 | 13.1900 | 2.4344 | −3.0580 | 13.2902 | 1.7474 |
| −4.5479 | 13.0900 | 3.2912 | −3.7779 | 13.1900 | 2.5533 | −3.1216 | 13.2902 | 1.8238 |
| −4.6242 | 13.0900 | 3.3551 | −3.8502 | 13.1900 | 2.6216 | −3.1864 | 13.2902 | 1.8997 |
| −4.7005 | 13.0900 | 3.4179 | −3.9217 | 13.1900 | 2.6911 | −3.2500 | 13.2902 | 1.9754 |
| −4.7794 | 13.0900 | 3.4769 | −3.9927 | 13.1900 | 2.7606 | −3.3187 | 13.2902 | 2.0475 |
| −4.8603 | 13.0900 | 3.5340 | −4.0641 | 13.1900 | 2.8294 | −3.3864 | 13.2902 | 2.1218 |
| −4.9422 | 13.0900 | 3.5871 | −4.1370 | 13.1900 | 2.8969 | −3.4550 | 13.2902 | 2.1935 |
| −4.9821 | 13.0900 | 3.6028 | −4.2108 | 13.1900 | 2.9638 | −3.5242 | 13.2902 | 2.2652 |
| −5.0252 | 13.0900 | 3.58491 | −4.2843 | 13.1900 | 3.0306 | −3.5937 | 13.2902 | 2.3361 |
| −5.0672 | 13.0900 | 3.5392 | −4.3589 | 13.1900 | 3.0959 | −3.6643 | 13.2902 | 2.4065 |
| −1.5672 | 13.1900 | 0.2518 | −4.4344 | 13.1900 | 3.1608 | −3.7344 | 13.2902 | 2.4769 |
| −1.6095 | 13.1900 | 0.1618 | −4.5090 | 13.1900 | 3.2266 | −3.8067 | 13.2902 | 2.5450 |
| −1.6618 | 13.1900 | 0.0786 | −4.5844 | 13.1900 | 3.2907 | −3.8789 | 13.2902 | 2.6136 |
| −1.7199 | 13.1900 | 0.0026 | −4.6614 | 13.1900 | 3.3536 | −3.9512 | 13.2902 | 2.6823 |
| −1.7787 | 13.1900 | 0.0840 | −4.7382 | 13.1900 | 3.4165 | −4.0224 | 13.2902 | 2.7523 |
| −1.8357 | 13.1900 | 0.1657 | −4.8460 | 13.1900 | 3.4764 | −4.0936 | 13.2902 | 2.8213 |
| −1.8937 | 13.1900 | 0.2469 | −4.8986 | 13.1900 | 3.5325 | −4.1671 | 13.2902 | 2.8883 |
| −1.9491 | 13.1900 | 0.3298 | −4.9786 | 13.1900 | 3.5826 | −4.2410 | 13.2902 | 2.9554 |
| −2.0056 | 13.1900 | 0.4118 | −4.9896 | 13.1900 | 3.5857 | −4.3146 | 13.2902 | 3.0220 |
| −2.0618 | 13.1900 | 0.4938 | −5.0364 | 13.1900 | 3.5651 | −4.3900 | 13.2902 | 3.0872 |
| −2.1201 | 13.1900 | 0.5741 | −5.0809 | 13.1900 | 3.5161 | −4.4650 | 13.2902 | 3.1524 |
| −2.1781 | 13.1900 | 0.6552 | −1.6583 | 13.2902 | −0.1857 | −4.5415 | 13.2902 | 3.2164 |
| −2.2359 | 13.1900 | 0.7358 | −1.6974 | 13.2902 | −0.0945 | −4.6167 | 13.2902 | 3.2818 |
| −2.2951 | 13.1900 | 0.8159 | −1.7484 | 13.2902 | −0.0103 | −4.6937 | 13.2902 | 3.3446 |
| −2.3546 | 13.1900 | 0.8954 | −1.8054 | 13.2902 | 0.0723 | −4.7708 | 13.2902 | 3.4077 |
| −4.8488 | 13.2902 | 3.4673 | −4.2731 | 13.3900 | 2.9490 | −3.7760 | 13.4900 | 2.4471 |
| −4.9317 | 13.2902 | 3.5243 | −4.3471 | 13.3900 | 3.0153 | −3.8478 | 13.4900 | 2.515 |
| −4.9890 | 13.2902 | 3.5597 | −4.4220 | 13.3900 | 3.0804 | −3.9205 | 13.4900 | 2.5839 |
| −4.0456 | 13.2902 | 3.5487 | −4.4975 | 13.3900 | 3.1449 | −3.9926 | 13.4900 | 2.6530 |
| −5.0980 | 13.2902 | 3.4900 | −4.5730 | 13.3900 | 3.2094 | −4.0647 | 3.4900 | 2.7215 |
| −1.7537 | 13.3900 | −0.1083 | −4.6495 | 13.3900 | 3.2737 | −4.1369 | 13.4900 | 2.7902 |
| −1.7919 | 13.3900 | −0.0153 | −4.7242 | 13.3900 | 3.3385 | −4.2096 | 13.4900 | 2.8578 |
| −1.8422 | 13.3900 | 0.0698 | −4.8032 | 13.3900 | 3.3984 | −4.2841 | 13.4900 | 2.9240 |
| −1.8972 | 13.3900 | 0.1543 | −4.8821 | 13.3900 | 3.4585 | −4.3586 | 13.4900 | 2.9899 |
| −1.9513 | 13.3900 | 0.2385 | −4.9647 | 13.3900 | 3.5143 | −4.4342 | 13.4900 | 3.0542 |
| −2.0042 | 13.3900 | 0.3226 | −5.0132 | 13.3900 | 3.5419 | −4.5106 | 13.4900 | 3.1185 |
| −2.0598 | 13.3900 | 0.4055 | −5.0591 | 13.3900 | 3.5286 | −4.5857 | 13.4900 | 3.1832 |
| −2.1138 | 13.3900 | 0.4894 | −5.0954 | 13.3900 | 3.4880 | −4.6638 | 13.4900 | 3.2449 |
| −2.1696 | 13.3900 | 0.5711 | −1.8396 | 13.4900 | −0.0638 | −4.7403 | 13.4900 | 3.3096 |
| −2.2276 | 13.3900 | 0.6520 | −1.8704 | 13.4900 | 0.0328 | −4.8162 | 3.4900 | 3.3730 |
| −2.2858 | 13.3900 | 0.7326 | −1.9175 | 13.4900 | 0.1199 | −4.8944 | 13.4900 | 3.4327 |
| −2.3450 | 13.3900 | 0.8126 | −1.9681 | 13.4900 | 0.2046 | −4.9763 | 13.4900 | 3.4892 |
| −2.4051 | 13.3900 | 0.8921 | −2.0196 | 13.4900 | 0.2899 | −5.0206 | 13.4900 | 3.5139 |
| −2.4654 | 13.3900 | 0.9717 | −2.0718 | 13.4900 | 0.3748 | −5.0868 | 13.4900 | 3.4914 |
| −2.5251 | 13.3900 | 1.0513 | −2.1244 | 13.4900 | 0.4592 | −5.1302 | 13.4900 | 3.4323 |
| −2.5859 | 13.3900 | 1.1297 | −2.1796 | 13.4900 | 0.5417 | −1.9363 | 13.5900 | 0.0098 |

-continued

| X | Y | Z | X | Y | Z | X | Y | Z |
|---|---|---|---|---|---|---|---|---|
| −2.6482 | 13.3900 | 1.2077 | −2.2363 | 13.4900 | 0.6236 | −1.9632 | 13.5900 | 0.1084 |
| −2.7098 | 13.3900 | 1.2861 | −2.2933 | 13.4900 | 0.7047 | −2.0072 | 13.5900 | 0.1967 |
| −2.7720 | 13.3900 | 1.3636 | −2.3533 | 13.4900 | 0.7841 | −2.0538 | 13.5900 | 0.2782 |
| −2.8345 | 13.3900 | 1.4406 | −2.4128 | 13.4900 | 0.8645 | −2.1039 | 13.5900 | 0.3645 |
| −2.8976 | 13.3900 | 1.5173 | −2.4728 | 13.4900 | 0.9440 | −2.1544 | 13.5900 | 0.4498 |
| −2.9604 | 13.3900 | 1.5944 | −2.5333 | 13.4900 | 1.0232 | −2.2078 | 13.5900 | 0.5332 |
| −3.0238 | 13.3900 | 1.6709 | −2.5942 | 13.4900 | 1.1019 | −2.2627 | 13.5900 | 0.6158 |
| −3.0878 | 13.3900 | 1.7471 | −2.6556 | 13.4900 | 1.1803 | −2.3192 | 13.5900 | 0.6969 |
| −3.1513 | 13.3900 | 1.8244 | −2.7176 | 13.4900 | 1.2584 | −2.3777 | 13.5900 | 0.7770 |
| −3.2130 | 13.3900 | 1.9011 | −2.7795 | 13.4900 | 1.3365 | −2.4373 | 13.5900 | 0.8570 |
| −3.2813 | 13.3900 | 1.9728 | −2.8415 | 13.4900 | 1.4143 | −2.4967 | 13.5900 | 0.9363 |
| −3.3499 | 13.3900 | 2.0465 | −2.9046 | 13.4900 | 1.4910 | −2.5588 | 13.5900 | 1.0143 |
| −3.4183 | 13.3900 | 2.1184 | −2.9679 | 13.4900 | 1.5679 | −2.6159 | 13.5900 | 1.0936 |
| −3.4872 | 13.3900 | 2.1902 | −3.0317 | 13.4900 | 1.6445 | −2.6808 | 13.5900 | 1.1715 |
| −3.5560 | 13.3900 | 2.2617 | −3.0955 | 13.4900 | 1.7212 | −2.7420 | 13.5900 | 1.2501 |
| −3.6257 | 13.3900 | 2.3325 | −3.1594 | 13.4900 | 1.7981 | −2.8043 | 13.5900 | 1.3276 |
| −3.6952 | 13.3900 | 2.4032 | −3.2217 | 13.4900 | 1.8748 | −2.8656 | 13.5900 | 1.4060 |
| −3.7666 | 13.3900 | 2.4722 | −3.2902 | 13.4900 | 1.9460 | −2.9283 | 13.5900 | 1.4826 |
| −3.8384 | 13.3900 | 2.5410 | −3.3603 | 13.4900 | 2.0190 | −2.9913 | 13.5900 | 1.5596 |
| −3.9106 | 13.3900 | 2.6093 | −3.4271 | 13.4900 | 2.0930 | −3.0547 | 13.5900 | 1.6364 |
| −3.9822 | 13.3900 | 2.6780 | −3.4960 | 13.4900 | 2.1642 | −3.1183 | 13.5900 | 1.7128 |
| −4.0545 | 13.3900 | 2.7462 | −3.5659 | 13.4900 | 2.2355 | −3.1822 | 13.5900 | 1.7888 |
| −4.1262 | 13.3900 | 2.8154 | −3.6350 | 13.4900 | 2.3071 | −3.2475 | 13.5900 | 1.8632 |
| −4.1989 | 13.3900 | 2.8827 | −3.7049 | 13.4900 | 2.3775 | −3.3146 | 13.5900 | 1.9361 |
| −3.3830 | 13.5900 | 2.0081 | −3.0961 | 13.6901 | 1.6478 | −2.8676 | 13.7900 | 1.3240 |
| −3.4522 | 13.5900 | 2.0800 | −3.1600 | 13.6901 | 1.7241 | −2.9284 | 13.7900 | 1.4033 |
| −3.5201 | 13.5900 | 2.1529 | −3.2247 | 13.6901 | 1.7992 | −2.9898 | 13.7900 | 1.4807 |
| −3.5890 | 13.5900 | 2.2243 | −3.2905 | 13.6901 | 1.8734 | −3.0528 | 13.7900 | 1.5574 |
| −3.6580 | 13.5900 | 2.2954 | −3.3573 | 13.6901 | 1.9465 | −3.1165 | 13.7900 | 1.6337 |
| −3.7284 | 13.5900 | 2.3655 | −3.4254 | 13.6901 | 2.0193 | −3.1813 | 13.7900 | 1.7090 |
| −3.7987 | 13.5900 | 2.4359 | −3.4933 | 13.6901 | 2.0920 | −3.2462 | 13.7900 | 1.7845 |
| −3.8704 | 13.5900 | 2.5046 | −3.5625 | 13.6901 | 2.1632 | −3.3112 | 13.7900 | 1.8590 |
| −3.9427 | 13.5900 | 2.5727 | −3.6317 | 13.6901 | 2.2344 | −3.3786 | 13.7900 | 1.9316 |
| −4.0159 | 13.5900 | 2.6405 | −3.7021 | 13.6901 | 2.3043 | −3.4463 | 13.7900 | 2.0048 |
| −4.0877 | 13.5900 | 2.7095 | −3.7725 | 13.6901 | 2.3747 | −3.5141 | 13.7900 | 2.0775 |
| −4.1600 | 13.5900 | 2.7773 | −3.8435 | 13.6901 | 2.4442 | −3.5828 | 13.7900 | 2.1493 |
| −4.2336 | 13.5900 | 2.8442 | −3.9148 | 13.6901 | 2.5134 | −3.6519 | 13.7900 | 2.2207 |
| −4.3076 | 13.5900 | 2.9106 | −3.9862 | 13.6901 | 2.5823 | −3.7218 | 13.7900 | 2.2911 |
| −4.3826 | 13.5900 | 2.9754 | −4.0586 | 13.6901 | 2.6501 | −3.7922 | 13.7900 | 2.3612 |
| −4.4589 | 13.5900 | 3.0395 | −4.1312 | 13.6901 | 2.7177 | −3.8626 | 13.7900 | 2.4313 |
| −4.5343 | 13.5900 | 3.1042 | −4.2046 | 13.6901 | 2.7845 | −3.9340 | 13.7900 | 2.5004 |
| −4.6110 | 13.5900 | 3.1667 | −4.2789 | 13.6901 | 2.8505 | −4.0059 | 13.7900 | 2.5689 |
| −4.6893 | 13.5900 | 3.2275 | −4.3543 | 13.6901 | 2.9157 | −4.0784 | 13.7900 | 2.6368 |
| −4.7684 | 13.5900 | 3.2901 | −4.4291 | 13.6901 | 2.9812 | −4.1514 | 13.7900 | 2.7037 |
| −4.8416 | 13.5900 | 3.3580 | −4.5052 | 13.6901 | 3.0449 | −4.2258 | 13.7900 | 2.7698 |
| −4.9204 | 13.5900 | 3.4183 | −4.5816 | 13.6901 | 3.1088 | −4.3000 | 13.7900 | 2.8361 |
| −5.0031 | 13.5900 | 3.4740 | −4.6576 | 13.6901 | 3.1721 | −4.3754 | 13.7900 | 2.9009 |
| −5.0421 | 13.5900 | 3.4949 | −4.7360 | 13.6901 | 3.2348 | −4.4510 | 13.7900 | 2.9659 |
| −5.0926 | 13.5900 | 3.4788 | −4.8102 | 13.6901 | 3.3011 | −4.5264 | 13.7900 | 3.0303 |
| −5.1399 | 13.5900 | 3.4140 | −4.8896 | 13.6901 | 3.3607 | −4.6030 | 13.7900 | 3.0938 |
| −2.0329 | 13.6901 | 0.0957 | −4.9710 | 13.6901 | 3.4189 | −4.6790 | 13.7900 | 3.1579 |
| −2.0596 | 13.6901 | 0.1945 | −5.0521 | 13.6901 | 3.4687 | −4.7560 | 13.7900 | 3.2205 |
| −2.1023 | 13.6901 | 0.2837 | −5.0572 | 13.6901 | 3.4706 | −4.8334 | 13.7900 | 3.2829 |
| −2.1495 | 13.6901 | 0.3733 | −5.1044 | 13.6901 | 3.4587 | −4.9122 | 13.7900 | 3.3421 |
| −2.1989 | 13.6901 | 0.4593 | −5.1507 | 13.6901 | 3.3952 | −4.9947 | 13.7900 | 3.3985 |
| −2.2508 | 13.6901 | 0.5436 | −2.1339 | 13.7900 | 0.1694 | −5.0747 | 13.7900 | 3.4495 |
| −2.3056 | 13.6901 | 0.6262 | −2.1512 | 13.7900 | 0.2739 | −5.0775 | 13.7900 | 3.4506 |
| −2.3612 | 13.6901 | 0.7082 | −2.1880 | 13.7900 | 0.3655 | −5.1122 | 13.7900 | 3.4418 |
| −2.4193 | 13.6901 | 0.7887 | −2.2272 | 13.7900 | 0.4407 | −5.1453 | 13.7900 | 3.3978 |
| −2.4783 | 13.6901 | 0.8692 | −2.2781 | 13.7900 | 0.5247 | −2.2301 | 13.8900 | 0.2787 |
| −2.5373 | 13.6901 | 0.9490 | −2.3340 | 13.7900 | 0.6072 | −2.2536 | 13.8900 | 0.3820 |
| −2.5983 | 13.6901 | 1.0273 | −2.3862 | 13.7900 | 0.6916 | −2.2922 | 13.8900 | 0.4727 |
| −2.6593 | 13.6901 | 1.1059 | −2.4429 | 13.7900 | 0.7727 | −2.3403 | 13.8900 | 0.5582 |
| −2.7211 | 13.6901 | 1.1839 | −2.5006 | 13.7900 | 9.8540 | −2.3966 | 13.8900 | 0.6403 |
| −2.7829 | 13.6901 | 1.2618 | −2.5604 | 13.7900 | 0.9333 | −2.4500 | 13.8900 | 0.7264 |
| −2.8460 | 13.6901 | 1.3390 | −2.6205 | 13.7900 | 1.0123 | −2.5065 | 13.8900 | 0.8073 |
| −2.9069 | 13.6901 | 1.4179 | −2.6817 | 13.7900 | 1.0904 | −2.5658 | 13.8900 | 0.8877 |
| −2.9692 | 13.6901 | 1.4947 | −2.7430 | 13.7900 | 1.1689 | −2.6251 | 13.8900 | 0.9676 |
| −3.0321 | 13.6901 | 1.5715 | −2.8043 | 13.7900 | 1.2469 | −2.6859 | 13.8900 | 1.0463 |
| −2.7470 | 13.8900 | 1.1248 | −2.7268 | 13.9900 | 1.0416 | −2.8803 | 14.0901 | 1.1796 |
| −2.8089 | 13.8900 | 1.2030 | −2.7878 | 13.9900 | 1.1203 | −2.9396 | 14.0901 | 1.2604 |
| −2.8702 | 13.8900 | 1.2821 | −2.8485 | 13.9900 | 1.1995 | −2.9997 | 14.0901 | 1.3397 |
| −2.9302 | 13.8900 | 1.3614 | −2.9087 | 13.9900 | 1.2793 | −3.0605 | 14.0901 | 1.4179 |
| −2.2992 | 13.8900 | 1.4388 | −2.9684 | 13.9900 | 1.3586 | −3.1227 | 14.0901 | 1.4952 |
| −3.0546 | 13.8900 | 1.5162 | −3.0303 | 13.9900 | 1.4364 | −3.1854 | 14.0901 | 1.5716 |
| −3.1178 | 13.8900 | 1.5929 | −3.0918 | 13.9900 | 1.5141 | −3.2511 | 14.0901 | 1.6467 |
| −3.1817 | 13.8900 | 1.6691 | −3.1564 | 13.9900 | 1.5897 | −3.3153 | 14.0901 | 1.7220 |

-continued

| X | Y | Z | X | Y | Z | X | Y | Z |
|---|---|---|---|---|---|---|---|---|
| −3.2470 | 13.8900 | 1.7441 | −3.2201 | 13.9900 | 1.6667 | −3.3836 | 14.0901 | 1.7947 |
| −3.3129 | 13.8900 | 1.8186 | −3.2849 | 13.9900 | 1.7417 | −3.4478 | 14.0901 | 1.8716 |
| −3.3793 | 13.8900 | 1.8927 | −3.3515 | 13.9900 | 1.8159 | −3.5142 | 14.0901 | 1.9453 |
| −3.4461 | 13.8900 | 1.9664 | −3.4173 | 13.9900 | 1.8907 | −3.5823 | 14.0901 | 2.0176 |
| −3.5137 | 13.8900 | 2.0393 | −3.4838 | 13.9900 | 1.9643 | −3.6515 | 14.0901 | 2.0893 |
| −3.5824 | 13.8900 | 2.1113 | −3.5521 | 13.9900 | 2.0367 | −3.7205 | 14.0901 | 2.1606 |
| −3.6515 | 13.8900 | 2.1829 | −3.6209 | 13.9900 | 2.1087 | −3.7913 | 14.0901 | 2.2301 |
| −3.7211 | 13.8900 | 2.2538 | −3.6902 | 13.9900 | 2.1800 | −3.8622 | 14.0901 | 2.2997 |
| −3.7911 | 13.8900 | 2.3241 | −3.7603 | 13.9900 | 2.2504 | −3.9344 | 14.0901 | 2.3674 |
| −3.8620 | 13.8900 | 2.3935 | −3.8309 | 13.9900 | 2.3202 | −4.0076 | 14.0901 | 2.4354 |
| −3.9337 | 13.8900 | 2.4626 | −3.9023 | 13.9900 | 2.3894 | −4.0793 | 14.0901 | 2.5043 |
| −4.0057 | 13.8900 | 2.5316 | −3.9739 | 13.9900 | 2.4582 | −4.1527 | 14.0901 | 2.5694 |
| −4.0778 | 13.8900 | 2.5995 | −4.0471 | 13.9900 | 2.5258 | −4.2306 | 14.0901 | 2.6330 |
| −4.1518 | 13.8900 | 2.6656 | −4.1198 | 13.9900 | 2.5927 | −4.3016 | 14.0901 | 2.7040 |
| −4.2254 | 13.8900 | 2.7324 | −4.1964 | 13.9900 | 2.6564 | −4.3762 | 14.0901 | 2.7710 |
| −4.3001 | 13.8900 | 2.7982 | −4.2692 | 13.9900 | 2.7259 | −4.4511 | 14.0901 | 2.8374 |
| −4.3742 | 13.8900 | 2.8651 | −4.3421 | 13.9900 | 2.7933 | −4.5256 | 14.0901 | 2.9037 |
| −4.4492 | 13.8900 | 2.9301 | −4.4177 | 13.9900 | 2.8586 | −4.5998 | 14.0901 | 2.9693 |
| −4.5253 | 13.8900 | 2.9943 | −4.4918 | 13.9900 | 2.9253 | −4.6763 | 14.0901 | 3.0331 |
| −4.6017 | 13.8900 | 3.0580 | −4.5673 | 13.9900 | 2.9893 | −4.7514 | 14.0901 | 3.0977 |
| −4.6783 | 13.8900 | 3.1215 | −4.6439 | 13.9900 | 3.0529 | −4.8296 | 14.0901 | 3.1583 |
| −4.7553 | 13.8900 | 3.1841 | −4.7205 | 13.9900 | 3.1161 | −4.9082 | 14.0901 | 3.2192 |
| −4.8339 | 13.8900 | 3.2451 | −4.7974 | 13.9900 | 3.1784 | −4.9886 | 14.0901 | 3.2758 |
| −4.9126 | 13.8900 | 3.3053 | −4.8764 | 13.9900 | 3.2389 | −5.0730 | 14.0901 | 3.3302 |
| −4.9945 | 13.8900 | 3.3602 | −4.9557 | 13.9900 | 3.2972 | −5.1070 | 14.0901 | 3.3514 |
| −5.0789 | 13.8900 | 3.4142 | −5.0401 | 13.9900 | 3.3529 | −5.1491 | 14.0901 | 3.3550 |
| −5.0934 | 13.8900 | 3.4225 | −5.0996 | 13.9900 | 3.3895 | −5.2002 | 14.0901 | 3.2711 |
| −5.1418 | 13.8900 | 3.3912 | −5.1456 | 13.9900 | 3.3728 | −2.6309 | 14.1900 | 0.6955 |
| −5.1902 | 13.8900 | 3.3191 | −5.1882 | 13.9900 | 3.2974 | −2.6697 | 14.1900 | 0.7890 |
| −2.3405 | 13.9900 | 0.3750 | −2.4614 | 14.0901 | 0.5092 | −2.7169 | 14.1900 | 0.8753 |
| −2.3577 | 13.9900 | 0.4787 | −2.4911 | 14.0901 | 0.6070 | −2.7706 | 14.1900 | 0.9582 |
| −2.3953 | 13.9900 | 0.5694 | −2.5331 | 14.0901 | 0.6954 | −2.8287 | 14.1900 | 1.0384 |
| −2.4360 | 13.9900 | 0.6374 | −2.5835 | 14.0901 | 0.7801 | −2.8885 | 14.1900 | 1.1183 |
| −2.4909 | 13.9900 | 0.7217 | −2.6400 | 14.0901 | 0.8609 | −2.9473 | 14.1900 | 1.1991 |
| −2.5463 | 13.9900 | 0.8037 | −2.6994 | 14.0901 | 0.9409 | −3.0060 | 14.1900 | 1.2795 |
| −2.6061 | 13.9900 | 0.8830 | −2.7596 | 14.0901 | 1.0190 | −3.0660 | 14.1900 | 1.3586 |
| −2.6663 | 13.9900 | 0.9625 | −2.8233 | 14.0901 | 1.0966 | −3.1273 | 14.1900 | 1.4367 |
| −3.1893 | 14.1900 | 1.5140 | −3.8659 | 14.2900 | 2.1819 | −5.2378 | 14.3900 | 3.1173 |
| −3.2533 | 14.1900 | 1.5900 | −3.9359 | 14.2900 | 2.2522 | −0.0021 | 12.4714 | 0.8063 |
| −3.3177 | 14.1900 | 1.6657 | −4.0086 | 14.2900 | 2.3192 | −0.2140 | 12.4782 | 0.8063 |
| −3.3838 | 14.1900 | 1.7402 | −4.0831 | 14.2900 | 2.3865 | −0.4872 | 12.5256 | 0.8063 |
| −3.4495 | 14.1900 | 1.8148 | −4.1542 | 14.2900 | 2.4565 | −0.7314 | 12.5952 | 0.8063 |
| −3.5162 | 14.1900 | 1.8880 | −4.2279 | 14.2900 | 2.5222 | −0.9554 | 12.6898 | 0.8063 |
| −3.5836 | 14.1900 | 1.9608 | −4.3034 | 14.2900 | 2.5878 | −1.2055 | 12.8428 | 0.8063 |
| −3.6523 | 14.1900 | 2.0325 | −4.3774 | 14.2900 | 2.6549 | −1.3727 | 12.9815 | 0.8063 |
| −3.7220 | 14.1900 | 2.1035 | −4.4511 | 14.2900 | 2.7212 | −1.5197 | 13.1330 | 0.8063 |
| −3.7921 | 14.1900 | 2.1739 | −4.5262 | 14.2900 | 2.7866 | −1.6854 | 13.3012 | 0.8063 |
| −3.8629 | 14.1900 | 2.2431 | −4.6015 | 14.2900 | 2.8518 | −1.8363 | 13.4771 | 0.8063 |
| −3.9349 | 14.1900 | 2.3106 | −4.6783 | 14.2900 | 2.9151 | −2.0097 | 13.6514 | 0.8063 |
| −4.0098 | 14.1900 | 2.3765 | −4.7554 | 14.2900 | 2.9785 | −2.1413 | 13.7850 | 0.8063 |
| −4.0822 | 14.1900 | 2.4467 | −4.8323 | 14.2900 | 3.0410 | −2.3519 | 13.9872 | 0.8063 |
| −4.1525 | 14.1900 | 2.5147 | −4.9115 | 14.2900 | 3.1018 | −2.5520 | 14.1228 | 0.8063 |
| −4.2304 | 14.1900 | 2.5770 | −4.9887 | 14.2900 | 3.1631 | −2.6691 | 14.1803 | 0.8063 |
| −4.3053 | 14.1900 | 2.6481 | −5.0714 | 14.2900 | 3.2210 | −2.7468 | 14.2196 | 0.8063 |
| −4.3777 | 14.1900 | 2.7164 | −5.1387 | 14.2900 | 3.2643 | −2.9352 | 14.2792 | 0.8063 |
| −4.4512 | 14.1900 | 2.7831 | −5.1795 | 14.2900 | 3.2577 | −3.0673 | 14.3104 | 0.8063 |
| −4.5262 | 14.1900 | 2.8486 | −5.2153 | 14.2900 | 3.2082 | −3.1912 | 14.3340 | 0.8063 |
| −4.6015 | 14.1900 | 2.9139 | −3.5006 | 14.3900 | 1.6745 | −3.3034 | 14.3509 | 0.8063 |
| −4.6769 | 14.1900 | 2.9783 | −3.5627 | 14.3900 | 1.7528 | −3.4516 | 14.3721 | 0.8063 |
| −4.7536 | 14.1900 | 3.0412 | −3.6254 | 14.3900 | 1.8298 | −3.6269 | 14.3916 | 0.8063 |
| −4.8308 | 14.1900 | 3.1034 | −3.6903 | 14.3900 | 1.9051 | −3.7820 | 14.4078 | 0.8063 |
| −4.9090 | 14.1900 | 3.1647 | −3.7565 | 14.3900 | 1.9794 | −3.9972 | 14.4277 | 0.8063 |
| −4.9876 | 14.1900 | 3.2246 | −3.8237 | 14.3900 | 2.0530 | −4.1765 | 14.4391 | 0.8063 |
| −5.0697 | 14.1900 | 3.2808 | −3.8918 | 14.3900 | 2.1254 | −4.3592 | 14.4460 | 0.8063 |
| −5.1129 | 14.1900 | 3.3078 | −3.9618 | 14.3900 | 2.1958 | −4.4891 | 14.4494 | 0.8063 |
| −5.1608 | 14.1900 | 3.3154 | −4.0334 | 14.3900 | 2.2646 | −4.6969 | 14.4566 | 0.8063 |
| −5.1948 | 14.1900 | 3.2673 | −4.1061 | 14.3900 | 2.3324 | −4.9122 | 14.4524 | 0.8063 |
| −2.9203 | 14.2900 | 1.0327 | −4.1795 | 14.3900 | 2.3995 | −5.0643 | 14.4447 | 0.8063 |
| −2.9708 | 14.2900 | 1.1193 | −4.2539 | 14.3900 | 2.4660 | −5.2064 | 14.4120 | 0.8063 |
| −3.0263 | 14.2900 | 1.2016 | −4.3278 | 14.3900 | 2.5327 | −0.4540 | 10.4663 | 0.8063 |
| −3.0832 | 14.2900 | 1.2839 | −4.4026 | 14.3900 | 2.5984 | −0.3581 | 10.4608 | 0.8063 |
| −3.1411 | 14.2900 | 1.3646 | −4.4774 | 14.3900 | 2.6642 | −0.2262 | 10.4524 | 0.8063 |
| −3.2006 | 14.2900 | 1.4437 | −4.5523 | 14.3900 | 2.7298 | −0.1265 | 10.4440 | 0.8063 |
| −3.2625 | 14.2900 | 1.5212 | −4.6273 | 14.3900 | 2.7956 | −0.0517 | 10.4410 | 0.8063 |
| −3.3253 | 14.2900 | 1.5982 | −4.7028 | 14.3900 | 2.8596 | −0.0009 | 10.4407 | 0.8063 |
| −3.3897 | 14.2900 | 1.6743 | −4.7813 | 14.3900 | 2.9210 | −4.9551 | 12.8543 | 0.8063 |
| −3.4543 | 14.2900 | 1.7499 | −4.8591 | 14.3900 | 2.9835 | −4.7357 | 12.8226 | 0.8063 |

-continued

| X | Y | Z | X | Y | Z | X | Y | Z |
|---|---|---|---|---|---|---|---|---|
| −3.5205 | 14.2900 | 1.8238 | −4.9379 | 14.3900 | 3.0443 | −4.4884 | 12.7929 | 0.8063 |
| −3.5876 | 14.2900 | 1.8970 | −5.0166 | 14.3900 | 3.1039 | −4.2637 | 12.7690 | 0.8063 |
| −3.6556 | 14.2900 | 1.9698 | −5.0989 | 14.3900 | 3.1627 | −4.0875 | 12.7528 | 0.8063 |
| −3.7241 | 14.2900 | 2.0418 | −5.1577 | 14.3900 | 3.2007 | −3.8871 | 12.7304 | 0.8063 |
| −3.7946 | 14.2900 | 2.1118 | −5.2097 | 14.3900 | 3.1855 | −3.7336 | 12.7002 | 0.8063 |
| −3.6521 | 12.6938 | 0.8063 | −3.5698 | −0.9258 | 0.8063 | | | |
| −3.5970 | 12.6076 | 0.8063 | −3.5423 | −1.1874 | 0.8063 | | | |
| −3.5425 | 12.4462 | 0.8063 | −3.4590 | −1.4650 | 0.8063 | | | |
| −3.4236 | 12.1767 | 0.8063 | −3.3077 | −1.7087 | 0.8063 | | | |
| −3.3306 | 11.8963 | 0.8063 | −3.0851 | −1.9211 | 0.8063 | | | |
| −3.2338 | 11.5870 | 0.8063 | −2.7750 | −2.0534 | 0.8063 | | | |
| −3.1159 | 11.1772 | 0.8063 | −2.4078 | −2.2163 | 0.8063 | | | |
| −3.0553 | 10.9431 | 0.8063 | −2.2583 | −2.1576 | 0.8063 | | | |
| −2.9931 | 10.7038 | 0.8063 | −1.8418 | −2.1577 | 0.8063 | | | |
| −2.9399 | 10.4326 | 0.8063 | −1.4751 | −2.2167 | 0.8063 | | | |
| −2.8984 | 10.1892 | 0.8063 | −1.0558 | −2.2168 | 0.8063 | | | |
| −2.8626 | 9.8936 | 0.8063 | −0.6442 | −2.3063 | 0.8063 | | | |
| −2.8454 | 9.6172 | 0.8063 | −0.2811 | −2.3061 | 0.8063 | | | |
| −2.8348 | 9.3729 | 0.8063 | −0.0124 | −2.3061 | 0.8063 | | | |
| −2.8198 | 8.9739 | 0.8063 | 0.0043 | −2.3061 | 0.8063 | | | |
| −2.8374 | 8.5530 | 0.8063 | | | | | | |
| −2.8685 | 8.1299 | 0.8063 | | | | | | |
| −2.9083 | 7.7393 | 0.8063 | | | | | | |
| −2.9826 | 7.2670 | 0.8063 | | | | | | |
| −3.0595 | 6.9054 | 0.8063 | | | | | | |
| −3.1482 | 6.5665 | 0.8063 | | | | | | |
| −3.2546 | 6.2832 | 0.8063 | | | | | | |
| −3.3732 | 5.9618 | 0.8063 | | | | | | |
| −3.4977 | 5.6397 | 0.8063 | | | | | | |
| −3.6845 | 5.1937 | 0.8063 | | | | | | |
| −3.8092 | 4.9113 | 0.8063 | | | | | | |
| −3.9459 | 4.5780 | 0.8063 | | | | | | |
| −4.0751 | 4.2689 | 0.8063 | | | | | | |
| −4.2200 | 3.9016 | 0.8063 | | | | | | |
| −4.3503 | 3.5892 | 0.8063 | | | | | | |
| −4.4971 | 3.1363 | 0.8063 | | | | | | |
| −4.5801 | 2.8051 | 0.8063 | | | | | | |
| −4.6371 | 2.4509 | 0.8063 | | | | | | |
| −4.6591 | 2.1481 | 0.8063 | | | | | | |
| −4.6578 | 1.8208 | 0.8063 | | | | | | |
| −4.6291 | 1.5584 | 0.8063 | | | | | | |
| −4.5568 | 1.2584 | 0.8063 | | | | | | |
| −4.4664 | 1.0066 | 0.8063 | | | | | | |
| −4.3200 | 0.6732 | 0.8063 | | | | | | |
| −4.1488 | 0.3674 | 0.8063 | | | | | | |
| −4.0180 | 0.1568 | 0.8063 | | | | | | |
| −4.0325 | 0.1859 | 0.8063 | | | | | | |
| −3.8155 | −0.1755 | 0.8063 | | | | | | |
| −3.6754 | −0.4694 | 0.8063 | | | | | | |
| −3.6189 | −0.6947 | 0.8063 | | | | | | |

5. The equine saddle of claim 4 wherein less than all data points can deviate less than about ten (10%) percent and all data points can deviate, in ratio, less than about twenty (20%) percent.

6. The equine saddle of claim 1 wherein said head further comprises a graphite reinforcement.

7. The equine saddle of claim 1 wherein said tree is manufactured from laminated wood, said laminated wood containing at least two nonadjacent layers of graphite between wood layers.

8. The equine saddle of claim 7 wherein said upper torsion springs have an interior edge and an exterior edge, an upper spring width between said interior edge and said exterior edge and a length, said interior edge being proximate said second edge of said side bars, said length being less than said tree length and said upper spring width being less that the distance between said side bar first edge and said side bar second edge.

9. The equine saddle of claim 7 wherein said lower torsion springs have an interior edge and an exterior edge, a lower spring width formed between said interior edge and said exterior edge and a length, said interior edge extending beyond said second edge of said side bar into said open seating area, said length being less than said tree length.

10. The equine saddle of claim 7 further comprising affixing means, said affixing means securing said upper torsion springs and said lower torsion springs to said tree, thereby supporting said first surface and said second surface of said tree.

11. The equine saddle of claim 1 further comprising a torsion spring support system, said support system comprising a pair of flexible upper torsion springs, said pair of upper torsion springs being proximate a first surface of said tree and a pair of flexible lower torsion springs, said lower torsion springs being proximate said second surface of said tree.

12. The equine saddle of claim 11 wherein said width of said upper torsion springs is greater proximate said tree head and decreases to a lesser width proximate said cantle.

13. The equine saddle of claim 12 wherein said affixing means are multiple rivets, at least two pairs of said multiple rivets are staggered proximate said head, said staggered rivets penetrating said top plate, said upper torsion spring, said tree, said gullet notch and said lower torsion spring, at least three pairs of rivets staggered proximate said top plate, said at least three pairs of rivets penetrating said upper torsion spring, said tree and said lower torsion spring, at least five rivets placed along said upper torsion spring, said at least five rivets penetrating said upper torsion spring, said tree and said lower torsion spring.

14. The equine saddle of claim 13 further having a buffer sheet, said buffer sheet being proximate a second side of said support panel.

15. The equine saddle of claim 13 wherein each of said support panels further has a withers wedge, said withers wedge being proximate the apex of said arced head between said foam body and said support panel, said withers wedge being beveled around its periphery and having a density greater than said foam body.

16. The saddle of claim 13 where each of said support panels further comprises a cantle wedge, said cantle wedge being proximate said cantle curvature at said lower panel edge between said foam body and said support panel, said cantle wedge extending to the periphery of said support panel and having a density greater than said foam body.

17. The equine saddle of claim 1 further comprising a support panel system for placement between the back of a horse and said tree, said system comprising a pair of mirror image panels, each of said support panels having:

an upper panel edge, said upper panel edge being curved and substantially equal to the length of said tree;

a lower panel edge, said lower panel edge having a cantle curvature, a side bar curvature and a head curvature, said head curvature extending beyond said head end points;

a foam body, said foam body having a flat surface and a contoured surface, said contoured surface having a first thickness at said cantle curvature, a second thickness at said side bar curvature and a third thickness at said head curvature, said first thickness being greater than said third thickness and said third thickness being greater than said second thickness;

a support panel, support panel having a periphery approximately equal to, or slightly less than, said periphery of said foam body, a first side of said support panel being affixed to said flat surface of said foam body;

said contoured surface of said foam body proximate said cantle extending over said periphery of said support panel proximate said cantle curvature and said foam body proximate said upper panel edge being tapered downwardly to said support panel; and said foam body proximate said head apex having a thickness greater than the thickness proximate said end points, said end points being tapered downwardly toward said support panel, whereby said panels prevent said tree from coming into contact with a horse's body and spread the rider's weight evenly over said horse's back.

18. The saddle of claim 1 further comprising a pair of stirrup bars, said stirrup bars being affixed to a saddle to removably affix stirrup leathers to said saddle, said stirrup bars being a modified "V" shape, a first leg of said modified "V" being affixed to said saddle at a connecting point proximate said saddle head and a second leg of said stirrup bar being aligned to place a center of said stirrup leather slide over said second leg in line with said connecting point, thereby maintaining a rider's direction of force in line with said connecting point to prevent said stirrup bars from torquing in relation to said saddle.

19. An equine saddle for providing minimal interference to a horse's movement having:

a tree having a first surface and a second surface;

an arced head, said arced head having end points forming the ends of said arced head, a cantle, a pair of side bars, each of said pair of side bars having a first surface, a second surface, a first edge and a second edge and connecting said head and said cantle, said head, said cantle and said second edge of said side bars enclosing an open seating area, the curvature of said tree being defined along X, Y and Z axes by data points, said Y axis is a plane along a length, said length being from said cantle to said head, said Y axis containing multiple Y data points corresponding to predetermined calculations;

said X axis being at a 90 degree angles to said Y axis, said X axis containing multiple pairs of opposing X data points corresponding to predetermined calculations; and said Z axis being at a 90 degree angle to said X axis and said Y axis, said Z axis containing multiple Z data points corresponding to predetermined calculations, said tree being configured to correspond to a series of symmetrical arcs defined by said data points, the apex of each of said arcs being a data point on said Z axis and the ends of each of said arcs being a pair of opposing data points on said X axis, wherein each of said arcs has a data point on the Z axis and a pair of opposing data points on the Y axis for each Y data point, said arcs forming a three dimensional tree having a height, width and length based on about 6,000 mirror image data points, a gullet notch, said gullet notch being within said pair of side bars proximate said head;

a gullet plate, said gullet plate having a lip, said lip dimensioned to fit within said gullet notch, said gullet plate being proximate said second surface of said head;

a top plate, said top plate being proximate said first surface of said head;

a pair of flexible upper torsion springs, said pair of upper torsion springs being proximate said first surface of said tree and said pair of flexible lower torsion springs being proximate said second surface of said tree, said upper torsion springs having an interior edge and an exterior edge, an upper spring width between said interior edge and said exterior edge, said upper torsion spring width being greater proximate said tree head and decreasing to a lesser width proximate said cantle, and a length, said interior edge being proximate said second edge of said side bars, said length being less than said tree length and said upper spring width being less that the distance between said side bar first edge and said side liar second edge, said upper spring being affixed to said first surface; said lower torsion springs having an interior edge and an exterior edge, a lower spring width formed between said interior edge and said exterior edge and a length, said interior edge extending beyond said second edge of said side bar into said open seating area, said length being less than said tree length, said torsion springs being affixed to said second surface of said tree;

a pair of support panels, each of said support panels having an upper panel periphery, said upper panel edge being curved and substantially equal to the length of said tree and a lower panel edge, said lower panel edge having a cantle curvature, a bar curvature and a head curvature, said head curvature extending beyond said arc end points;

a foam body, said foam body having a flat surface and a contoured surface, said contoured surface having a first thickness at said cantle curvature, a second thickness at said bar curvature and a third thickness at said head curvature, said first thickness being greater than said third thickness and said third thickness being greater than said second thickness;

a support panel, support panel having a periphery approximately equal to, or slightly less than, said periphery of said foam, a first side of said support panel being affixed to said flat surface of said foam panel;

a mid-sheet, said mid-sheet covering a second side of said support panel and affixed to said second surface of said tree;

a withers wedge, said wither wedge being proximate the apex of said arced head between said foam body and said support panel, said wither wedge being beveled around its periphery and having a density greater than said foam body;

a cantle wedge, said cantle wedge being proximate said cantle curvature at said lower panel edge between said foam body and said support panel, said cantle wedge extending to the periphery of said support panel and having a density greater than said foam body;

said contoured surface of said foam body proximate said cantle extending over said support panel proximate said cantle curvature and said foam body proximate said upper panel edge being tapered downwardly to said support panel; and said foam body proximate said head apex having a thickness greater than the thickness proximate said end points, said end points being tapered downwardly toward said support panel, said panels preventing said tree from coming into contact with a horse's body and spreading the rider's weight evenly over said horse's back;

a pair of stirrup bars, said stirrup bars being affixed to a saddle to removably affix stirrup leathers to said saddle, said stirrup bars being a modified "V" shape, a first leg of said modified "V" being affixed to said saddle at a connecting point proximate said saddle head and a second leg of said stirrup bar being aligned to place a center of said stirrup leather slide over said second leg in line with said connecting point, thereby maintaining a rider's direction of force in line with said connecting point to prevent said stirrup bars from torquing in relation to said saddle, wherein said saddle evenly distributes a rider's weight, preventing said saddle from pinching said horse's back.

20. The method of manufacturing a tree for use as a substrate for an equine saddle, said tree having:

a first surface and a second surface an arced head, said arced head having end points, said end points being the ends of said arced head, a cantle, a pair of side bars, each of said pair of side bars having a first surface, a second surface, a first edge and a second edge, a said side bars connecting said head and said cantle, said head, said cantle and said second edge of said side bars enclosing an open seating area, the curvature of said tree being defined along X, Y and Z axes, wherein:

said Y axis being along a length, said length being from said cantle to said head, said Y axis containing multiple Y data points corresponding to predetermined calculations;

said X axis being at a 90 degree angles to said Y axis, said X axis containing multiple pairs of opposing X data points corresponding to predetermined calculations; and said Z axis being at a 90 degree angle to said X axis and said Y axis, said Z axis containing multiple Z data points corresponding to predetermined calculations, comprising the steps of:

determining the curvature of a saddle tree to correspond to the muscle positioning of a horse's back in an engaged, optimal performance position;

creating a computer model of said tree using Y as a length axis, Z as a height axis and X as a width axis, plotting data points along said X, Y and Z axes to form a series of symmetrical arcs comprising about 12,000 data points, said series of symmetrical arcs being defined by said data points, the apex of each of said arcs being a data point on said Z axis and the ends of each of said arcs being a pair of opposing data points on said X axis, each of said arcs has a data point on the Z axis and a pair of opposing data points on the Y axis for each Y data point.

21. The method of claim 20 further comprising the steps of:

manufacturing a mold representing said series of symmetrical arcs;

molding said a substrate material to said mold to form a tree;

wherein said tree reflects the data points.

22. The method of claim 21 wherein reinforcing said tree comprising the steps of:

cutting a gullet notch, said gullet notch being within said pair of side bars proximate said head;

placing a gullet plate, having a lip dimensioned to fit within said gullet notch, proximate said second surface of said head;

placing a pair of flexible upper torsion springs proximate said first surface of said tree, aligning an interior edge of each of said upper torsion springs proximate said second edge of said side bars;

placing a pair of flexible lower torsion springs proximate said second surface of said tree;

aligning an interior edge of each of said lower torsion springs to overlap said second edge of said side bars and cover a portion of said open seating area;

placing a top plate proximate said first surface of said head opposite said gullet plate;

securing said top plate, said upper torsion springs, said lower torsion springs and said gullet plate to said tree;

wherein securing said tree between said gullet plate and said top plate and said upper torsion springs and said lower torsion springs reinforces the strength of said tree, maintaining all data points in the predesigned position.

23. The method of claim 21 wherein providing cushioning between said tree and said horse's back by placing support panels adjacent said second surface of said tree, configuring of the support panels comprising the steps of:

determining the periphery of said support panels to provide a curved upper panel edge substantially equal to the length of said tree and a lower panel edge having a cantle curvature, a bar curvature and a head curvature, said head curvature extending beyond said arc end points;

determining the contoured surface configuration of said support panels to provide optimum support by having a first thickness at said cantle curvature, a second thickness at said bar curvature and a third thickness at said head curvature, said first thickness being greater than said third thickness and said third thickness being greater than said second thickness;

creating a molds reflecting said support panel contoured surface configuration and said periphery for each side of said tree;

creating a foam panel using said mold, having a contoured outer surface and a flat inner surface;

cutting a semi-rigid support panel having a periphery approximately equal to, or slightly less than, said periphery of said foam to said flat inner surface;

preparing a withers wedge to disperse the riders weight along the horse's withers area using a material having a density greater than said foam body and beveled around its periphery to prevent any abrupt change in thickness;

securing a withers wedge to said support panel proximate the apex of said arced head;

preparing a cantle wedge to absorb said rider's weight along the horse's back using a material having a density greater than said foam body and a periphery equal to said support panel;

securing said cantle wedge to said support panel proximate said cantle curvature at said lower panel edge;

securing said foam body to said support panel;

rolling said foam body along the exterior of said cantle wedge to come in contact with said support panel;

wherein said support panels disperse said rider's weight evenly along said horse's back and maintains the tree approximately equidistant to said horse's back when said horse is engaged in a optimal performance position.

24. An equine saddle having a tree, said tree having a first surface and a second surface, a cantle, and a head, said cantle and said head being connected by a pair of side bars, said tree further comprising a torsion spring support system, said support system comprising:

a pair of flexible upper torsion springs, said pair of upper torsion springs being proximate a first surface of said tree, said upper torsion springs having an interior edge and an exterior edge, an upper spring width between said interior edge and said exterior edge and a length, said interior edge being proximate said second edge of said side bars, said length being less than said tree length and said upper spring width being less that the distance between said side bar first edge and said side bar second edge, said width of said upper torsion springs being greater proximate said tree head and decreasing to a lesser width proximate said cantle; and a pair of flexible lower torsion springs, said lower torsion springs being proximate said second surface of said tree, said lower torsion springs having an interior edge and an exterior edge, a lower spring width formed between said interior edge and said exterior edge and a length, said interior edge extending beyond said second edge of said side bar into said open seating area, said length being less than said tree length;

wherein said upper torsion springs and said lower torsion springs are affixed to said tree, thereby supporting said first surface and said second surface of said tree.

25. The equine saddle of claim 24 wherein said upper torsion springs and said lower torsion springs are affixed to said tree with multiple rivets, at least two pairs of said multiple rivets are staggered proximate said head, said staggered rivets penetrating said top plate, said upper torsion spring, said tree, said gullet notch and said lower torsion spring, at least three pairs of rivets staggered proximate said top plate, said at least three pairs of rivets penetrating said upper torsion spring, said tree and said lower torsion spring, at least five rivets placed along said upper torsion spring, said at least five rivets penetrating said upper torsion spring, said tree and said lower torsion spring.

26. An equine saddle having a tree, said tree having a first surface and a second surface, a cantle, and a head, said cantle and said head being connected by a pair of side bars, said tree further comprising a support panel system for placement between the back of a horse and said tree, said system comprising a pair of mirror image panels, each of said support panels having:

an upper panel edge, said upper panel edge being curved and substantially equal to the length of said tree;

a lower panel edge, said lower panel edge having a cantle curvature, a side bar curvature and a head curvature, said head curvature extending beyond said head end points;

a foam body, said foam body having a flat surface and a contoured surface, said contoured surface having a first thickness at said cantle curvature, a second thickness at said side bar curvature and a third thickness at said head curvature, said first thickness being greater than said third thickness and said third thickness being greater than said second thickness;

a support panel, support panel having a periphery approximately equal to or slightly less than, said periphery of said foam body, a first side of said support panel being affixed to said flat surface of said foam body;

said contoured surface of said foam body proximate said cantle extending over said periphery of said support panel proximate said cantle curvature and said foam body proximate said upper panel edge being tapered downwardly to said support panel; and said foam body proximate said head apex having a thickness greater than the thickness proximate said end points, said end points being tapered downwardly toward said support panel, whereby said panels prevent said tree from coming into contact with a horse's body and spread the rider's weight evenly over said horse's back.

* * * * *